US012268268B2

(12) United States Patent
Varga et al.

(10) Patent No.: US 12,268,268 B2
(45) Date of Patent: Apr. 8, 2025

(54) MACHINE VENDIBLE EXPANDABLE HELMET AND MANUFACTURE OF SAME

(71) Applicant: Membrain Safety Solutions, LLC, Los Angeles, CA (US)

(72) Inventors: Emerick Varga, Los Angeles, CA (US); Jack Queen, Los Angeles, CA (US); Kenneth B. Hertz, Los Angeles, CA (US); Jeffrey Jones, Deerfield, IL (US); Isis Alexandra Shiffer, Brooklyn, NY (US); Walter Hansen, Columbus, OH (US)

(73) Assignee: Membrain Safety Solutions, LLC, Los Angeles, CA (US)

( * ) Notice: Subject to any disclaimer, the term of this patent is extended or adjusted under 35 U.S.C. 154(b) by 113 days.

(21) Appl. No.: 18/113,770

(22) Filed: Feb. 24, 2023

(65) Prior Publication Data

US 2023/0248105 A1 Aug. 10, 2023

Related U.S. Application Data

(63) Continuation-in-part of application No. 17/504,944, filed on Oct. 19, 2021, now Pat. No. 11,864,617, (Continued)

(51) Int. Cl.

| | |
|---|---|
| ***A42B 3/32*** | (2006.01) |
| ***A42B 3/06*** | (2006.01) |
| ***A42B 3/12*** | (2006.01) |

(52) U.S. Cl.

CPC ..... *A42B 3/322* (2013.01); *A42B 3/065* (2013.01); *A42B 3/066* (2013.01); *A42B 3/124* (2013.01)

(58) Field of Classification Search

CPC ..... A42B 3/322; A42B 3/065; A42B 3/066; A42B 3/124

See application file for complete search history.

(56) References Cited

U.S. PATENT DOCUMENTS 1,996,254 A 4/1935 Ernest
2,659,481 A * 11/1953 Jones ..... A42B 1/18 206/8

(Continued)

FOREIGN PATENT DOCUMENTS

CN 203416852 U 2/2014
CN 104432928 A 3/2015

(Continued)

OTHER PUBLICATIONS

Extended European Search Report for EP Application No. 17851421.2 mailed Apr. 8, 2020.

(Continued)

*Primary Examiner* — Khaled Annis
(74) *Attorney, Agent, or Firm* — RMCK Law Group PLC

(57) ABSTRACT

A bicycle helmet that fits over a surface of a head of a user generally includes a segment of flexible cell structures that form a radial honeycomb matrix movable between a folded condition where each side of the segment is disposed generally parallel and an expanded condition where the radial honeycomb matrix of the segment is configured to be expanded at least partially over the head of the user and arranged radially relative to the surface of the head of the user. The bicycle helmet includes a first and second side frame disposed respectively at the first and second ends of the honeycomb matrix.

20 Claims, 121 Drawing Sheets

Related U.S. Application Data which is a continuation-in-part of application No. 17/215,396, filed on Mar. 29, 2021, now Pat. No. 11,678,711, which is a continuation of application No. 16/189,423, filed on Nov. 13, 2018, now Pat. No. 10,959,480, which is a continuation of application No. PCT/US2017/051277, filed on Sep. 13, 2017.

(60) Provisional application No. 63/313,984, filed on Feb. 25, 2022, provisional application No. 62/458,767, filed on Feb. 14, 2017, provisional application No. 62/415,057, filed on Oct. 31, 2016, provisional application No. 62/393,911, filed on Sep. 13, 2016.

(56) References Cited

U.S. PATENT DOCUMENTS

| | | | | | |
|---|---|---|---|---|---|
| 3,026,525 | A * | 3/1962 | Gyorfy | A42B 3/322 | 2/202 |
| 3,169,251 | A | 2/1965 | Humes | | |
| 3,514,787 | A * | 6/1970 | Kennedy, Jr. | A42B 3/322 | D29/104 |
| 3,811,130 | A * | 5/1974 | Townsend, Jr. | A42C 5/04 | 428/116 |
| 3,991,422 | A * | 11/1976 | Saotome | A42B 3/322 | 2/410 |
| RE29,452 | E * | 10/1977 | Townsend, Jr. | A42C 5/04 | 2/200.1 |
| 4,607,397 | A * | 8/1986 | Laxo | A42B 3/322 | 2/410 |
| D297,173 | S * | 8/1988 | Andersen | D26/136 | |
| 5,012,533 | A | 5/1991 | Raffler | | |
| 5,139,017 | A | 8/1992 | McCloud | | |
| 5,173,970 | A * | 12/1992 | Shifrin | A42B 3/00 | 2/209.12 |
| 5,628,071 | A | 5/1997 | Nezer | | |
| 5,687,426 | A | 11/1997 | Sperber | | |
| D387,501 | S | 12/1997 | Cheng | | |
| 5,745,924 | A | 5/1998 | Egger | | |
| 5,774,901 | A * | 7/1998 | Minami | A42B 3/147 | 2/421 |
| 6,256,796 | B1 * | 7/2001 | Fleming | A42B 1/004 | 2/244 |
| 7,328,462 | B1 | 2/2008 | Straus | | |
| 7,669,378 | B2 * | 3/2010 | Tsunoda | F16F 7/121 | 52/79.8 |
| 7,958,572 | B2 | 6/2011 | Loury et al. | | |
| D758,340 | S * | 6/2016 | Katopis | D14/205 | |
| 9,675,127 | B2 * | 6/2017 | Guadagnin | A42B 3/04 | |
| 10,085,508 | B2 * | 10/2018 | Surabhi | A42B 3/065 | |
| 10,188,159 | B2 * | 1/2019 | Armour | A63B 71/081 | |
| 10,357,072 | B2 * | 7/2019 | Chong | A42B 1/205 | |
| D899,697 | S * | 10/2020 | Shiffer | D29/102 | |
| 2004/0261157 | A1 | 12/2004 | Talluri | | |
| 2005/0257312 | A1 | 11/2005 | Puchalski | | |
| 2007/0226881 | A1 | 10/2007 | Reinhard et al. | | |
| 2007/0277295 | A1 | 12/2007 | Bullock | | |
| 2010/0031426 | A1 | 2/2010 | Lapham | | |
| 2013/0305435 | A1 | 11/2013 | Surabhi | | |
| 2014/0013492 | A1 | 1/2014 | Bottlang et al. | | |
| 2014/0189939 | A1 | 7/2014 | Cheng | | |
| 2018/0027914 | A1 * | 2/2018 | Cook | A42B 3/12 | |
| 2018/0049508 | A1 * | 2/2018 | Terry | A42B 3/322 | |
| 2018/0252286 | A1 | 9/2018 | Abdolahian et al. | | |
| 2019/0142100 | A1 * | 5/2019 | Shiffer | A42B 3/066 | 2/417 |
| 2022/0104574 | A1 * | 4/2022 | Varga | A42B 3/124 | |

FOREIGN PATENT DOCUMENTS

| | | | |
|---|---|---|---|
| CN | 104687626 | A | 6/2015 |
| CN | 205585390 | U | 9/2016 |
| CN | 206275234 | U | 6/2017 |
| DE | 202008013670 | U1 | 1/2009 |
| FR | 2781650 | A1 | 2/2000 |
| GB | 2565524 | A | 2/2019 |
| GB | 2590811 | B | 3/2022 |
| IT | PD20120335 | A1 | 5/2014 |
| JP | S56131015 | A | 10/1981 |
| JP | 2002044708 | A | 2/2002 |
| JP | 2007092198 | A | 4/2007 |
| JP | 2007331725 | A | 12/2007 |
| JP | 3205084 | U | 7/2016 |
| KR | 20150113232 | A | 10/2015 |
| WO | 2017046757 | A1 | 3/2017 |

OTHER PUBLICATIONS

First Examination Report for IN Application No. 201917014347 mailed Sep. 8, 2021.

International Search Report and Written Opinion for International Application No. PCT/US2017/051277 mailed Dec. 14, 2017, 14 pages.

Japanese Office Action for JP Application No. 2019-535205 mailed Jun. 7, 2021.

U.S. Appl. No. 17/504,944, filed Oct. 19, 2021.

* cited by examiner

MACHINE VENDIBLE EXPANDABLE HELMET AND MANUFACTURE OF SAME

CROSS-REFERENCE TO RELATED APPLICATIONS

This application is a continuation in part of U.S. Non-Provisional application Ser. No. 17/504,944, which was filed on Oct. 19, 2021, entitled "Machine Vendible Expandable Helmet and Manufacture of Dame", which is a continuation in part of U.S. Non-Provisional application Ser. No. 17/215,396, which was filed on Mar. 29, 2021, entitled "Machine Vendible Expandable Helmet And Manufacture of Same", which is a continuation of U.S. Non-Provisional application Ser. No. 16/189,423, which was filed on Nov. 13, 2018, entitled "Machine Vendible Expandable Helmet And Manufacture of Same", which is a continuation of International Application No. PCT/US2017/051277, which was filed on Sep. 13, 2017, which claims the benefit of U.S. Provisional Application Ser. No. 62/393,911, which was filed on Sep. 13, 2016, entitled "EcoHelmet"; U.S. Provisional Application Ser. No. 62/415,057, which was filed on Oct. 31, 2016, entitled "Bicycle Helmet"; and U.S. Provisional Application Ser. No. 62/458,767 filed Feb. 14, 2017, entitled "Bicycle Helmet". This application also claims priority to U.S. Provisional Application Ser. No. 63/313,984, which was filed on Feb. 25, 2022, entitled "Machine Vendible Expandable Helmet". The above applications are hereby incorporated by reference as if fully set forth herein in their entirety.

This application is related to U.S. Design patent application Ser. No. 29/690,167 filed on May 6, 2019, entitled "Bicycle Helmet", which is a continuation of U.S. Design patent application Ser. No. 29/593,908, filed on Feb. 14, 2017, entitled "Bicycle Helmet", which is a continuation-in-part of U.S. Design patent application Ser. No. 29/582,807 filed on Oct. 31, 2016, entitled "Bicycle Helmet". The above applications are hereby incorporated by reference as if fully set forth herein.

FIELD

The present disclosure relates to a folding helmet having a radially-aligned honeycomb matrix that may be expanded over a head of the user from a collapsed or folded condition to an expanded condition that provides head protection while riding a bicycle.

BACKGROUND

Typically, helmets are bulky and are inconvenient especially when not being worn. When not being worn, the helmet may be left with a bicycle leaving it exposed to possible damage from the environment or to a security risk if not otherwise locked to the bicycle. When not being worn, the helmet may be taken with the user but there are usually no convenient ways to store the helmet causing it to be left behind. Properly wearing helmets may be shown to reduce head injuries in the event of a bicycle accident up to 85%. In bicycle share program scenarios, users are either required to bring their own helmets, buy one specifically for the bicycle rental, or rent a helmet. In such bicycle share programs, only about 10% of users wear helmets. Accordingly, the inventor has recognized a need for improved methods, systems, products, and components to provide an improved helmet for enabling easy vending, transport, deployment of the improved helmets throughout an ecosystem of bicycle sales, rental, and use.

SUMMARY

In embodiments, a helmet for use with bicycles or other instances where head protection is desirable. The helmet may collapse or fold to a reduced size when not in use. Provided herein are improved methods, systems, products, and components (all of these collectively referred to in the alternative as a "platform" or a "solution," except where context indicates otherwise), including the improved helmet, its accessories, and a host system for various information technology capabilities, for enabling packaging, security, safety, tracking, compliance, and quality in the ecosystem for bicycles and bicycle sharing programs.

In embodiments, a helmet that fits over a head of a user. The helmet includes at least one segment of flexible material that forms a honeycomb matrix movable from a collapsed or folded condition where each side of the at least one segment is disposed generally parallel and an expanded condition where the honeycomb matrix is expanded and at least partially disposed over the head of the user. Cells of the honeycomb matrix are radially oriented in a direction that is perpendicular to a surface of a head of a user.

In embodiments, the helmet includes a first and a second side frame respectively at the first and second ends of the honeycomb matrix. In embodiments, a sliding latch comprises a first portion coupled to the first side frame and a second portion coupled to the second side frame. The first and second portions are selectively translatable relative to each other to move the first and side frame toward and away from each other to accommodate different sized heads of the user.

In embodiments, an internal restriction strap is disposed along an inside surface of the helmet. The internal restriction strap is configured to limit expansion of the helmet beyond the expanded position. The restriction straps can be coupled to the respective side frames.

In embodiments, a helmet that also includes a chin strap connected to at least one side of the at least one segment of flexible material.

In embodiments, a helmet with at least one segment that includes a middle segment of flexible material between two side segments of flexible material and the middle segment and the side segments are each movable from a collapsed or folded condition where each side of the side segments are disposed generally parallel and an expanded condition where the middle segment and the side segments are expanded and in cooperation are at least partially disposed over the head of the user.

In embodiments, a helmet with the honeycomb matrix of the at least one segment including a plurality of cells that is disposed in a position that is generally perpendicular to a surface of the head of the user when in the expanded condition.

In embodiments, a helmet that fits over a surface of the head of the user includes at least one segment of flexible cell structures that form a radial honeycomb matrix movable between a collapsed or folded condition where each side of the at least one segment is disposed generally parallel and an expanded condition where the radial honeycomb matrix of the at least one segment is configured to be expanded at least partially over the head of the user and arranged radially relative to the surface of the head of the user.

In embodiments, a helmet includes a chin strap assembly connected to at least one side of the at least one segment of flexible material.

In embodiments, the at least one segment includes a middle segment between two side segments each including flexible cell structures that form the radial honeycomb matrix movable from the collapsed or folded condition where each side of the side segments is disposed generally parallel and an expanded condition where the middle segment and the side segments are expanded and in cooperation are at least partially disposed over the head of the user and arranged radially relative to the surface of the head of the user.

In embodiments, the flexible cell structures of the radial honeycomb matrix of the at least one segment are each configured to be located adjacent to and positioned generally perpendicular to a portion of the surface of the head of the user.

In embodiments, a helmet includes a chin strap mechanism having at least one strap connected to the at least one segment. In embodiments, the chin strap mechanism is configured to be releasably coupled around the head of the user.

In embodiments, a helmet includes a helmet location indicator mechanism configured to connect over a wireless network with one of a mobile device, a vending kiosk, a proximity detector, and a computer.

In embodiments, the at least one segment includes a middle segment between two side segments each including flexible cell structures that form the radial honeycomb matrix movable from the collapsed or folded condition where each side of the side segments is disposed generally parallel and an expanded condition where the middle segment and the side segments are expanded and in cooperation form an exterior curvature of the helmet that is on an opposite side of the helmet from an interior curvature that is configured to be at least partially disposed over the head of the user. The flexible cell structures of the radial honeycomb matrix in the expanded condition are each arranged radially in a direction that is perpendicular to the interior curvature configured to be disposed over the head of the user.

In embodiments, a helmet includes at least one strap positioned over the helmet configured to limit an amount of expansion of the honeycomb matrix when moving into the expanded condition.

In embodiments, a helmet includes a chin strap assembly connected to the at least one side of the at least one segment of flexible material. In embodiments, a portion of the chin strap assembly includes the at least one strap positioned over the helmet.

In embodiments, a portion of the chin strap assembly is made of the same material as the at least one strap positioned over the helmet.

In embodiments, the honeycomb matrix includes a plurality of walls that is arranged to form cells of the honeycomb matrix. A first portion of the plurality of walls extends from a front of the helmet to a rear of the helmet and a second portion of the plurality of walls extends from a central location of the helmet part way toward the front and the rear of the helmet resulting in a reduced number of cells proximate the front and rear of the helmet relative to the central location that is distal from the front and rear of the helmet.

In embodiments, a helmet includes a helmet location indicator mechanism connected to the helmet and configured to connect over a wireless network with one of a mobile device, a vending kiosk, a proximity detector, and a computer. In embodiments, an inventory control facility processes at least a portion of helmet inventory and sale by detecting the helmet location indicator mechanism.

In embodiments, a helmet includes a use indicator mechanism connected to the helmet that indicates that the helmet has been opened to its expanded condition.

In embodiments, a helmet includes at least one light mechanism connected to the helmet that is configured to switch on illumination when the helmet is opened to its expanded condition.

In embodiments, at least one light mechanism connected to the helmet is a use indicator mechanism that is configured to switch on illumination when the helmet is opened to its expanded condition and indicates that the helmet has been used.

In embodiments, at least one segment in its expanded condition is configured to display a portion of one of advertising, a graphic, and text on an outer surface that defines an exterior curvature of the least one segment of the helmet.

In embodiments, at least one segment in its collapsed or folded condition is configured to reduce visibility of the portion of one of advertising, a graphic, and text on the outer surface that defines the exterior curvature of the at least one segment of the helmet and is configured to reveal the portion of one of advertising, a graphic, and text on the outer surface as the at least one segment of the helmet moves from the collapsed or folded condition to the expanded condition.

In embodiments, a helmet that fits over a head of a user includes a honeycomb matrix movable from a collapsed or folded condition where the honeycomb matrix is collapsed and an expanded condition where the honeycomb matrix is expanded and at least partially disposed over the head of the user and arranged radially relative to the surface of the head of the user. The helmet also includes at least one strap that is configured to limit an amount of expansion of the honeycomb matrix in the expanded condition.

In embodiments, the at least one strap that is configured to limit the amount of expansion is disposed over an outer surface of the honeycomb matrix when the helmet is disposed in the expanded condition.

In embodiments, a helmet includes the at least one strap that is configured to limit the amount of expansion is configured to one of gather, fold, or coil when the honeycomb matrix is in the collapsed or folded condition.

In embodiments, a helmet includes a chin strap mechanism having at least one strap that is attached to a strap attachment region of an exterior wall of the honeycomb matrix with a portion of the at least one strap that is configured to limit an amount of expansion of the honeycomb matrix.

In embodiments, the honeycomb matrix defines a recess configured to accept at least a portion of the at least one strap that is configured to limit an amount of expansion of the honeycomb matrix when the honeycomb matrix is in the expanded condition.

In embodiments, a helmet that fits over a head of a user including a honeycomb matrix movable between a collapsed or folded condition where the honeycomb is unopened and an expanded condition where the honeycomb matrix is opened up and at least partially disposed over the head of the user. The honeycomb matrix includes a plurality of cells that are disposed in a position that is generally perpendicular to a surface of the head of the user when in the expanded condition. The honeycomb matrix includes a reduced number of cells proximate a front and a rear of the helmet relative to a central location that is distal from the front and rear of the helmet.

In embodiments, the honeycomb matrix includes the plurality of cells that includes cells each radially aligned with each other.

In embodiments, a helmet includes at least one strap positioned over the honeycomb matrix and configured to limit an amount of expansion of the honeycomb matrix when moving into the expanded condition.

In embodiments, a helmet includes a chin strap assembly connected to an exterior wall of the honeycomb matrix. In embodiments, a portion of the chin strap assembly includes the at least one strap positioned over the honeycomb matrix.

In embodiments, a portion of the chin strap assembly is made of the same material as the at least one strap positioned over the honeycomb matrix.

In embodiments, a helmet includes at least one light mechanism connected to the helmet that is configured to switch on illumination when the helmet is opened to its expanded condition.

In embodiments, a middle segment between two side segments each includes plurality of cells that form the honeycomb matrix movable from the collapsed or folded condition where each side of the side segments are disposed generally parallel and an expanded condition where the middle segment and the side segments are expanded and in cooperation and form an exterior curvature of the helmet that is on an opposite side of the helmet from an interior curvature that is configured to be at least partially disposed over the head of the user.

In embodiments, the honeycomb matrix in its expanded condition is configured to display a portion of one of advertising, a graphic, and text on an outer surface that defines an exterior curvature of the helmet. In embodiments, the honeycomb matrix in its collapsed or folded condition is configured to reduce visibility of the portion of one of advertising, a graphic, and text on the outer surface that defines the exterior curvature of the helmet and is configured to reveal the portion of one of advertising, a graphic, and text on the outer surface as the honeycomb matrix moves from the collapsed or folded condition to the expanded condition.

In embodiments, a method for protecting a head of a user of a bicycle from impact includes expanding at least one segment of flexible cell structures that form a honeycomb matrix movable from a collapsed or folded condition where each side of the at least one segment is disposed generally parallel to an expanded condition where the honeycomb matrix is at least partially disposed over the head of the user. In embodiments, the cell structures of the honeycomb matrix of the at least one segment are disposed in a position that is generally perpendicular to a surface of the head of the rider when in the expanded condition.

In embodiments, the method includes closing a chin strap mechanism under a chin on the head of the user.

In embodiments, the method includes signaling a location of the helmet from a mechanism on the helmet that is configured to connect over a wireless network with one of a mobile device, a vending kiosk, a proximity detector, and a computer.

In embodiments, the method includes limiting the expansion of the honeycomb matrix when moving into the expanded condition with at least one strap positioned over the helmet configured to limit an amount of the expansion.

In embodiments, the method includes indicating with a use indicator mechanism connected to the helmet that the helmet has been opened to its expanded condition.

In embodiments, the method includes providing illumination from the helmet with at least one light mechanism that is configured to switch on illumination when the helmet is opened to its expanded condition.

In embodiments, a helmet that also includes at least one solid side frame attached to an external face of the at least one segment. In embodiments, a helmet that also includes a chin strap connected to the at least one solid side frame.

In embodiments, a helmet includes at least one segment having a middle segment of flexible material between two side segments of flexible material and the middle segment and the side segments are each movable from a collapsed or folded condition where each side of the side segments are disposed generally parallel and an expanded condition where the middle segment and the side segments are expanded and in cooperation are at least partially disposed over the head of the user. In embodiments, the two side segments, each includes a solid side frame attached to the external face of the side segment. In embodiments, the solid side frames are connected with each other through a set of hinges. In embodiments, the solid side frames are made of plastic. In embodiments, the solid side frames include perforations extending through the length of the frames. In embodiments, the helmet further comprises at least one pipe structure extending through the length of the helmet, the pipe structure integrated with and fitting into the honeycomb matrix at a plurality of points.

In embodiments, the helmet includes a tracking system integrated with the helmet configured to connect over a wireless network with a mobile device, a vending kiosk, a proximity detector and a computer to monitor and report the usage, condition and location of the helmet.

In embodiments, the helmet is part of a bicycle ride share infrastructure configured to determine the supply chain logistics associated with rent and return of the helmet. Accordingly, the helmet may be configured to report its disposition to an inventory management system when the helmet is dispensed from and returned to a helmet dispensing kiosk.

In embodiments, the helmet includes a fitness tracker paired with the mobile device, or smart bicycle, scooter, or other forms of mobility or outdoor exercise equipment of the user. In embodiments, the fitness tracker includes at least one sensor configured to detect and report at least one physiological parameter of the user of the helmet. The physiological parameter may, for example, be the heartbeat, pulse rate or oxygen saturation of the user of the helmet.

In embodiments, the helmet is configured to provide reporting to an emergency response service when damage to the helmet exceeds a certain threshold.

In embodiments, the helmet includes a notification system configured to communicate an alert to the user of the helmet upon triggering of pre-determined condition.

In embodiments, the helmet is fabricated using a 3D printing system. The 3D printing system may be provided at a bike-share station for customizing the helmet based on the requirements of the user. Accordingly, in embodiments, the 3D printing system includes a helmet sizing system for measuring the helmet requirements for a user.

In embodiments, the helmet includes at least one sensor mechanism configured to transmit a signal to a paired device when the helmet is worn properly by the user, the paired device allowing the user to operate the bicycle. In embodiments, the sensor mechanism includes a communication interface configured to transmit signals to and receive signals from the paired device in accordance with a communication protocol. In embodiments, the communication protocol is Bluetooth.

In embodiments, a method includes the manufacturing of an expandable helmet for protecting a head of a user of a bicycle from impact. The helmet includes flexible cell structures that form a honeycomb matrix movable from a collapsed or folded condition to an expanded condition where the honeycomb matrix is at least partially disposed over the head of the user and arranged radially relative to the surface of the head of the user. The method includes creating a three-dimensional scanned digital image of the head of the user, storing the scanned image in a computer memory, using computer aided design (CAD) software to produce a design for the expandable helmet and using the CAD produced design to custom manufacture the helmet with a three-dimensional printer.

In embodiments, a bicycle helmet for fitting over a head of a user includes a segment of flexible cell structures; a first side frame and a second side frame. The segment of flexible cell structures form a radial honeycomb matrix between first and second ends, the segment movable between a folded condition where each of the first and second ends of the segment are disposed generally parallel and an expanded condition where the radial honeycomb matrix of the at least one segment is configured to be expanded at least partially over the head of the user and arranged radially relative to the surface of the head of the user. The first side frame is disposed at the first end of the honeycomb matrix, the first side frame including a first hinge arm having a first finger extending therefrom, the first hinge arm defining a first notch adjacent to the first finger, the first finger having a first lip formed thereon. The second side frame is disposed at the second end of the honeycomb matrix, the second side frame including a first locating ridge. During movement of at least one of the first and second side frames toward an expanded use position, the first finger (i) slidably moves across the second side frame causing the first finger to be initially deflected into the first notch followed by (ii) the first lip positively locating at the first locating ridge.

In examples, movement of the first lip at the first locating ridge causes an audible sound and positive tactile feedback. The first side frame includes a second locating ridge and the second side frame includes a second hinge arm having a second finger extending therefrom. The second hinge arm defines a second notch adjacent to the second finger. The second finger has a second lip formed thereon. During movement of the at least one of the first and second side frames toward the expanded use position, the second finger (i) slidably moves across the first side frame causing the second finger to be initially deflected into the second notch followed by (ii) the second lip positively locating at the second locating ridge. Movement of the second lip at the second locating ridge causes an audible sound and positive tactile feedback. The first and second hinge arms define a common aperture, the helmet further comprising a first axle that locates through the common aperture creating a first hinge assembly. The first axle includes a series of fingers that snapingly pass through the common aperture during assembly. The series of fingers collectively include a terminal ridge. The series of fingers initially deflect inward until the terminal ridge clears the first and second hinge arms.

In other features, the first side frame includes a third hinge arm having a third finger extending therefrom, the third hinge arm defining a third notch adjacent to the third finger, the third finger having a third lip formed thereon, the second side frame including a second locating ridge. During movement of at least one of the first and second side frames toward an expanded use position, the third finger (i) slidably moves across the second side frame causing the third finger to be initially deflected into the third notch followed by (ii) the third lip positively locating at the third locating ridge. The second hinge arm locates intermediate the first and third hinge arms. The common aperture is further defined through the third hinge arm, the first axle passing through each of the first, second and third hinge arms. The first and second frames rotate to a position beyond parallel in the expanded position.

BRIEF DESCRIPTION OF THE FIGURES

In the accompanying figures, like reference numerals refer to identical or functionally similar elements throughout the separate views and together with the detailed description below are incorporated in and form part of the specification, serve to further illustrate various embodiments and to explain various principles and advantages all in accordance with the systems and methods disclosed herein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of the many embodiments of the systems and methods disclosed herein.

DETAILED DESCRIPTION

The present disclosure will now be described in detail by describing various illustrative, non-limiting embodiments thereof with reference to the accompanying drawings and exhibits. The disclosure may, however, be embodied in many different forms and should not be construed as being limited to the illustrative embodiments set forth herein. Rather, the embodiments are provided so that this disclosure will be thorough and will fully convey the concept of the disclosure to those skilled in the art. The claims should be consulted to ascertain the true scope of the disclosure.

Figure 5:
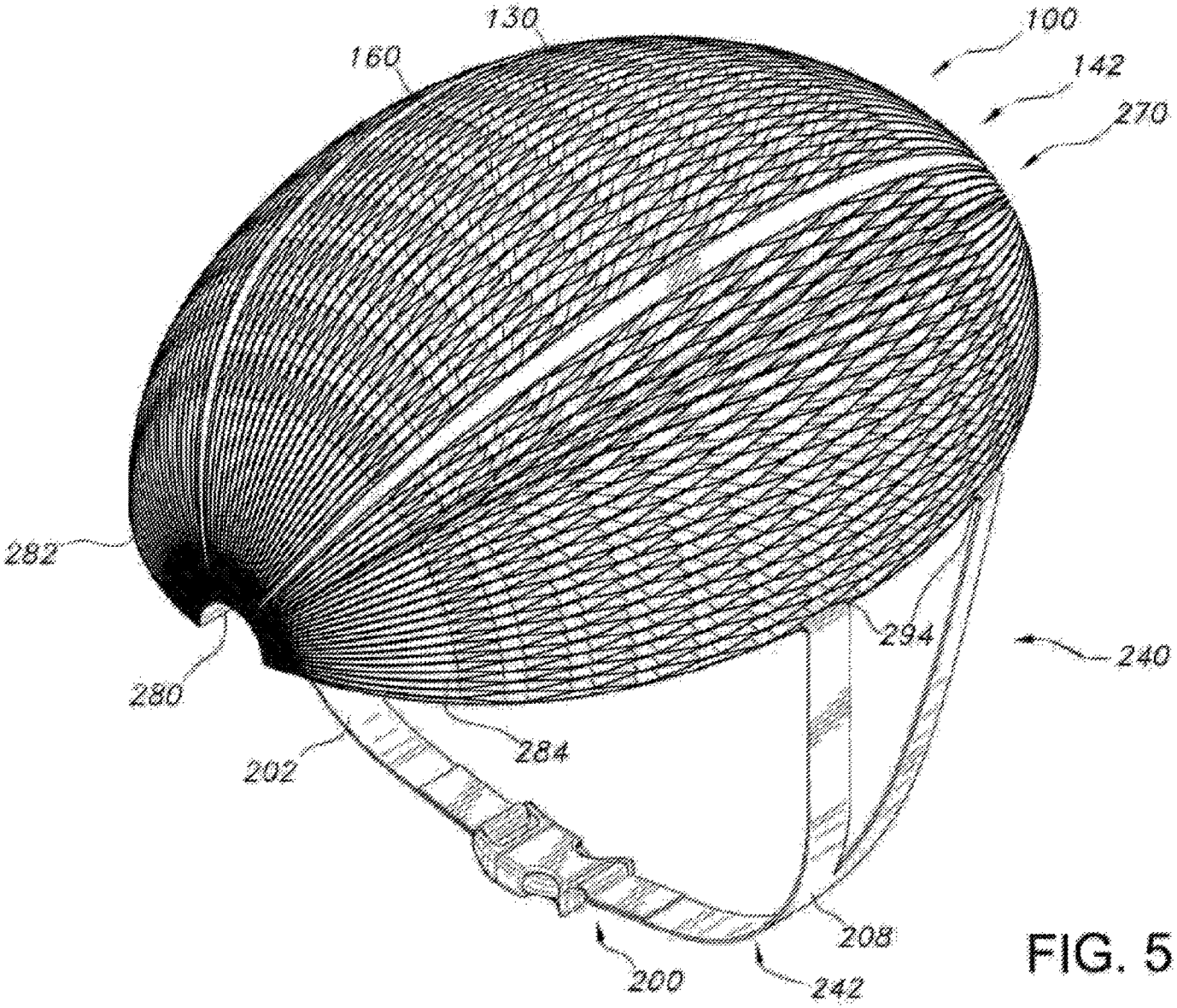
FIG. 5 is a top perspective view of a helmet in an operational or expanded condition in accordance with the present disclosure.

With reference to the Figures, FIG. 5 illustrates a helmet 100 that may be worn by a user 110 and may be shown to protect the user 110 when in a crash or fall while riding a bicycle 120. The helmet 100 includes a honeycomb-shaped matrix 130. The honeycomb-shaped matrix 130 configuration provides head protection to the user 110 while the user 110 rides the bicycle 120. The honeycomb-shaped matrix 130 provides structural integrity to the helmet 100, thereby allowing the helmet 100 to protect the head 150 of the user 110. The helmet 100 and the orientation and configuration of the honeycomb-shaped matrix 130 may include numerous ornamental features independent and distinct from its numerous technical and functional features disclosed herein.

FIGS. 13-20 illustrate the helmet 100 in a collapsed condition. In some embodiments, the helmet 100 can be sold, rented, leased, manufactured, dispensed, and/or stored in the folded, i.e., collapsed, condition 140. The user 110 can buy, retrieve, rent, lease, or otherwise retrieve the helmet 100 while the helmet 100 is in the collapsed condition 140 and expand the helmet to its expanded condition 142 prior to placing on the head 150 of the user 100. The helmet 100 may be expanded and moved to its expanded, operational, open, or the like condition 142, which is illustrated in FIGS. 5-12. Movement between the collapsed condition 140 and the expanded condition 142 are depicted in the figures including FIGS. 2, 3 and 4.

In the collapsed or folded condition 140, the helmet 100 may be stored until use, sale, giveaway, or the like. When the helmet 100 is deployed to its expanded condition 142, the helmet 100 may be worn on the head 150 of the user 110 to protect the head 150 of the user 110 while riding. FIGS. 2-5 illustrate an outer surface 152 of the head 150. The outer surface 152 has contours 154. The honeycomb matrix 130 has a plurality of cell structures 160. In embodiments, the cell structures 160 may be radially disposed over the contours 154 in a direction that is generally perpendicular to the outer surface 152 of the head 150 to protect the head 150. The user 110 may return the helmet 100 to its collapsed or folded condition 140, such as at a stop during a bicycle ride or at a conclusion of a bicycle ride. The user 110 may later unfold and expand the helmet 100. In some embodiments, the user 110 may move the helmet 100 between the collapsed condition 140 and the expanded condition 152 several times, such as before and/or after several bicycle rides, thereby reusing the helmet 100 several times. In some embodiments, the helmet 100 may be moved between the collapsed or folded condition 140 and the expanded condition 142 many times over a service lifetime of the helmet 100. In some embodiments, the helmet 110 may be moved between the collapsed or folded condition 140 and an expanded condition 142 a predetermined amount of movements to define the service lifetime of the helmet 100. In some embodiments, the helmet 100 may be moved between the collapsed or folded condition 140 and the expanded condition 142 once or a limited number of times indicative of the service lifetime and then recycled or discarded. In embodiments, repeated movement between the collapsed or folded condition 140 and the expanded condition 142 of the helmet 100 within its service lifetime may be shown to not impede the efficacy of the head protection offered by the helmet 100.

In some embodiments, the helmet 100 may include a use indicator, the use indicator indicating use but otherwise not compromising the overall structural integrity of the helmet 100. For example, the use indicator may indicate that the helmet 100 has been unfolded to the expanded condition 142. The user indicator can include, for example, a sheet of paper that is irreversibly broken when the helmet 100 is unfolded to the expanded condition 142. The use indicator can be any suitable means of permanently or semi-permanently indicating that the helmet 100 has been unfolded to the expanded condition 142.

Figure 55:
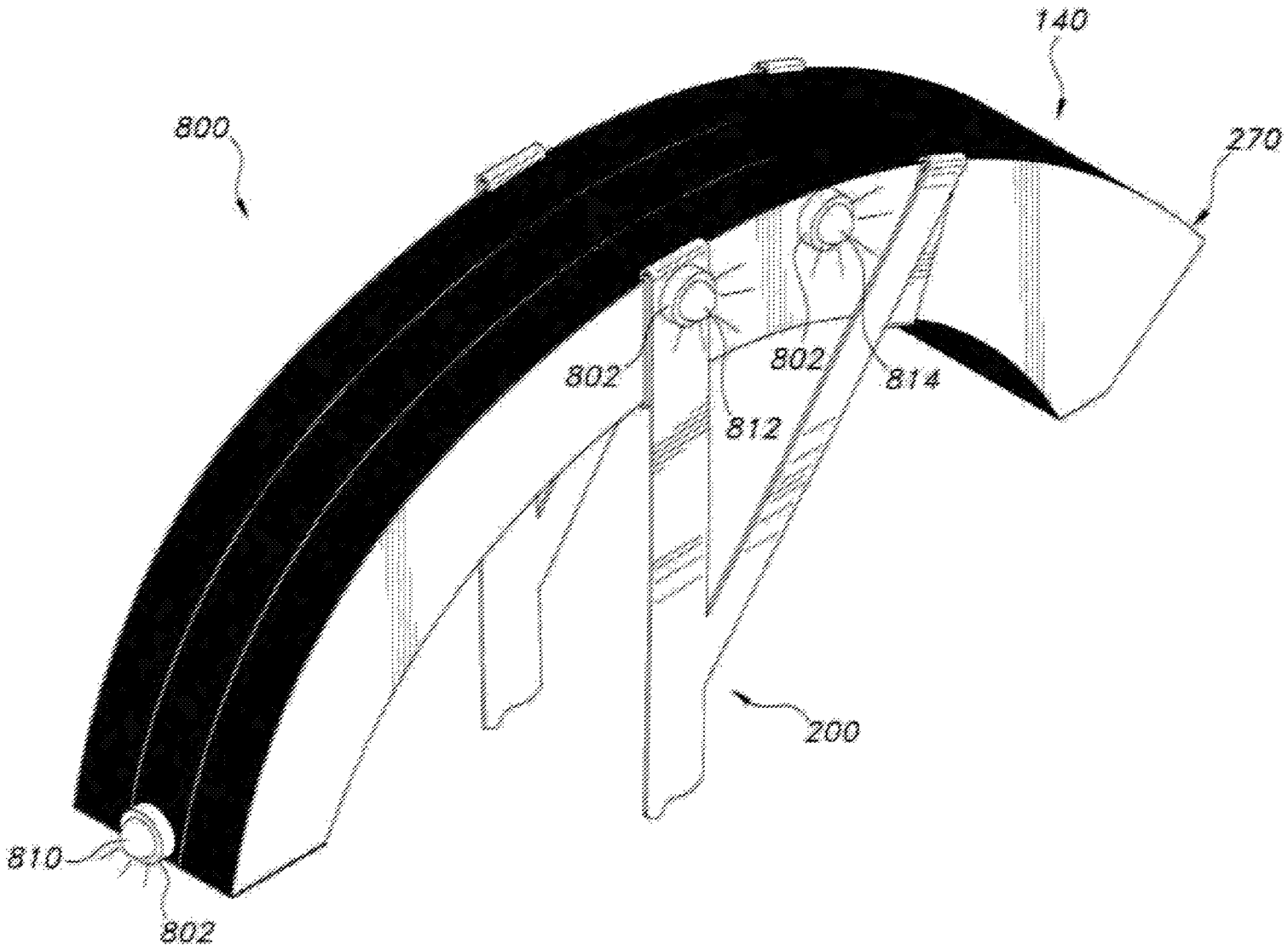
FIGS. 55 and 56 are diagrammatic views of embodiments of helmets with lighting mechanism deployed during use in accordance with the present disclosure.
Figure 56:
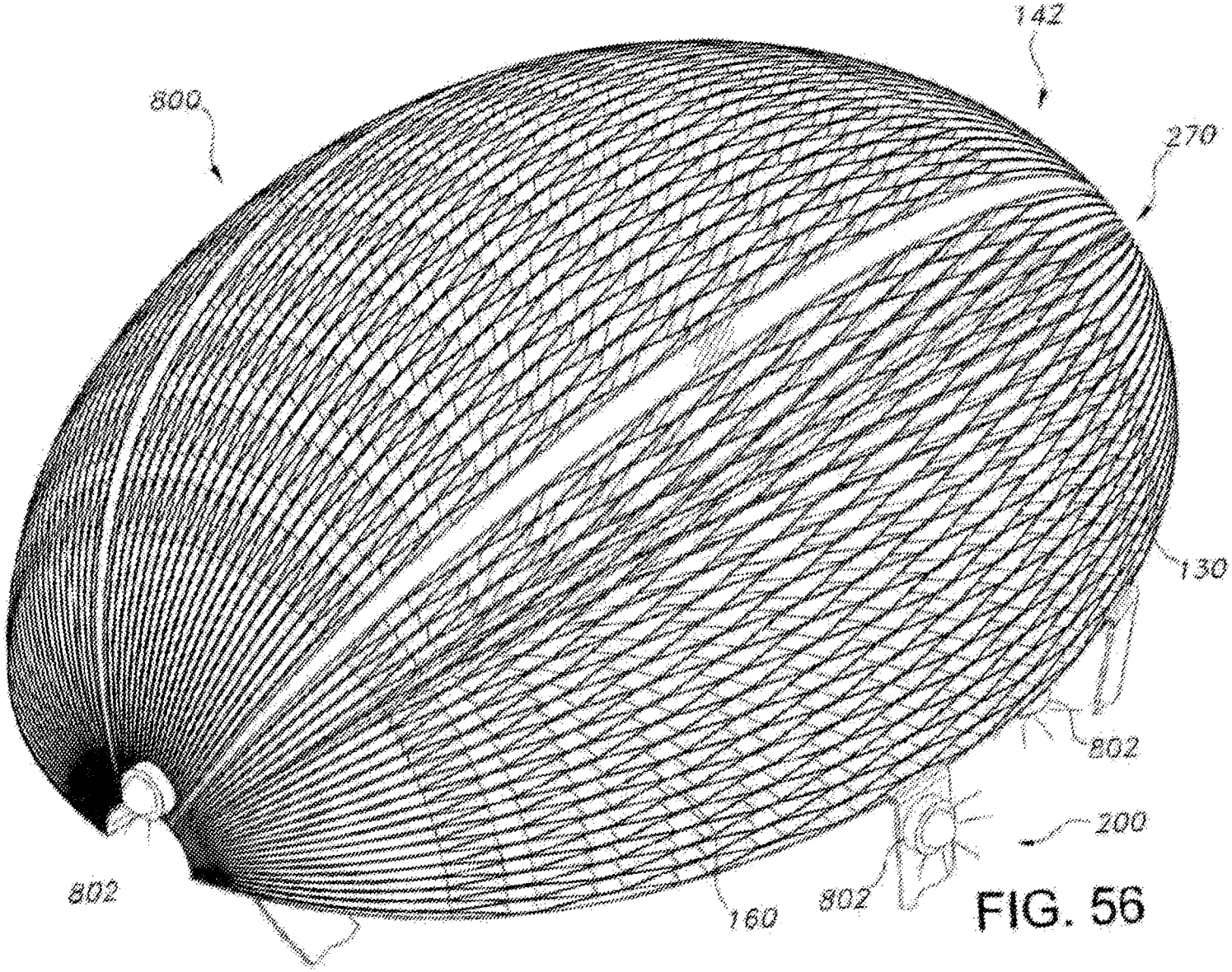

Referring to FIGS. 55 and 56, in some embodiments, the helmet 100 may include one or more light mechanisms 802. The light mechanisms 802 can include reflectors, light emitting diodes, or any other suitable means of reflecting or emitting light. In some examples, the one or more light mechanism 802 may be activated when the helmet 100 is moved from the collapsed or folded condition 140 to the expanded condition 142. In some embodiments, activation of the one or more light mechanisms by moving the helmet 100 from the collapsed or folded condition 140 to the expanded condition 142 can be a use indicator. In embodiments, the activation of the one or more light mechanisms 802 by moving the helmet 100 from the collapsed or folded condition 140 to the expanded condition 142 may serve as a trackable indicator of use, one-time use, a number of uses, or any other suitable condition of the helmet 100.

Figure 1:
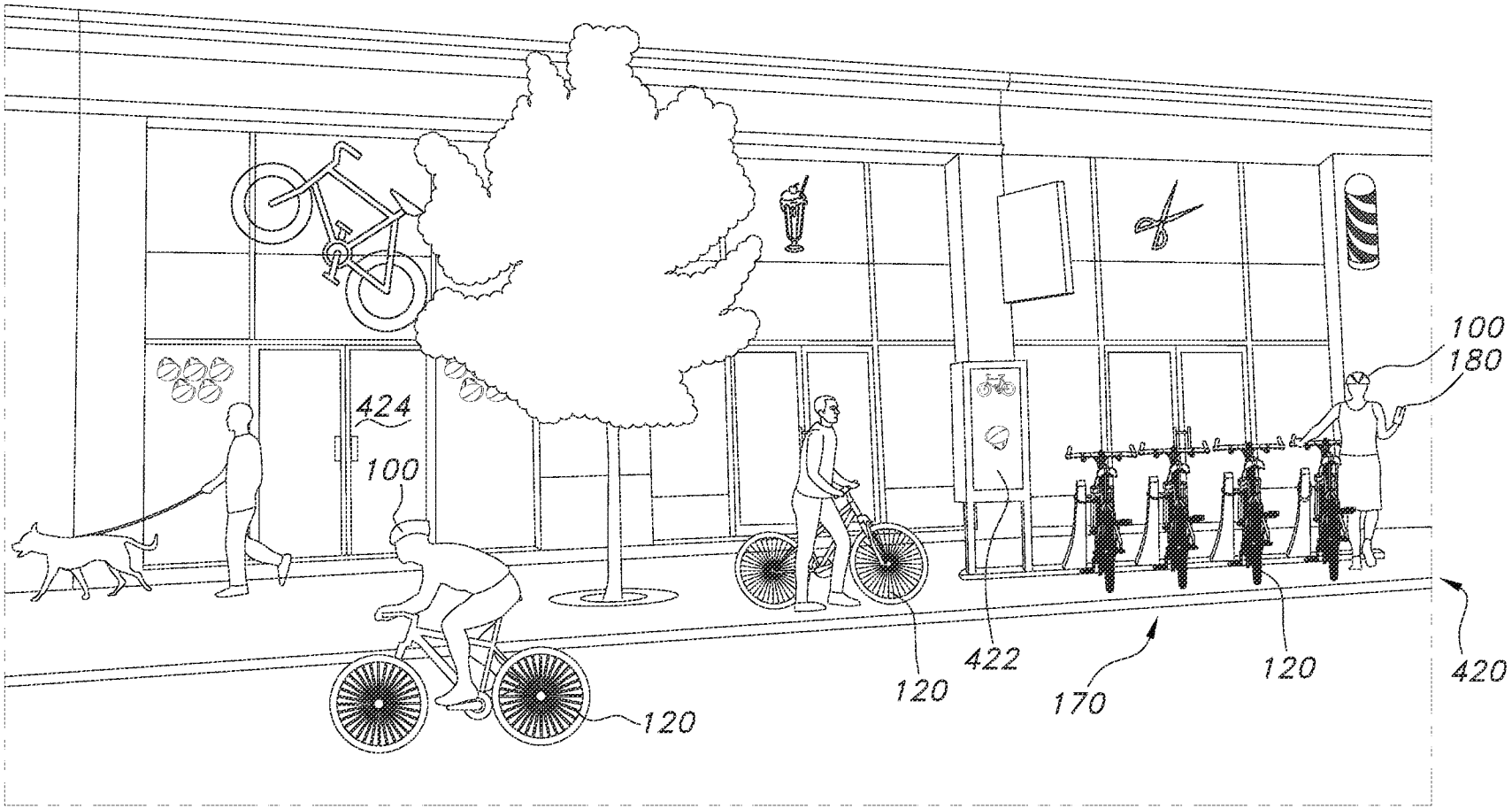
FIG. 1 is a diagrammatic view of helmets deployed into a bicycle sharing or other mobility unit sharing environment in combination with a helmet vending environment with bicycles, scooters, skateboards, or other units in accordance with the present disclosure.

Referring to FIG. 1, in some embodiments, the helmet 100 may be sold, rented, leased, or otherwise dispensed, such as from a vending machine. In some embodiments, the helmet 100 is dispensed in the collapsed or folded condition 140. In some embodiments, the helmet 100 may be dispensed as a part of result of a transaction that may include one or more of renting, sharing, purchase, giveaways, promotional offers, or the like.

Figure 53:
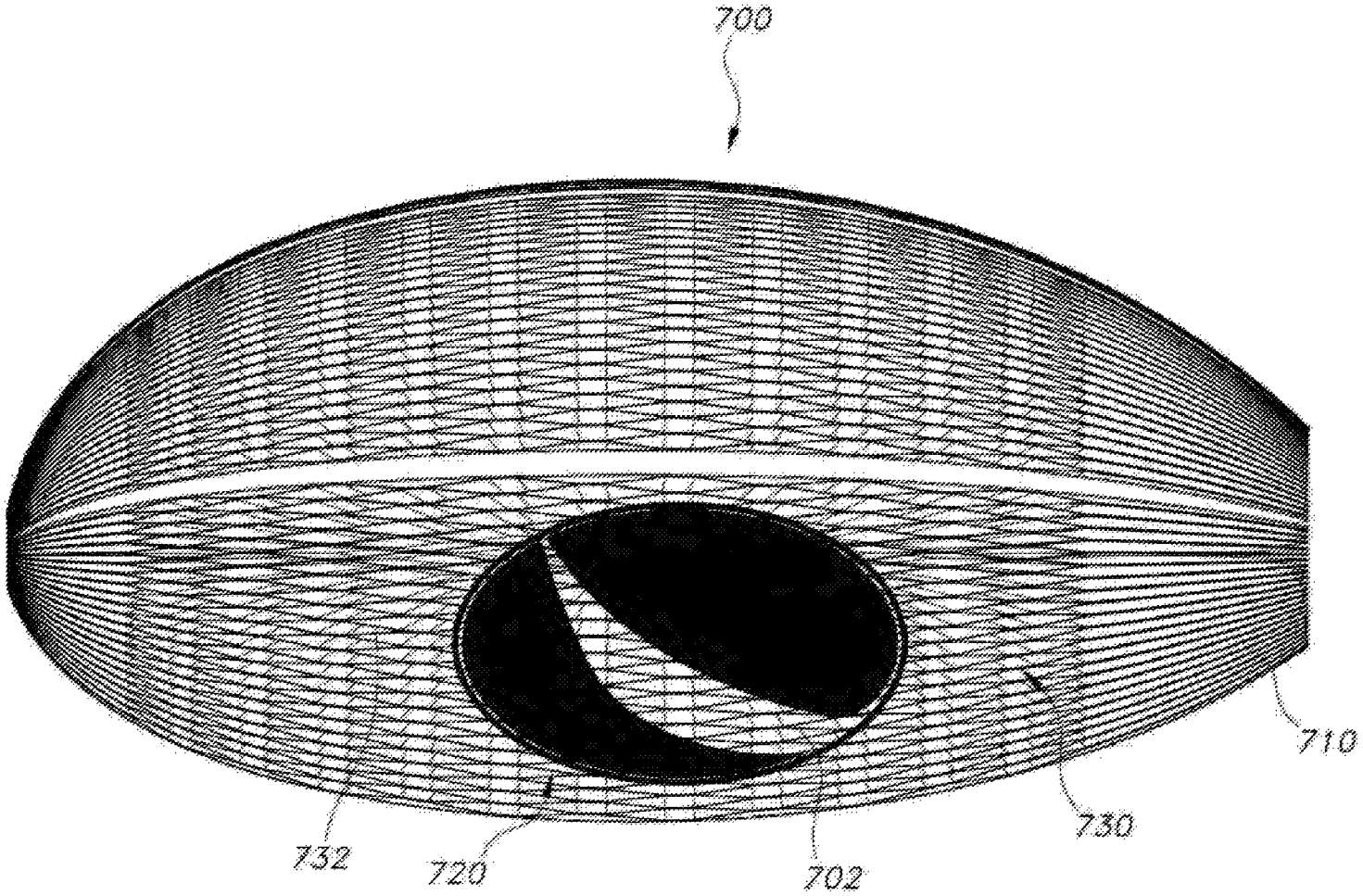
Figure 54:
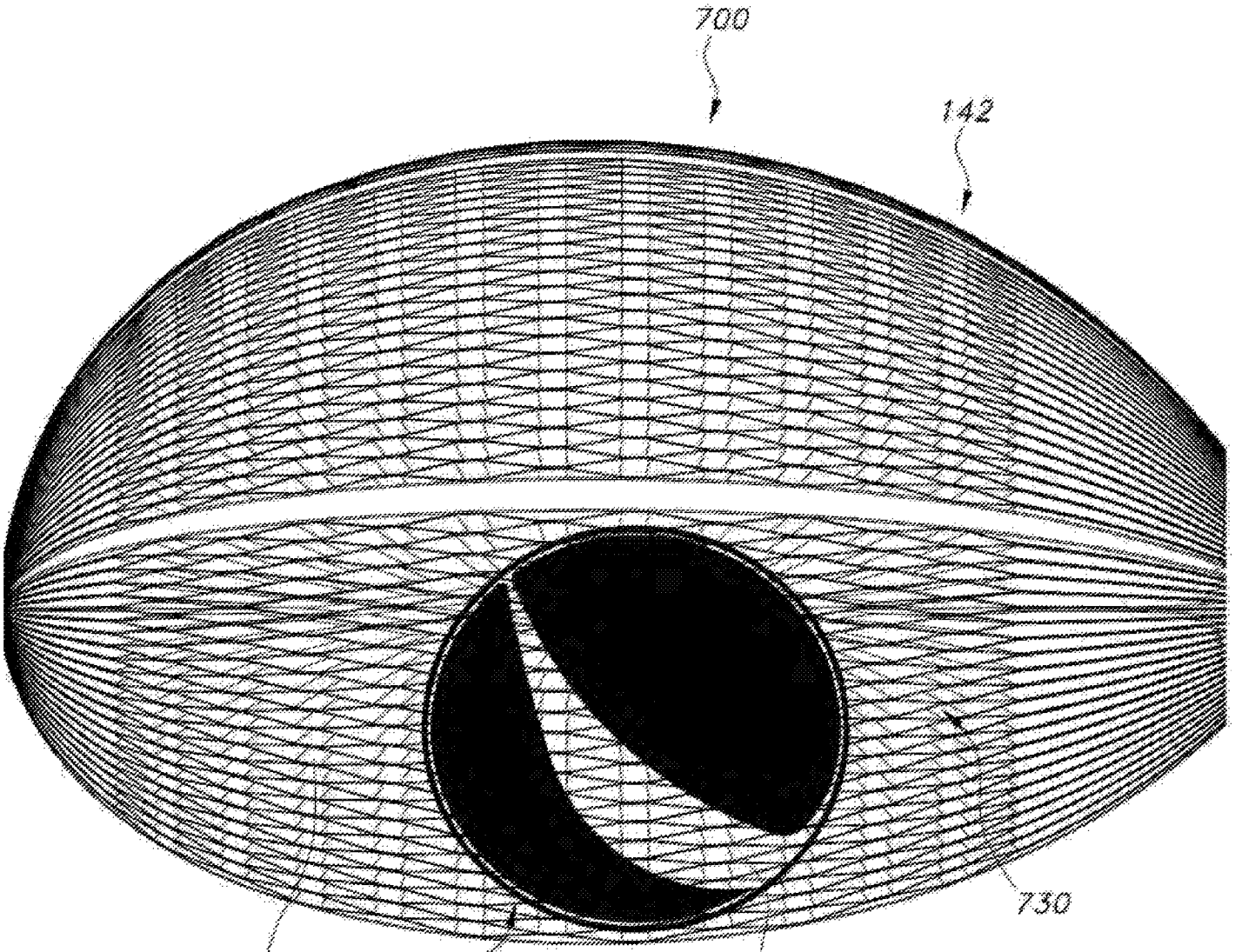

Referring to FIGS. 53 and 54, in some embodiments, the helmet 100 may contain and display one or more advertising marks 702. The advertising marks 702 can include text, figures, logos, slogans, website information, phone numbers, business names, a combination thereof, or any other suitable form of advertising. In some embodiments, the helmet 100 may contain and display advertising 702. The advertising marks 702 may be visible when the helmet 100 is in the expanded condition 142. In some embodiments, the advertising 702 is not fully visible when in its collapsed or folded condition 140. In embodiments, the helmet 100 may reveal advertising or a graphic on an exterior curvature on its outer surface when moved into the expanded condition 142. In one example, the advertising marks 702 are from an entity providing rental of the helmet 100 or a bicycle rental, sharing, purchase, or use service. In some embodiments, the advertising marks 702 may be visible when the helmet 100 is in the collapsed or folded condition. In some embodiments, the advertising marks 702 are visible only when the bicycle is in the expanded condition 142, only when the helmet 100 is in the collapsed or folded condition 140, or both when the helmet 100 is in the expanded condition 142 and the collapsed or folded condition 140. In some embodiments, the advertising marks 702 differ based on whether the helmet 100 is in the collapsed or folded condition 140 or the expanded condition 142.

FIG. 1 illustrates an exemplary bicycle vending scenario, including a vending machine 422 for dispensing the helmet 100 and a bicycle rental device 170 for rental of a bicycle 120. In some embodiments, one or more people, such as the user 110, may rent one or more bicycles including the bicycle 120 via the bicycle system 170. In some embodiments, the user 110 may register for one or more of the bicycle rental devices 170 including sharing programs, rental arrangements, or the like, and may maintain an identity, profile, system information, or the like including a user profile 172, or a portion thereof, that is unique to the one or more bicycle systems 170. In embodiments, the users 110 may use a connected device 180 including mobile phones, a mobile phone of the user 110, web browsers, kiosks, or the like to access, interact with and deploy one or more ride sharing applications or the like and to configure various preferences and/or priorities associated with the user profile 172.

Figure 2:
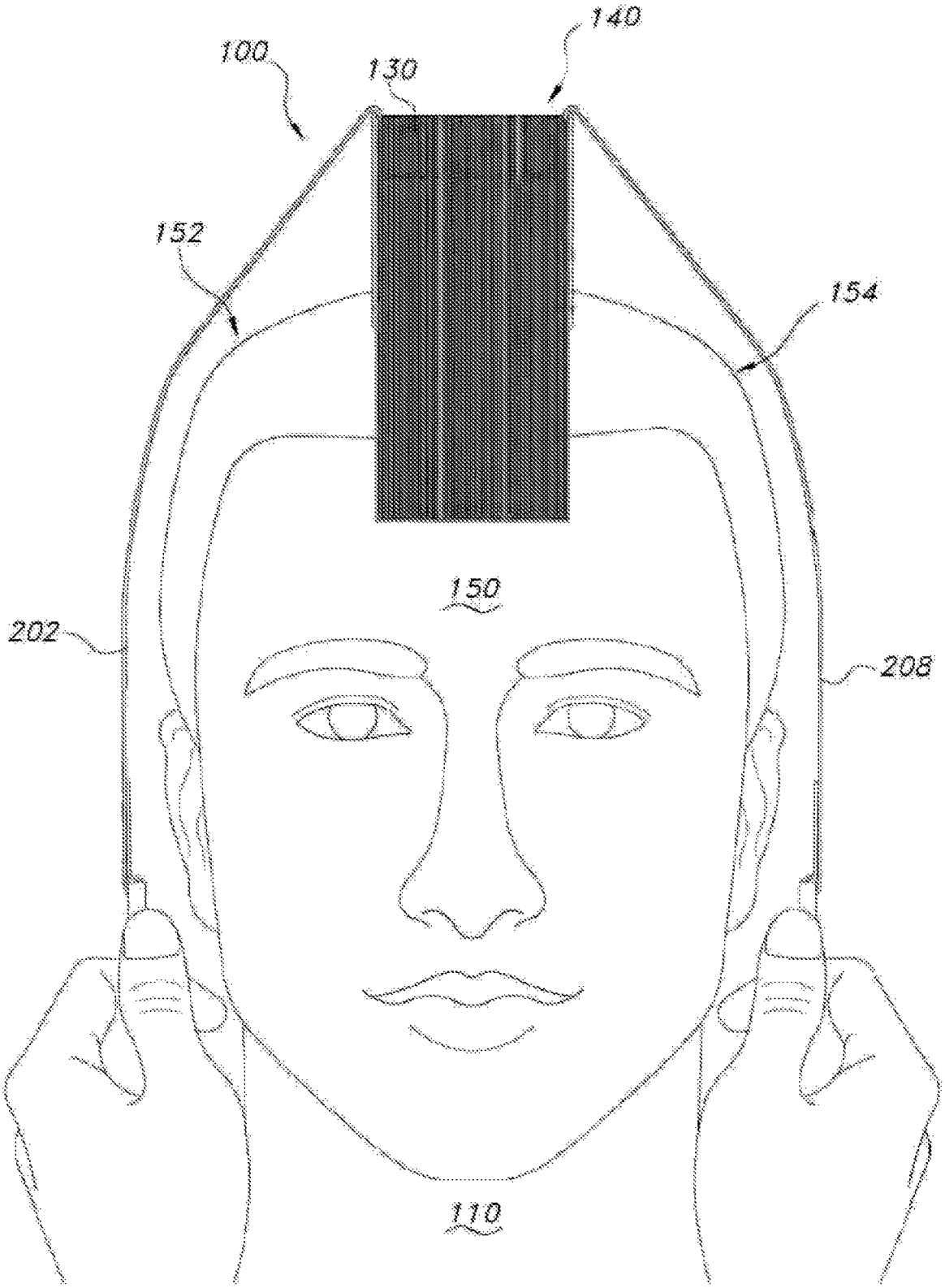
FIG. 2 is a diagrammatic view of a user expanding a helmet from its collapsed or folded condition in accordance with the present disclosure.
Figure 3:
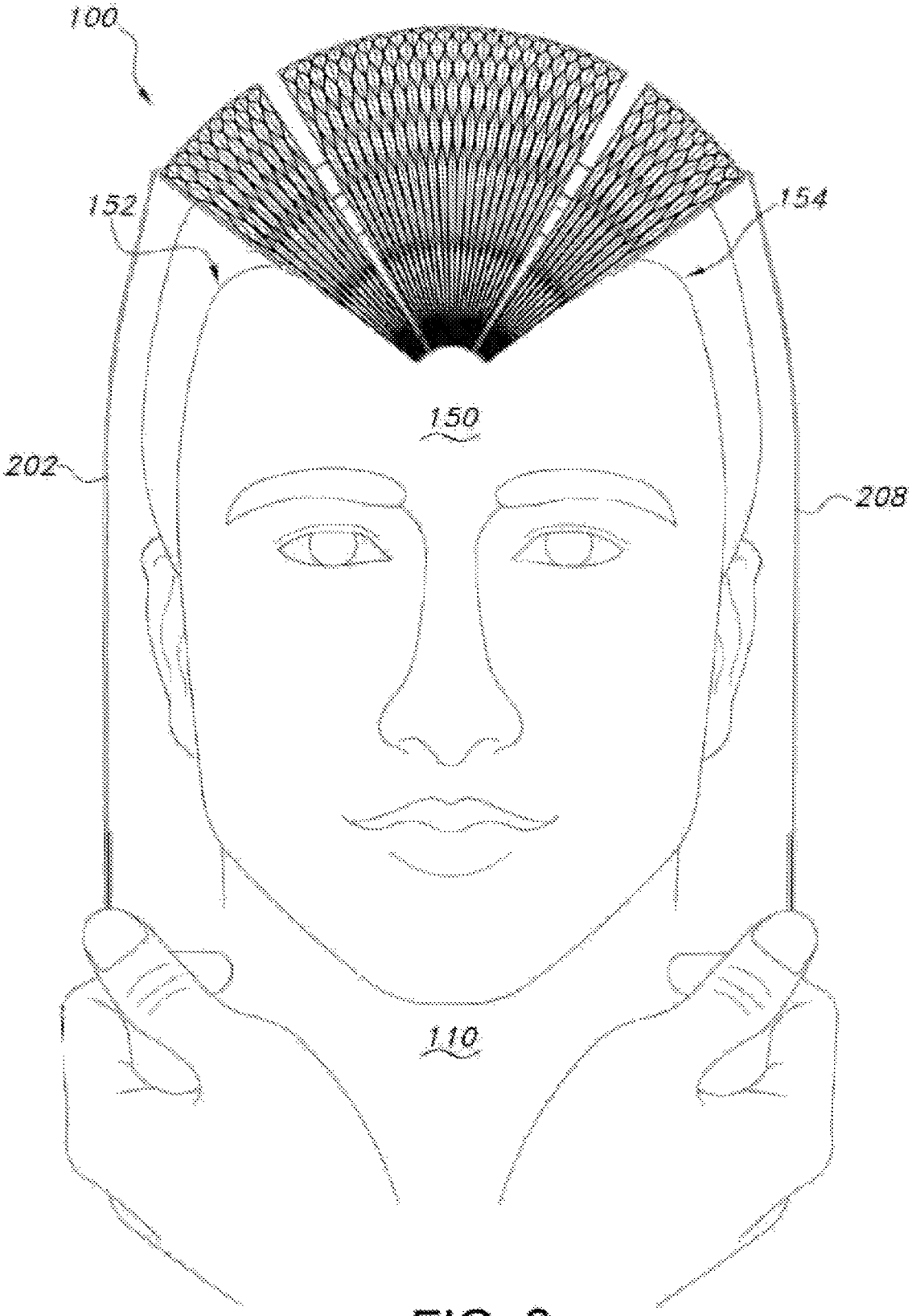
FIG. 3 is a diagrammatic view of the user further expanding the helmet of FIG. 2.
Figure 4:
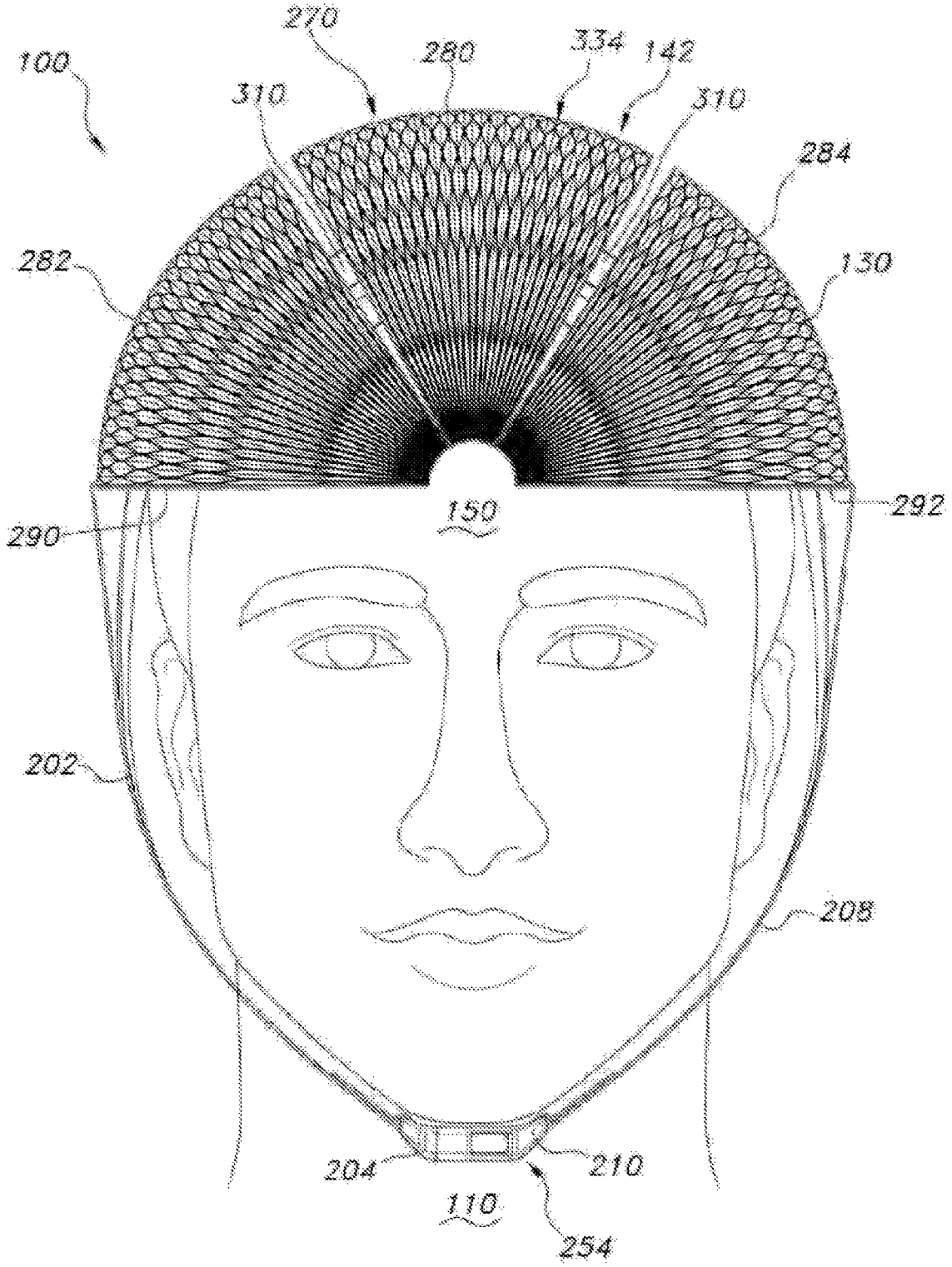
FIG. 4 is a diagrammatic view of the user tightening a chin strap of the expanded helmet of FIG. 3.

FIGS. 2, 3, and 4 illustrate the helmet 100 in the collapsed or folded condition 140, in an intermediate condition between the collapsed condition 140 and the expanded condition 142, and in the expanded condition 142, respectively. Referring to FIG. 2, in some embodiments the helmet 100 includes a chin strap assembly 200. The chin strap assembly 200 includes a plurality of side straps 202, 208 and a plurality of side latches 204, 210. The first side strap 202 is attached to the first side latch 204. The second side strap 208 is attached to the second latch 210. In some embodiments, the user 110 may place the helmet 100 on the head 150 of the user 110 while the helmet 100 is in the collapsed condition 140, and grasp the side straps 202, 208 of the chin strap assembly 200 to pull the helmet 100 over the head 150 of the user 110. FIG. 3 illustrates an intermediate condition between the collapsed condition 140 and the expanded condition 142 of the helmet 100. In some embodiments, as the user 110 pulls on the first side strap 202 connected to a first latch 204 and the second side strap 208 connected to the second latch 210, the helmet 100 moves into the intermediate condition between the collapsed condition 140 and the expanded condition 142 while on the head 150 of the user 110. Referring to FIG. 4, the user 110 may complete the process of securing the helmet 100 to the head 150 of the user 110 and moving the helmet to the expanded condition 142 by securing the first latch 204 to the second latch 210, resulting in the chin strap assembly 200 being secured over a chin 220 of the user 110. In some embodiments, the chin strap assembly 200 is adjustable, such as by adjusting lengths of the first and second side straps 202, 208, for comfort of the user. Closing of the chin strap assembly 200 over and around the chin 220 of the user 110 may place the helmet 100 into its expanded condition 142 and be properly located over the head 150 of the user 110.

In some embodiments, the helmet 100 may be at least partially made of a thin and flexible material 230. The thin and flexible material 230 may form the cell structures 160 of the honeycomb matrix 130. In some embodiments, the honeycomb matrix 130 may be a paper matrix. In some embodiments, the honeycomb matrix 130 may be a plastic or composite matrix. When the helmet 100 is in its expanded condition 142 and the honeycomb matrix 130 is positioned around the head 150 of the user 110, the honeycomb matrix 130 may provide sufficient protection and structural integrity to protect the head 150 of the user 110, for example during an impact of the head 150 with another object during a bicycle ride. In some embodiments, the honeycomb matrix 130 may serve as structural elements in the helmet 100. In some embodiments, the honeycomb matrix 130 may substantially serve as the only structural element of the helmet 100, the only protective element of the helmet 100, and a foldable or collapsible element that substantially permits the helmet 100 to move between the collapsed or folded condition 140 and the expanded condition 142. In some embodiments, the honeycomb matrix 130 is constructed of a radially-disposed matrix of cells. In some embodiments, the honeycomb matrix 130 is constructed of a radially-disposed matrix of cells, where radially-disposed includes any orientation of the cell structures 160 relative to one another that does not include them being parallel to one another. In some embodiments, adjacent cell structures 160 of the honeycomb matrix 130 are not parallel.

In some embodiments, the thin and flexible helmet material 230 of the helmet 100 may be a paper material, a polypropylene material, a composite material, or the like. In some embodiments, the thin and flexible helmet material 230 may also be a paper material substitute, corn plastics, PET plastics, sucrose based plastics, cornstarch based plastics, hemp, woven plastic, recycled paper, and other organic fibers. In some embodiments, the thin and flexible helmet material 230 may be less than 1 mm in thickness. In some embodiments, the configuration of the thin and flexible helmet material 230 as deployed as the honeycomb matrix 130 may permit the helmet 100 to be initially deployed in the collapsed or folded condition 140 and subsequently move multiple times between the collapsed or folded condition 140 and the expanded condition 142. In embodiments, an ability of the honeycomb matrix 130 to flex may permit the helmet 100 to move between the collapsed or folded condition 140 and the expanded condition 142.

The helmet 100 may be worn by the user in the operational or expanded condition 142 and may protect the user when the user experiences a crash, a fall or other head impact while using a bicycle. When worn in an expanded condition 142, the helmet 100 may protect the user 110 by absorbing at least some of the impact resulting from an impact to a user's head 150. It may be shown that the user 110 may be protected from experiencing an impact to the head 150 with the helmet 100 from almost any direction during a crash or other impact into or from an object that could be the ground, a curb, a motor vehicle, another bicycle, another person, an animal, a building, a signpost, or the like.

In some embodiments, the chin strap assembly 200 may secure the helmet 100 to the head 150 of the user 110 by wrapping underneath the chin 220 of the user. The chin strap assembly 200 may include the first side strap 202 connected to the first latch 204 and the second side strap 208 connected to the second latch 210. The second latch 210 may temporarily connect to the first latch 204 to secure the chin strap assembly 200, and thereby secure the helmet 100 to the head 150 of the user 110. The chin strap assembly 200 may be made from polypropylene braided mesh, cotton mesh, and other suitable strap material. In further examples, the chin strap assembly 200 may be made of paper, leather, composite material, polypropylene material, or the like.

Referring to FIG. 5, the first and second side straps 202, 208 of the chin strap assembly 200 may each include and upper chin strap 240, a lower chin straps 242, and a buckle 254. In some embodiments, the upper chin straps 240 may each include two upper chin strap portions 250, 252. The lower chin straps 242 may each connect to the latches 204, 210 to form a buckle 254. In some embodiments, the first side strap 202 and the second side strap 208 may each include one of the upper chin straps 240 and one of the lower chin straps 242 and may releasably connect at the buckle 254.

With reference to FIG. 5 through FIG. 12, the helmet 100 may include a plurality of segments 270. In some embodiments, the segments 270 may be separated by and define gaps 272 between the segments 270. In some embodiments, the helmet 100 may include three segments 270, the three segments 270 defining two gaps 272 therebetween. The three segments 270 may include a middle segment 280 and two side segments 282, 284. In some embodiments, each of the segments 270 each include the honeycomb matrix 130 with the radially aligned cell structures 160. In some embodiments, the cell structures 160 may cooperate in combination to form the honeycomb matrix 130. The honeycomb matrix 130 and its cell structures 160 may be formed of layers of the helmet material 230 such as paper, plastics, and/or other suitable materials.

In some embodiments, layers of the helmet material 230 may be glued in a pattern to form the cell structures 160. The pattern of the layers of the helmet material 230 may be arranged so that the cell structures 160 are orthogonal to the outer surface 152 of the head 150 the user 110 and the cell structures 160 permit the helmet 100 to move between the collapsed or folded condition 140 and the expanded condition 142. In some embodiments, the pattern of the layers of the helmet material 230 may also be arranged to permit the cell structures 160 to collapse or fold and allow the segments 270 to each lay flat laterally while the helmet 100 is in the collapsed or folded condition 140. In some embodiments, layers of the helmet material 230 may be glued in an alternating radial pattern that may form the individual structural cells 160 of the honeycomb matrix 130. In some embodiments, the structural cells 160 may be less than or equal to 1.5 cm wide in any direction when the helmet 100 is in the expanded condition 142.

In some embodiments, the first side strap 202 and the second side strap 208 of the upper chin straps 240 may each attach to the two side segments 282, 284. In some embodiments, various configurations of the chin strap assembly 200 and other mechanisms to secure the helmet 100 to the user 110 may be used. In some embodiments, the first side segment 282 may have a first external face 290 and the second side segment 284 may have a second external face 292. In the collapsed or folded condition 140 of the helmet 100, the first and second external faces 290 and 292 may be substantially parallel. In some embodiments, the first and second external faces 290, 292 include attachment points 294, 298 for attachment of the first and second side straps 202, 208. The first and second side straps 202, 208 of the chin strap assembly 200 may attach to the first and second side segments 282, 284 at attachment points 294, 298 on the first and second external faces 290, 292, respectively. In some embodiments, at least one of the upper chin straps 240 and the two upper chin strap portions 250, 252 may be secured to the attachment points 294, 298 with glue, other appropriate adhesives, mechanical fasteners, or the like. In embodiments, the at least one of the upper chin straps 240 and the two upper chin strap portions 250, 252 may also lock or tie into a portion of the two side segments 282, 284, or the like.

Figure 6:
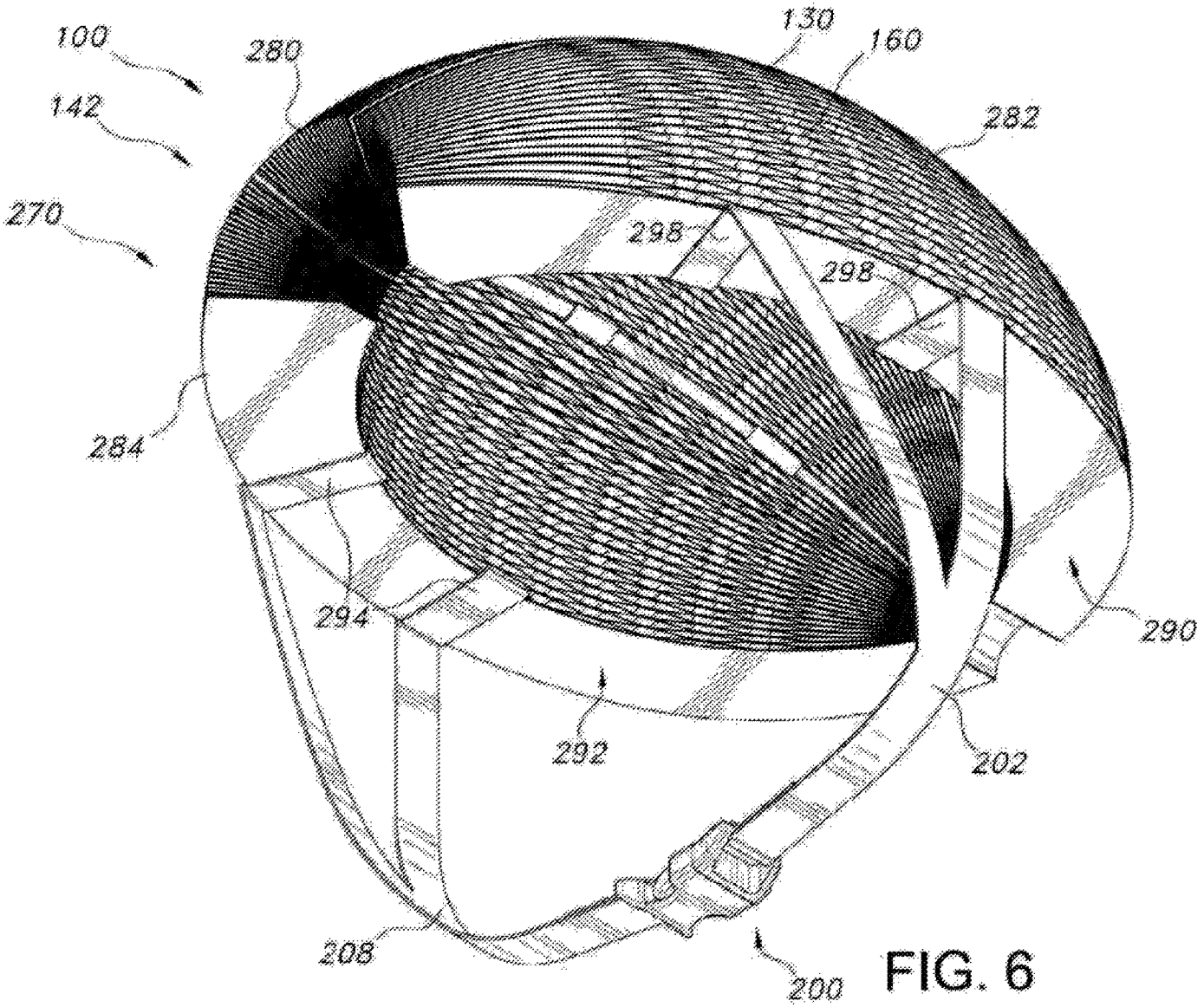
FIG. 6 is a bottom perspective view of the helmet of FIG. 5.
Figure 7:
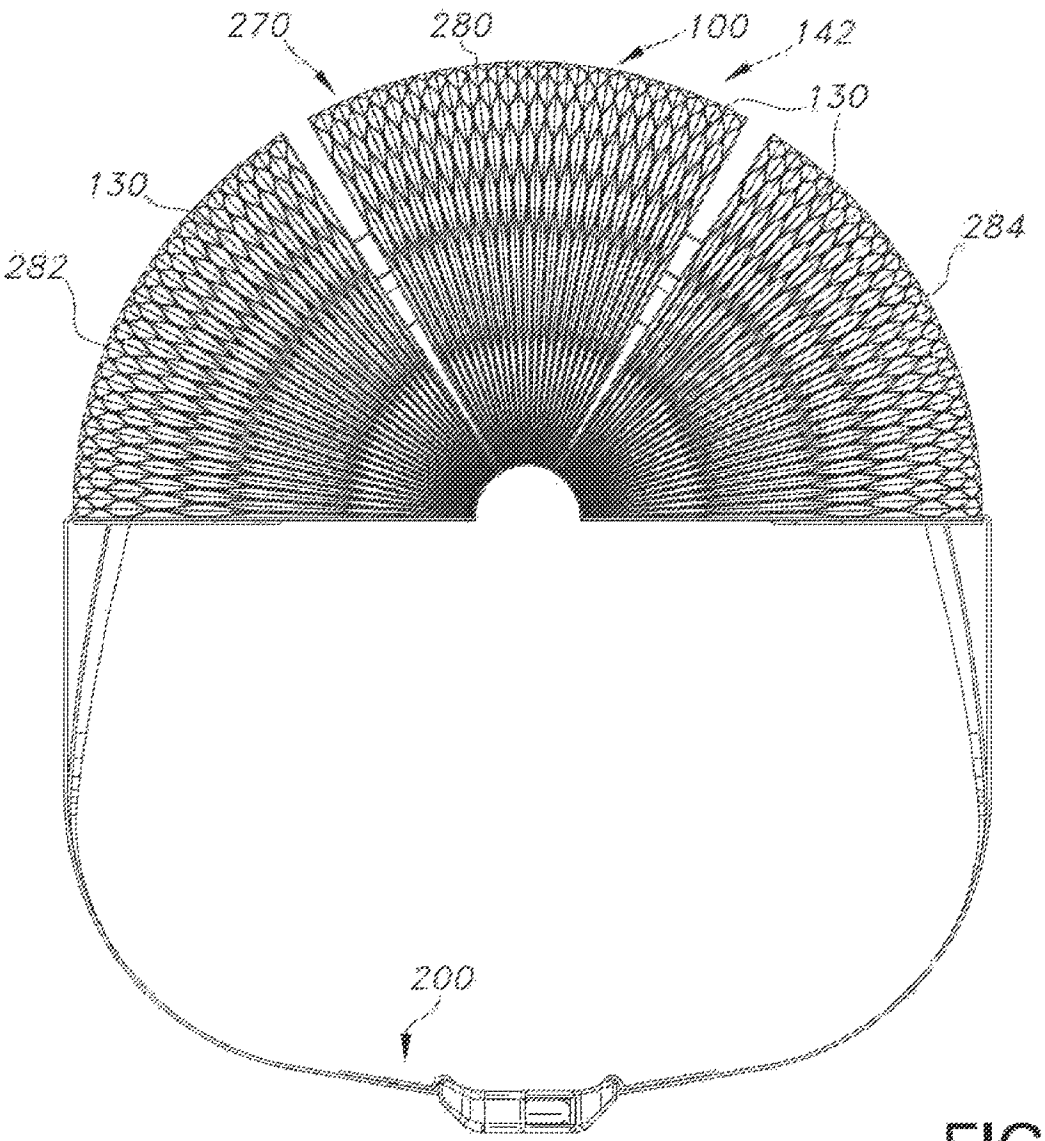
FIG. 7 is a front view of the helmet of FIG. 5.
Figure 8:
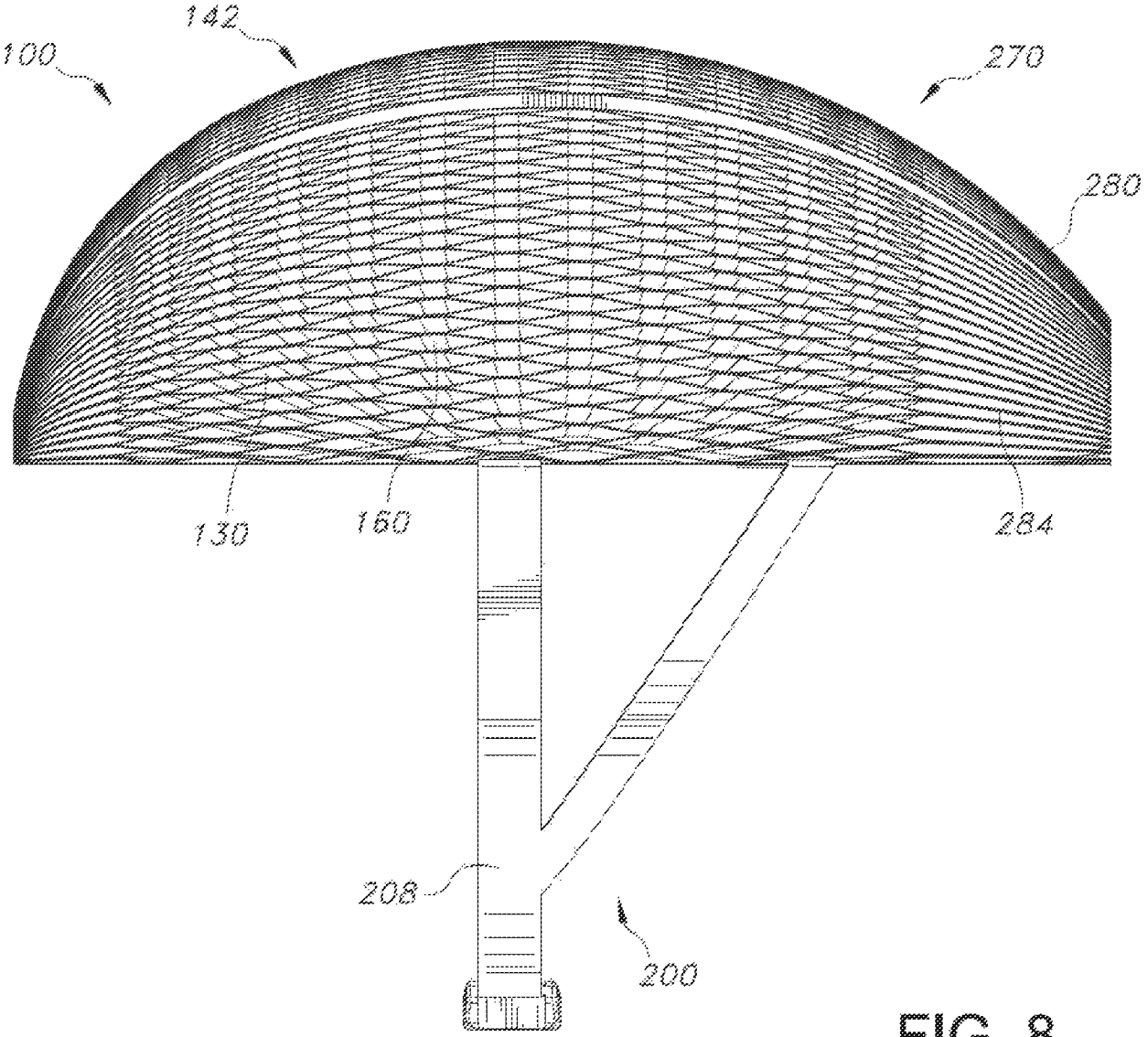
FIG. 8 is a right side view of the helmet of FIG. 5.
Figure 9:
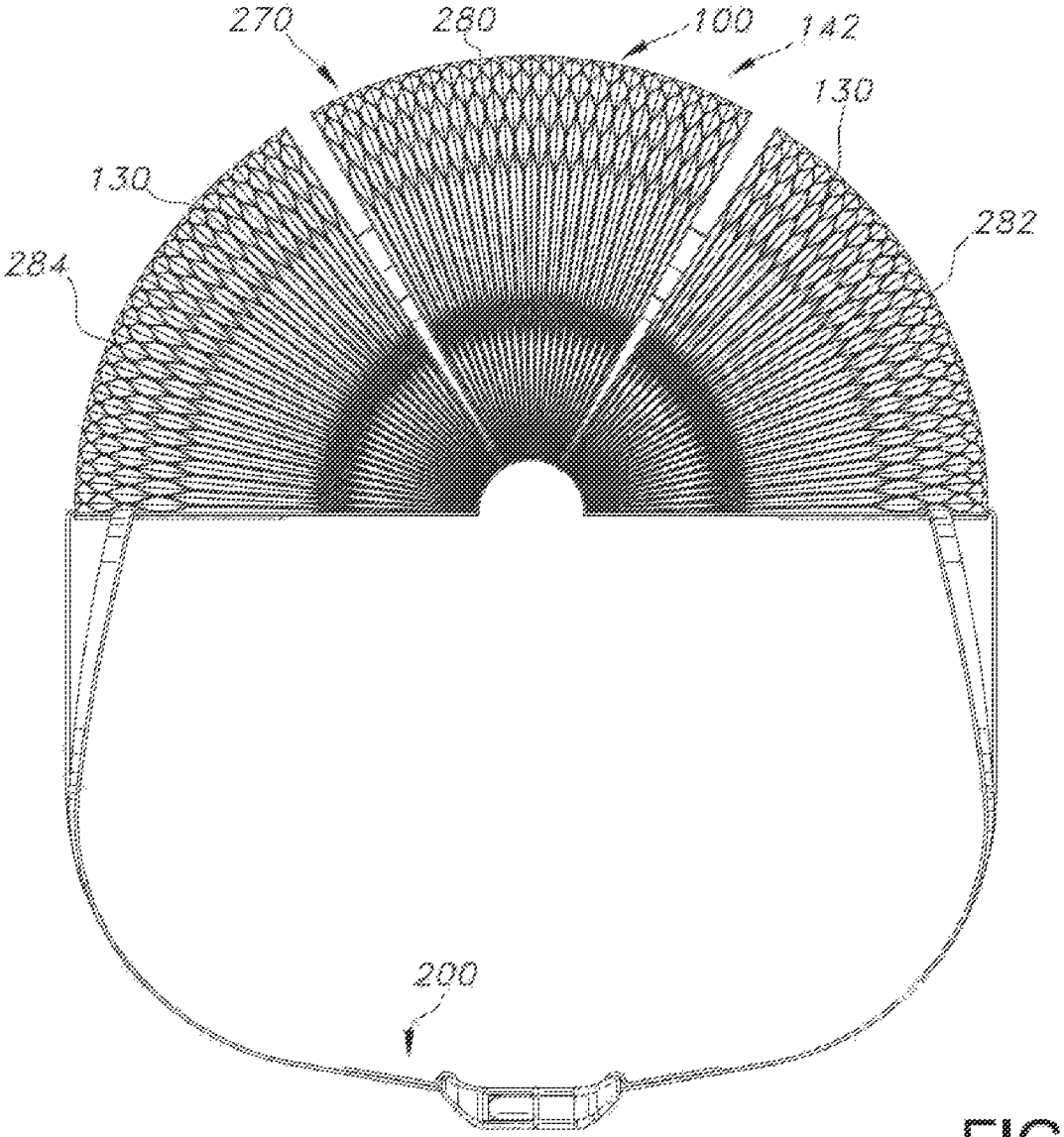
FIG. 9 is a rear view of the helmet of FIG. 5.
Figure 10:
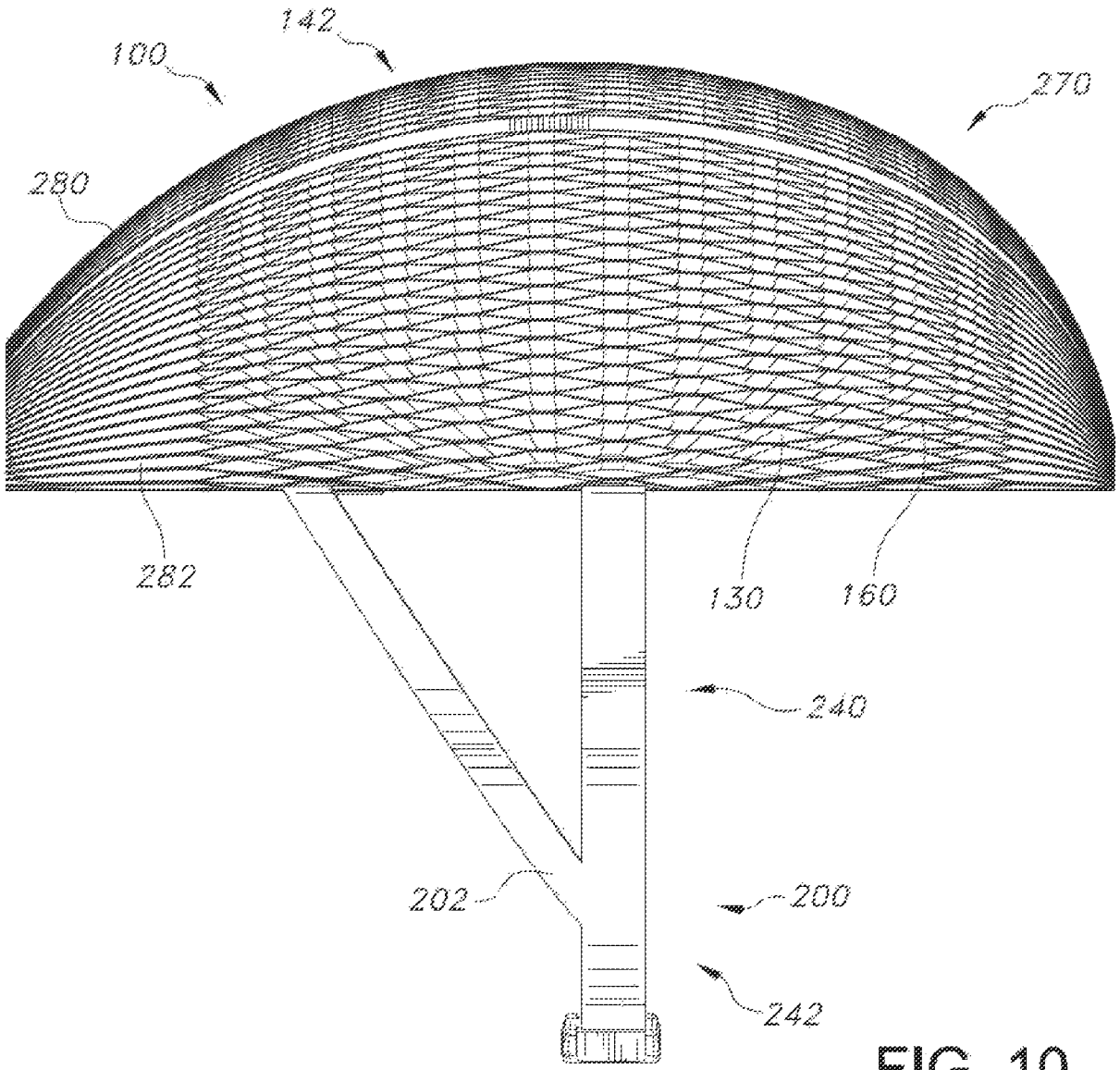
FIG. 10 is a left side view of the helmet of FIG. 5.
Figure 11:
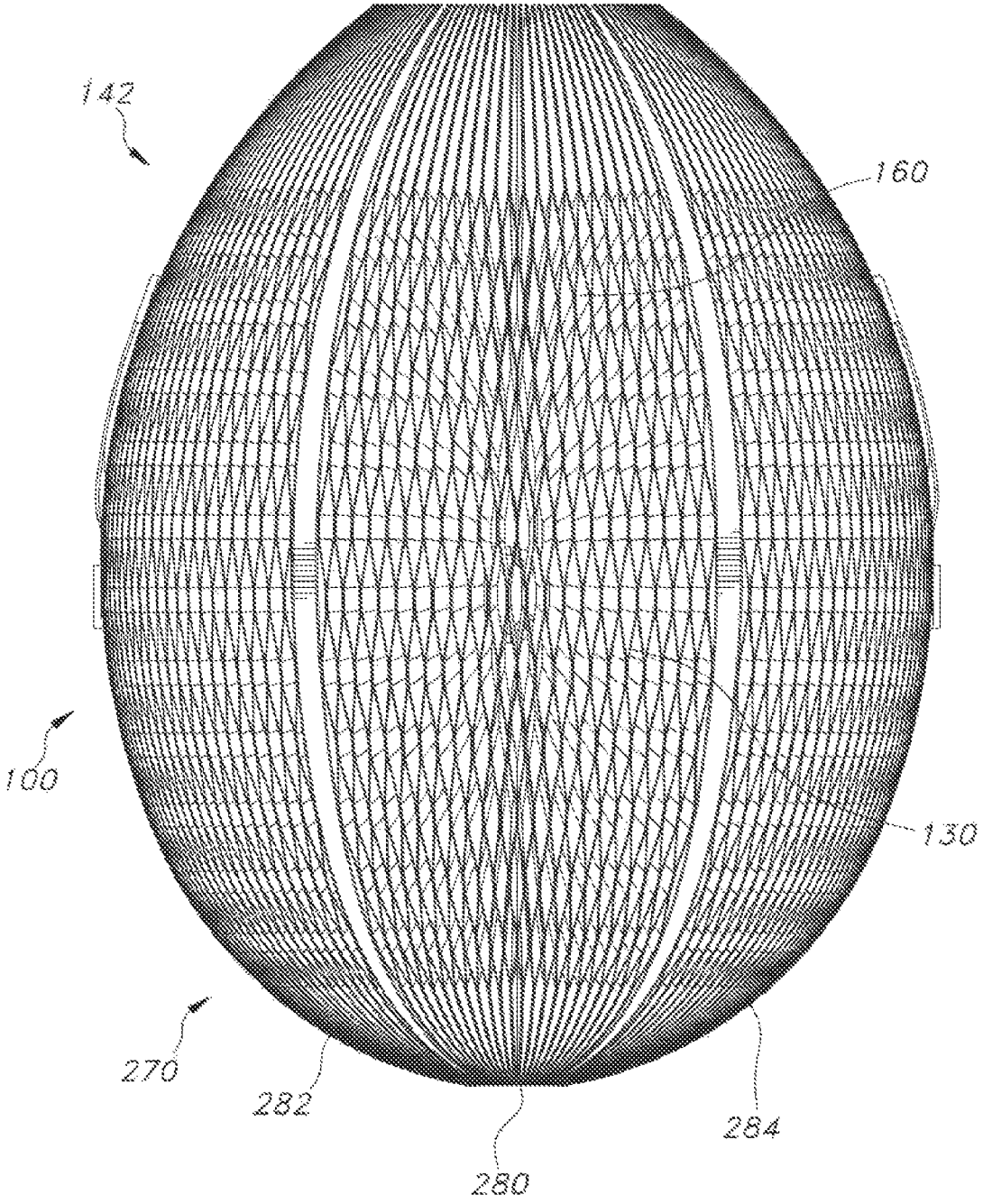
FIG. 11 is a top view of the helmet of FIG. 5.
Figure 12:
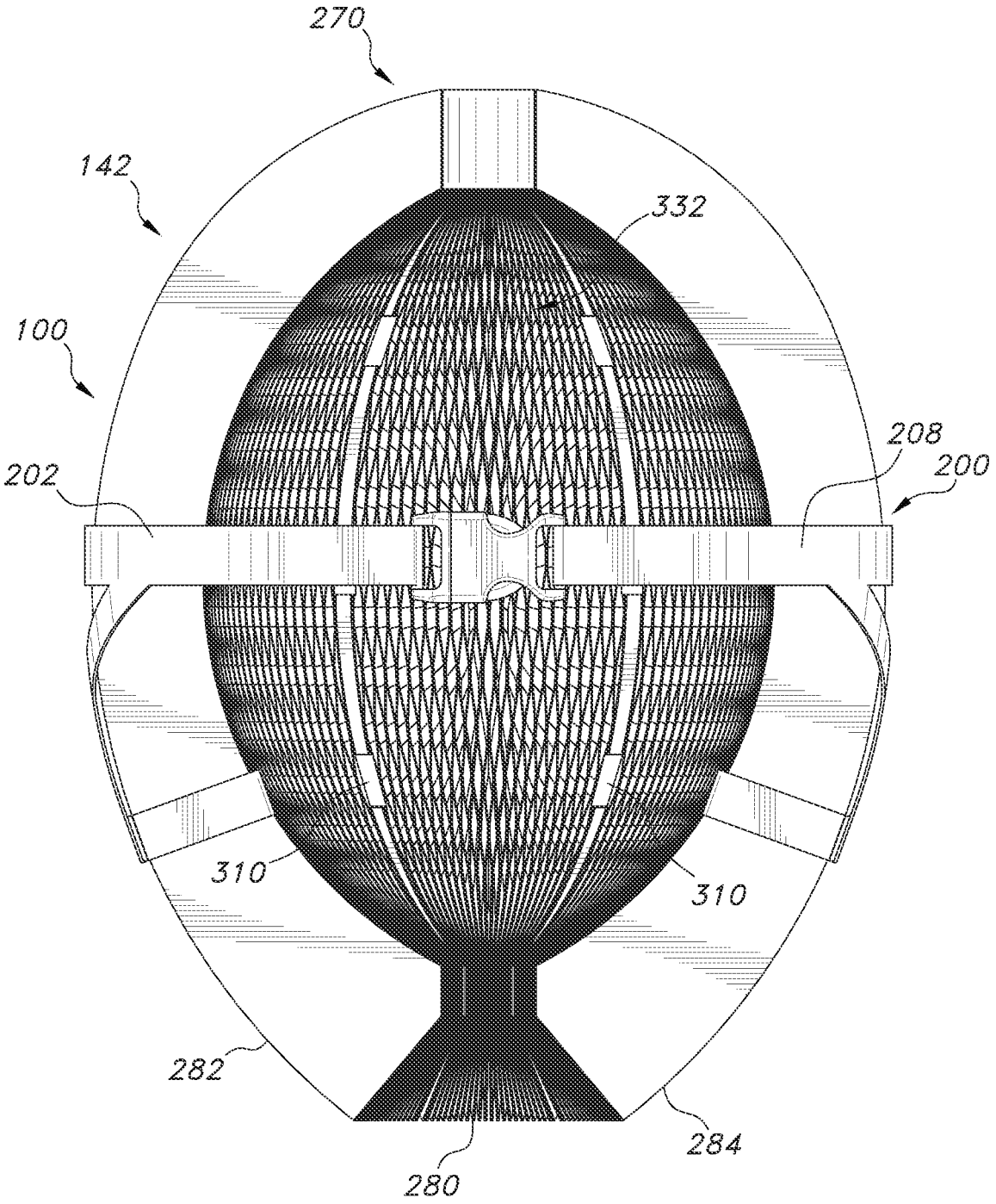
FIG. 12 is a bottom view of the helmet of FIG. 5.
Figure 13:
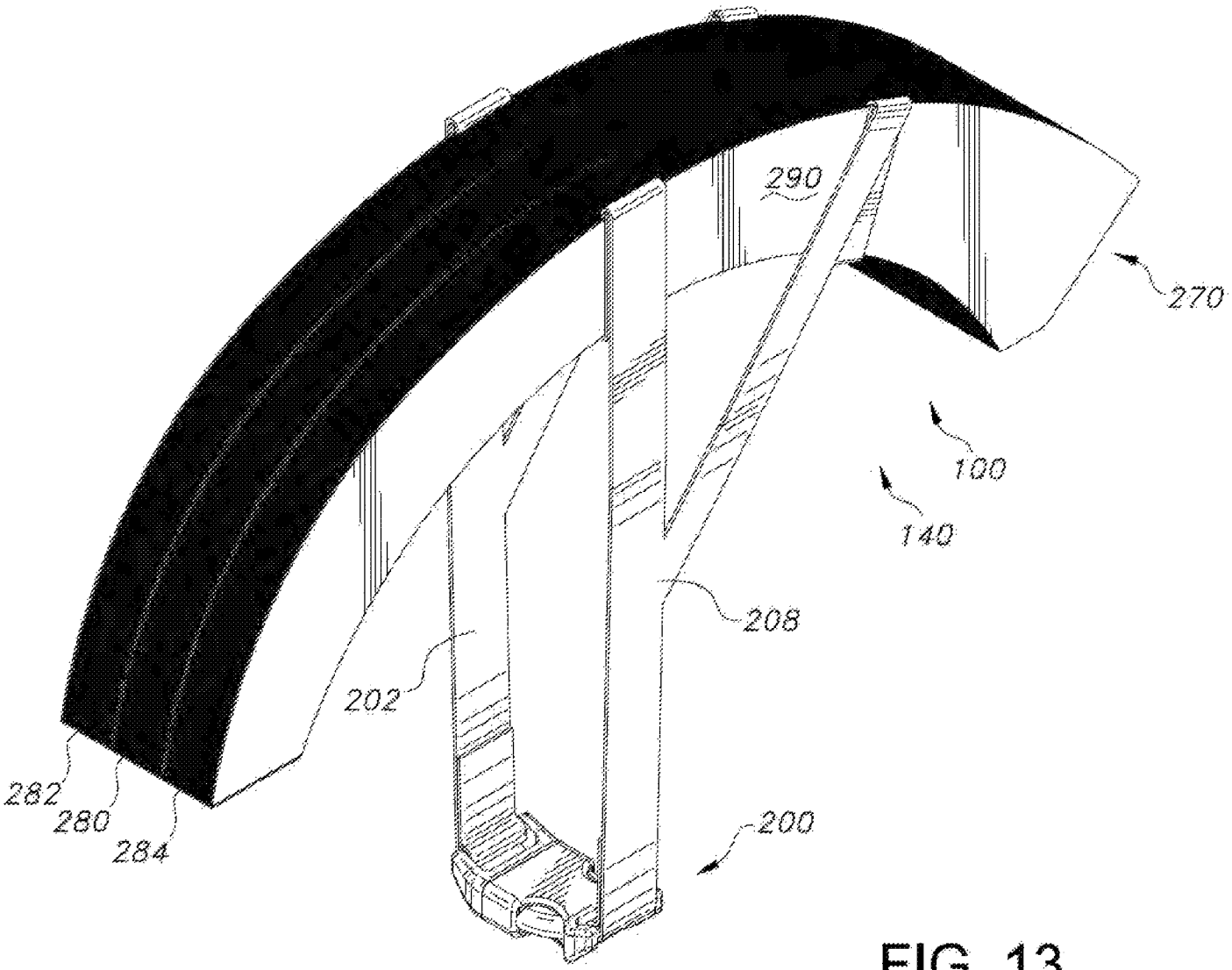
FIG. 13 is a top perspective view of a helmet in a collapsed or folded condition in accordance with the present disclosure.
Figure 14:
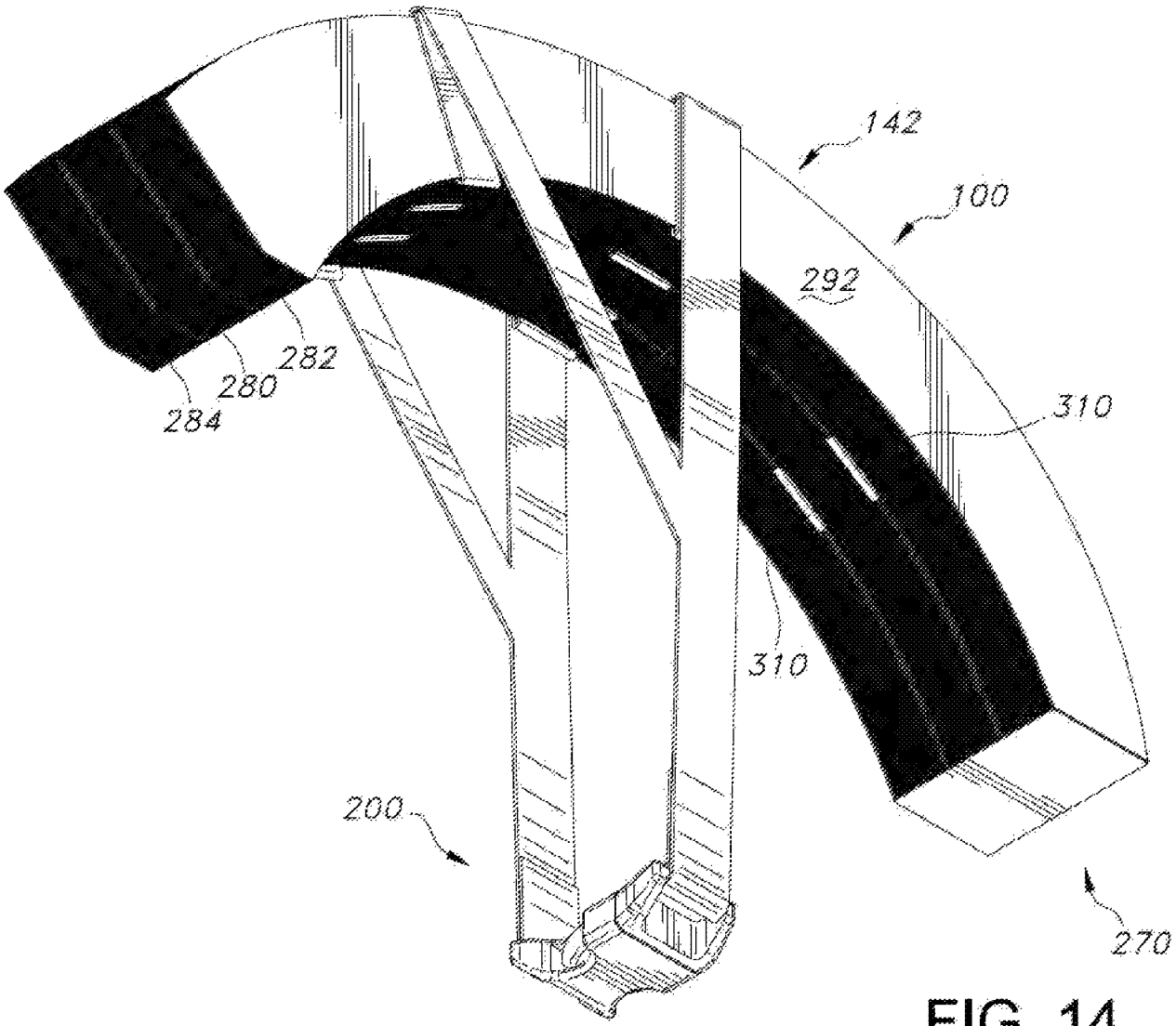
FIG. 14 is a bottom perspective view of the helmet of FIG. 13.
Figure 16:
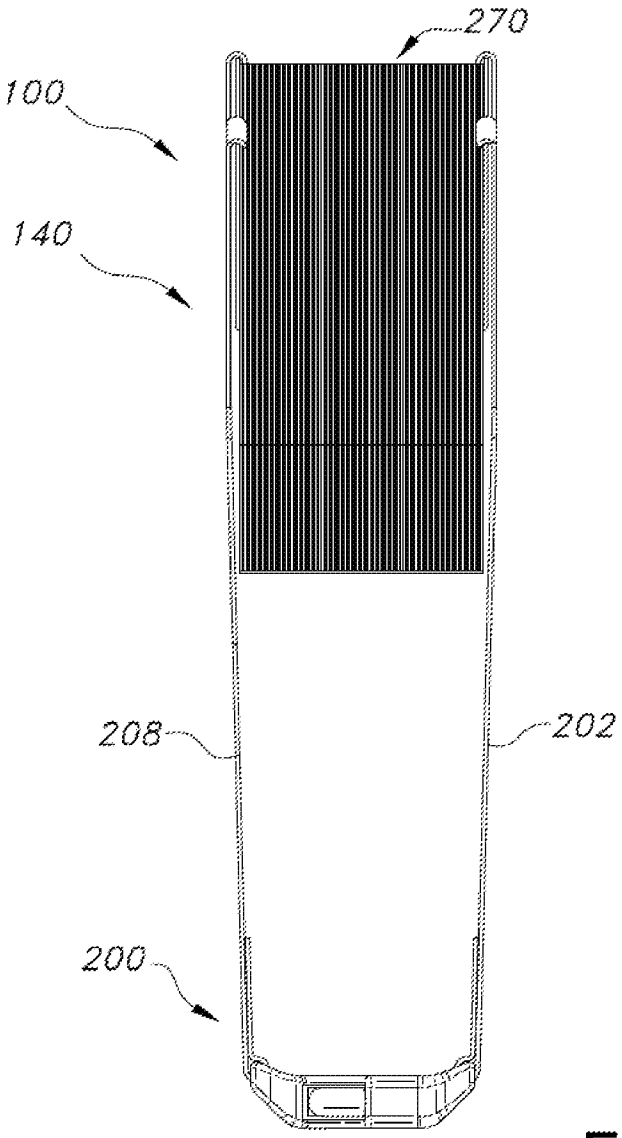
FIG. 16 is a rear view of the helmet of FIG. 13.
Figure 15:
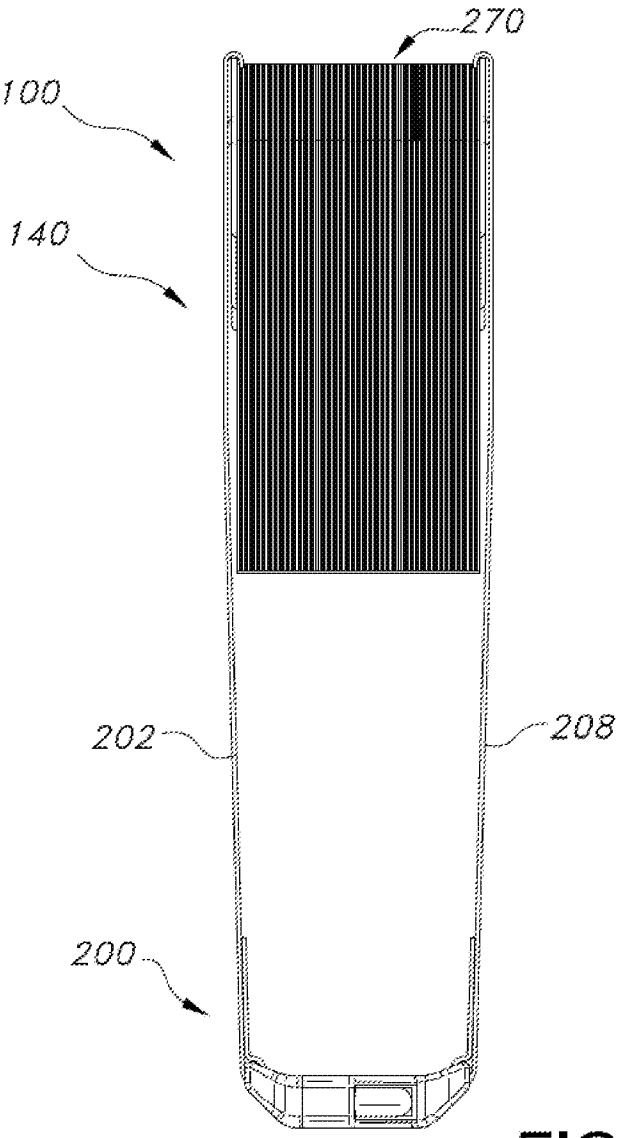
FIG. 15 is a front view of the helmet of FIG. 13.
Figure 17:
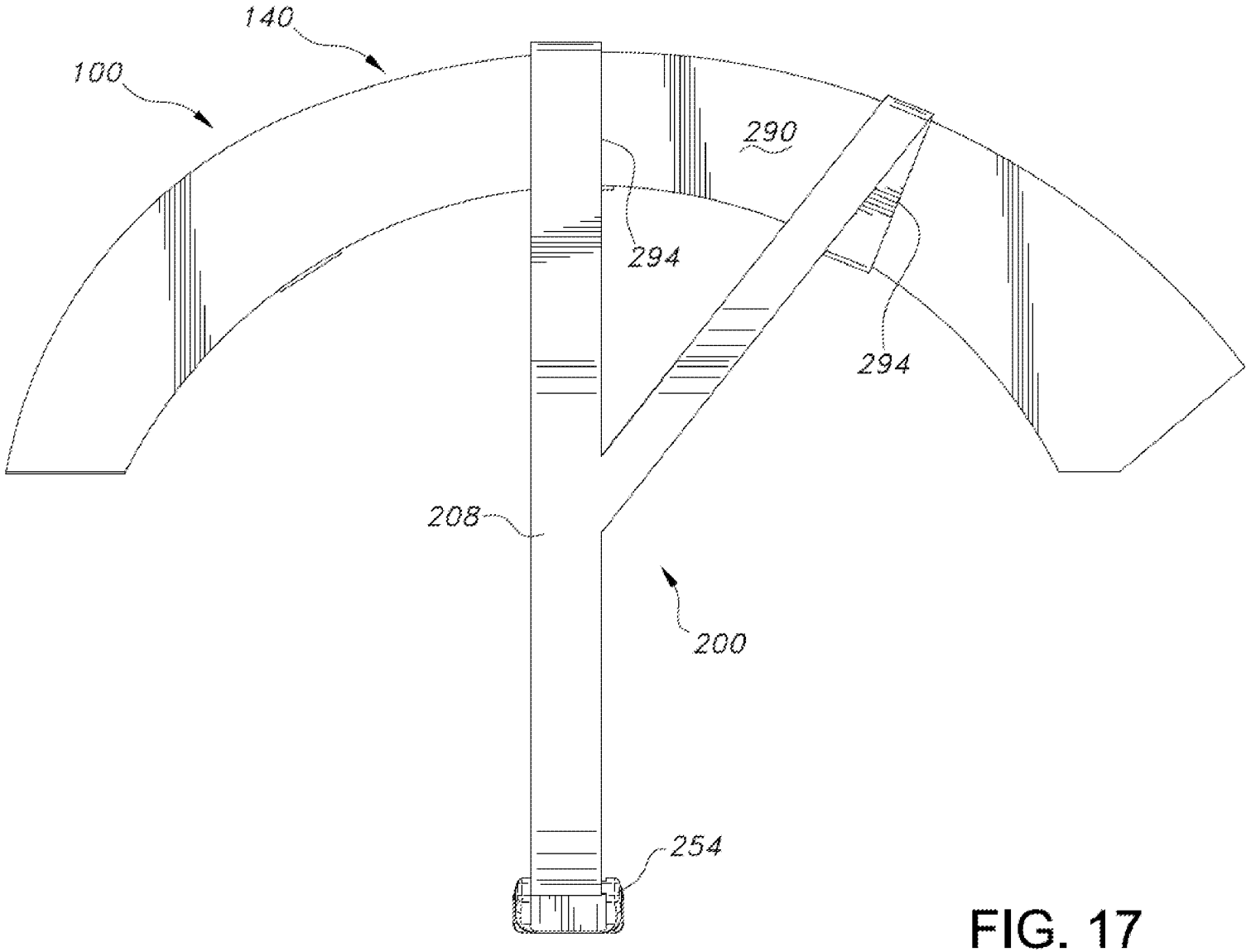
FIG. 17 is a right side view of the helmet of FIG. 13.
Figure 18:
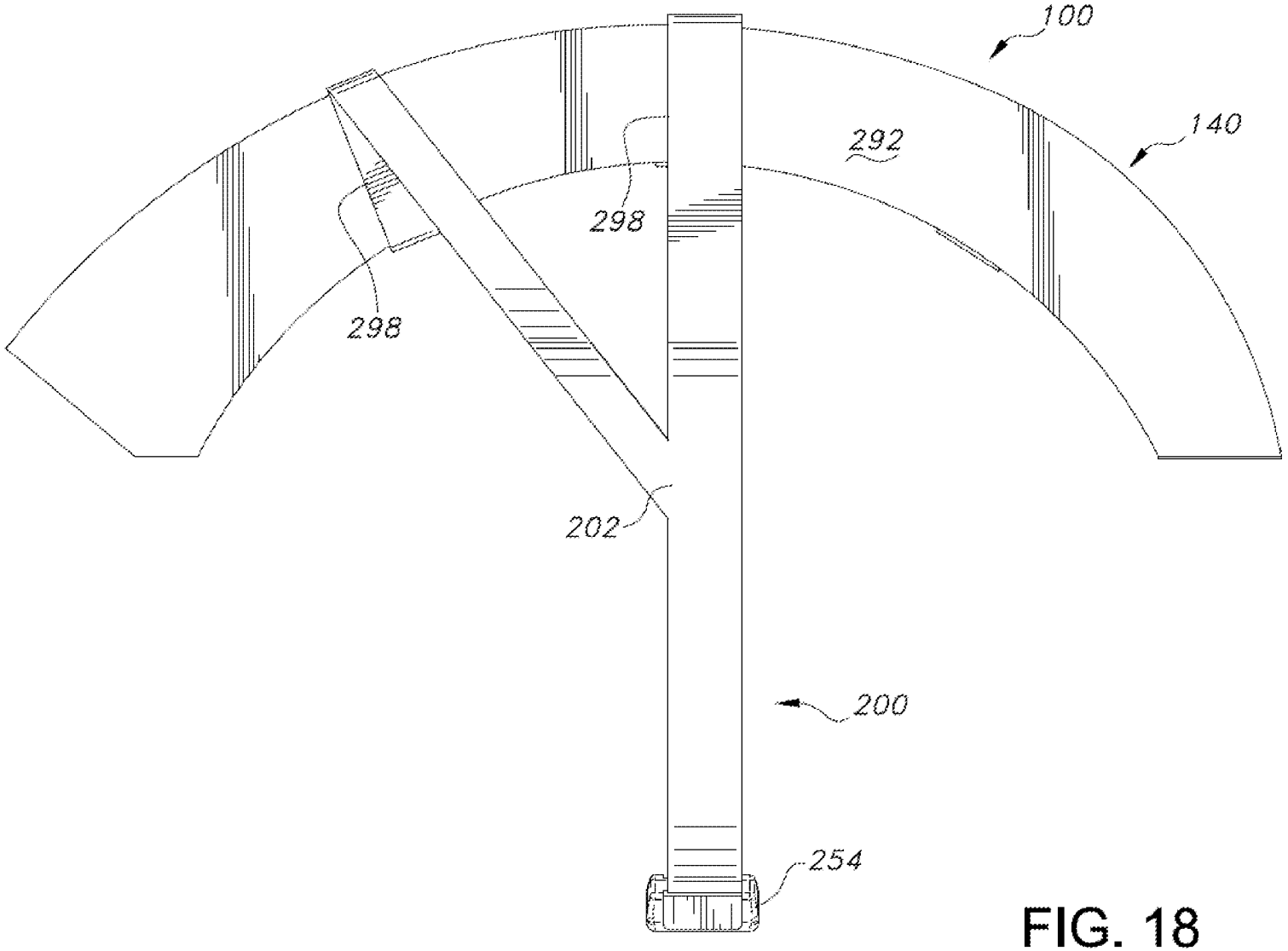
FIG. 18 is a left side view of the helmet of FIG. 13.
Figure 19:
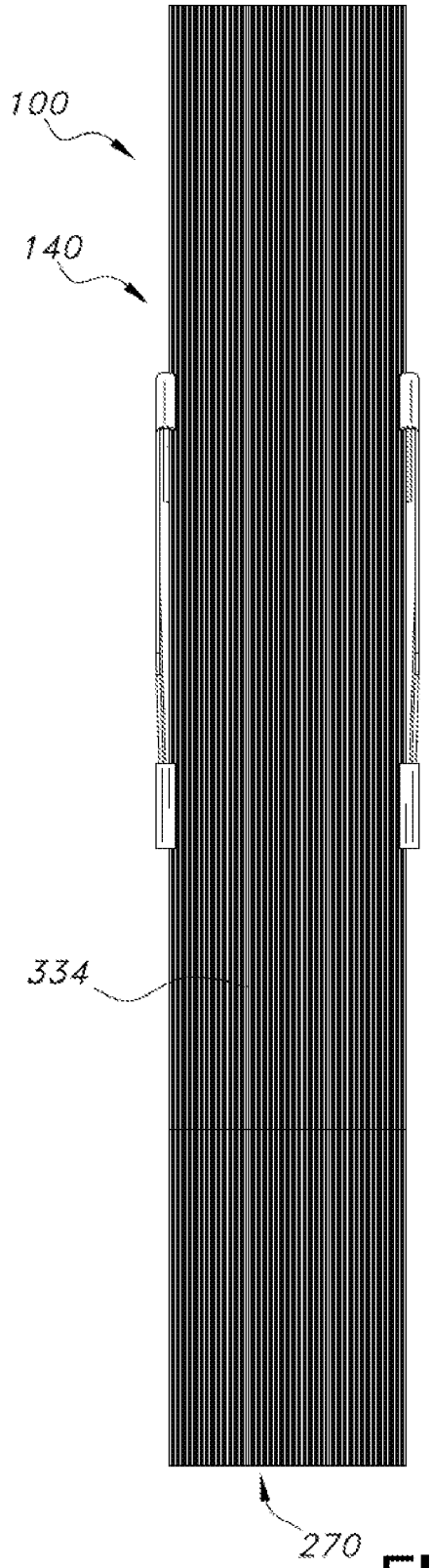
FIG. 19 is a top view of the helmet of FIG. 13.
Figure 20:
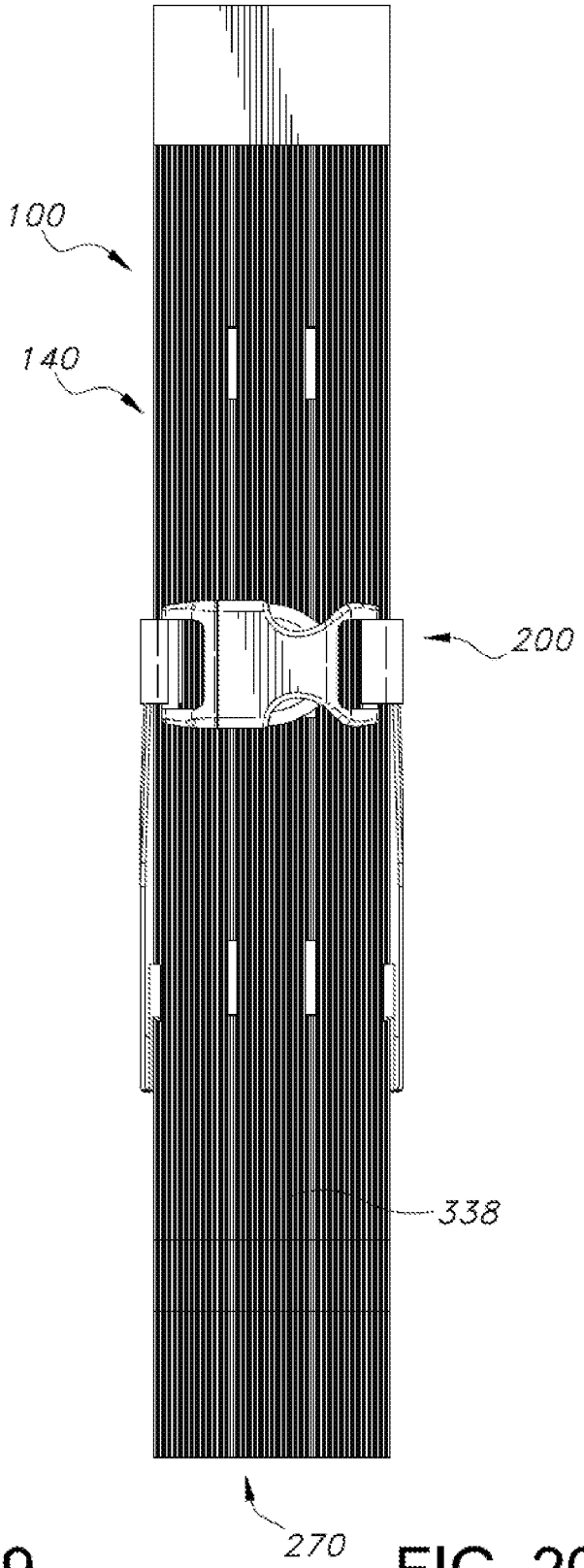
FIG. 20 is a bottom view of the helmet of FIG. 13.

In some embodiments, the segments 270 may be held together by connecting straps 310, as is illustrated in FIG. 6 and FIG. 16. The connecting straps 310 may collapse or fold and lay flat when the helmet 100 is deployed in its collapsed or folded condition 140, as is depicted in FIG. 6. In some embodiments, the connecting straps 310 expand when the helmet 100 is deployed in its expanded condition 142. In some embodiments, the connecting straps 310 act as spacers or bumpers that may be slightly flexible or rigid. In some embodiments, the connecting straps 310 are made from a strap material similar to the straps of the chin strap assembly 200. The material of the connecting straps 310 may be a paper composite material, polypropylene material, or a similar material. In some embodiments, a portion of the material of the connecting straps 310 may be the same material as a portion of the structural cells 160 of the honeycomb matrix 130.

Figure 49:
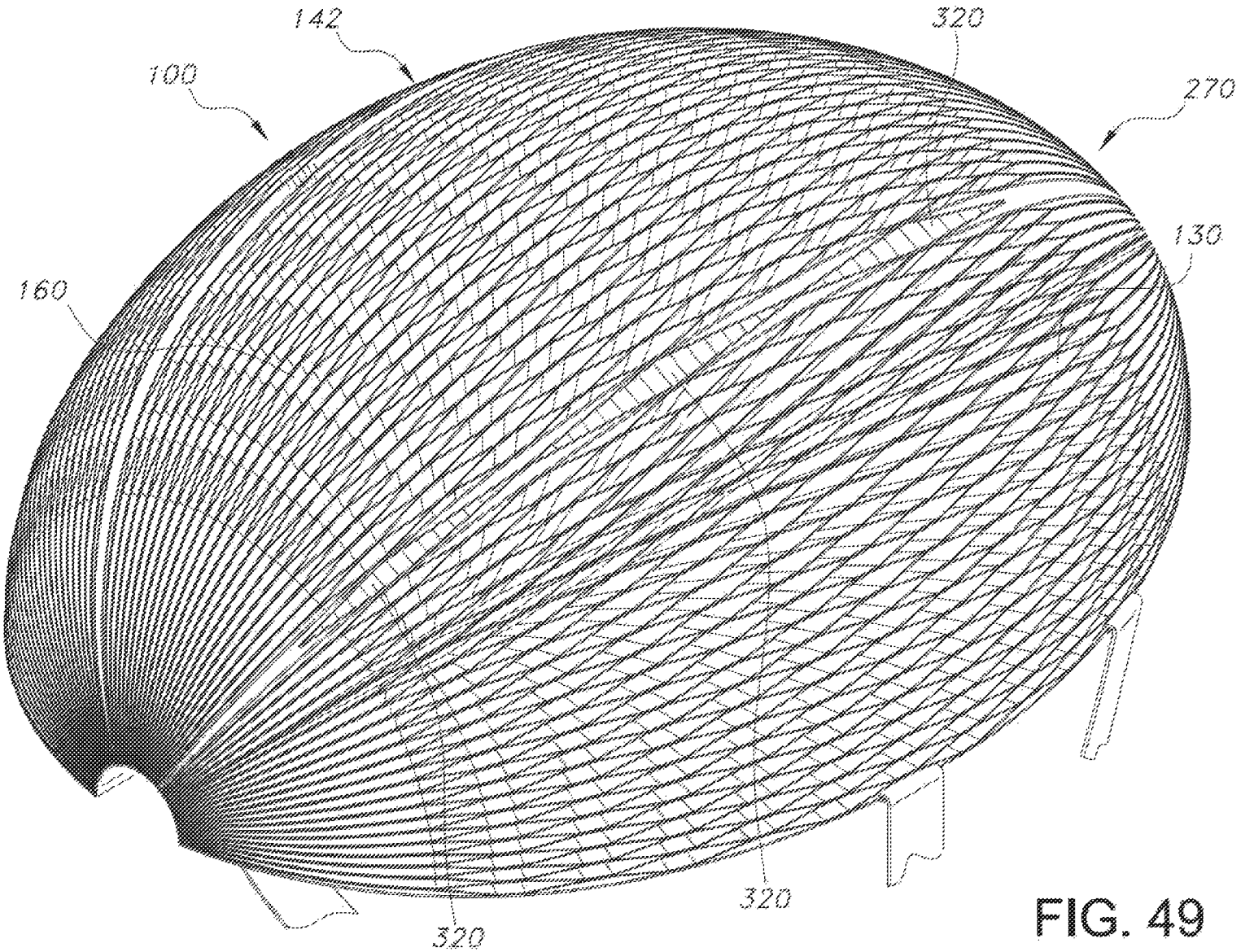
FIG. 49 is a diagrammatic view of embodiments of a helmet with structures between the segments of the helmet in accordance with the present disclosure.

Referring to FIG. 49, in some embodiments, the segments 270 of the helmet 100 may be held together by honeycomb blocks 320. The honeycomb blocks 320 may be made of similar material to the honeycomb matrix 130. In some embodiments, the segments 270 of the helmet 100 may be attached to one another through a front to back strip comprising one or more of the honeycomb blocks 320 whose cells may expand wider than the cells structure 160 in the honeycomb matrix 130. The honeycomb blocks 320 may contribute to the overall structure of the helmet 100, including impact resistance. The honeycomb blocks 320 may be more flexible than the honeycomb matrix 130 and may allow a portion of the structural cells 160 that may be adjacent the exterior curvature 330 of the helmet 100 to expand much more than a portion of the structural cells 160 adjacent an inner curvature 332. An outer surface 334 of the helmet 100 may have a larger area than its inner surface 338, which is a surface closest to the head 150 of the user 110 when the helmet 100 is expanded into its expanded condition 142.

In some embodiments, the segments 270 of the helmet 100 may include the honeycomb blocks 320 in lieu of the connecting straps 310. The segments 270 may include fewer cell structures 160 of the honeycomb matrix 130 relative to the segments 270 using the honeycomb blocks 320 while spanning substantially the same distance from the front to the back, and side to side, of the helmet 100. In some embodiments, the segments of the helmet may be configured with five segments, each of the five segments being connected to one another using the honeycomb blocks 320. In some embodiments, the segments of the helmet may be configured with five segments, each of the segments being connected to one another using the connecting straps 310.

In some embodiments, the cell structures 160 of the honeycomb matrix 130 are configured radially to relative to one another and each of the cell structures 160 are substantially perpendicular to the outer surface 152 of the head 150 of the user 110. In some embodiments, the cell structures 160 of the radially-disposed honeycomb matrix 160 of at least one of the segments 270 is adjacent and substantially perpendicular to a portion of the surface 152 of the head 150 of the user 110 proximate to that cell in the honeycomb matrix 130. The cell structures 160 of the honeycomb matrix 130 may thereby provide protection against an impact to the head 150 of the user 110 from substantially any angle that would be experienced during normal operation of the bicycle 120. Upon receiving an impact, the material of the cell structures 160 from the honeycomb matrix 130 may crumple or crush near the impact and absorb a sufficient amount of the impact of the impact to protect the head 150 of the user 110.

In some embodiments, the helmet 100 may pass many safety tests, such as safety tests that test impact, placement of the helmet 100, and safety of the user. In some embodiments, the helmet may be impacted with an impactor during the safety tests to confirm its impact resistance. In some embodiments, the impactor is a spherical impactor that may be larger than 146 mm (5.75 inches) in diameter. In some embodiments, the impactor is made of aluminum. In some embodiments, the impactor may be dropped at a velocity that is in excess of five meters per second. In one example, the impactor is dropped at a velocity of substantially 5.44 m/s. In some embodiments, the impactor may be a flat anvil. In some embodiments, the impactor may be a hemispherical anvil. In some embodiments, the impactor may be a curbstone anvil. In some embodiments, the helmet 110 may be dropped at a velocity that is in excess of four meters per second. In one example, the helmet 110 is dropped at a velocity substantially equal to 6.2 m/s. In one example, the helmet is dropped at a velocity substantially equal to 4.8 m/s In some embodiments, the helmet 100 may be deployed in the collapsed or folded condition 140 when not being worn by a user. The helmet 100 deployed in the collapsed or folded condition 140 may facilitate storage of the helmet 100, as while the helmet 100 is in the collapsed or folded condition 140, the helmet may lay flat and be compressed and, therefore, may take up less space than a typical hard-shell helmet. In some embodiments, the helmet 100 may be lighter and fold more flatly than other helmets. The helmet 100 may distribute crush impact more evenly around the head than available polystyrene helmets. Moreover, the construction and materials of the helmet 100 may allow for a relatively inexpensive production and bill of materials.

In some embodiments, the honeycomb matrix 130 of the helmet 100 may include a single segment unfolding from a central point. The honeycomb matrix 130 of the helmet 100 may include adhesive to hold and fix portions of the honeycomb matrix 130 in place. By way of this example, the cells 204 of the honeycomb matrix 130 may include adhesive strips that are pressed together to assemble the helmet 100 and may flatten laterally while the helmet is in the collapsed or folded condition 140. In some embodiments, layers of the helmet material 230 of the honeycomb matrix 130 may be glued in an alternating radial fashion or a suitable pattern to create the cell structures 160 that may be disposed in a direction that is perpendicular to the outer surface 152 of the head 150 of the user 110.

In some embodiments, the helmet 100 includes a middle segment 280 of the helmet material 230 situated between two side segments 282, 284 of the helmet material 230. The middle segment 280 and the side segments 282, 284 may each be movable from the collapsed or folded condition 140 such that each side of the side segments 282, 284 is disposed substantially parallel to one another. When the helmet 100 is in the expanded condition 142, the middle segment 280 and the side segments 282, 284 may be expanded and at least partially disposed over the head 150 of the user 110.

In some embodiments, honeycomb matrix 130 may be formed of radially-aligned structural cells 160 that are disposed generally perpendicular to portions of the outer surface 152 of the head 150 of the user 110 and proximate to each of the structural cells 160. The honeycomb matrix may narrow near the front of the head 150, near the rear of the head 150, or both near the front of the head 150 and the rear of the head 150. The combination of the exterior and interior curvatures 330, 332, the radially-aligned structural cells 160, and the narrowing of each of the rows of the cells 160 of the honeycomb matrix 130 at the front and at the rear of the helmet 100 may cause the cells 160 to arrange themselves automatically to be perpendicular to the outer surface 152 of the head 150 of the user 110 when the helmet 100 is placed in the expanded condition 142, or at least when the helmet is expanded at least to 85% of its expanded condition 142.

In some embodiments, the honeycomb matrix 130 includes several interconnected panels 350. In some embodiments, one or more of the interconnected panels 350 may extend over the entire length of the helmet 100. In other embodiments, one or more of the interconnected panels 350 may extend only over a portion of the length of the helmet 100. In some embodiments, one or more of the interconnected panels 350 may extend over the entire length of the helmet 100 and one or more of the interconnected panels 350 may extend only over a portion of the length of the helmet 100. In some embodiments, the interconnected panels 350 may be interconnected at a plurality of points to form and be integrated with the honeycomb matrix 130. In some embodiments, flexing of the honeycomb matrix 130 during expansion of the helmet 100 from the collapsed or folded condition 140 to the expanded condition 142 may allow individual structural cells 160 in the honeycomb matrix 130 to open and arrange themselves in a substantially perpendicular orientation relative to the interior curvature 332, whereby the interior curvature 332 of the helmet 100 is configured to conform to the outer surface 152 of the head 150 of the user 110.

Figure 21:
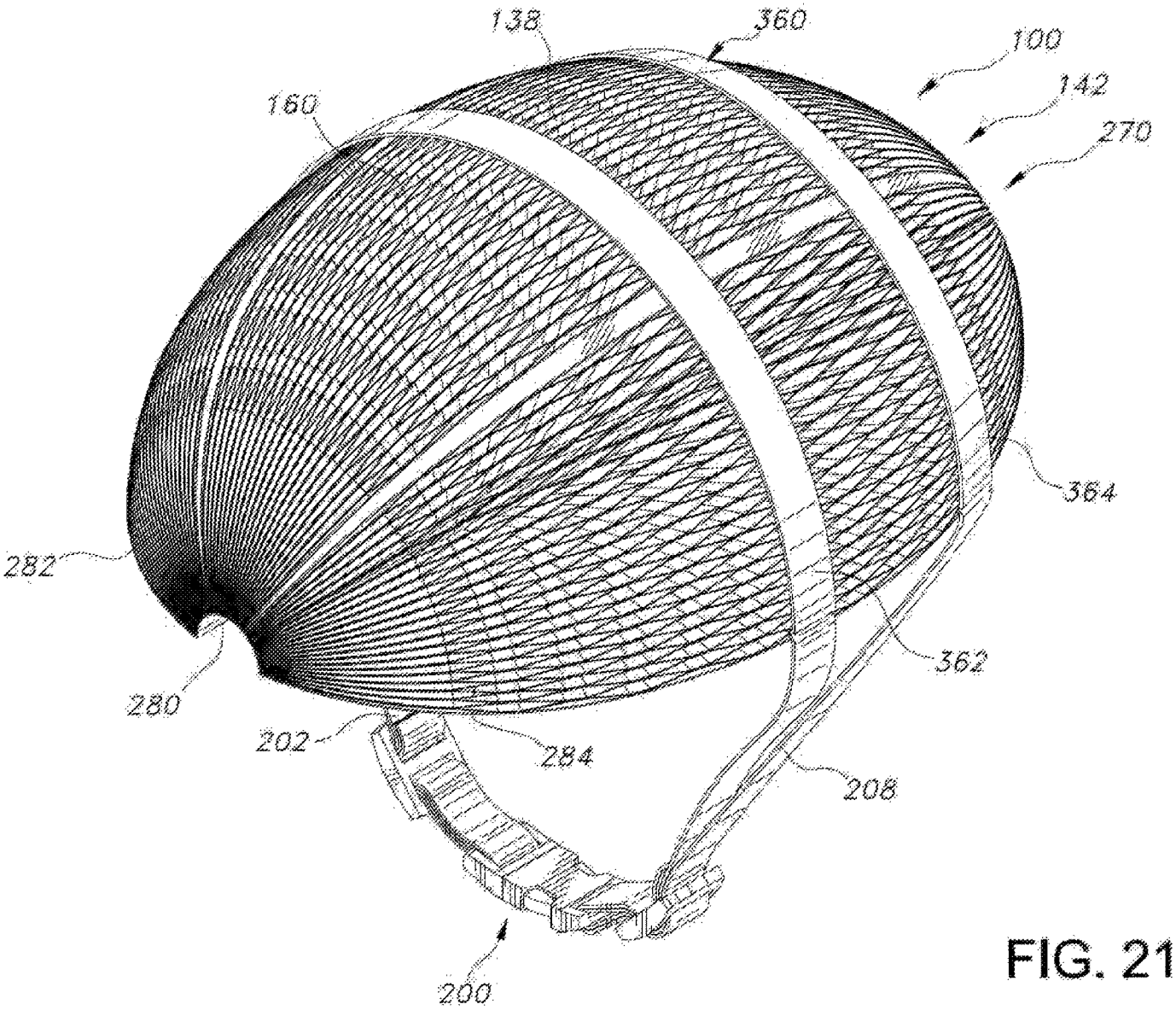
FIG. 21 is a top perspective view of a helmet with straps over the helmet opened in an operational or expanded condition in accordance with the present disclosure.
Figure 22:
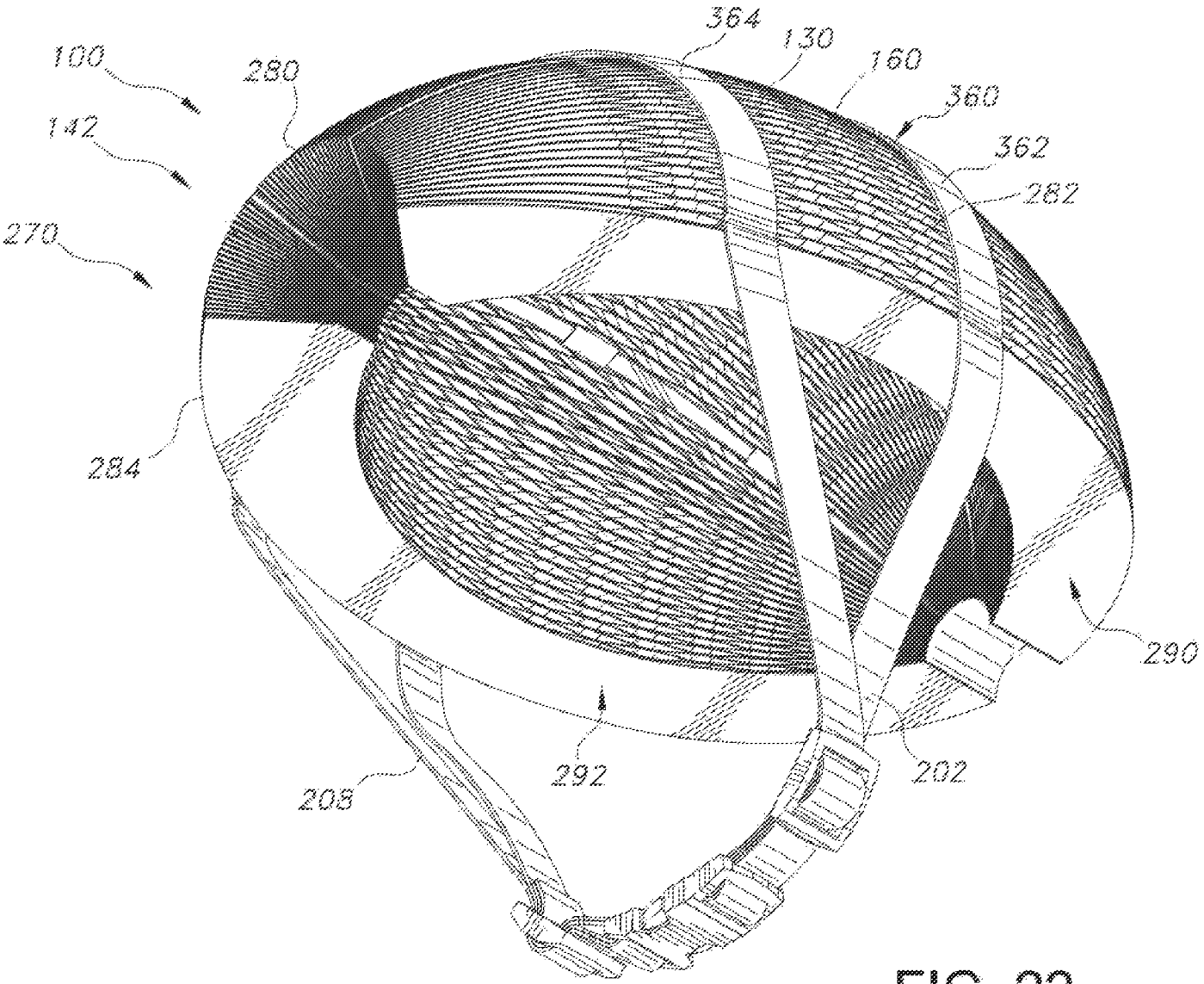
FIG. 22 is a bottom perspective view of the helmet of FIG. 21.
Figure 23:
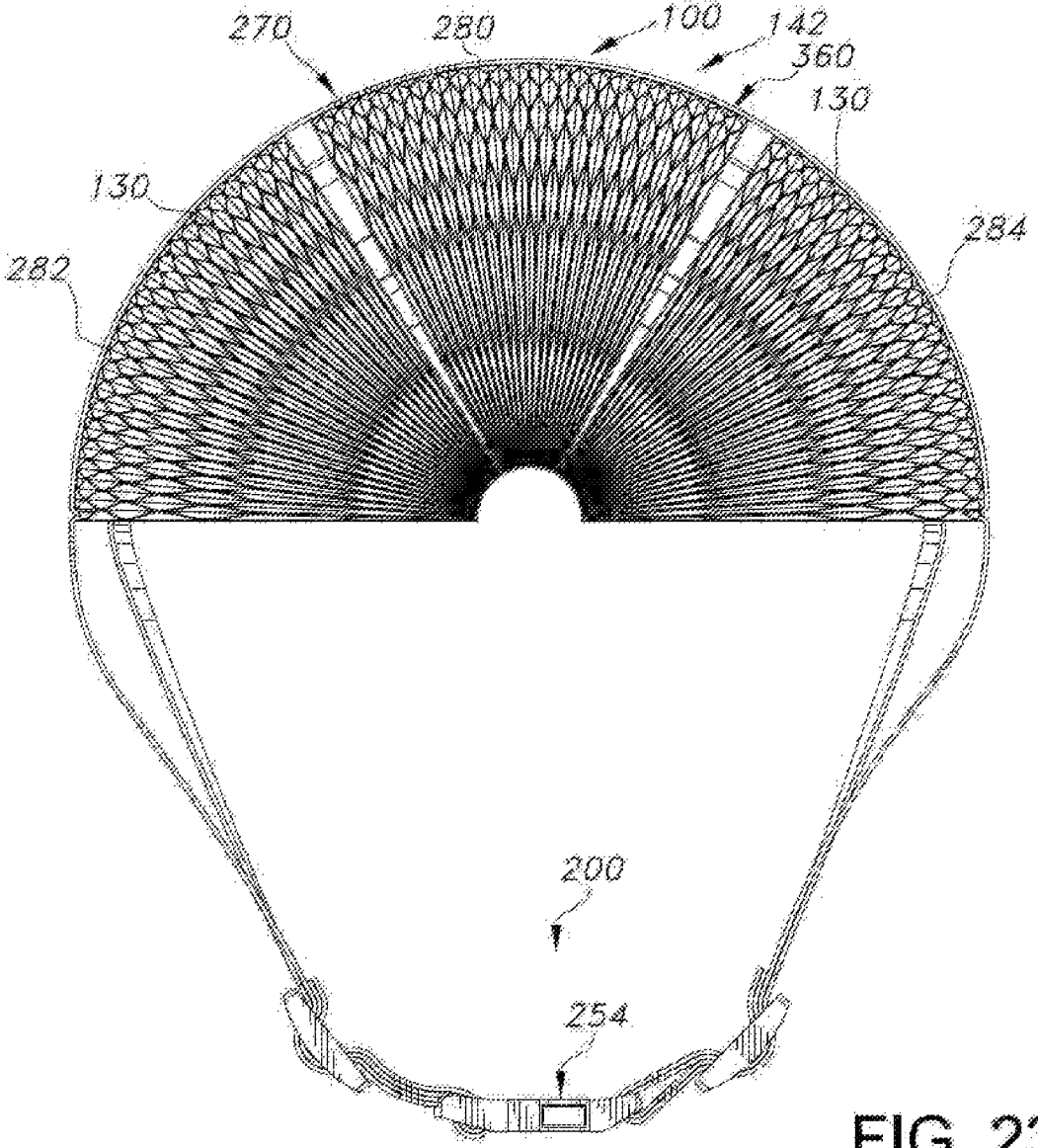
FIG. 23 is a front view of the helmet of FIG. 21.
Figure 24:
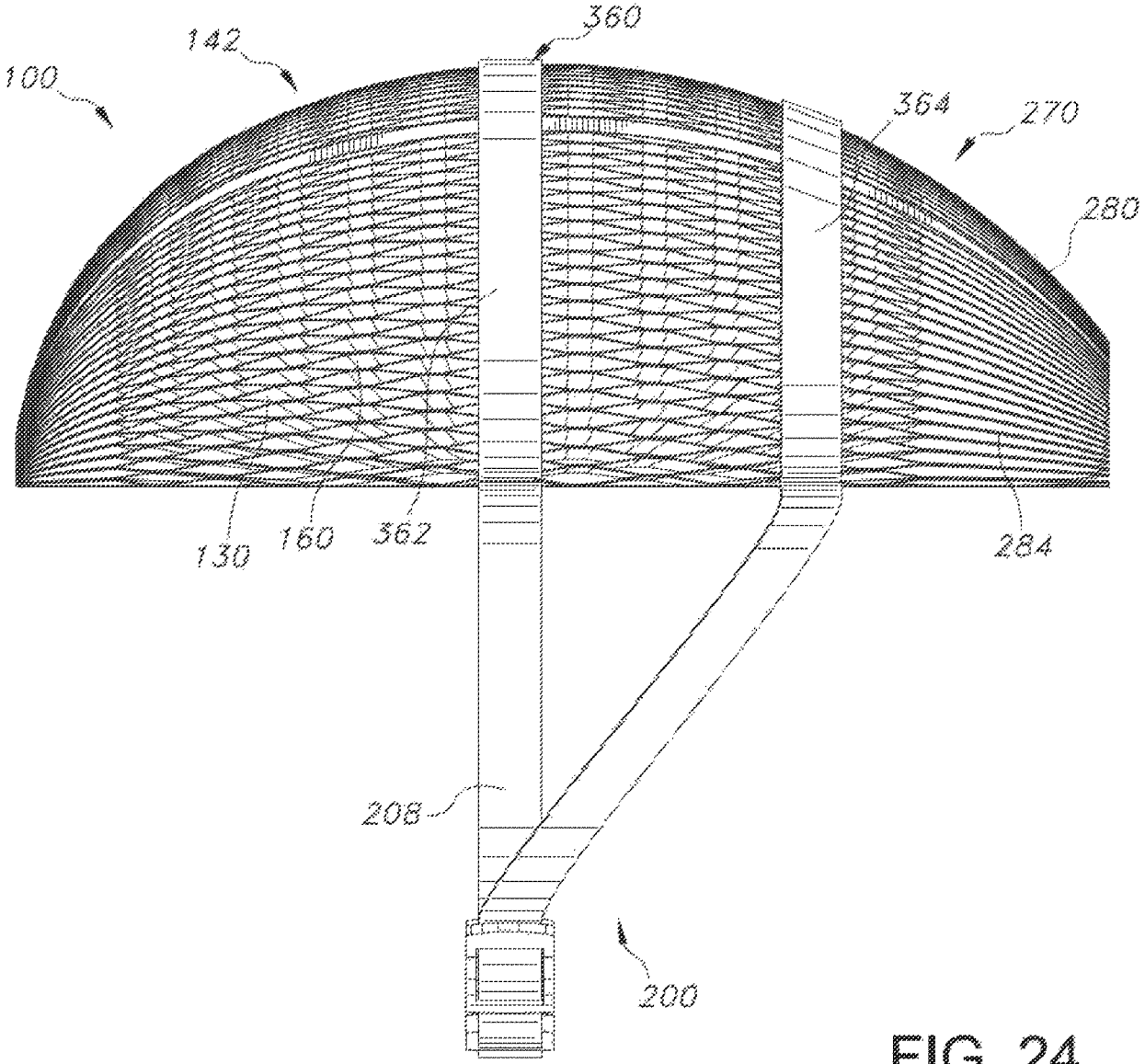
FIG. 24 is a right side view of the helmet of FIG. 21.
Figure 25:
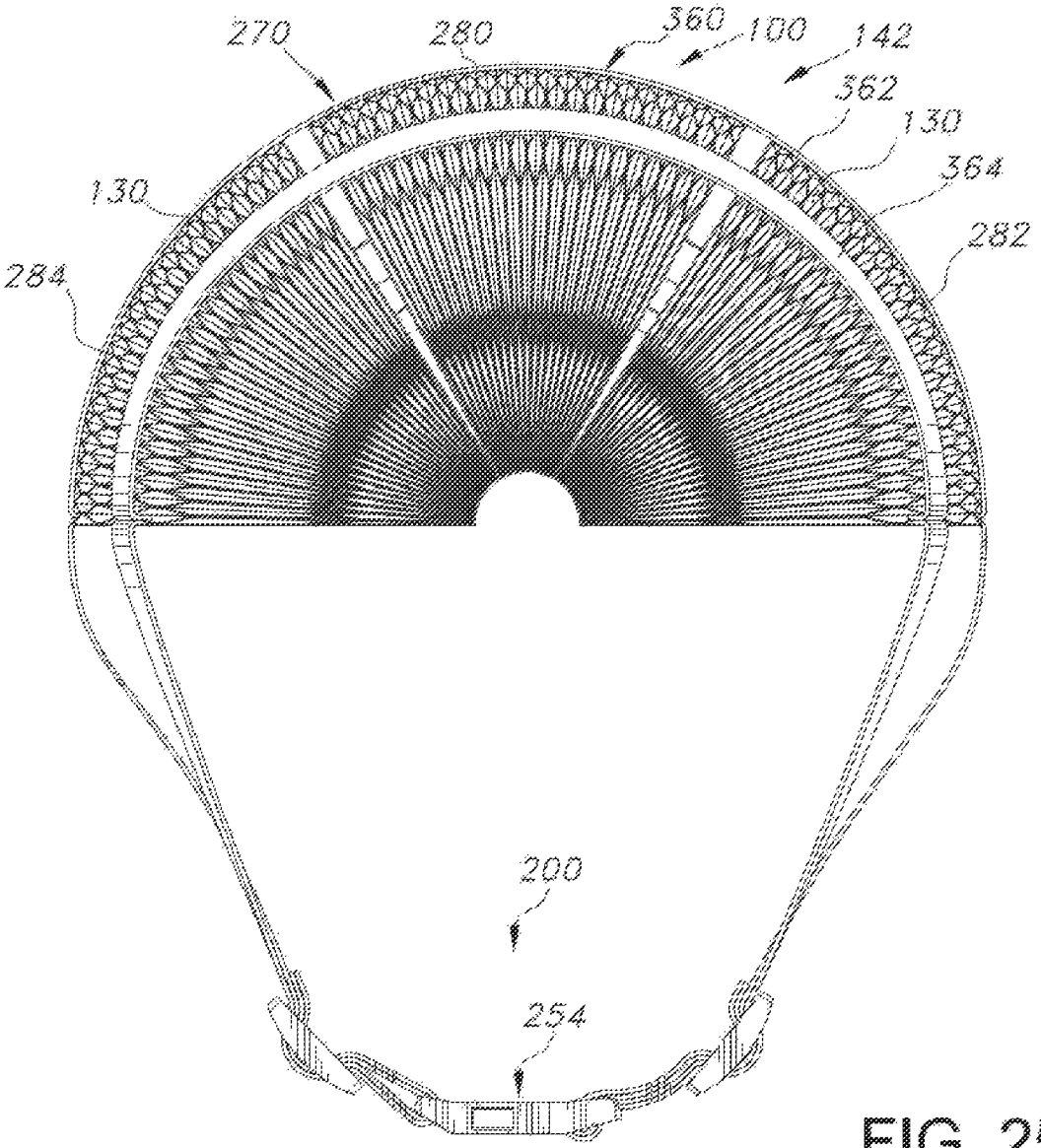
FIG. 25 is a rear view of the helmet of FIG. 21.
Figure 26:
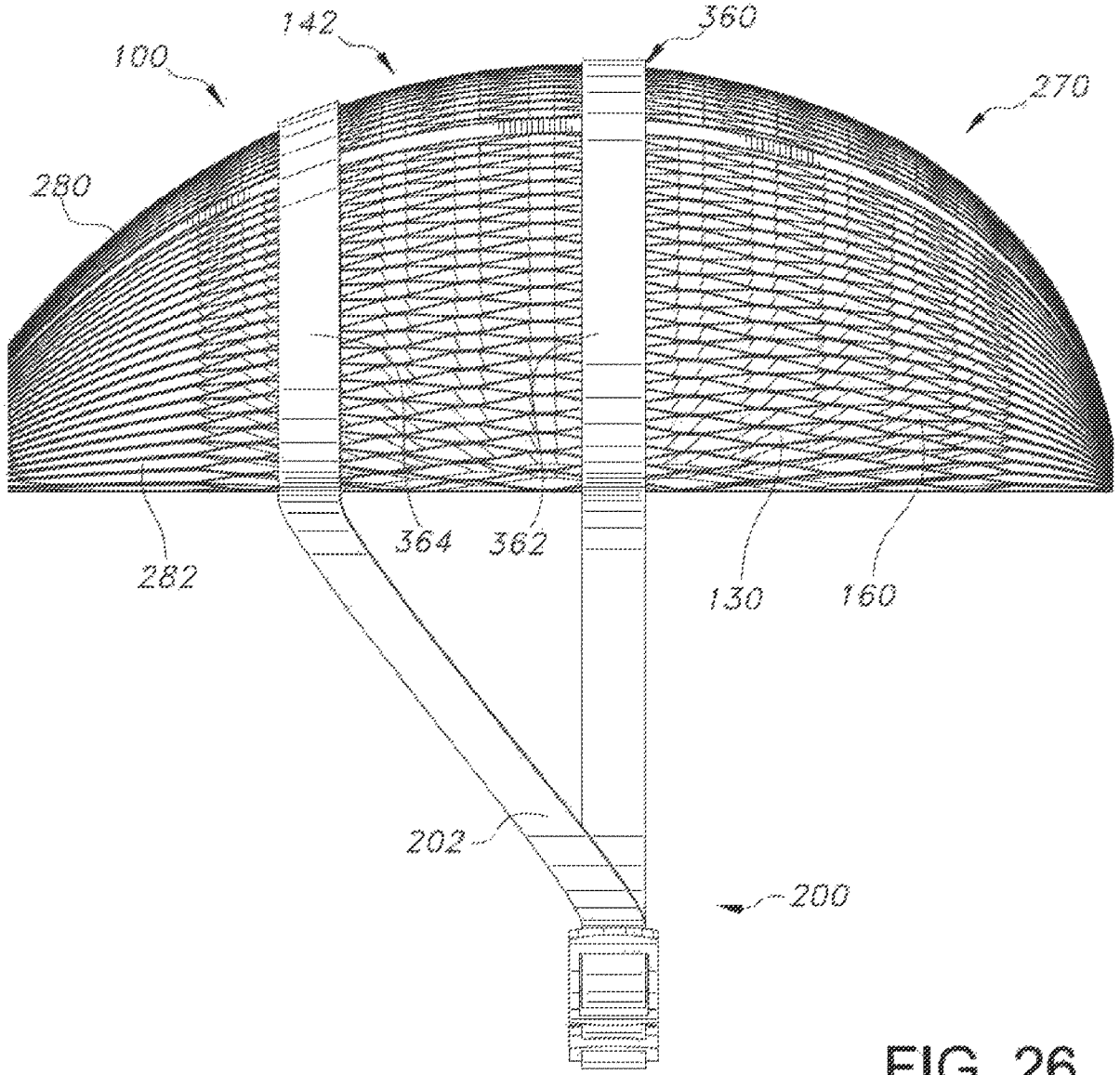
FIG. 26 is a left side view of the helmet of FIG. 21.
Figure 27:
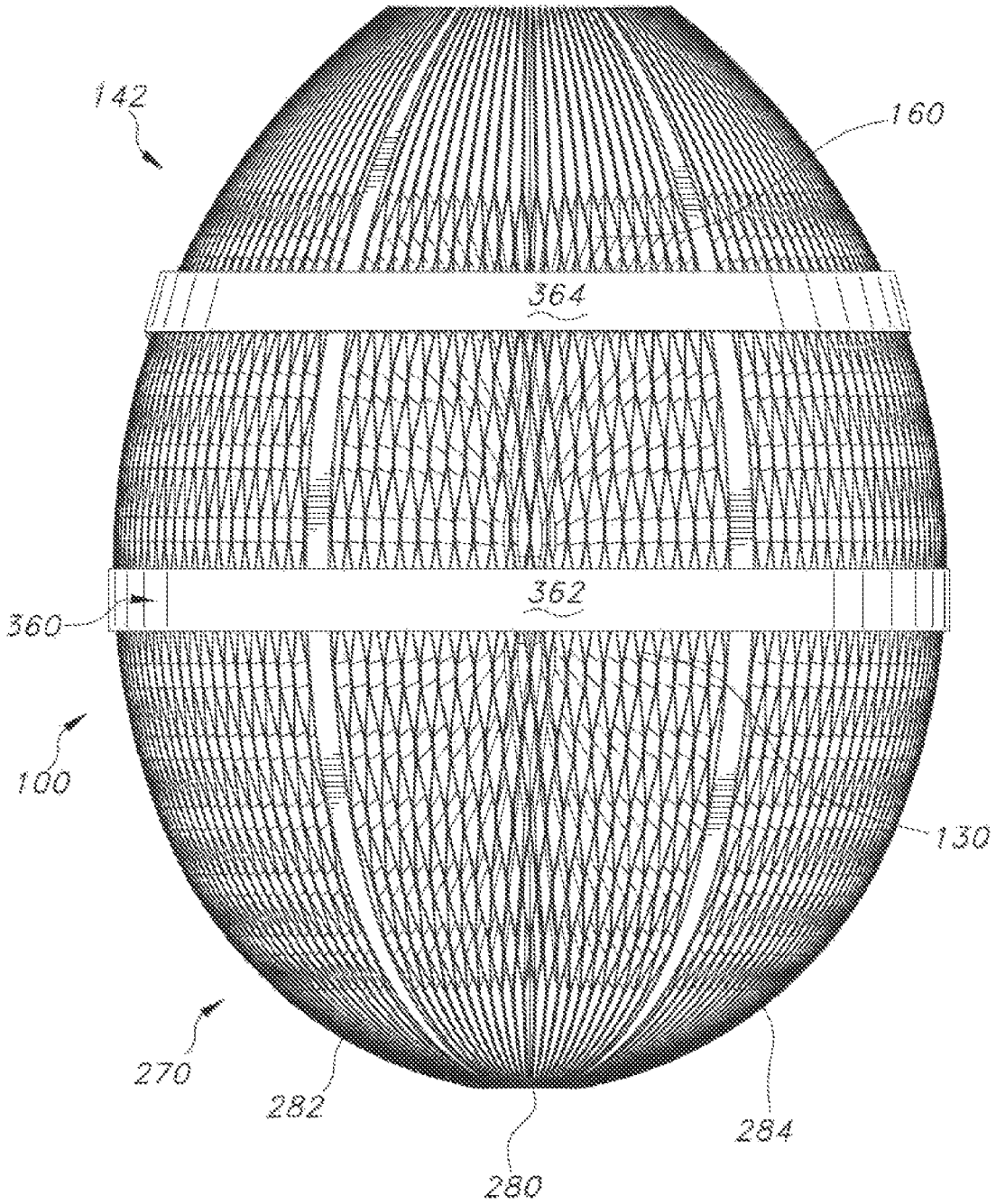
FIG. 27 is a top view of the helmet of FIG. 21.
Figure 28:
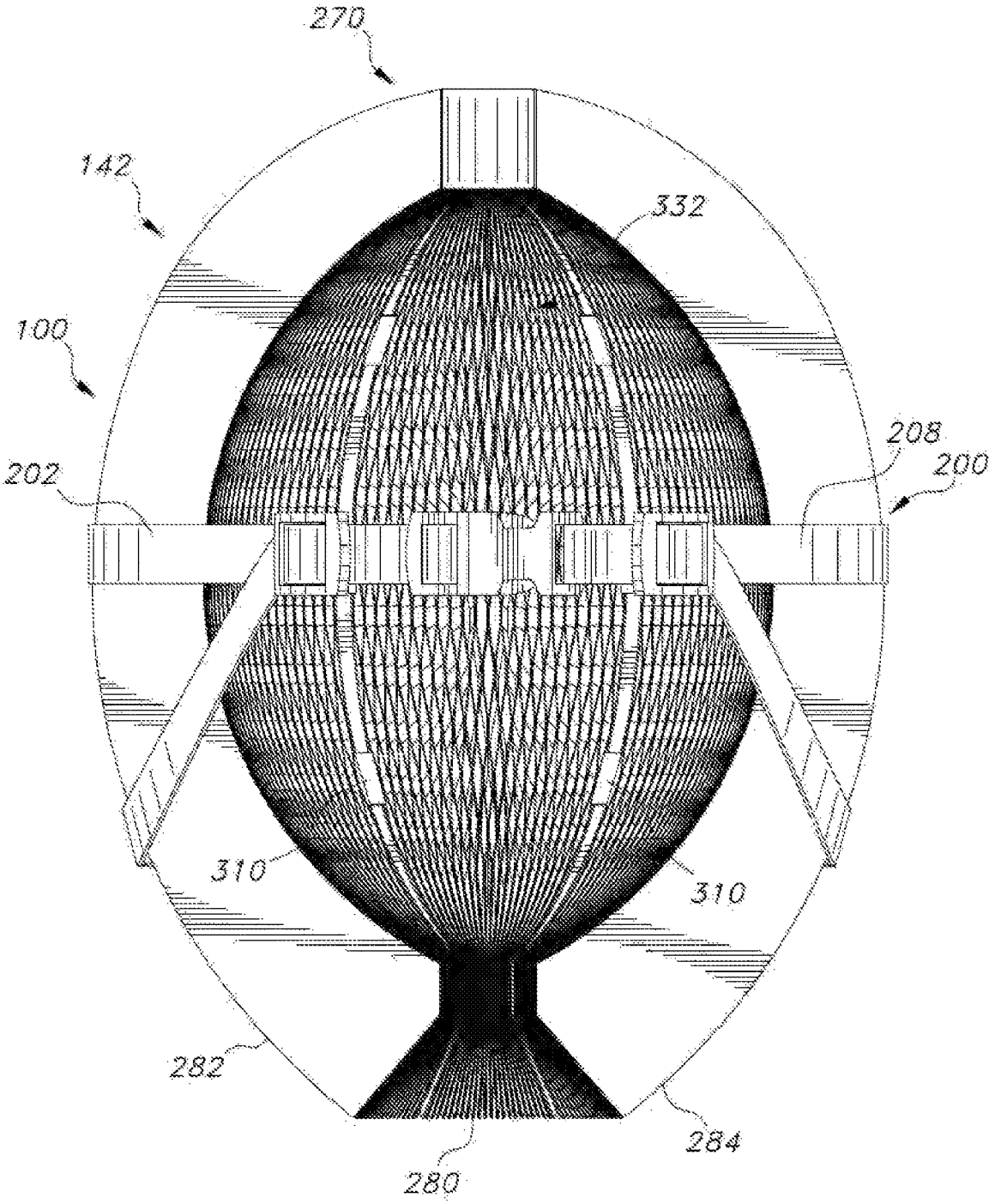
FIG. 28 is a bottom view of the helmet of FIG. 21.
Figure 29:
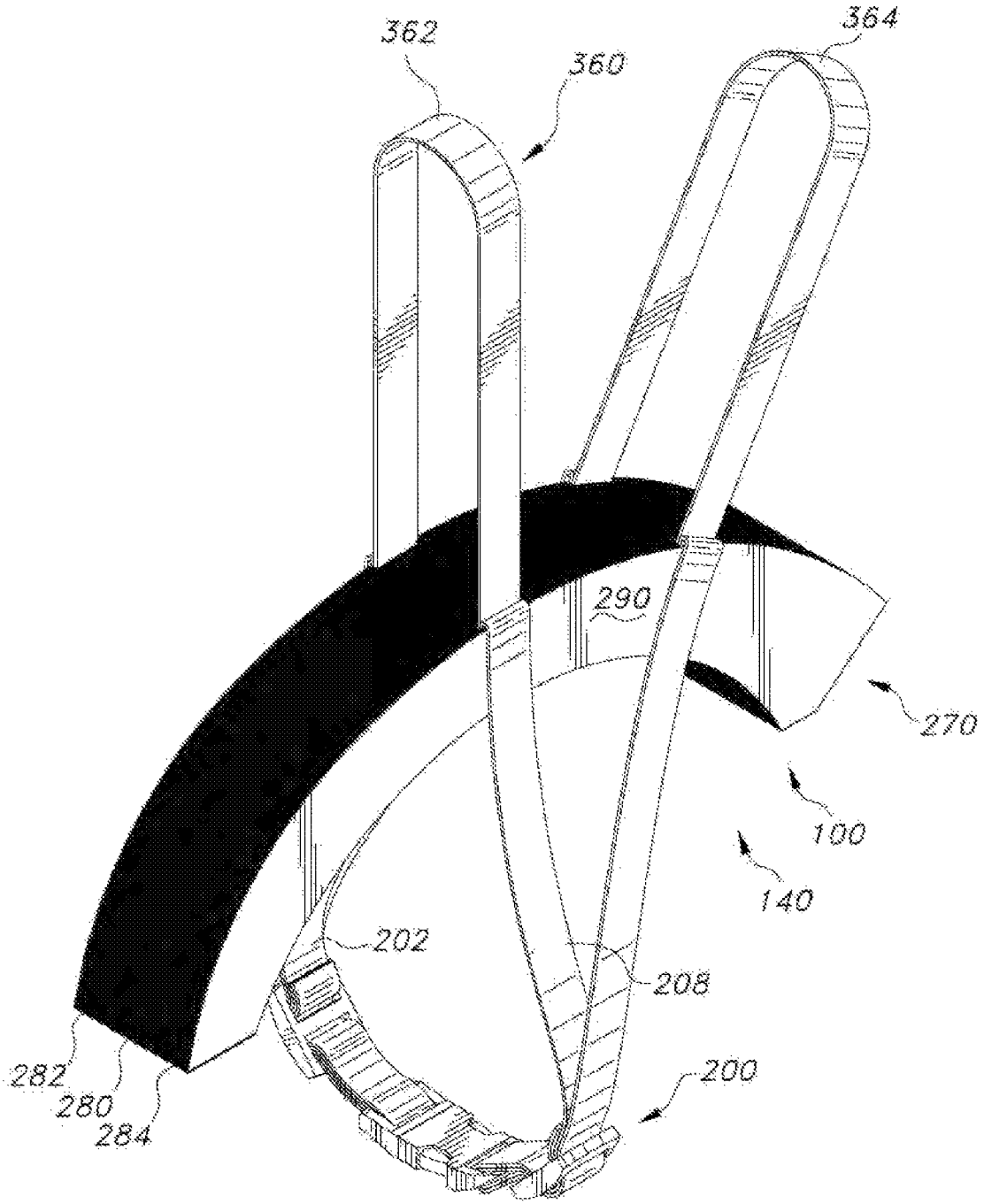
FIG. 29 is a top perspective view of a helmet with straps over the helmet in a collapsed or folded condition in accordance with the present disclosure.
Figure 30:
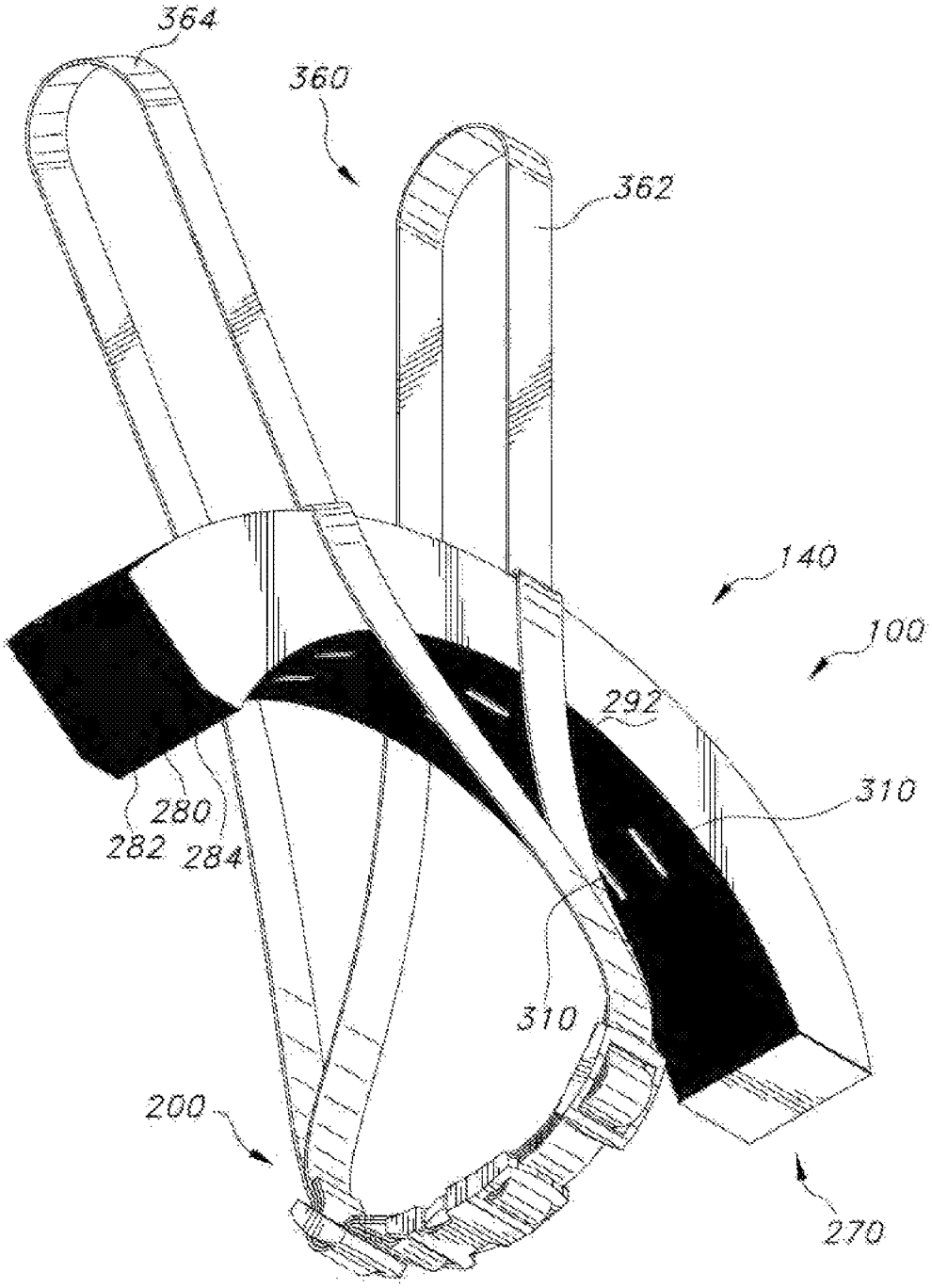
FIG. 30 is a bottom perspective view of the helmet of FIG. 29.
Figure 31:
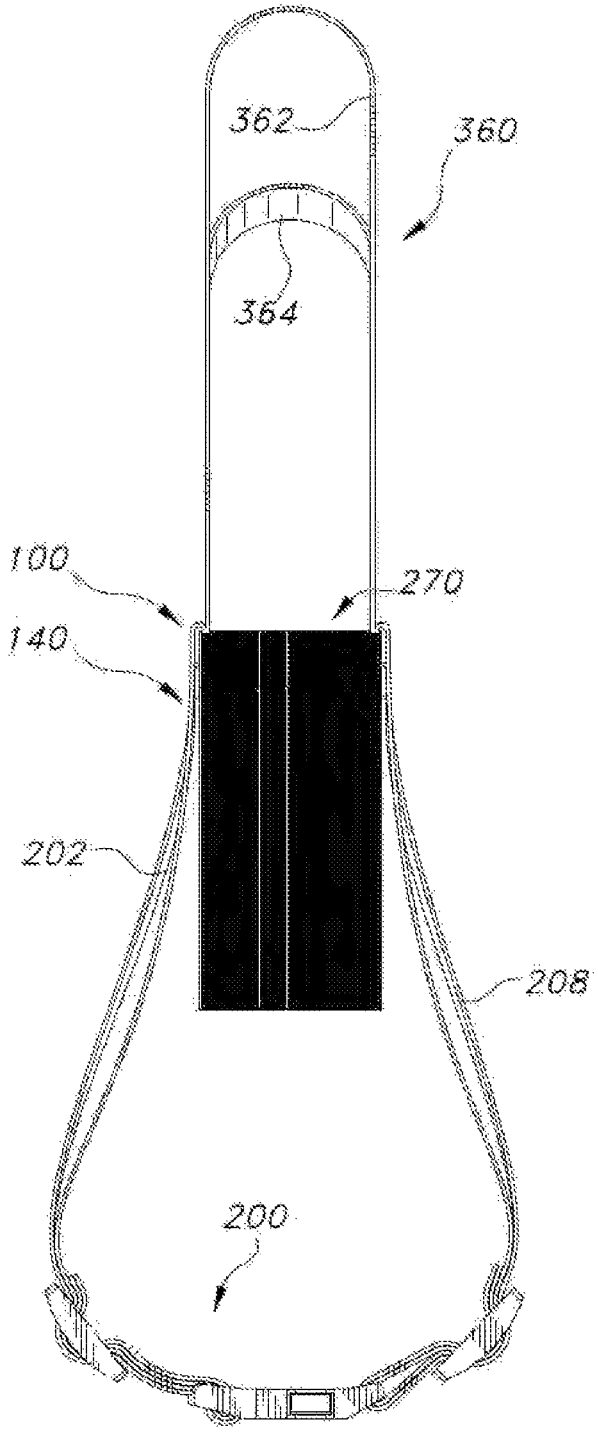
FIG. 31 is a front view of the helmet of FIG. 29.
Figure 32:
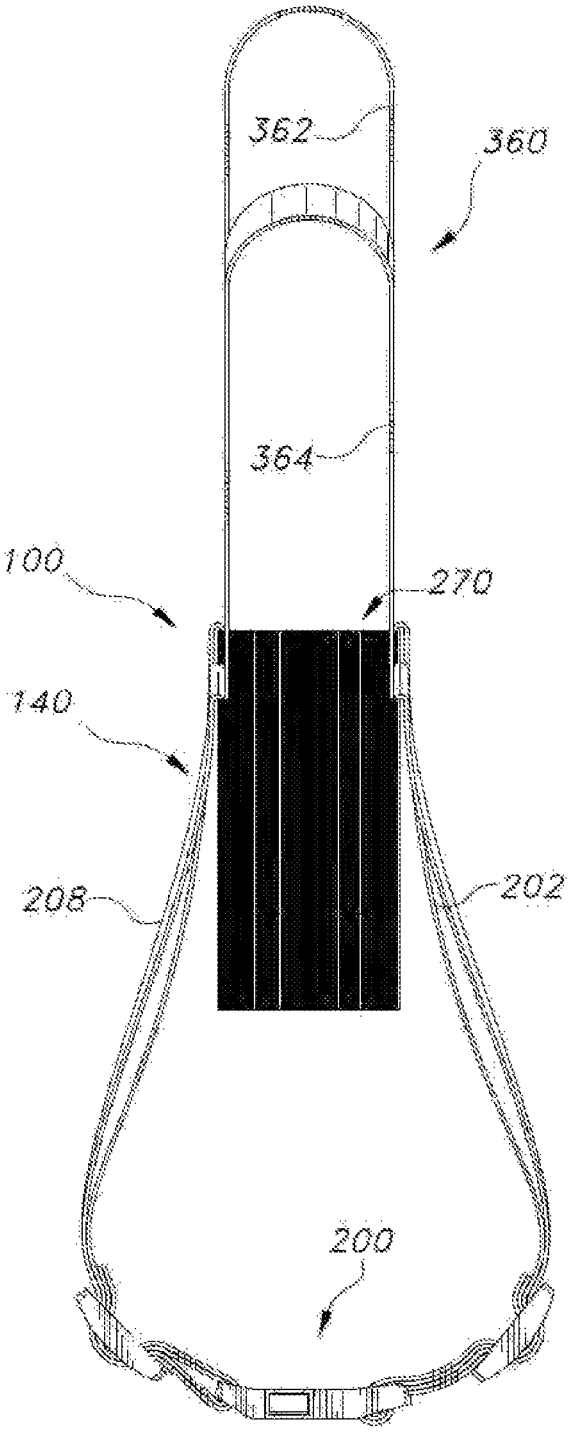
FIG. 32 is a rear view of the helmet of FIG. 29.
Figure 33:
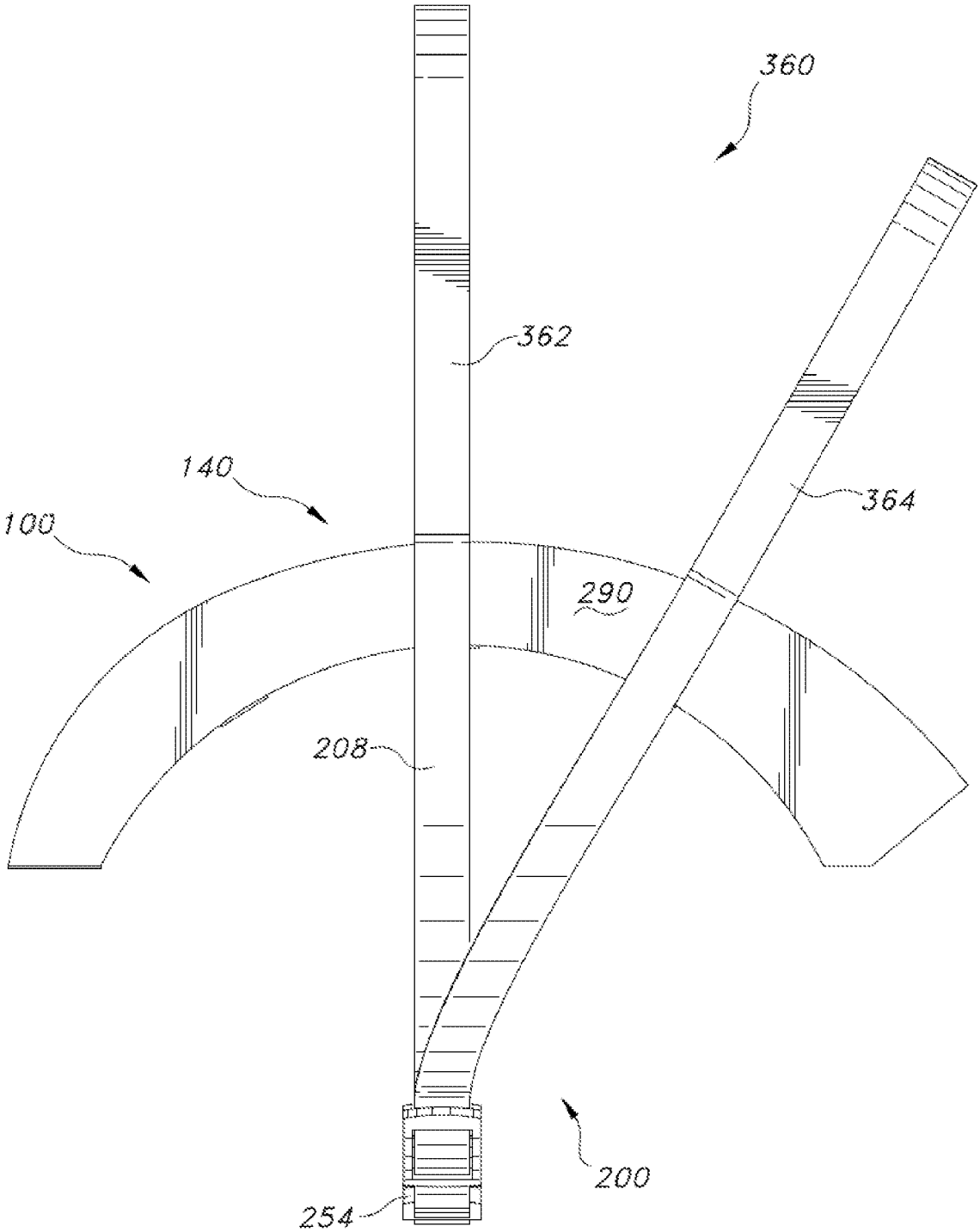
FIG. 33 is a right side view of the helmet of FIG. 29.
Figure 34:
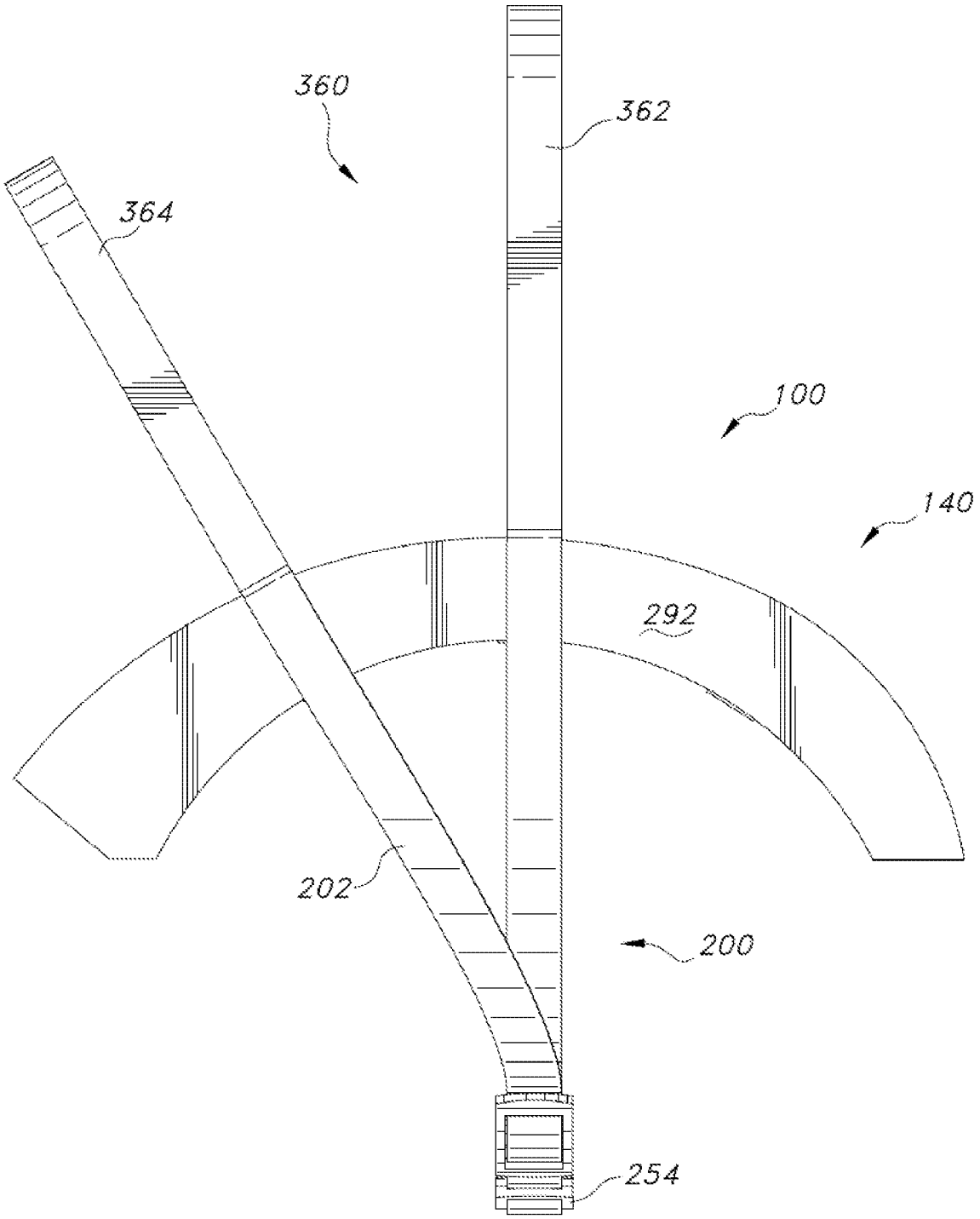
FIG. 34 is a left side view of the helmet of FIG. 29.
Figure 35:
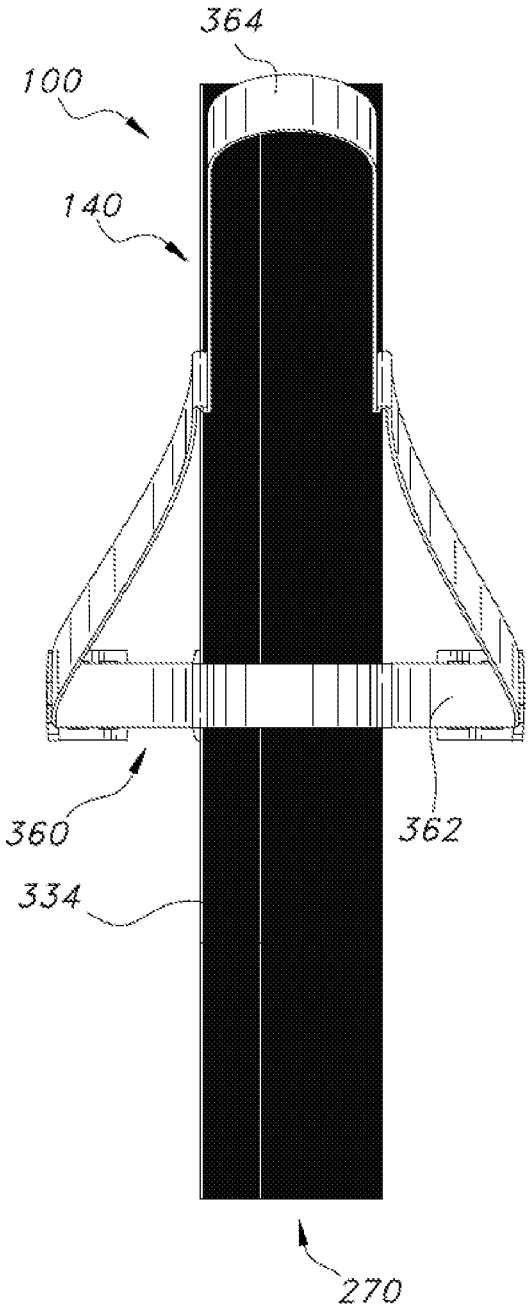
FIG. 35 is a top view of the helmet of FIG. 29.
Figure 36:
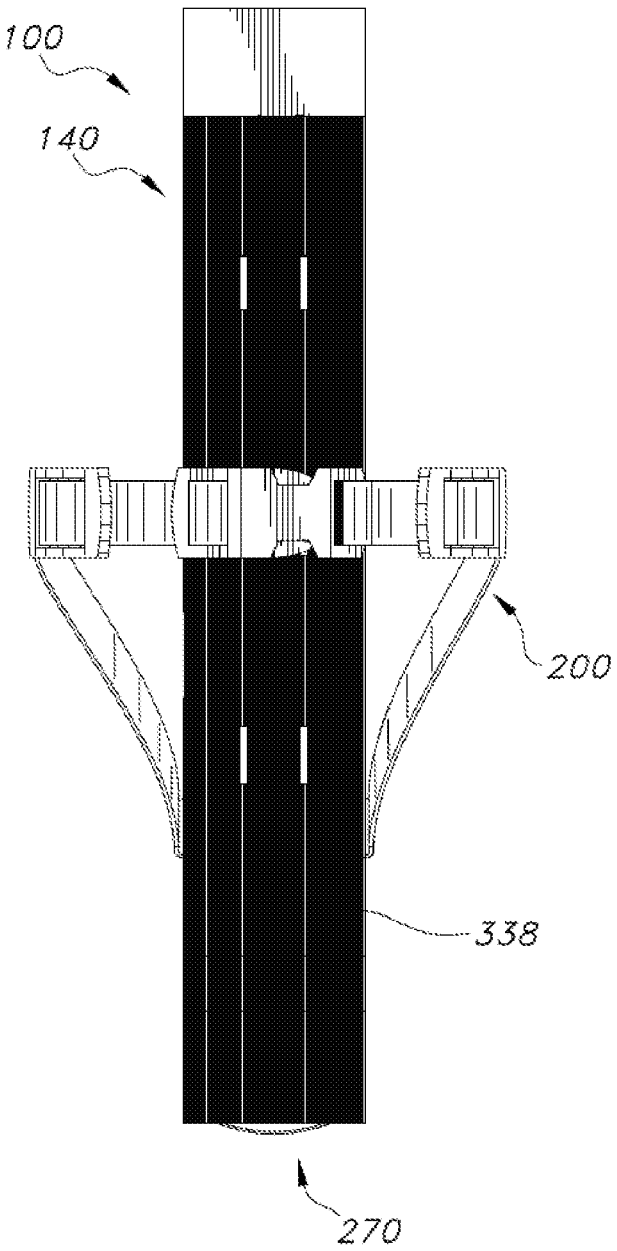
FIG. 36 is a bottom view of the helmet of FIG. 29.

Referring to FIG. 21, in some embodiments, the helmet 100 may include a restriction strap 360, whereby the restriction strap 360 prohibits the helmet 100 from moving to the expanded condition 142 while the restriction strap 360 is secured. The restriction strap 360 may be disposed over the exterior curvature 330 of the helmet, as shown in FIG. 21 through FIG. 36. In some embodiments, the restriction strap 360 includes two straps 362, 364. The two straps 362, 364 may be extended from the two upper chin strap portions 250, 252 of the chin strap assembly 200. In some embodiments, the restriction strap 360 may be positioned over the helmet 100 and configured to limit an amount of expansion of the honeycomb matrix 130 when moving into the expanded condition 142. In embodiments, the chin strap assembly 200 may be connected to at least one side of the at least one segment 270. A portion of the chin strap assembly 200 may include the at least one restriction strap 360 that may be positioned over the helmet 100. A portion of the chin strap assembly 200 may extend over the helmet 100 and may form a portion of the restriction strap 360. In some embodiments, a portion of the chin strap assembly 200 may be made of the same material as the restriction strap 360. In some embodiments, a portion of the chin strap assembly 200 and the restriction strap 360 may be a unitary construction.

Figure 37:
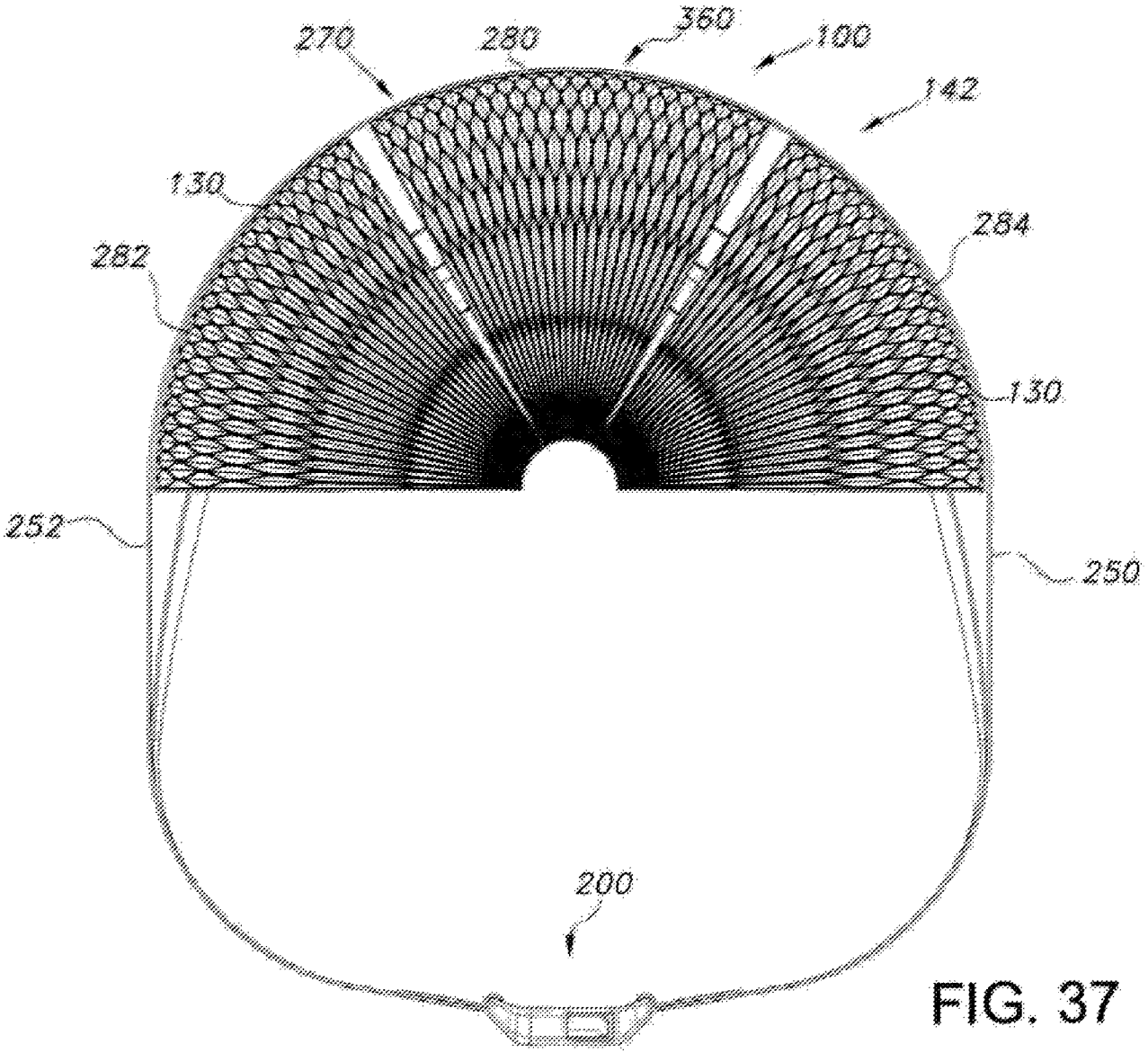
FIG. 37 is a diagrammatic view of embodiments of a helmet having straps that define a chin strip and continue over the helmet forming a unitary construction in accordance with the present disclosure.

Referring to FIG. 37, in some embodiments, the restriction strap 360 may extend as a single piece of material from the two upper chin strap portions 250, 252 to an opposite side of the helmet 100 and connect to other portions of the chin strap assembly 200. In embodiments, the restriction strap 360 may extend over the outer surface 334 of the helmet 100 such that the restriction strap 360 does not prevent expansion of the individual structural cells 160 of the honeycomb matrix 130 as the helmet 100 moves to the expanded condition 142, as shown in FIG. 21 through FIG. 36. In some embodiments, the restriction strap 360 may extend over the outer surface 334 each of the segments 270 of the helmet 100 and allow the individual structural cells 160 of the honeycomb matrix 130 to expand as the helmet 100 moves to the expanded condition 142. In some embodiments, the restriction strap 360 may extend over the outer surface 334 each of the segments 270, may extend over the entirety of the helmet 100, and combinations thereof while allowing the individual structural cells 160 of the honeycomb matrix 130 to expand as the helmet 100 moves to the expanded condition 142. By way of these examples, the restriction strap 360 may be positioned above helmet 100 when the helmet 100 is in its collapsed or folded condition 140 and then may be positioned on top of the outer surface 334 of the helmet 100 while the helmet 100 is in the expanded condition 142.

Figure 38:
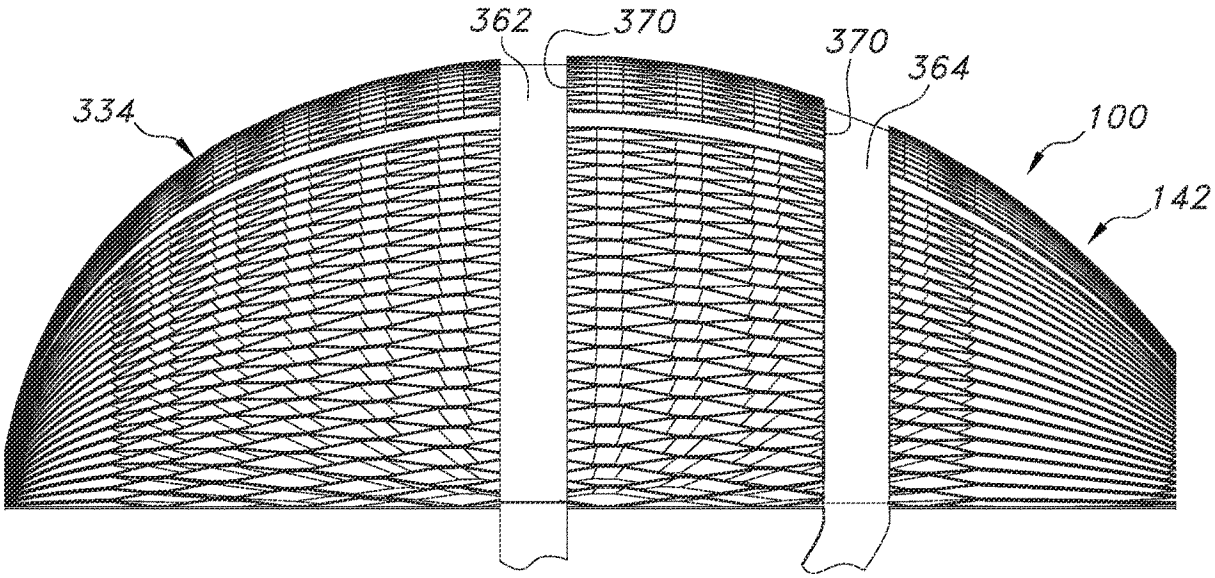
FIG. 38 is a diagrammatic view of embodiments of a helmet with straps over the helmet in areas recessed into the helmet in accordance with the present disclosure.
Figure 40:
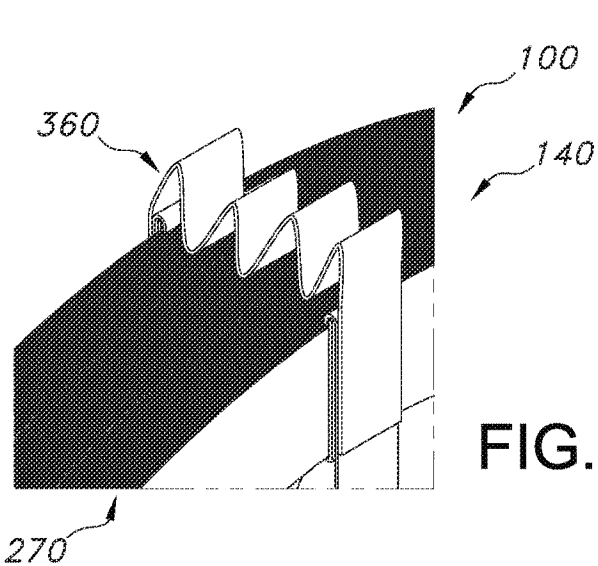
FIGS. 39 and 40 are diagrammatic views embodiments of helmets in a collapsed or folded condition in accordance with the present disclosure.
Figure 39:
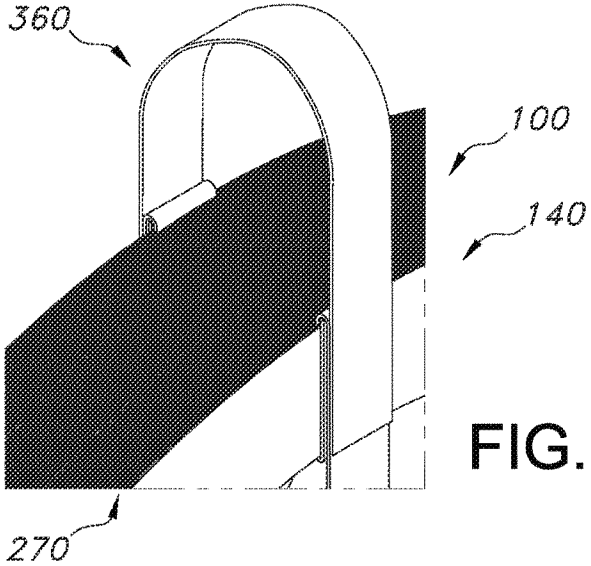

Referring to FIG. 38, in some embodiments, the helmet 100 defines a recess 370 in the honeycomb matrix to accept the restriction strap 360. In some embodiments, the helmet 100 defines the recess 370 in the honeycomb matrix 130 such that the recess 370 can accept one of the two straps 362, 364. In some embodiments, the helmet 100 may define the recess 370 in the honeycomb matrix 130 to accept both of the two straps 362, 364. In some embodiments, the restriction strap 360 may fold when the helmet 100 is in the collapsed or folded condition 140, as shown in FIG. 39. In some embodiments, the restriction strap 360 may coil when the helmet 100 is in the collapsed or folded condition 140, as shown in FIG. 40. In some embodiments, the restriction strap 360 is configured to one of gather, fold, or coil when the honeycomb matrix 130 of the helmet 100 is in the collapsed or folded condition 140. In some embodiments, limiting the expansion of the helmet 100 via the restriction strap 360 may enable the helmet 100 to expand to the expanded condition 142 without allowing the helmet 100 to expand too far as to possibly reduce structural integrity. In some embodiments, limiting the expansion of the helmet 100 with the restriction strap 360 may enable the helmet 100 to expand to an expanded condition 142 without allowing the helmet 100 to expand too much, thereby countering a pulling force of the user 110 on the first and second side straps 202, 208. In some embodiments, limiting expansion of the helmet 100 may be accomplished with substantially only the structural rigidity of the honeycomb matrix 130 resisting a possible over-expansion of the helmet 100

In some embodiments, the restriction strap 360 may be a fixed length or may be elastic to expand with the helmet 100 as the helmet 100 is moved to its expanded condition 142. The restriction strap 360 may be made of a stretchable material, such as an elastic-type material that is normally contracted and extends when a force is applied by the user expanding the helmet 100. In some embodiments, the restriction strap 360 may be made of a crimped, e.g., an accordion-like, material that alternately coils upon itself when collapsed or folded and unfolds when expanded. By way of these examples, the maximum unfolded length of such restriction strap 360 may impose a limit on the degree of expansion permitted for the helmet.

Figure 42:
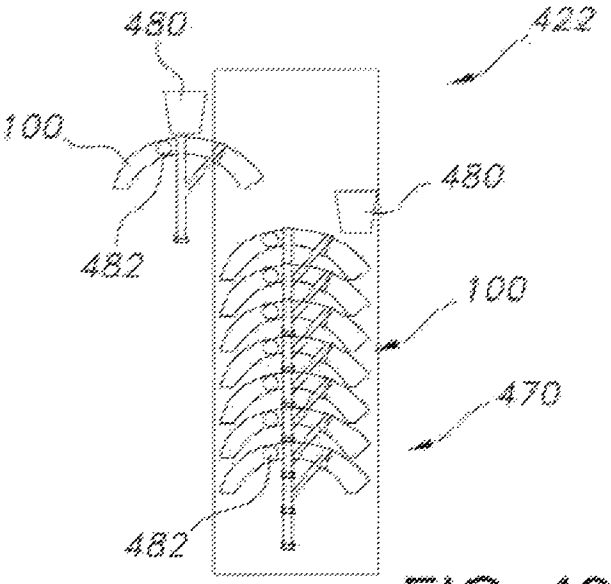
FIGS. 41, 42, and 43 are diagrammatic views of embodiments of helmets in an ecosystem including vending, tracking, receipt, recycling, use, and/or the like of the helmets in accordance with the present disclosure.
Figure 41:
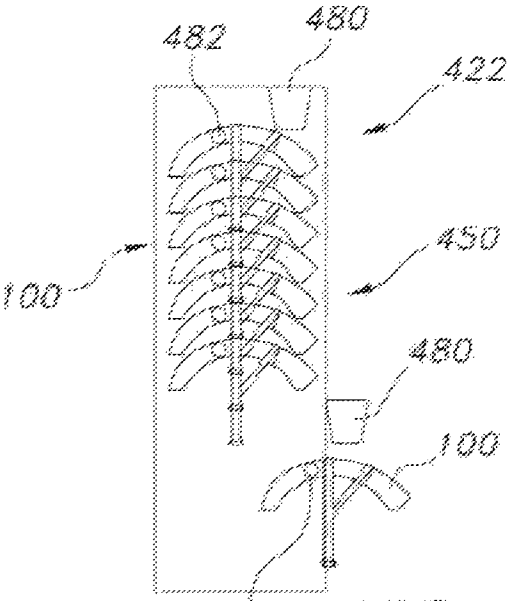
Figure 43:
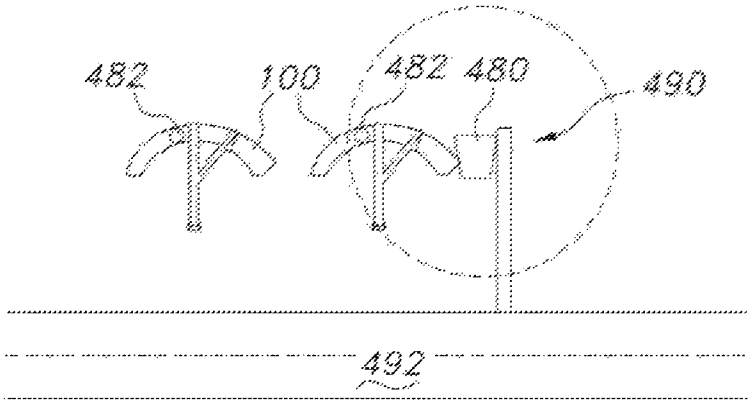

Referring to FIGS. 41-43, the helmet 100 may be configured to include tracking, usage, and inventory components 400 that may be deployed in a bicycle ride share system 170. The tracking, usage, and inventory components can include one or more of a microprocessor, memory, a battery, an alternating current adapter, and an antenna. In some embodiments, the preferences and/or priorities, including the user profiles 172, may be used by the one or more bicycle systems 170 to help the user 110 gain benefits, such as a customized experience, a fast check in and departure, and/or the like from the bicycle system 170. In some embodiments, the one or more bicycle systems 170 may require that the user 110 obtain and wear the helmet 100 or another helmet as a condition of receiving the bicycle 120 from the bicycle system 170.

In some embodiments, the user 110 may use one or more cameras 410 of a connected device 180 to capture one or more headshots that may be used to recommend a size of the helmet or to ensure that the helmet is being worn correctly. The user 110 may transmit the one or more headshots via the connected device 180, and receive one or both of a recommendation of the helmet 100 that will fit the user 110 or an alphanumerical indicator corresponding to the helmet 100 that will fit the user 110. Data corresponding to one or more measurements of the head 150 of the user 110 may be stored in a database and/or shared with the user, and in some embodiments may be associated with the user profile 172 associated with the user 110. In some embodiments, the user may access one or more bicycles at a bicycle sharing depot 420 or the like associated with the bicycle system 170. The user 110 may select one of a plurality of available bicycles, such as a subset of bicycles that may be recommended to the user based on the user's preferences and the user profiles 172. In some embodiments, the user 110 may request to reserve one or more bicycles in advance to ensure that a bicycle will be available at the reserved place and time. Reserving and/or selecting one or more of the bicycles, including checking an inventory of bicycles and/or access to helmets at bicycle sharing depots may be done through the connected device 180 of the user 110, such as through a bicycle sharing or helmet sharing mobile application and/or the like. In some embodiments, accessing a bicycle and/or reserving a bicycle may also include access and/or reservation of one or more of the helmets 100 from a helmet vending machine 422, a helmet vending facility 424, or any helmet dispensing system 450 offering the helmets 100 that may be co-located with the bicycle sharing depot 420 that the user 110 may access and/or at which the user has reserved one or more of the bicycles 120.

The bicycle system 170 may coordinate and manage bicycle sharing and may also coordinate and manage helmet access and/or may maintain an inventory of bicycles and or helmets by depot location. In embodiments, the bicycle systems 170 may similarly coordinate maintaining an inventory 460 of the helmets 100 and provide visibility to what helmets 100 may be available at or near depot locations. The user 110 may access the bicycle 120 by activating the bicycle system 170 through the application on the connected device 180 to be granted access to the helmet 100 for use while using the bicycle 120. In some embodiments, use of a helmet, such as the helmet 100, may be optional such that the user may opt out of accessing a helmet. In other embodiments, use of a helmet may be mandatory, such as to comply with local regulations. In such cases, the user may confirm use of the helmet 100 or of another helmet.

In some embodiments, the helmet 100 may be provided through the vending machine 422 or other helmet dispensing systems 450. The vending machine 422 or other helmet dispensing systems 450 may dispense the helmet 100 to the user 110 with the helmet 100 in the collapsed or folded condition 140. The user 110 may accept the helmet 100 from the vending machine 422 or the helmet dispensing systems 450, expand the helmet 100, and wear the helmet 100, such as during a bicycle ride. When the user 110 wishes to dispose of the helmet 100, the user 110 may return the helmet 100 to a destination helmet receptacle 470, as is shown in FIG. 42, or other helmet dispensing systems 450, or may place the helmet 100 in a suitable recycling container or system. Methods and systems for tracking helmet inventories 460, uses, locations, and reuse may be deployed in application embodiments, such as in the vending machine 422.

In some embodiments, accessing and/or reserving one or more of the helmets 100 may include benefits associated with sponsors of the helmets 100, other bicycle sharing programs, retail bike locations, other retail locations, and/or the like. One or more businesses may opt to sponsor access, giveaways, contests, and other programs with the helmet 100, such as through paying a fee for each helmet 100 that is dispensed to the public. In some embodiments, sponsoring access to a helmet 100 as described herein, a business may offer the user 110 of the helmet 100 an incentive, such as a digital coupon for a reduced-price product or service of the sponsor. Incentives for access and use of the helmet 100 may include promotions, e.g., digital coupons and/or the like, by sponsors in exchange for the user 110 accessing or obtaining the helmet 100. In some embodiments, incentives may also be associated with the detected use of one or more helmets 100, such as through video capture of bicycle users riding along a public bike path and/or the like. Users who are detected wearing one or more of the helmets 100 may be offered incentives that may be electronically delivered directly to the user's bicycle sharing account and accessed through the user's connected device 180.

The user 110 of the helmet 100 may also be offered incentives for proper disposal of the helmet 100 after use, such as through a proper recycling facility or used helmet receptacle facility that may be located at bicycle sharing depots. One or more of the helmets 100 may be dispensed at a first location and may include electronic and/or physical markings that facilitate detecting the helmet 100 when it is delivered to a recycling or helmet access facility. In some embodiments, one or more of the helmets 100 may include electronic markings, such as RFID tags. In some embodiments, one or more of the helmets 100 may include physical markings, such as serial numbers and/or authentication holograms. When the helmet 100 is detected as retrieved after it was earlier dispensed, the helmet 100 may be designated as being properly recycled. In some embodiments, return of the helmet 100 for recycling may generate a reward, such as a deposit refund or a social media indicator. In some embodiments, incentives such as discounts or free future bicycle use may be offered for making reservations, using bicycle sharing, helmet use detection, helmet disposal detection, or any other suitable use and/or disposal of the helmet 100.

In some embodiments, deployment environments may include the helmet dispensing systems 450, return systems, reuse systems, and other systems, such as a receptable adapted to receive the helmet 100 and positioned at a destination of a bicycle ride. In some embodiments, the user 110 may rent and retrieve the bicycle 120 and the helmet 100 at a first location (e.g., a location near a residence) and ride the bicycle 120 with the helmet 100 to travel to another location at which point the user 110 may drop off the bicycle 120 and the helmet 100 at a bicycle receptacle and the destination helmet receptacle 470 near the final destination. Moreover, the user 110 may retain the helmet 100 and reuse the helmet 100 if the bicycle ride or journey continues.

In some embodiments, the helmet dispensing system 450, the helmet vending machine 422, the helmet vending facility 424, or the like, may be configured with a helmet detection system 480 that is configured to detect presence or proximity of one or more tracking devices 482 included in the helmet 100. The tracking device 482 may include a serial number that facilitates individual helmet detection and tracking. Dispensing helmet 100 may include registering a serial number of each of the dispensed helmets 100. The serial number may be read by the helmet detection system 480, thereby providing an indication of the dispensing of the helmet 100. In some embodiments, tracking of the serial number during dispensing and/or retrieving of the helmet 100 may be used with inventory tracking services to automatically order additional inventory so that inventory of one or more of the helmet dispensing systems 450 may be replenished. Tracking of the serial number during dispensing and/or retrieving of the helmet 100 may also be used in maintaining a record of inventory for each dispensing station. For example, when an inventory of helmets such as the helmet 100 at a dispensing station such as the helmet vending machine 422 falls below an inventory threshold, or a rate at which the helmets 100 are being dispensed exceeds a dispensing threshold, automated techniques may be employed to facilitate replenishing inventories of the helmets 100 at one or more of the helmet vending machines 422, the helmet vending facilities 424, the helmet dispensing systems 450, or the like.

In some embodiments, the helmet tracking devices 482 may facilitate tracking a location of the helmet 100. Tracking of the location of the helmet 100 via the helmet tracking devices 482 may be used to report the location of the helmet 100, such as through a cellular network, via a Wi-Fi hot spot, or other methods. In some embodiments, the helmet tracking devices 482 may transmit and/or receive data to or from the connected device 180 of the user 110. In some embodiments, a location of the helmet 100 may be determined when the helmet 100 is presented before a detection system, such as a local helmet dispensing system 450, a detection station 490 along a bicycle path 492, and/or the like.

In some embodiments, the helmet tracking device 482 may monitor a condition of the helmet 100 and report to an emergency response service if damage to the helmet exceeds a certain threshold. For example, aspects of such system may be deployed in sports related environments to alert emergency responders to sports-related emergencies, including emergencies or crashes during bicycling, skiing, hiking, motorcycling, skating, etc.

In some embodiments, the helmet tracking device 482 includes a fitness tracker paired with the connected device 180, a mobile device, a smart bicycle of the user 110, or any other suitable device. The fitness tracker may be configured to detect and report one or more physiological parameters of the user 110, such as heart rate, pulse rate, and blood oxygen saturation.

In some embodiments, the helmet tracking device 482 is configured to determine that the helmet 100 has been worn properly by the user 110 and allows the user 110 to operate the bicycle only when the helmet has been worn properly.

Figure 44:
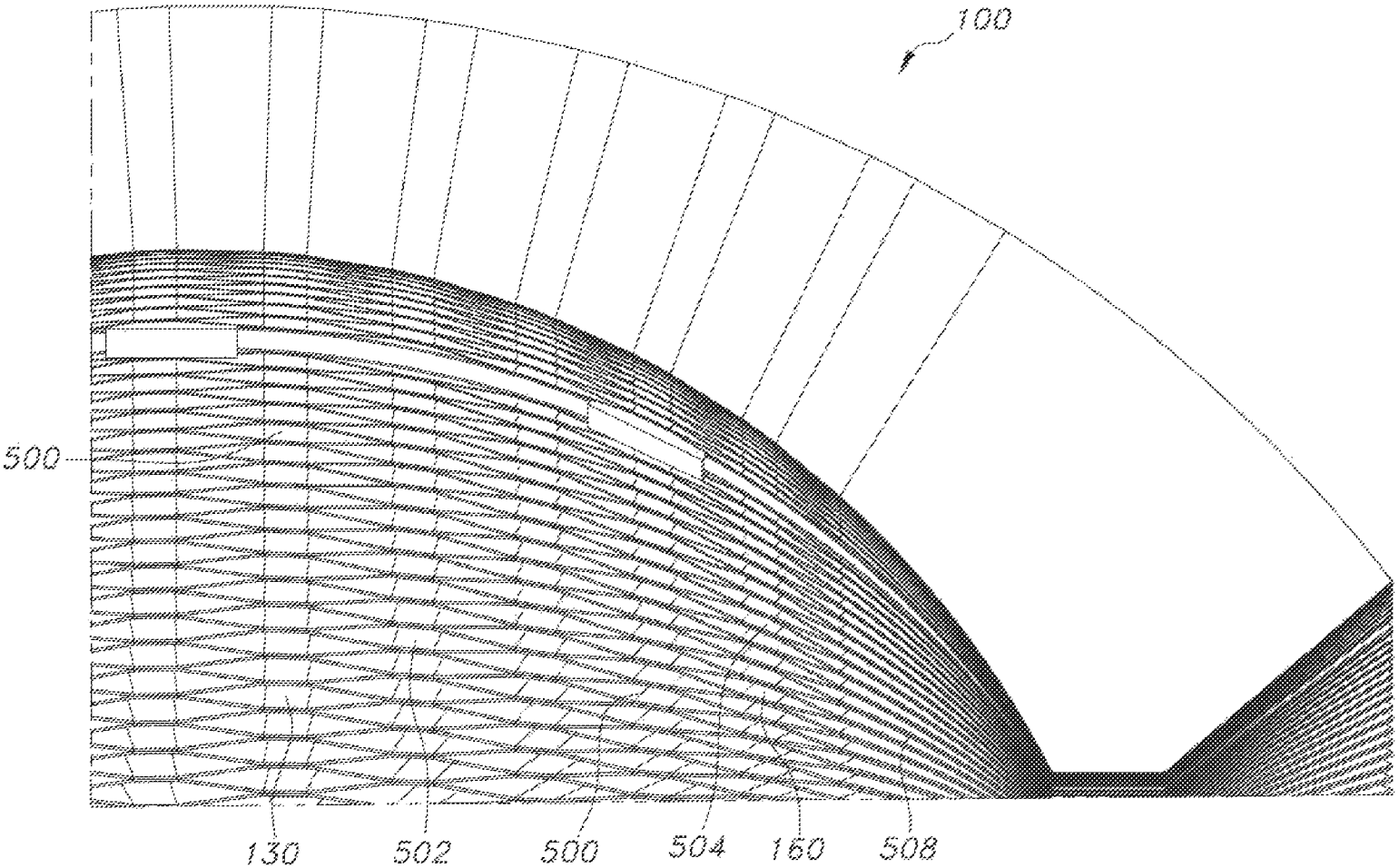
FIGS. 44, 45, and 46 are diagrammatic views of embodiments of helmets with cell structures of the honeycomb matrix having different shapes relative to positions along a surface of a head of a user in accordance with the present disclosure.
Figure 45:
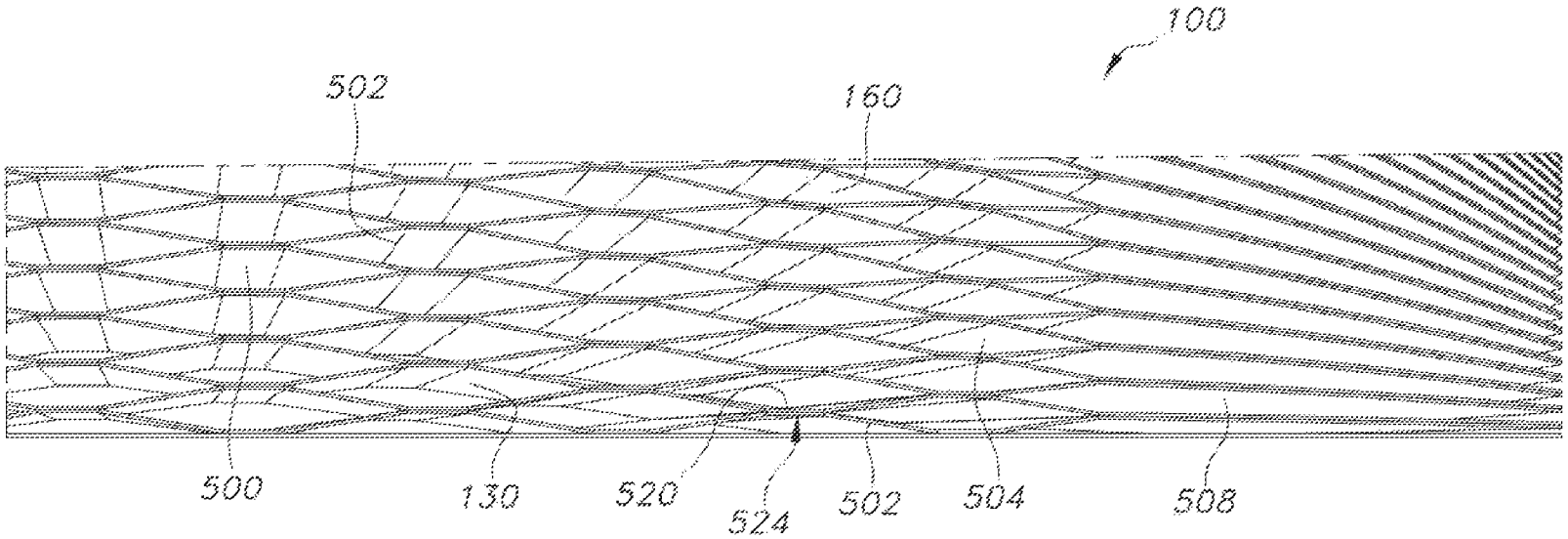
Figure 46:
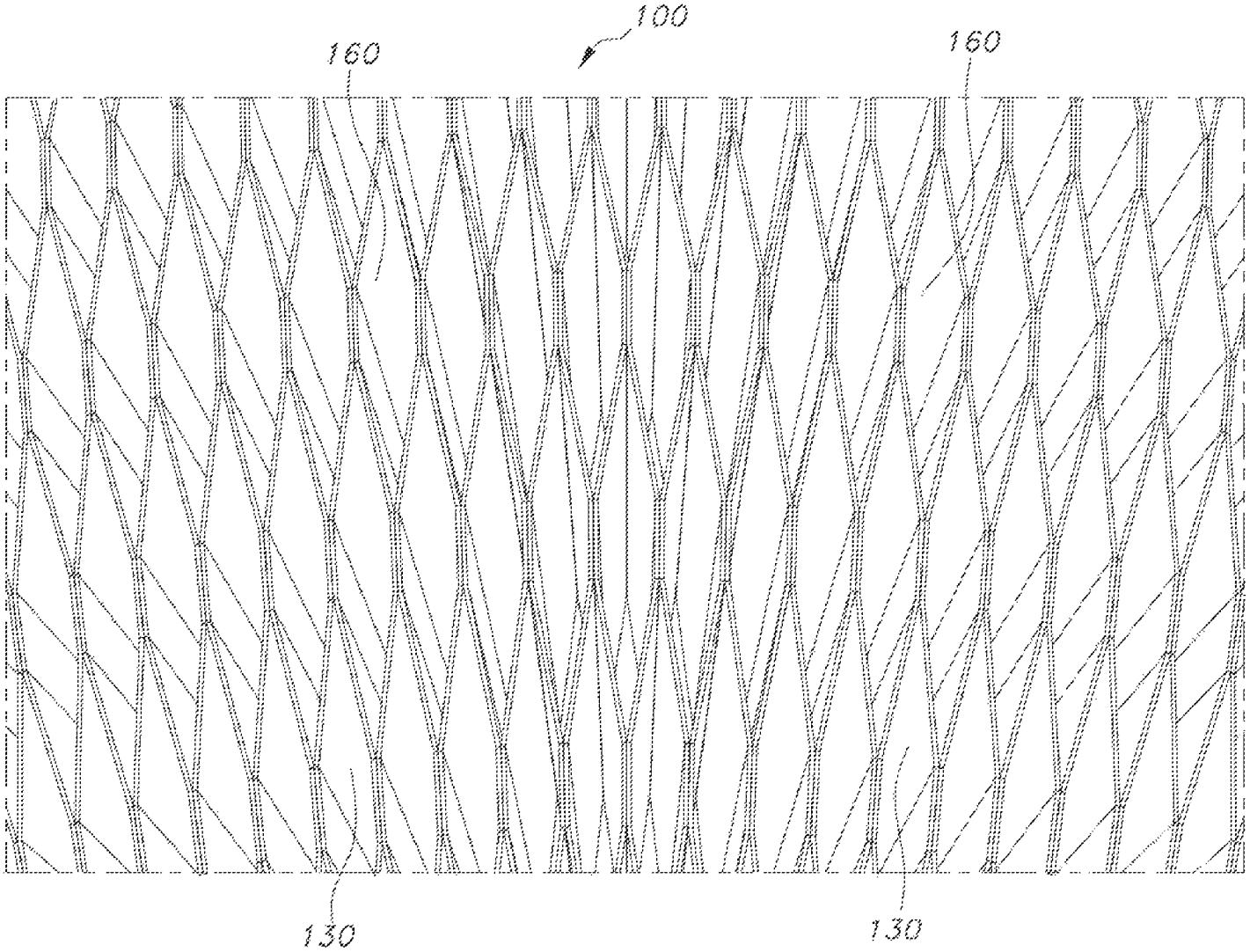

FIGS. 44, 45, and 46 illustrate embodiments of the helmet 100 wherein shapes 500 of the structural cells 160 of the honeycomb matrix 130 vary in response to the pre-determined position of the cells 160 and conform to the contours 154 of the head 150 of the user 110 when the helmet 100 is disposed in an expanded condition 142. The shapes 500 of the structural cells 160 may be fixed but vary in a predetermined fashion relative to the contours 154 of the user's head 150 proximate to the structural cells 160. In some embodiments, adjacent structural cells may have different shapes from one another, such as cells 502, 504, 508, based on shapes of the contours 154 of the outer surface 152 of the head 150 of the user 110. The cells 502, 504, 508 may have different shapes to accommodate the changes in curvature of the contours 154 of the user's head 150 and may maintain the radial direction of the structural cells 160 that keep the structural cells 160 generally perpendicular to the head 150 of the user 110.

In some embodiments, a front and a rear portion of the helmet may expand substantially less than a midsection a central portion of the helmet 100. To enable variation in the expansion of the helmet 100 from the central portion of the helmet 100 to either the front or the back, the honeycomb matrix 130 may be more narrow near the front and the back of the head 150 than near the center of the head 150. In some embodiments, a fewer number of the structural cells 160 may be present in locations of the honeycomb matrix 130 proximal to and at the front or back of the user's head 150, and the number of the structural cells 160 may increase for a given area more toward the central portion of the helmet 100.

In some embodiments, a number of the structural cells 160 are in the honeycomb matrix 130. In some embodiments, a first and second walls 520, 522 are combined with or extend from the panel 350 to form multiple structural cells 160 of the honeycomb matrix 130 and may be combined to reduce the number of structural cells 160 toward the front or the back of the helmet 100. In some examples, the second wall 522 terminates at a point of connection with the first wall 520, such as at a connection region 524. The first wall 520 may continue toward the front or toward the rear of the helmet 100 to achieve a desired length for the helmet 100, and the second wall 522 may terminate at the connection region 524 or at one or more other predetermined locations to facilitate a certain pattern or shape. In some embodiments, the first and second walls 520, 522 may merge by being attached continuously from a merge point to a predetermined terminus toward the front or the back of the helmet to reduce the number of structural cells 160. In some embodiments, the first and second walls 520, 522 may be combined and have reduced thickness or rigidity to reduce a local count of structural cells 160.

Figure 48:
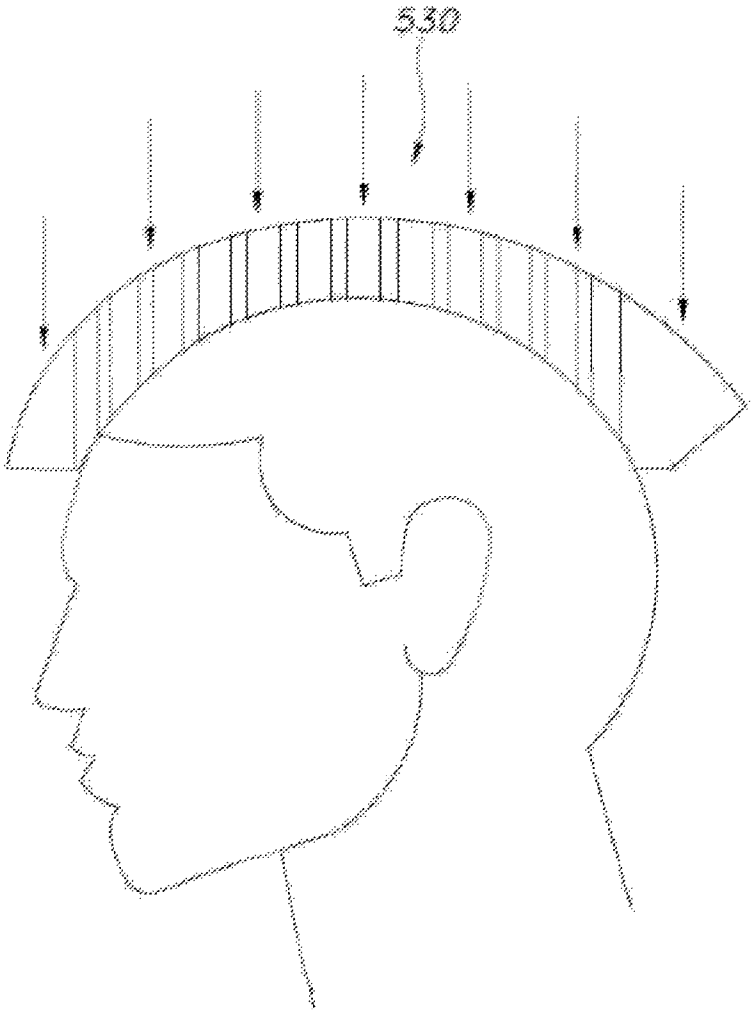
FIG. 48 is a diagrammatic view of a helmet with cell structures that have a parallel alignment and a honeycomb matrix is aligned in directions that are not perpendicular to many locations of an outer surface of a head of a user.
Figure 47:
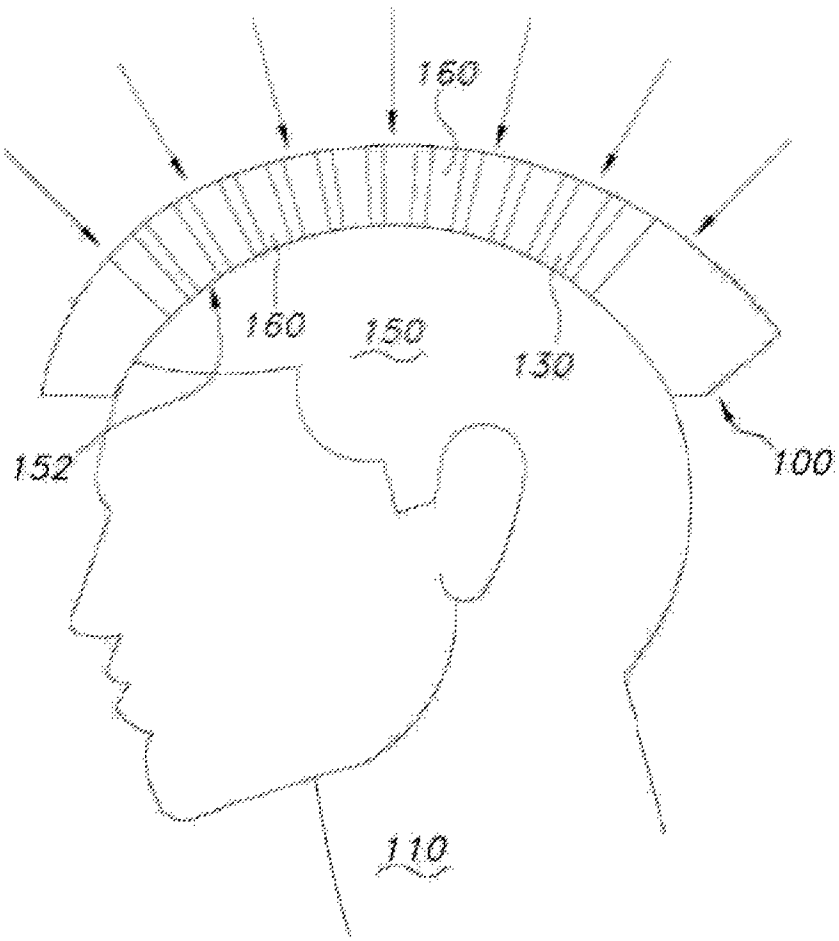
FIG. 47 is a diagrammatic view of embodiments of a helmet with radially-aligned cell structures of a honeycomb matrix in directions that are perpendicular to the outer surface of a head of a user in accordance with the present disclosure.

FIG. 47 illustrates the radial alignment of the structural cells 160 of the honeycomb matrix 130 relative to the outer surface 152 of the head 150 of the user 110. The radial alignment of the structural cells 160 of the honeycomb matrix 130 relative to the outer surface 152 of the head 150 of the user 110 facilitates radial absorption of impact forces. FIG. 48 illustrates embodiments of the helmet 100 wherein a parallel alignment 530 of the cells of the helmet 100 do not direct impact radially and therefore may be unable to withstand impact forces in an accident or similar situation or that may be required from an impactor, anvil, or other tests that may qualify the helmet for sale under local rules and regulations.

Figure 50:
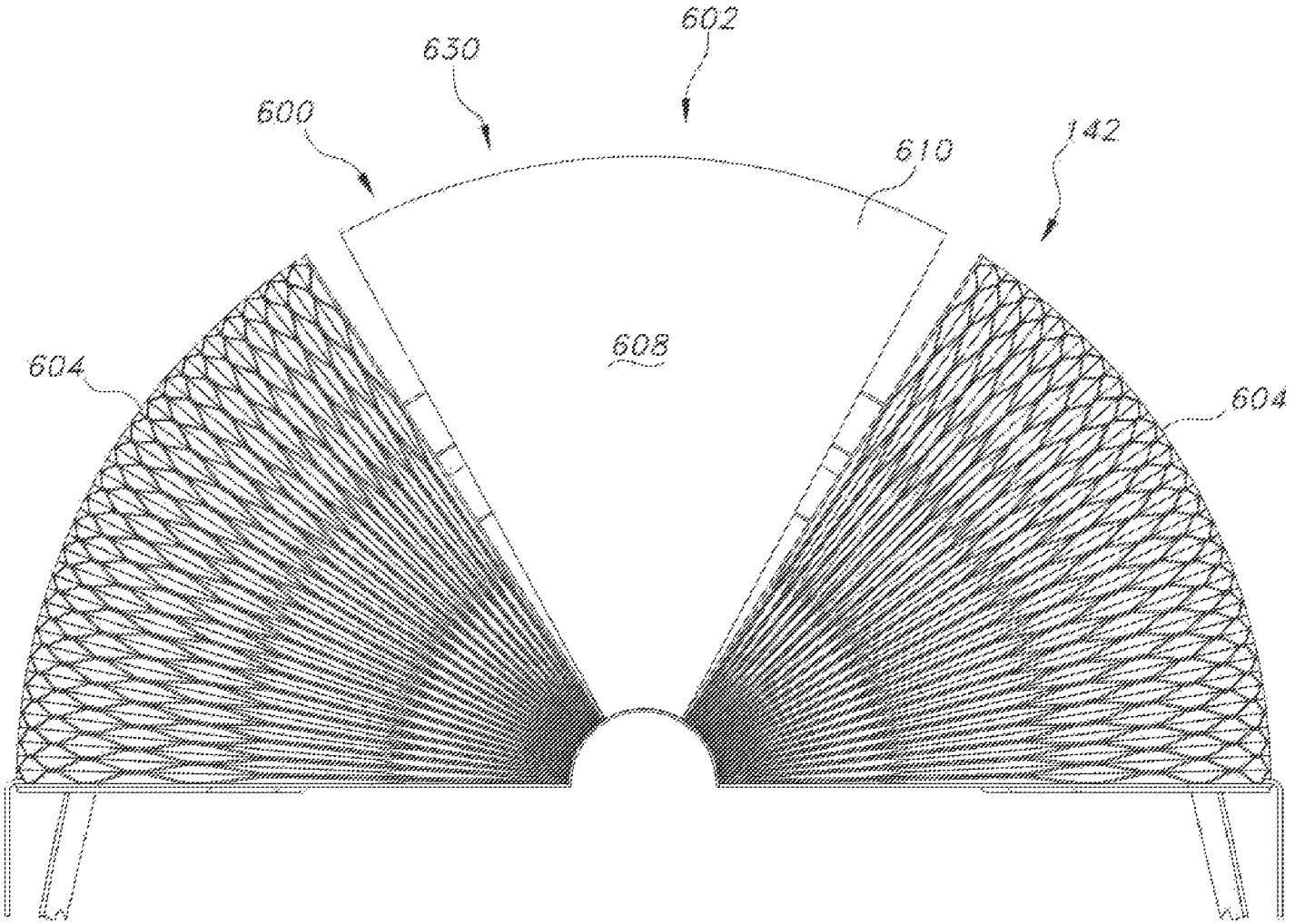
FIGS. 50 and 51 are diagrammatic views of embodiments of helmets with segments or portions of segments of a honeycomb matrix filled or replaced with structures lacking the honeycomb matrix in accordance with the present disclosure.
Figure 51:
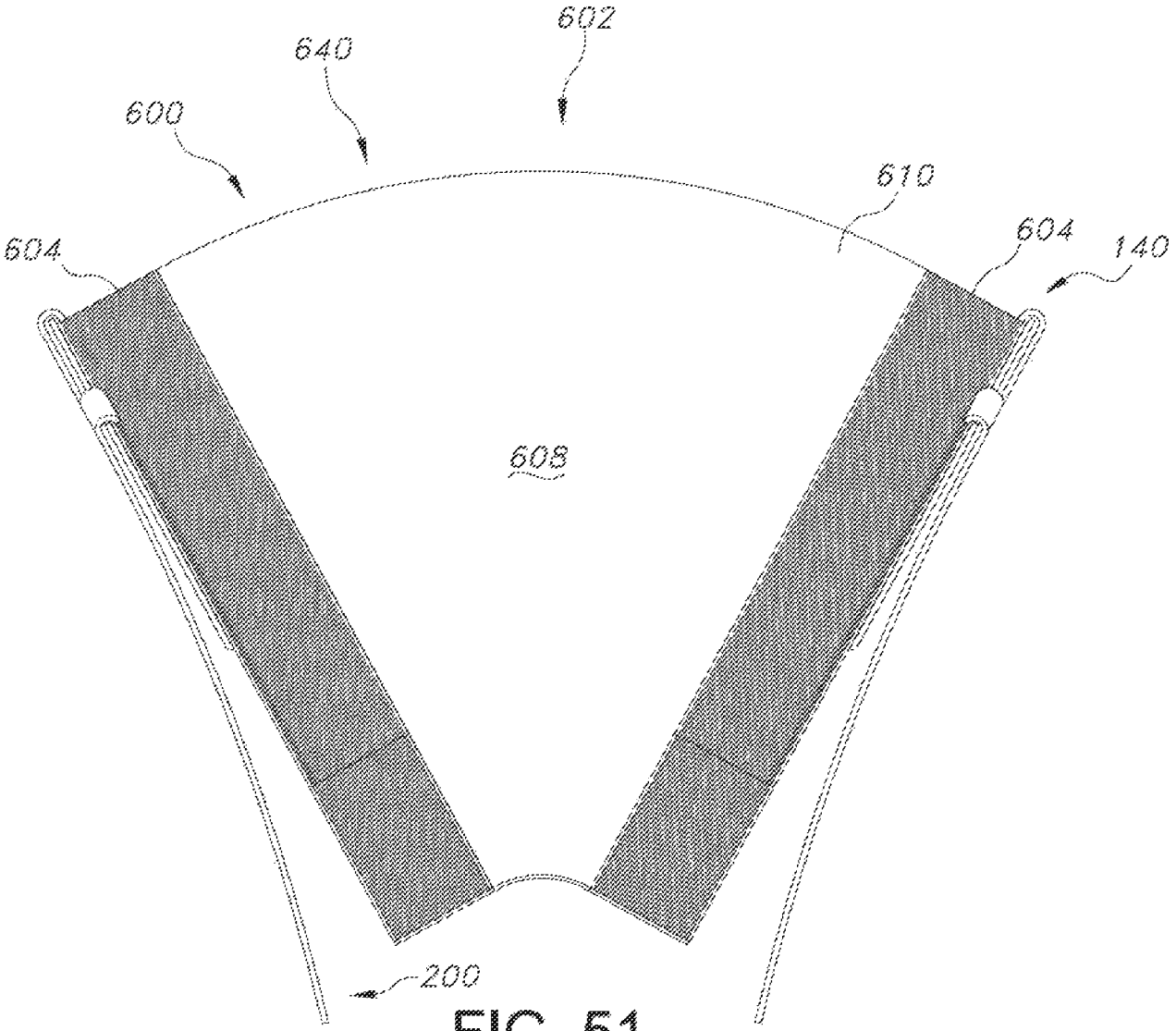

FIGS. 50 and 51 depict a helmet 600 including a combination of segments 602 that further includes a plurality of side segments 604 made at least partially of the honeycomb matrix 130 and a central segment 608 made at least partially of a solid impact absorbing material 610. The number and position of the segments 602 and the selection of materials for the segments 602 may be based on cost, impact protection goals or results, weight, the desired degree of collapse, the compactness in the collapsed or folded condition, the smallness of the helmet when collapsed, folded, and/or the like. The helmet 600 is illustrated in an expanded condition 630 that is similar to the expanded condition 142 of previously discussed embodiments of the helmet 100. FIG. 51 depicts a partially collapsed or folded condition 640 including the side segments 604 folded against the central segment 608. The central segment 608 that is solid and therefore does not fold. In some embodiments, the central segment 608 may include polystyrene, a solid matrix, and/or the like. Attachment of the two segments 604 to the solid segment 608 may be performed through methods and systems comparable to those described herein for attaching segments 270 in previously discussed embodiments of the helmet 100 herein. In some embodiments, the segments 602 may be radially-oriented and include the structural cells 160 of the honeycomb matrix 130.

Figure 52:
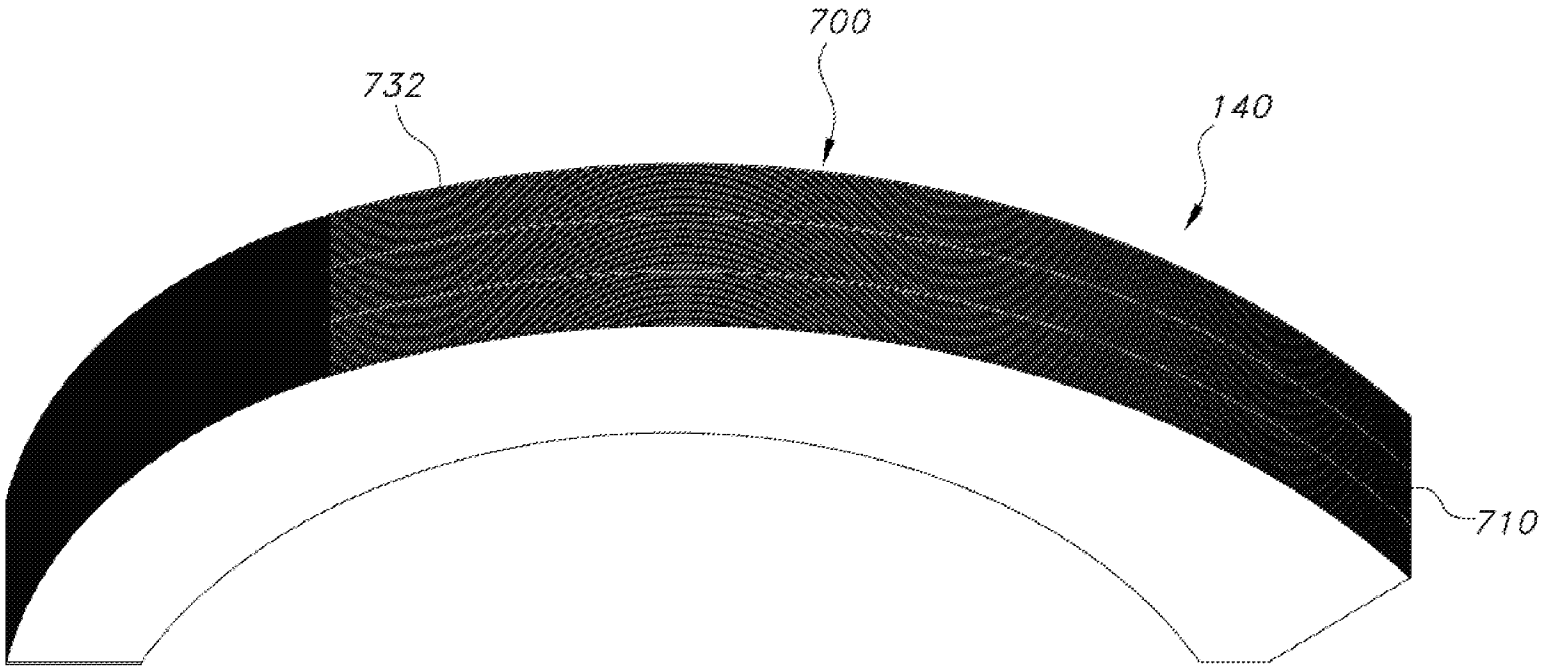
FIGS. 52, 53, and 54 are diagrammatic views of embodiments of helmets depicting a progression of moving the helmet to its operational or expanded condition to reveal a logo or other predetermined graphic or the like formed on a honeycomb matrix in accordance with the present disclosure.

FIGS. 52, 53 and 54 depict an embodiment of a helmet 700 that includes one or more regions 702 for branding or depicting a graphic such as for a logo or other marketing indicia. One or more of the regions 702 may be disposed on a segment 710 having the structural cells 160 of the honeycomb matrix 130. The segment 710 may move between the collapsed or folded condition 140 and the expanded condition 142. In some embodiments, while the helmet 700 is in the expanded condition 142, the segment 710 may be configured to display a portion of advertising, a graphic, text, or the like 720 on an outer surface 730 that defines an exterior curvature 732 of the segment 710. In some embodiments, while the helmet is in the collapsed or folded condition 140, the segment 710 may be configured to reduce the visibility of the portion of advertising, a graphic, text, or the like 720 on the outer surface 730 that defines the exterior curvature 732 of the segment 710. The segment 710 may be further configured to reveal the portion of advertising, a graphic, text, or the like 720 on the outer surface 730 as the segment 710 moves from the collapsed or folded condition 140 to the expanded condition 142. In some embodiments, the portion of advertising 720 may include a trademark 740. In some embodiments, the portion of advertising may include an intended indicator of source. In some embodiments, the portion of advertising 720 may include artwork for which a license is obtained to produce the artwork on each of the helmets 700. In some embodiments, the portion of advertising 720 may be associated with one or more of the helmet dispensing systems 450.

In some embodiments, the advertising 720 may be printed onto the outer surface 730 of the honeycomb matrix of the segment 710 to be visible when the segment 710 is in its expanded condition 142. In some embodiments, the advertising 720 may be viewed from a position that permits viewing more easily or exclusively from a left or right side of the segment 710. In some embodiments, the printing of the advertising 720 onto the outer surface 730 permits viewing at least partially of the advertising 720 when the helmet 700 is in its collapsed or folded condition 140. In some embodiments, the printing of the advertising 720 onto the outer surface 730 is configured to not be discernable when the helmet 700 is in its collapsed or folded condition 140.

In some embodiments, the advertising 720 is applied using any known technique including, without limitation, printing, silk screening, laser etching, chemical etching, embossing, mechanical etching, sublimation, and/or the like. The graphic, logo and/or the like may be applied as part of a manufacturing step, such as applying a coating to the honeycomb matrix 130, such as to improve water repellency and/or the like. The advertising 720 is added to the honeycomb matrix walls before assembly so that relevant portions of the advertising 720 is present on the structural cells 160 of the honeycomb matrix 130. In some embodiments, the advertising 720 may be added to the helmet 700 at the time it is dispensed. By way of these examples, information may be printed on the helmet 700 to facilitate a recipient of the dispensed helmet accessing information such as online content, a prize, or the like as a benefit for using the helmet. The information may include codes (e.g., a 2D barcode, batch and inventory numbers, retail price information, package information, or the like) or prize information (e.g., a URL, a QR code, or the like). In this way, the costs associated with making, vending, and recycling the helmet may be shared with a sponsor, an advertiser, a philanthropic partner, or the like in exchange for an opportunity to interact through the code or prize information provided to the user 110 of the helmet 700.

FIGS. 55 and 56 illustrate a helmet 800 that includes one or more light mechanisms 802 that are capable of emitting light 804. The one or more light mechanisms 802 may include one or more safety lights, such as safety lights 810, 812, 814 each disposed on at least one of a front, a back, and sides of the helmet 800. In some embodiments, the one or more light mechanisms 802 are connected to the helmet 800 and are configured to provide illumination when the helmet 800 is opened to its expanded condition. In some embodiments, the one or more light mechanisms 802 are connected to the helmet 800 and configured as a use indicator mechanism that may be configured to switch on illumination when the helmet 800 is opened to its expanded condition 142 and is also configured so that when one illumination is activated it is also an indicator that the helmet 800 has been used.

In embodiments, each of the light mechanisms 802 on the helmet 800 is self-powered. By way of these examples, each of the light mechanisms 802 includes a small cell battery and/or the like and may automatically activate when the helmet is no longer folded, such as upon expanding of the helmet to its expanded condition 142. In some embodiments, a mechanical or proximity type switch (e.g., Hall effect) may be used to detect a portion of the helmet in a condition in which it is no longer in its collapsed or folded condition 140 including moving the helmet 800 to the expanded condition 142. In some embodiments, a mechanical switch is disposed so that the switch disrupts a flow of energy (e.g., from a battery) to the one or more light mechanisms 802, and may provide an indication of when the helmet 800 is in its collapsed or folded condition 140. The mechanical switch may be forced into an energy disrupting position by coming into contact with a portion of the helmet, such as the wall of a honeycomb when the honeycomb is folded.

In some embodiments, when activated, the one or more light mechanisms 802 are configured to sense ambient light and may optionally turn on or off to achieve an acceptable level of illumination based on an amount of the ambient light sensed. In some embodiments, one or more of the helmet safety lights 810, 812, 814 includes a sensor such as the indicator 482 that is configured to detect when the ambient light proximal to the helmet 800 is above a pre-determined threshold, whereupon the helmet safety lights 810, 812, 814 may be configured to turn off, saving energy, and extending the operational life of the energy source. In some embodiments, the one or more light mechanisms 802 and the helmet safety lights 810, 812, 814 include an LED type light for low power consumption; however, other types of lights may be used based on application needs or the like. In embodiments, the one or more light mechanisms 802 and the helmet safety lights 810, 812, 814 may include a battery power source but may also use or integrate solar panels to charge the onboard batteries.

Figure 57:
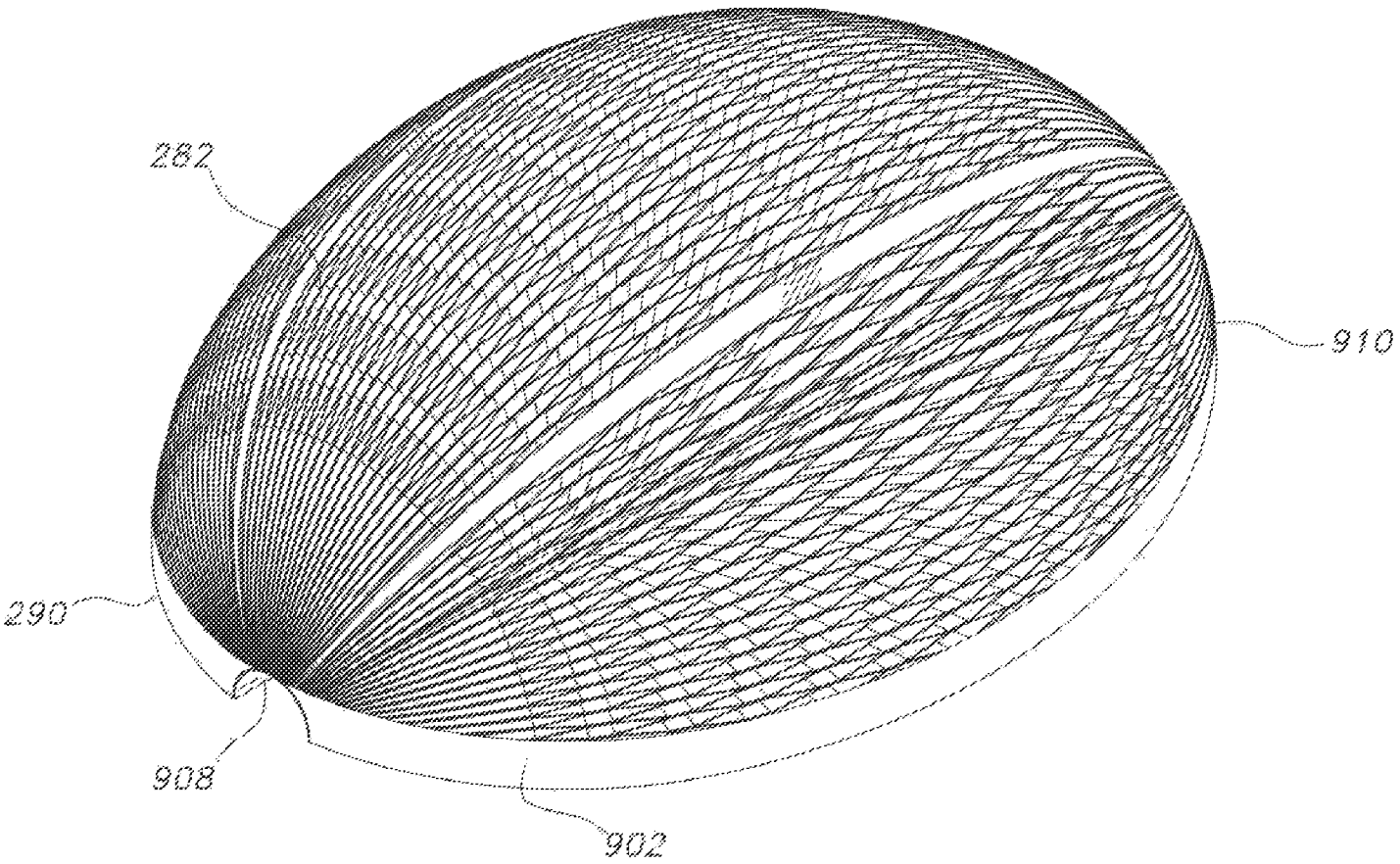
FIGS. 57, 58 and 59 are side, front and bottom views detailing a helmet with solid side frames in an expanded or operational condition in accordance with the present disclosure.
Figure 58:
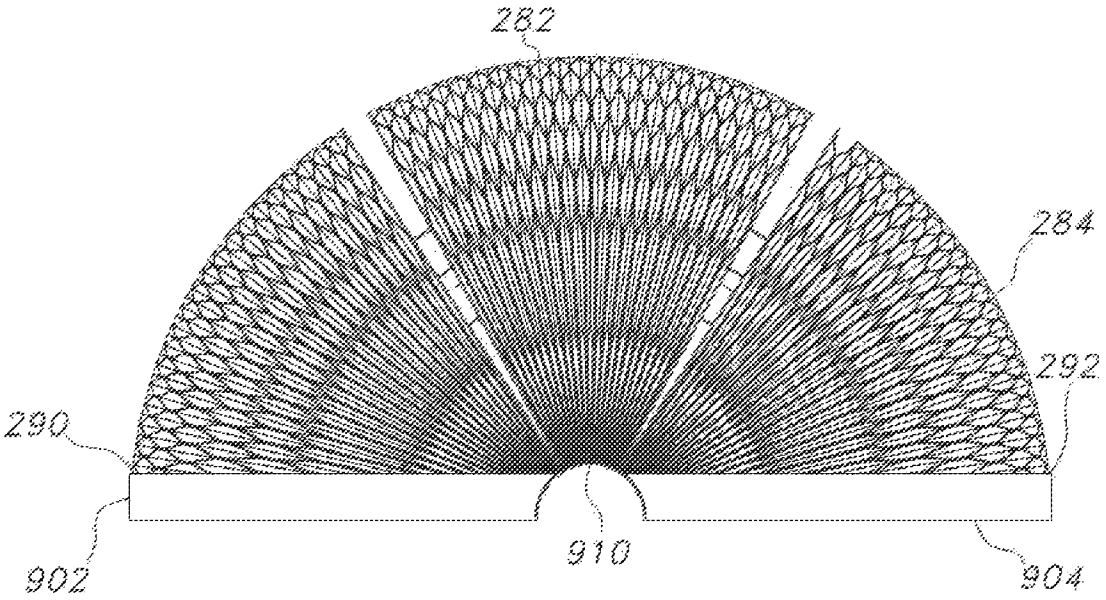
Figure 59:
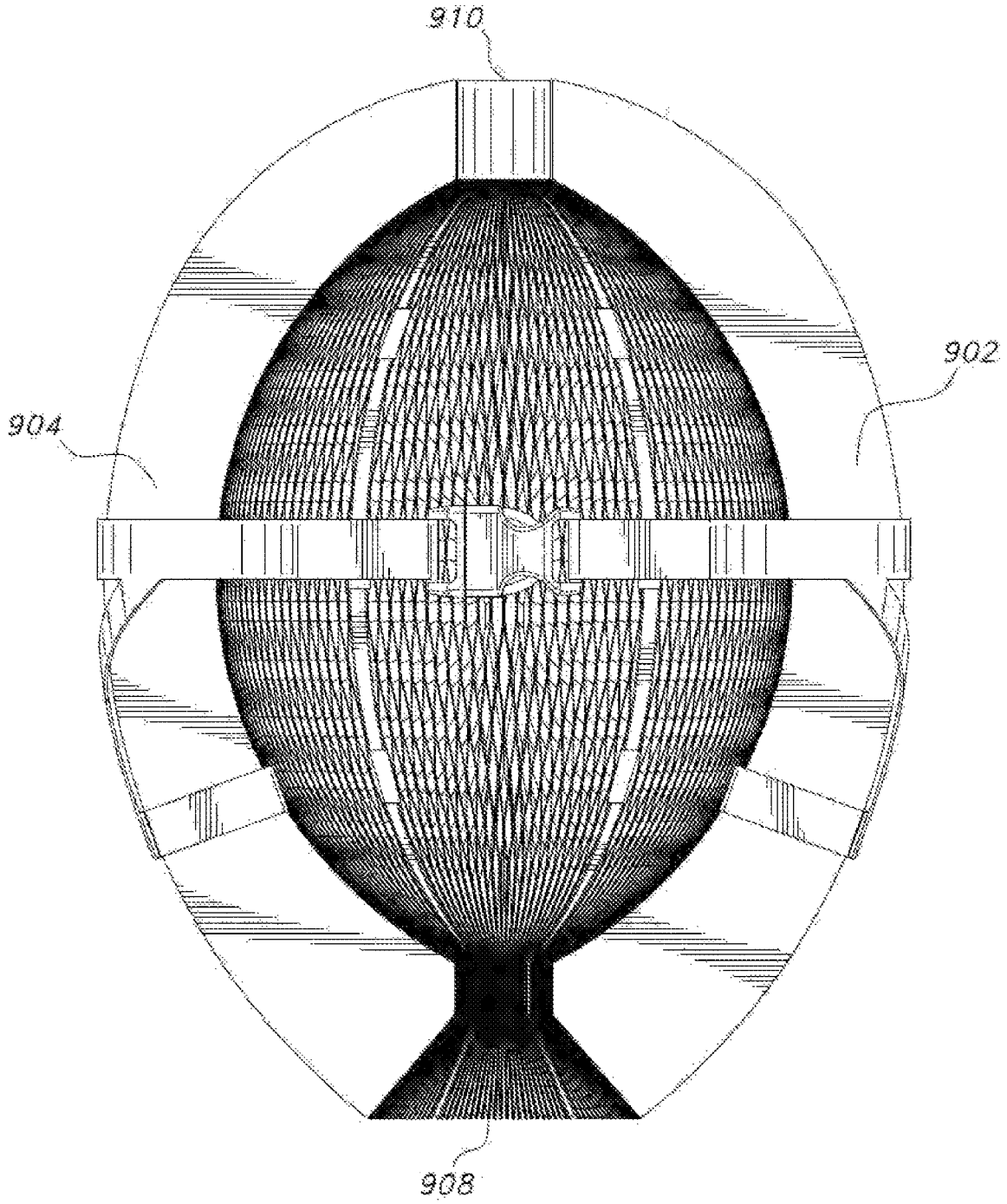

FIGS. 57, 58 and 59 illustrate an embodiment of the helmet 100 including first and second solid side frames 902, 904 attached to first and last layers of the honeycomb matrix 130. The helmet 100 is shown in an open, expanded or operational condition. The solid side frames 902 and 904 provide stability to the helmet 100 and reduce bulk by eliminating, for example, 40-60 layers of the honeycomb matrix 130. Additionally, the solid side frames 902, 904 eliminate any need to weigh down the helmet 100 to remain expanded while atop the head of the user 110 in the expanded condition 142. The first solid side frame 902 is attached to the side segment 282 at an external face 290 and the second solid side frame 904 is attached to the side segment 284 at an external face 292. The solid side frames 902, 904 are connected to each other by a set of hinges 908 and 910. The solid side frames 902, 904 may be made of a rigid plastic material such as a polycarbonate. In some embodiments, the chin strap assembly 200 is connected to each of the solid side frames 902, 904 and the side straps 202 and 208 are configured to be releasably coupled around the head 150 of the user 110.

Figure 60:
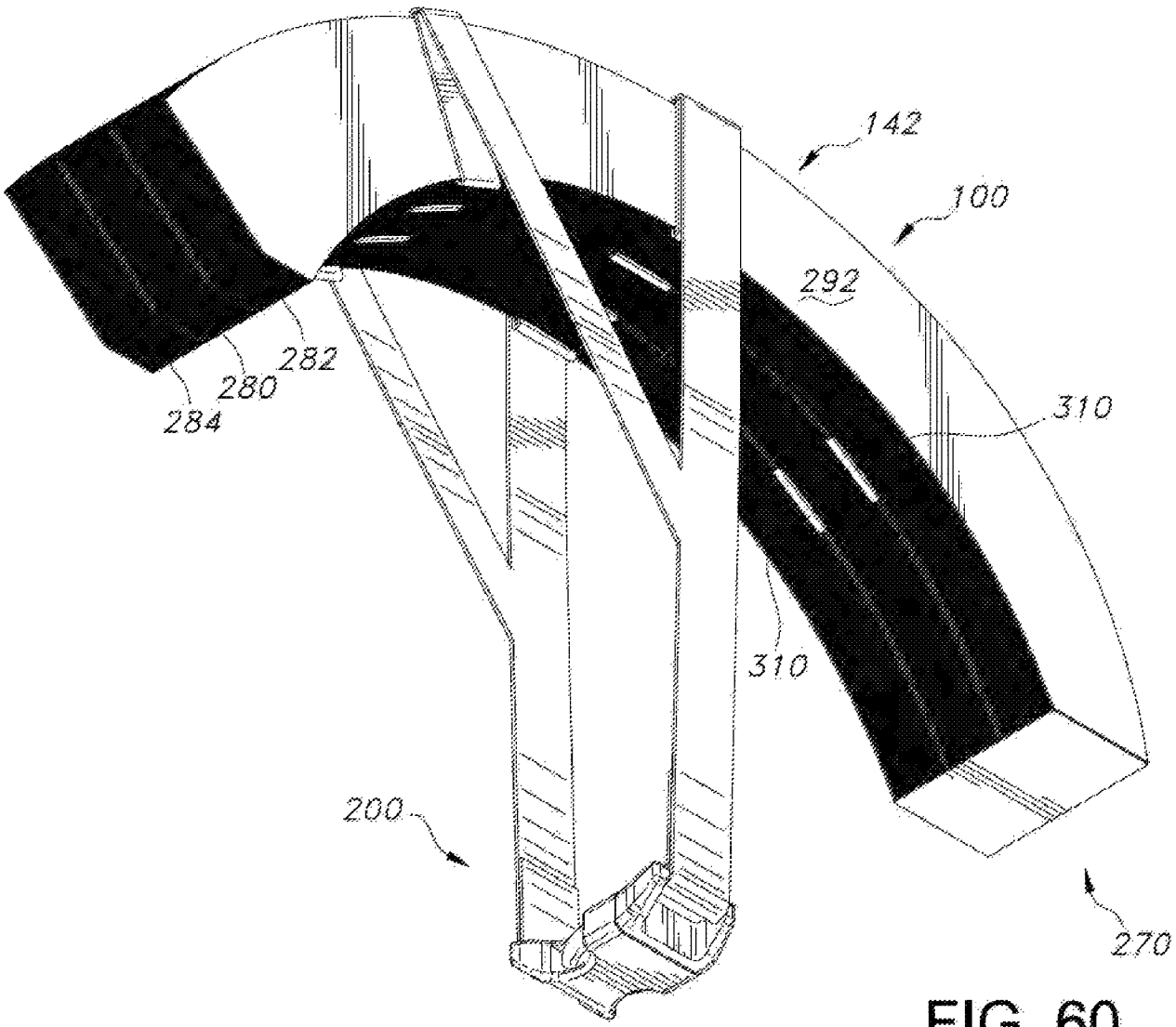
FIGS. 60 and 61 depict side view and top view of the helmet with solid side frames in the closed, folded or collapsed position in accordance with the present disclosure.
Figure 61:
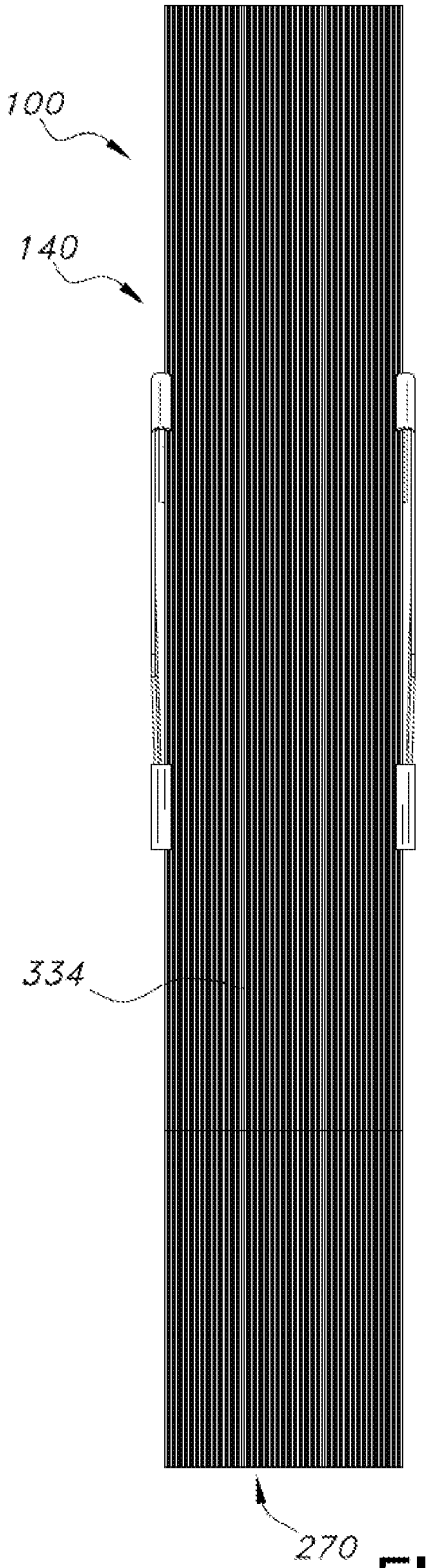

FIGS. 60 and 61 illustrate an embodiment of the helmet 100 including solid side frames 902 and 904 in the collapsed or folded condition 140. While the helmet 100 is in the collapsed or folded condition 140, the external faces 290, 292 as well as the corresponding solid side frames 902, 904 are substantially parallel. The solid side frames 902, 904 add to the structure of the helmet 100 and also may help user 110 grasp the helmet 100 easily when the helmet 100 is in the collapsed or folded condition 140. The hinges 908, 910 include a locking mechanism that holds together the solid side frames 902, 904 and allows for the helmet 100 to move from the collapsed or folded condition 140 to an expanded condition 142.

Figure 63:
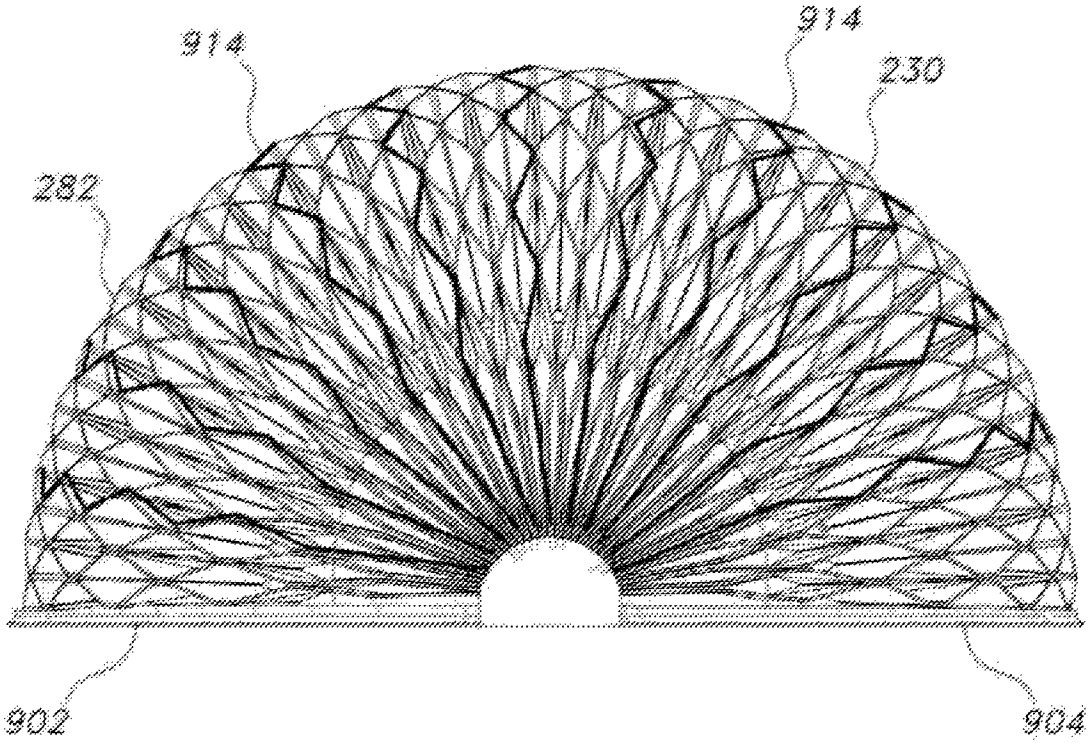
FIGS. 62 and 63 depict perspective views of the helmet with solid side frames in folded and expanded conditions in accordance with the present disclosure.
Figure 62:
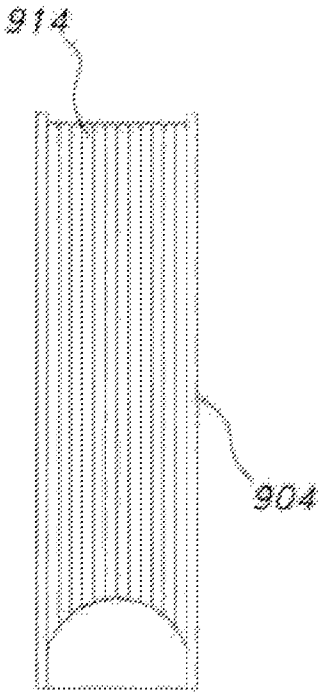

FIGS. 62 and 63 illustrate an embodiment of the helmet with solid side frames in the collapsed or folded condition (FIG. 62) and in expanded condition (FIG. 63), respectively. In some embodiments, the solid side frames 902, 904 define perforations extending through the lengths of the solid side frames 902, 904. In some embodiments, the pattern of the layers of the helmet material 230 may also be arranged to permit the cell structures to collapse or fold and allow the segments to each lay flat laterally while the helmet 100 is in the collapsed or folded condition (FIG. 62). As shown in FIG. 63, in some embodiments, the segments of helmet 100 are held together by a plurality of pipe structures 914 extending over the entire front-to-back length of the helmet. In some embodiments, the pipe structures 914 extend only over a portion of the front-to-back length of the helmet 100. In some embodiments, the pipe structures 914 fit into and are integrated with the honeycomb matrix at a plurality of points. The pipe structures 914 provide structural integrity to the helmet 100 and help with impact resistance. In some embodiments, the pipe structures 914 are made of rubber. In some embodiments, the rubber may be made at least partially of natural rubber, santoprene, polyurethane rubber, neoprene, nitrile, ethylene-propylene and/or the like. In some embodiments, the pipe structures 914 are made of polypropylene. The number of pipe structures 914 and the selection of materials for the pipe structures 914 may be based on considerations like cost, weight, compactness in the collapsed or folded condition and so on.

In some embodiments, the helmet 100 is fabricated using a 3D printing system. The 3D printing system may be provided at a bike-share station for customizing the helmet based on the requirements of the user. Accordingly, in embodiments, the 3D printing system may include a helmet sizing system for measuring the helmet requirements for a user.

Figure 64:
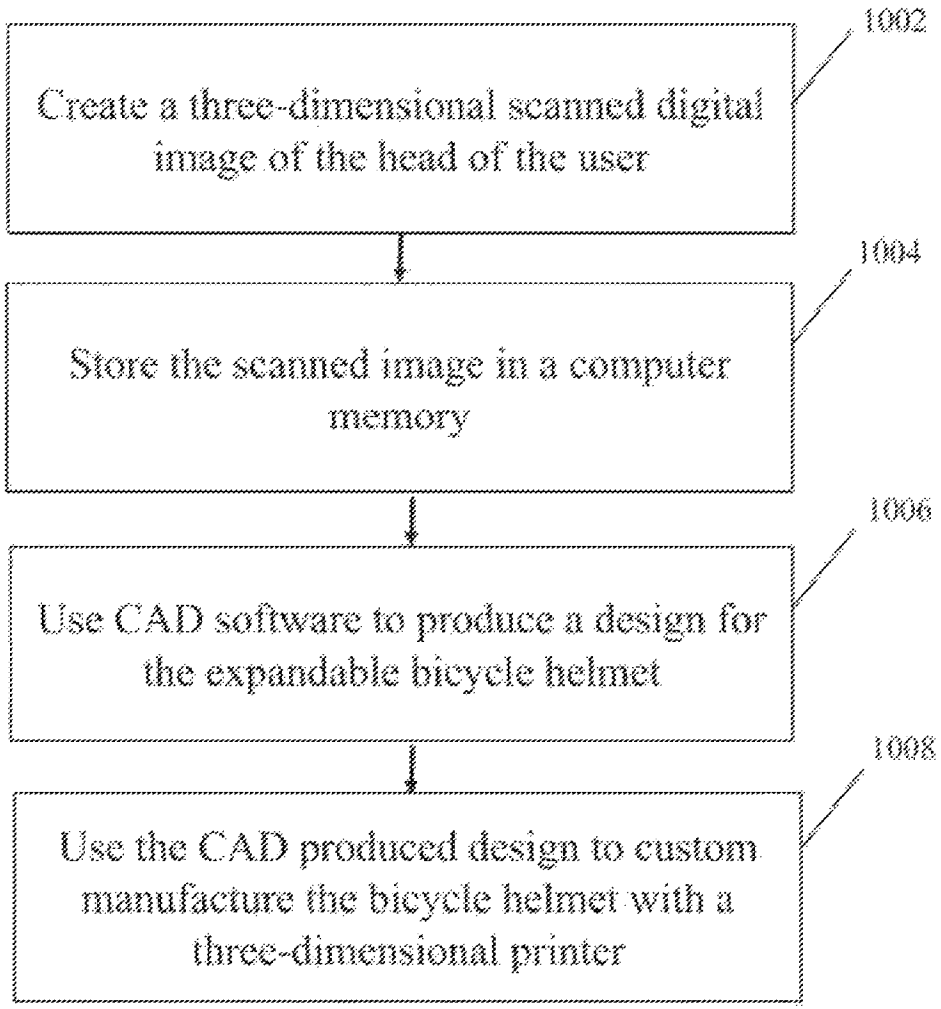
FIG. 64 is a flow diagram details methods for manufacturing an expandable helmet for protecting a head of a user from impact while riding.
Figure 65:
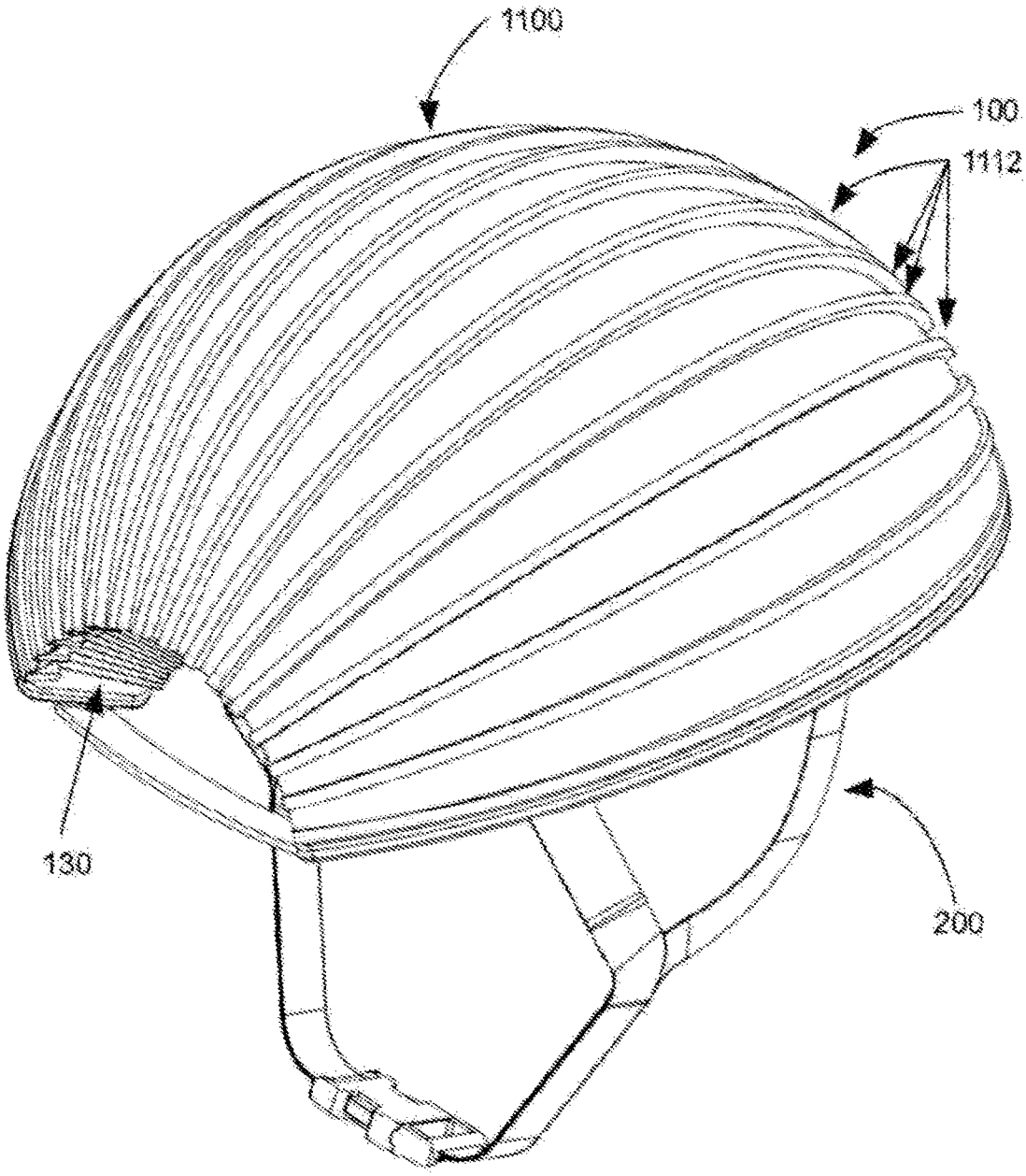
FIG. 65-74 are perspective views of embodiments of the helmet having a rib structure over the cell structure in accordance with the present disclosure.
Figure 66:
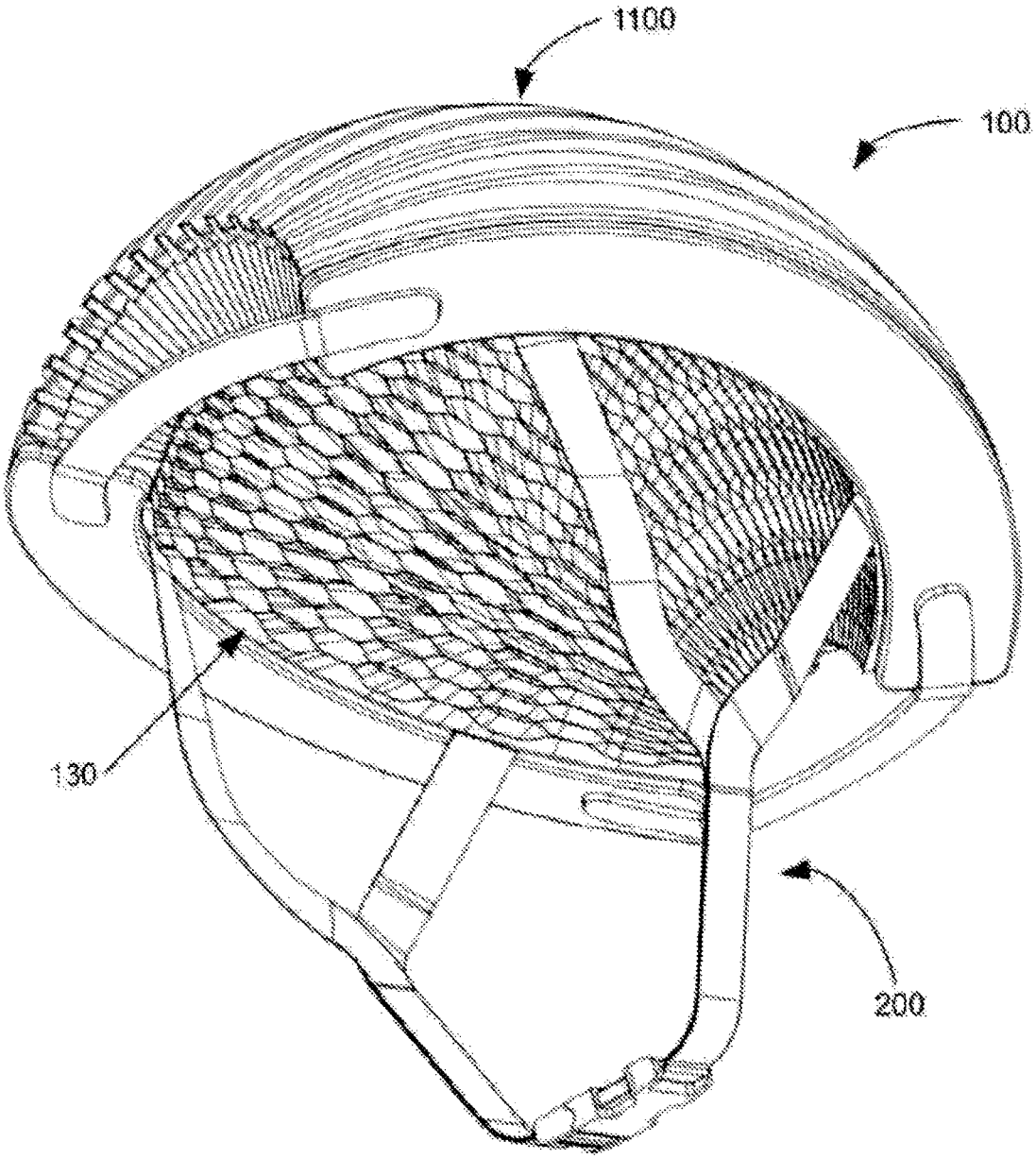
Figure 67:
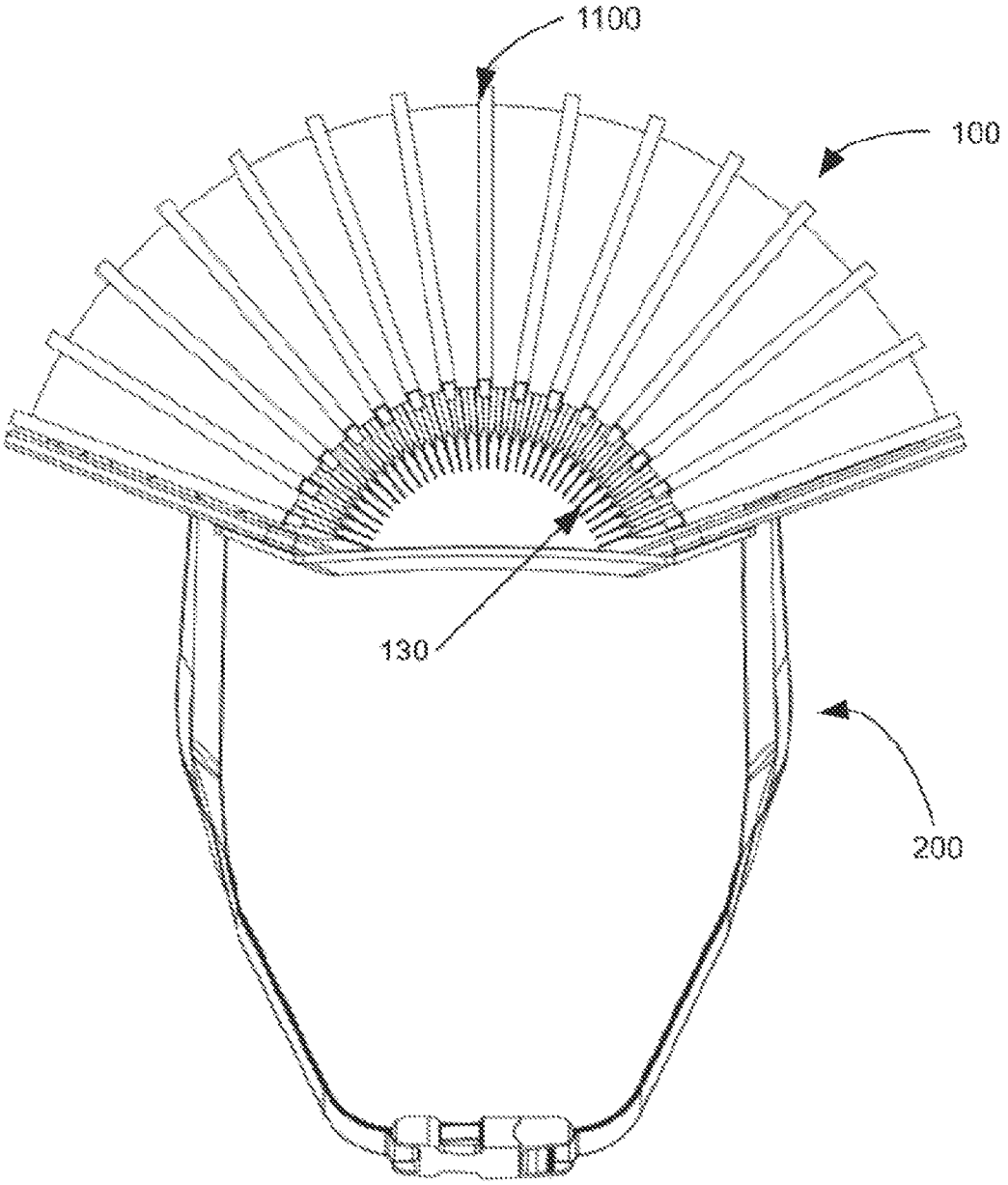
Figure 68:
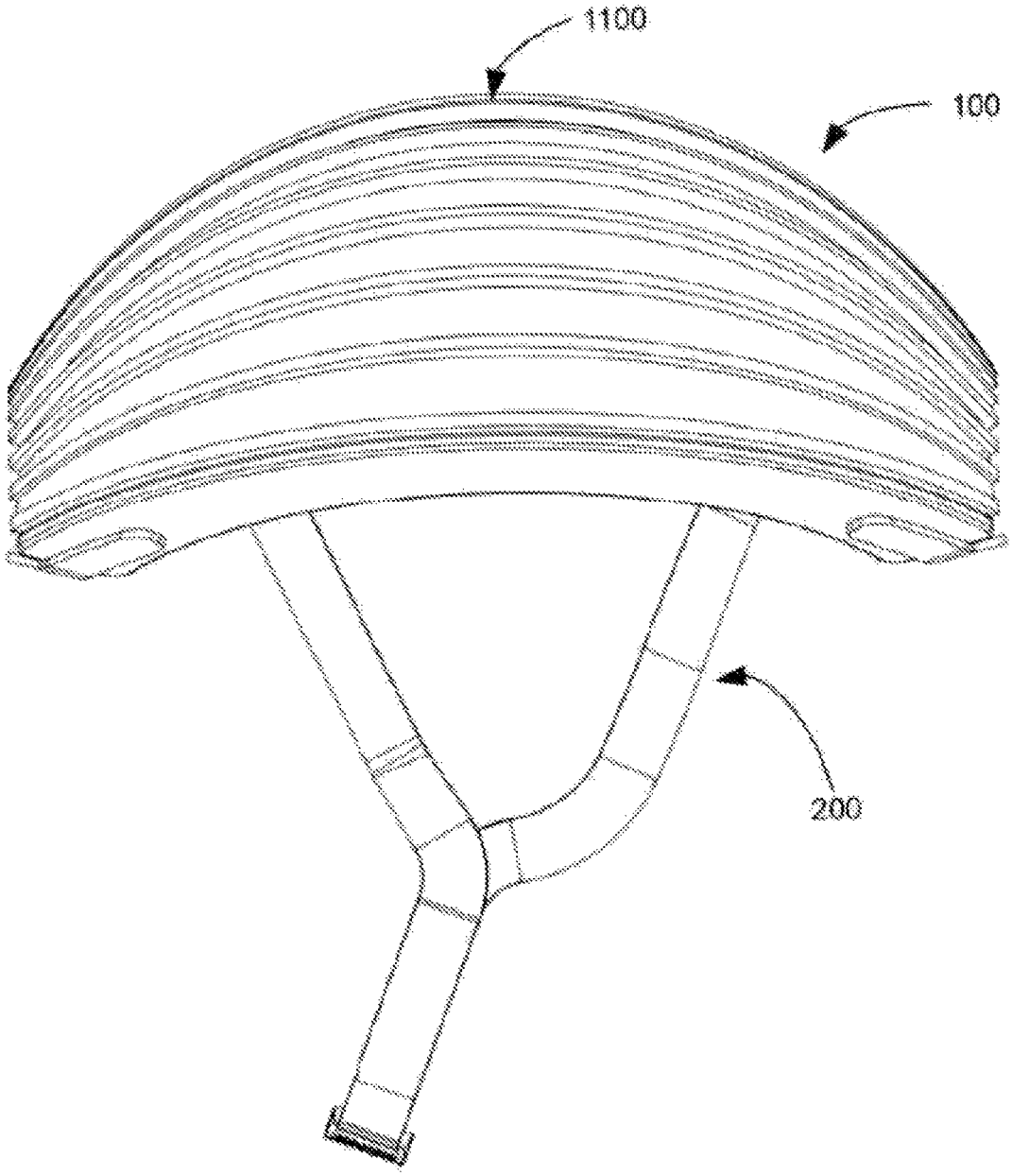
Figure 69:
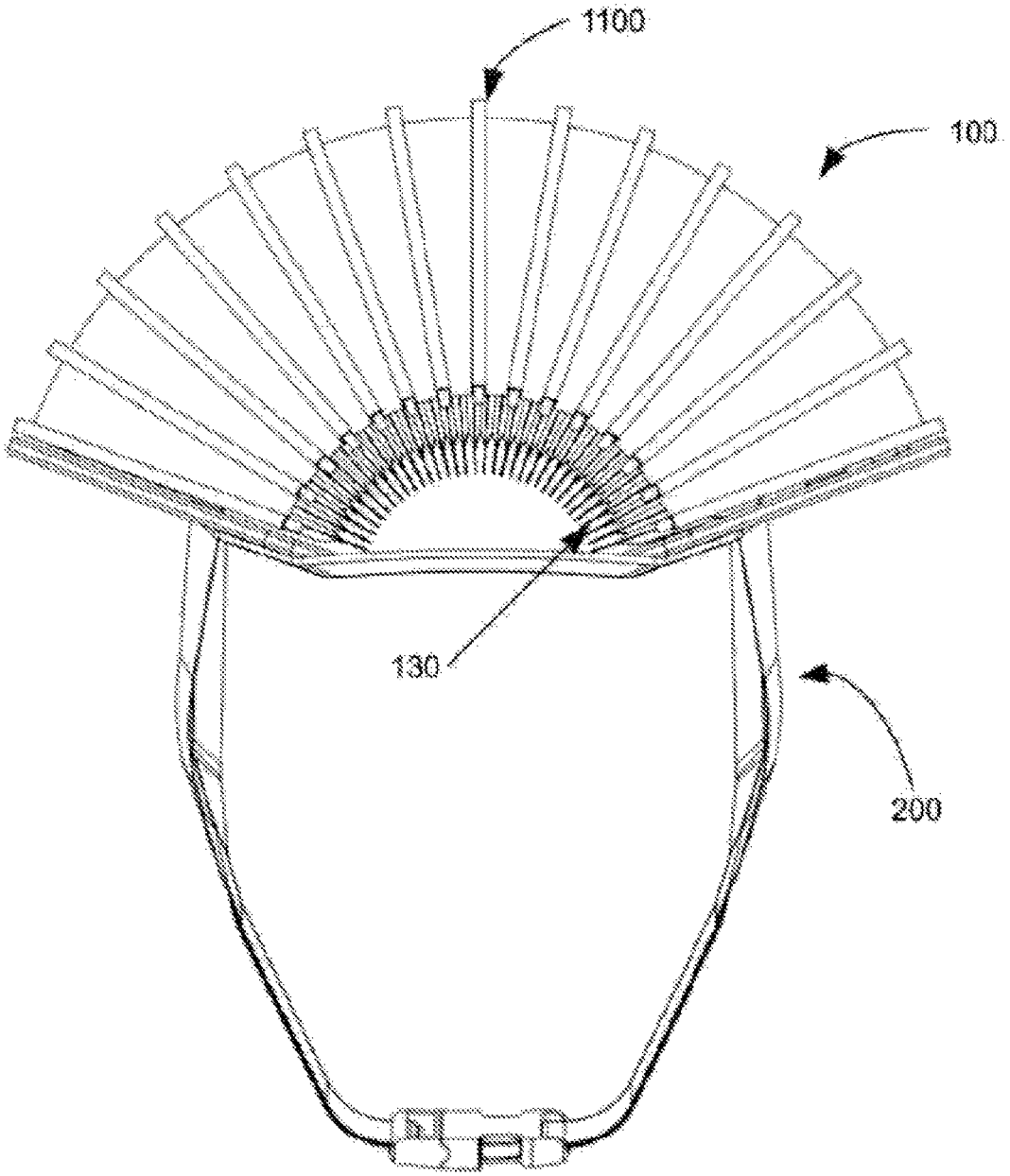
Figure 70:
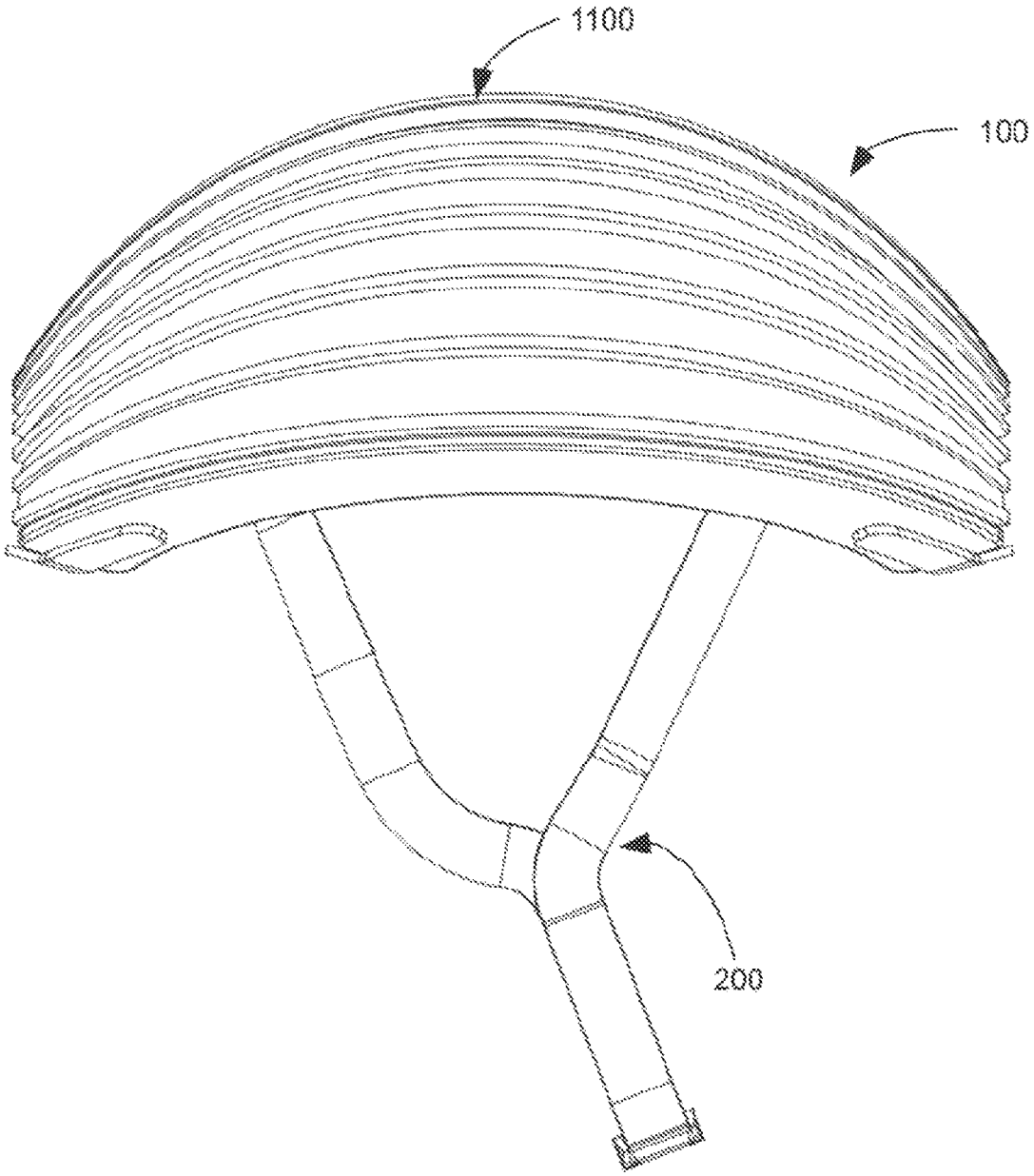
Figure 71:
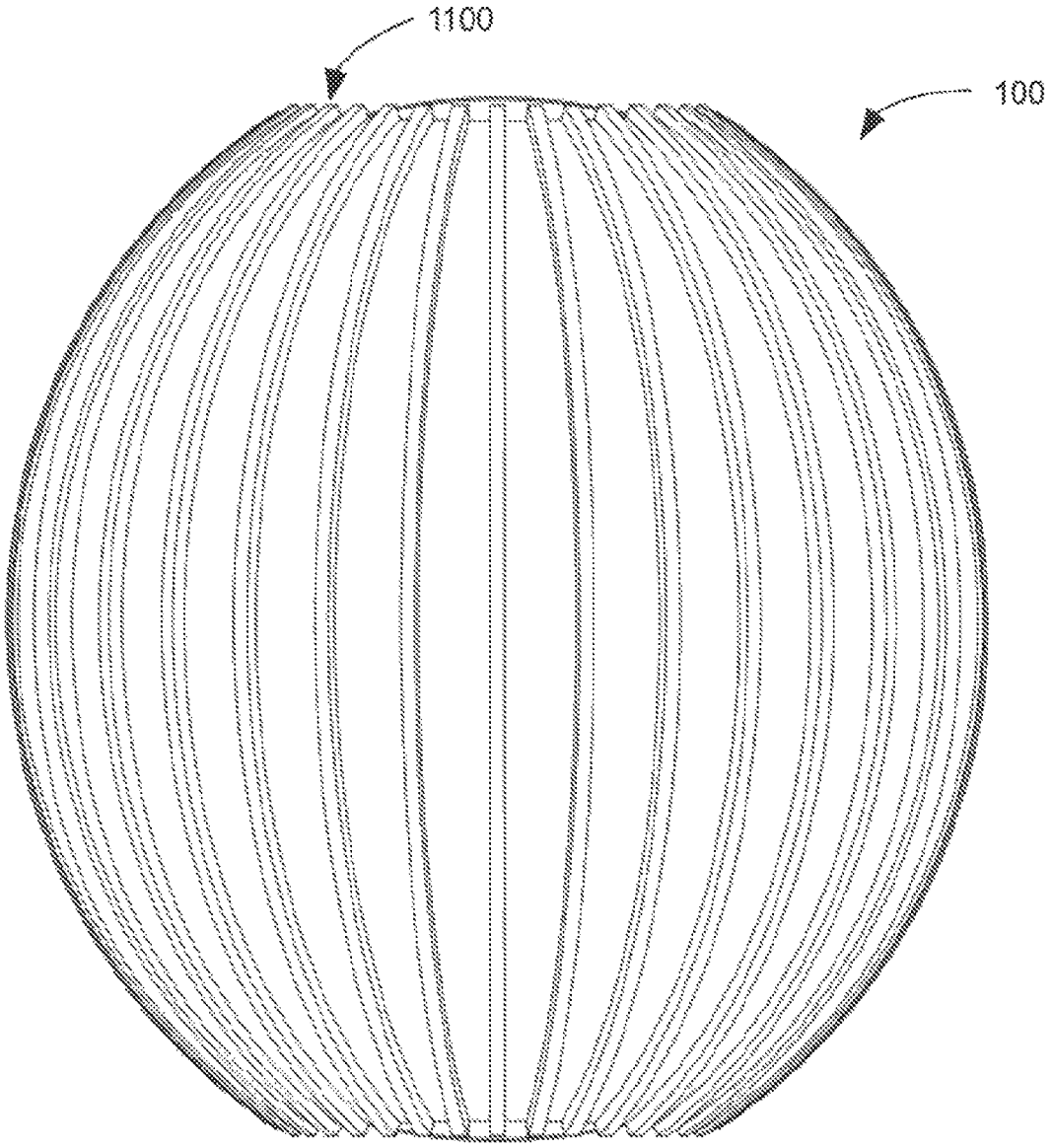
Figure 72:
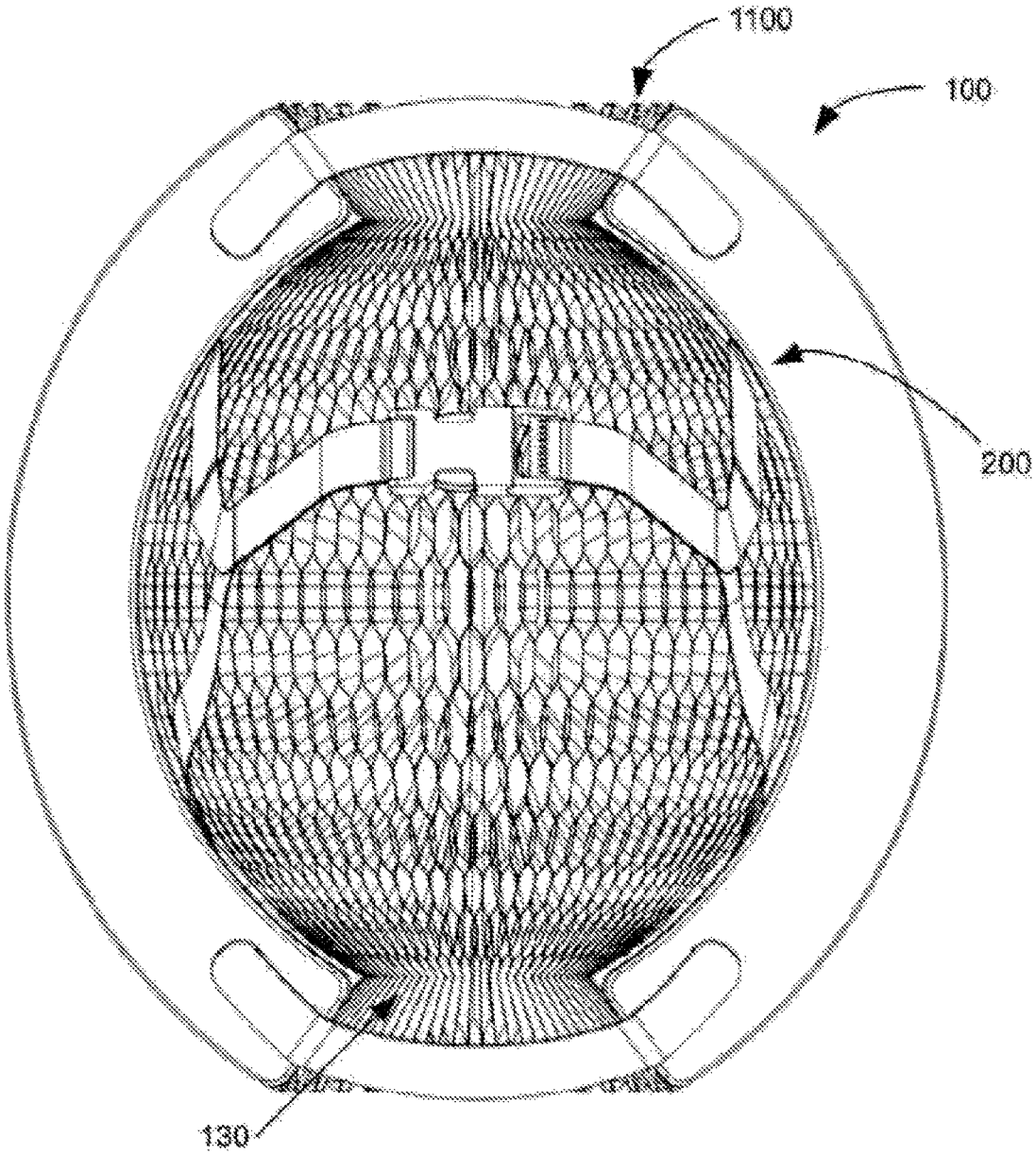
Figure 73:
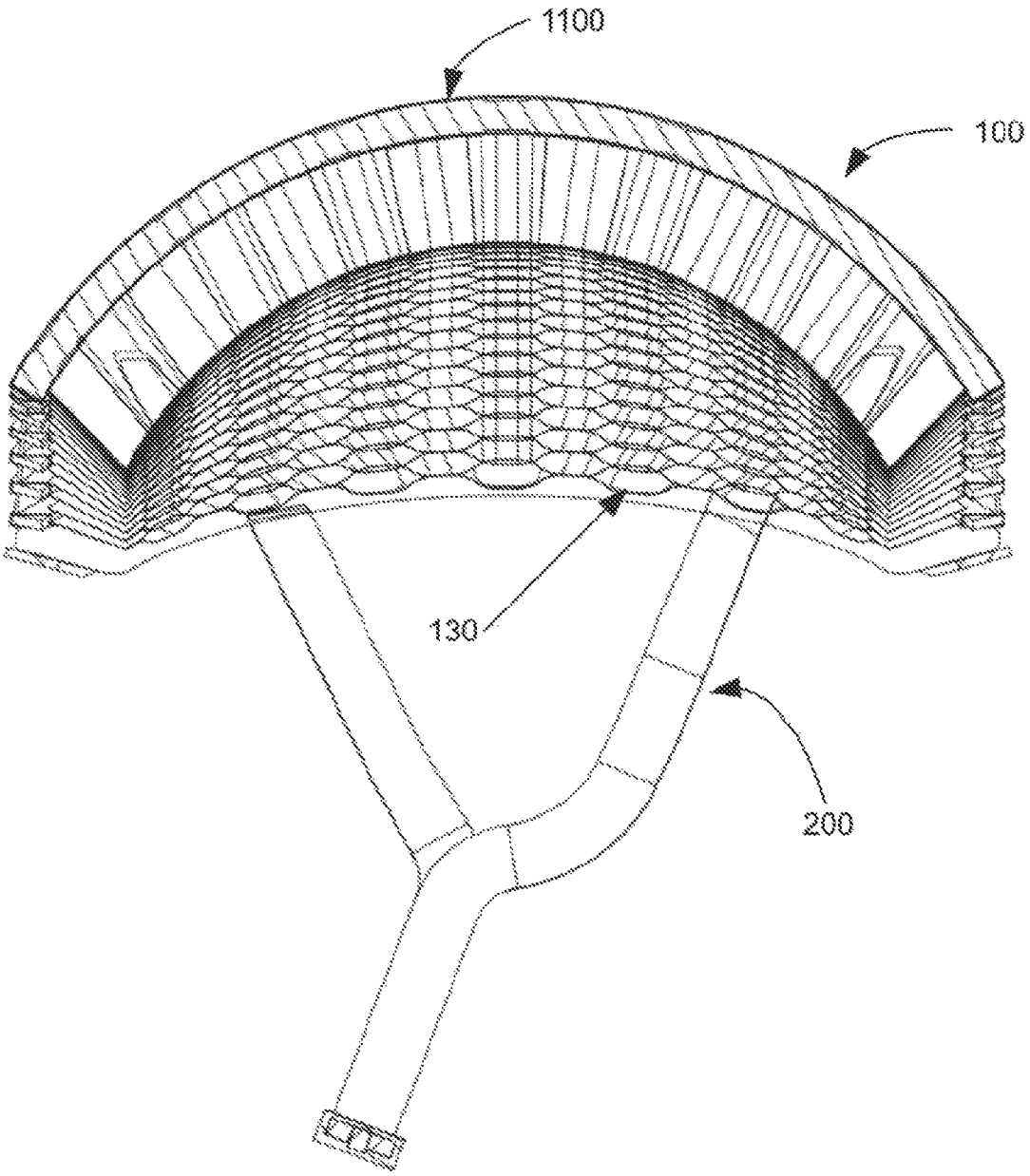
Figure 74:
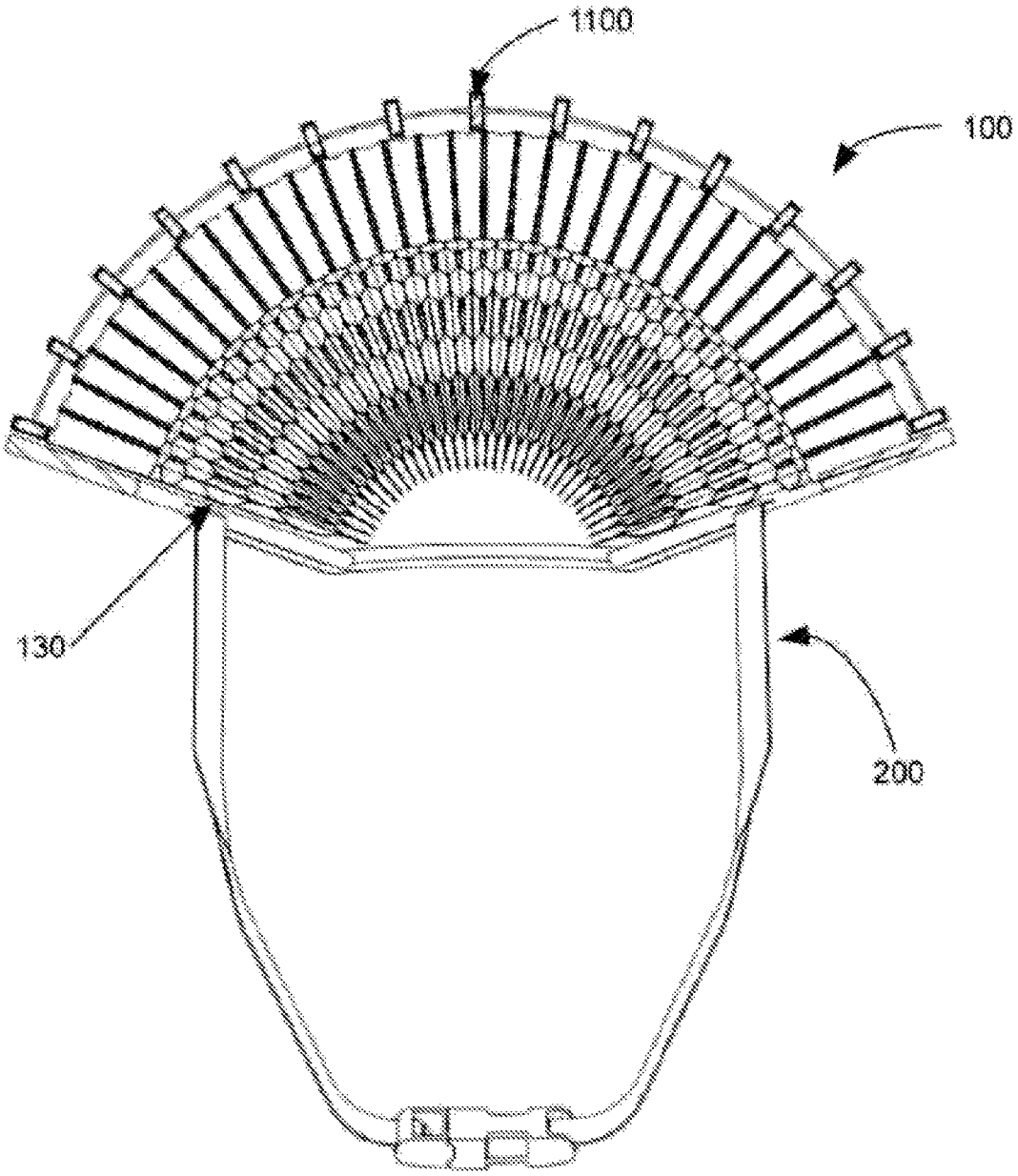
Figure 75A:
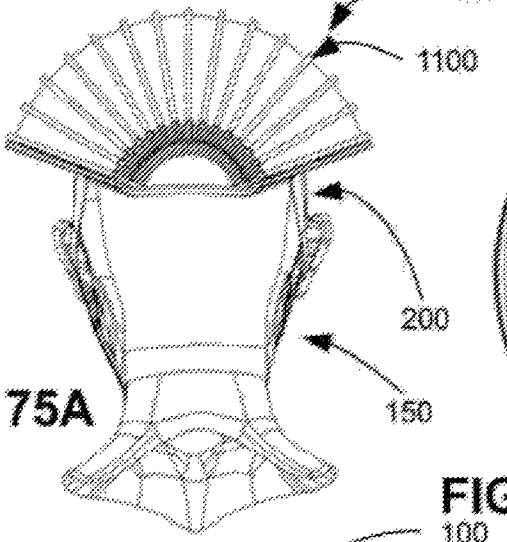
FIGS. 75A, 75B, 75C, 75D, 75E and 75F are multiple views embodiments of the helmet of FIGS. 65-74 on a head of a user in accordance with the present disclosure.
Figure 75B:
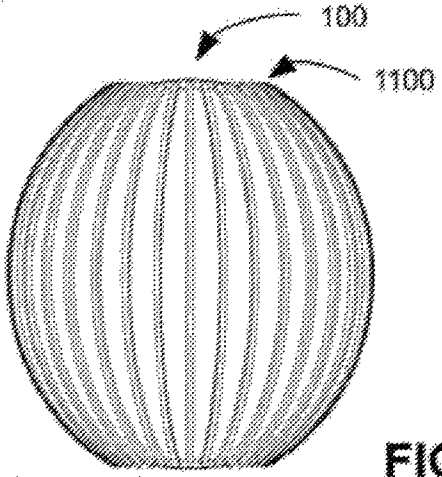
Figure 75C:
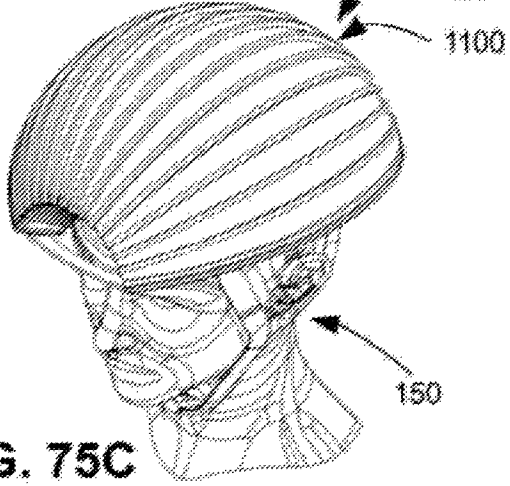
Figure 75D:
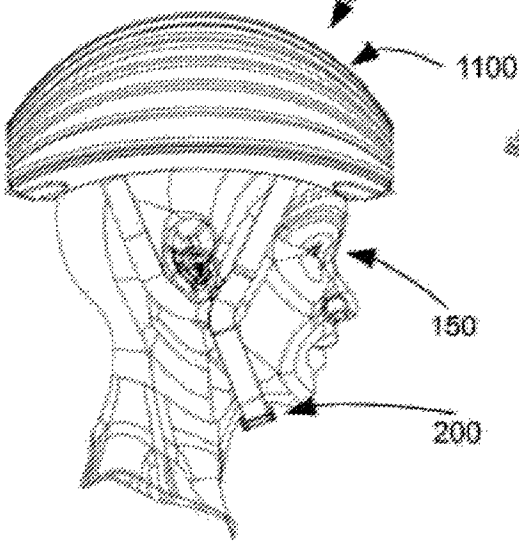
Figure 75E:
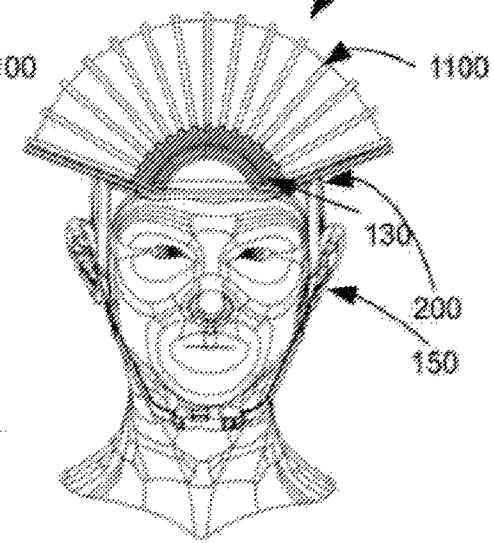
Figure 75F:
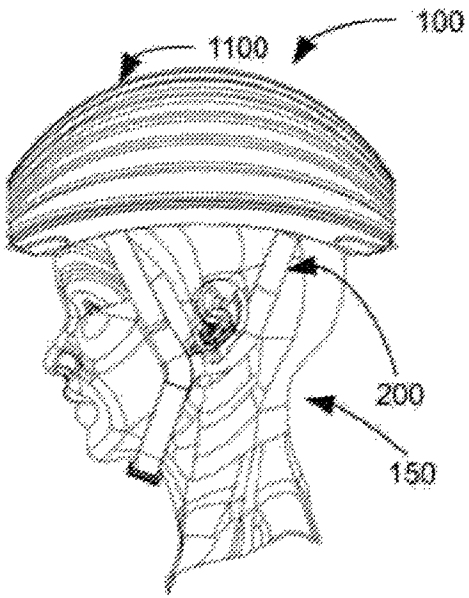
Figure 76:
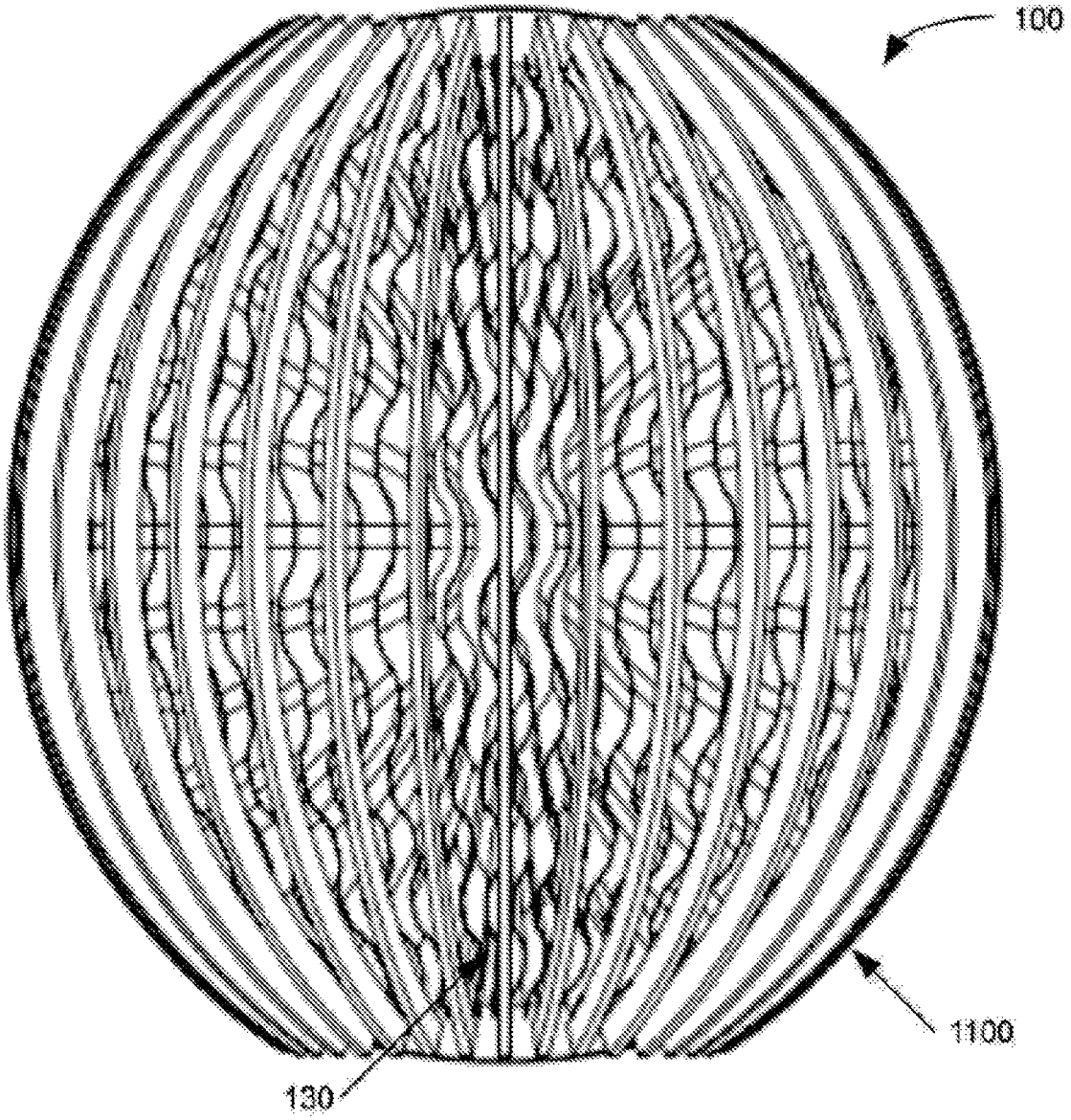
FIG. 76-82 are perspective views of embodiments of the helmet having a rib structure over the cell structure in an operational condition in accordance with the present disclosure.
Figure 77:
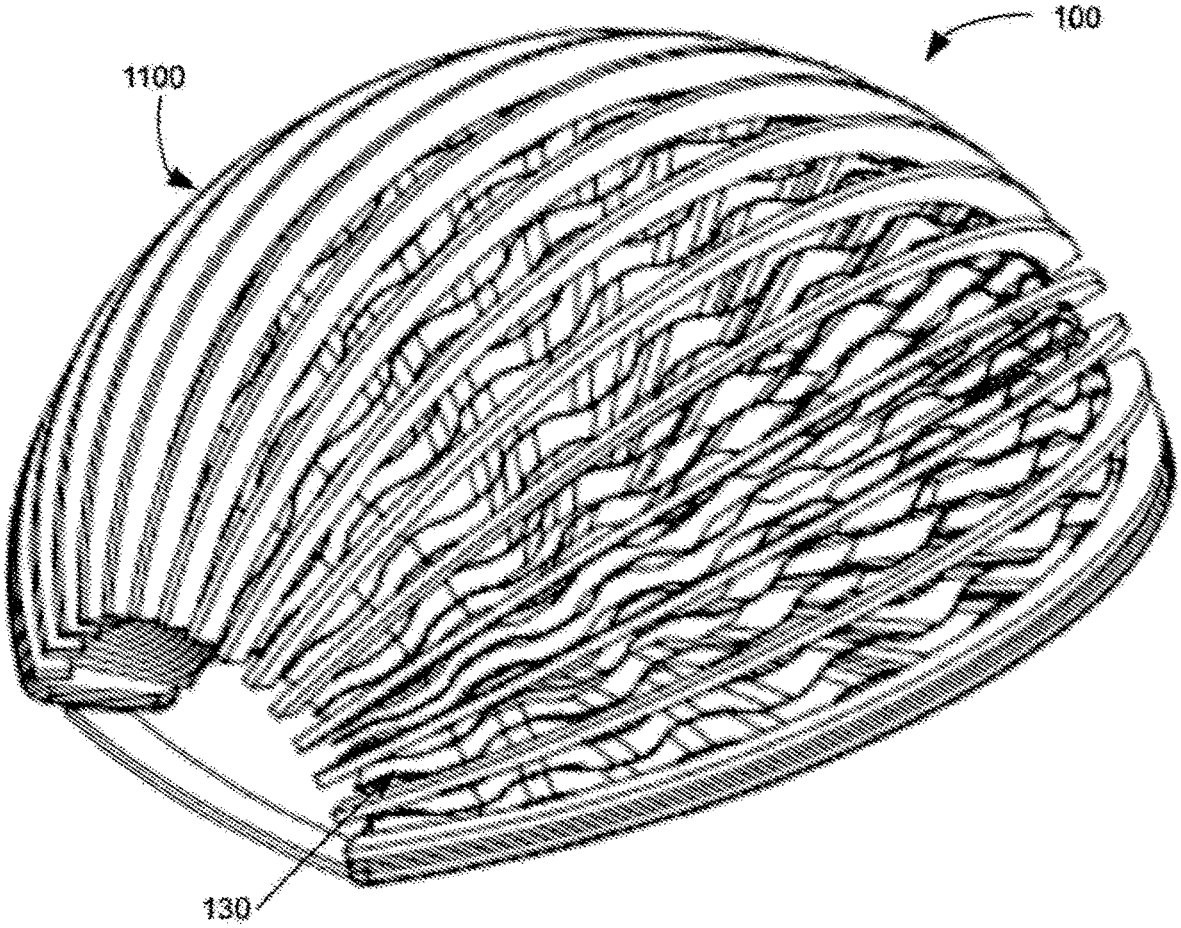
Figure 78:
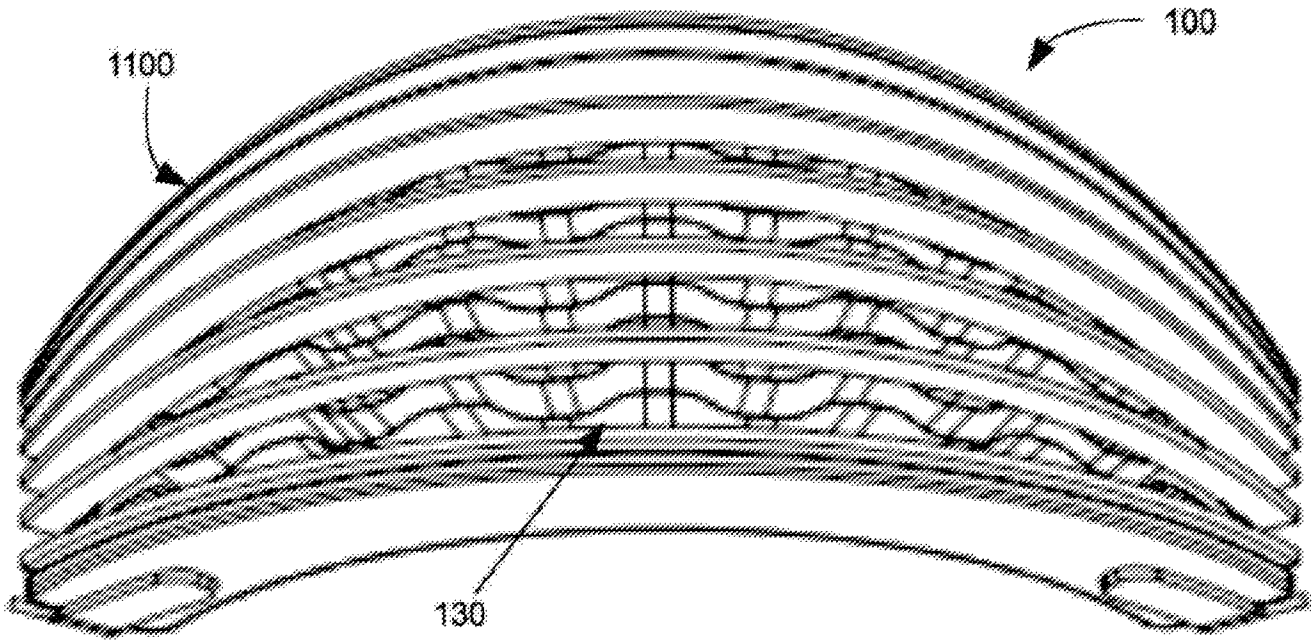
Figure 79:
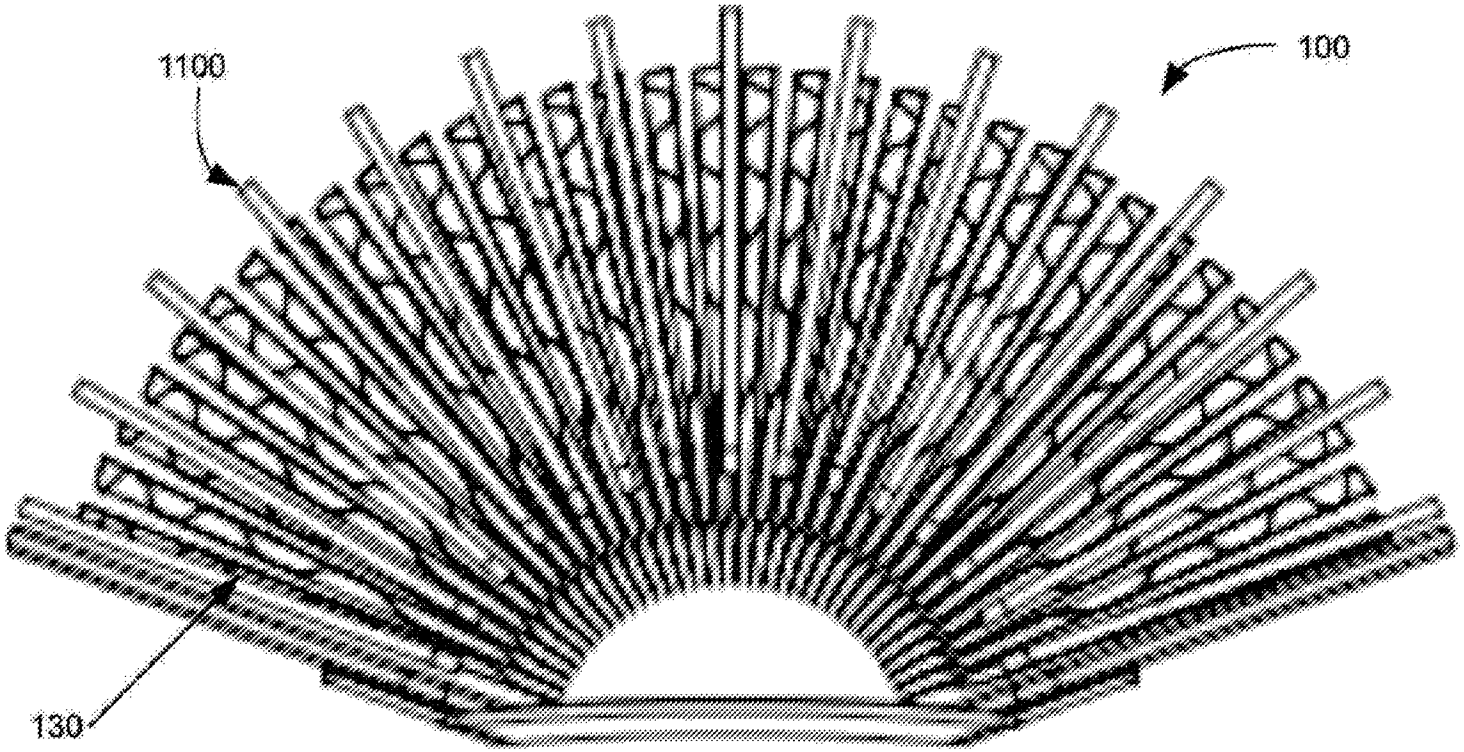
Figure 80:
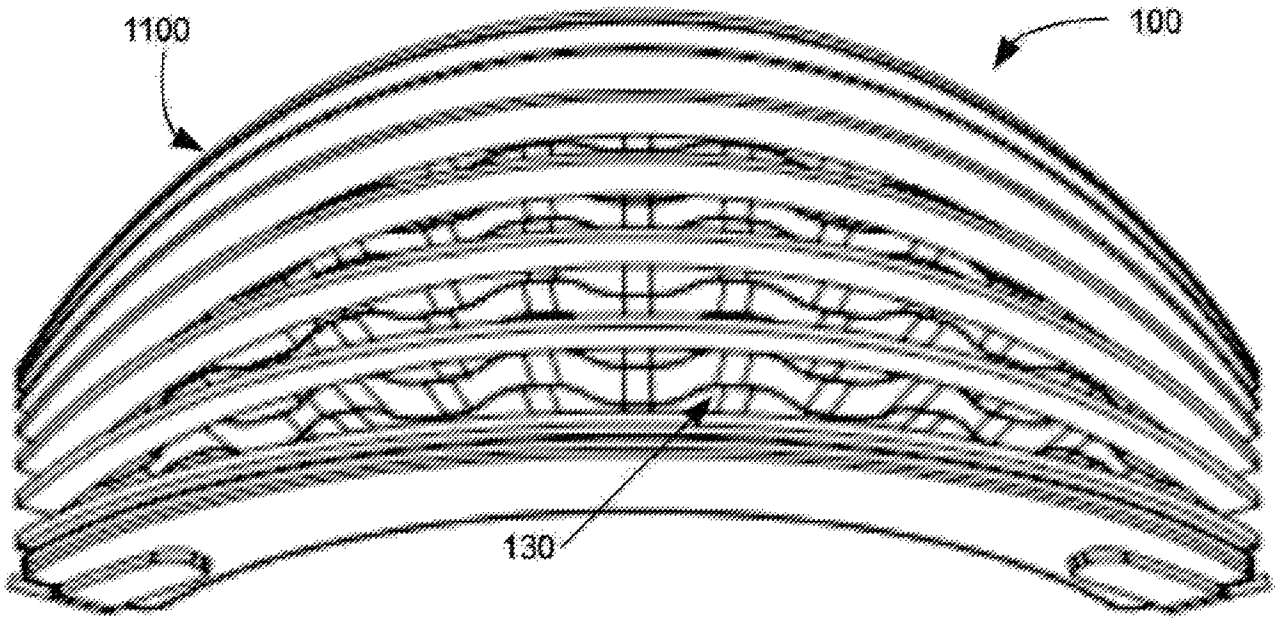
Figure 81:
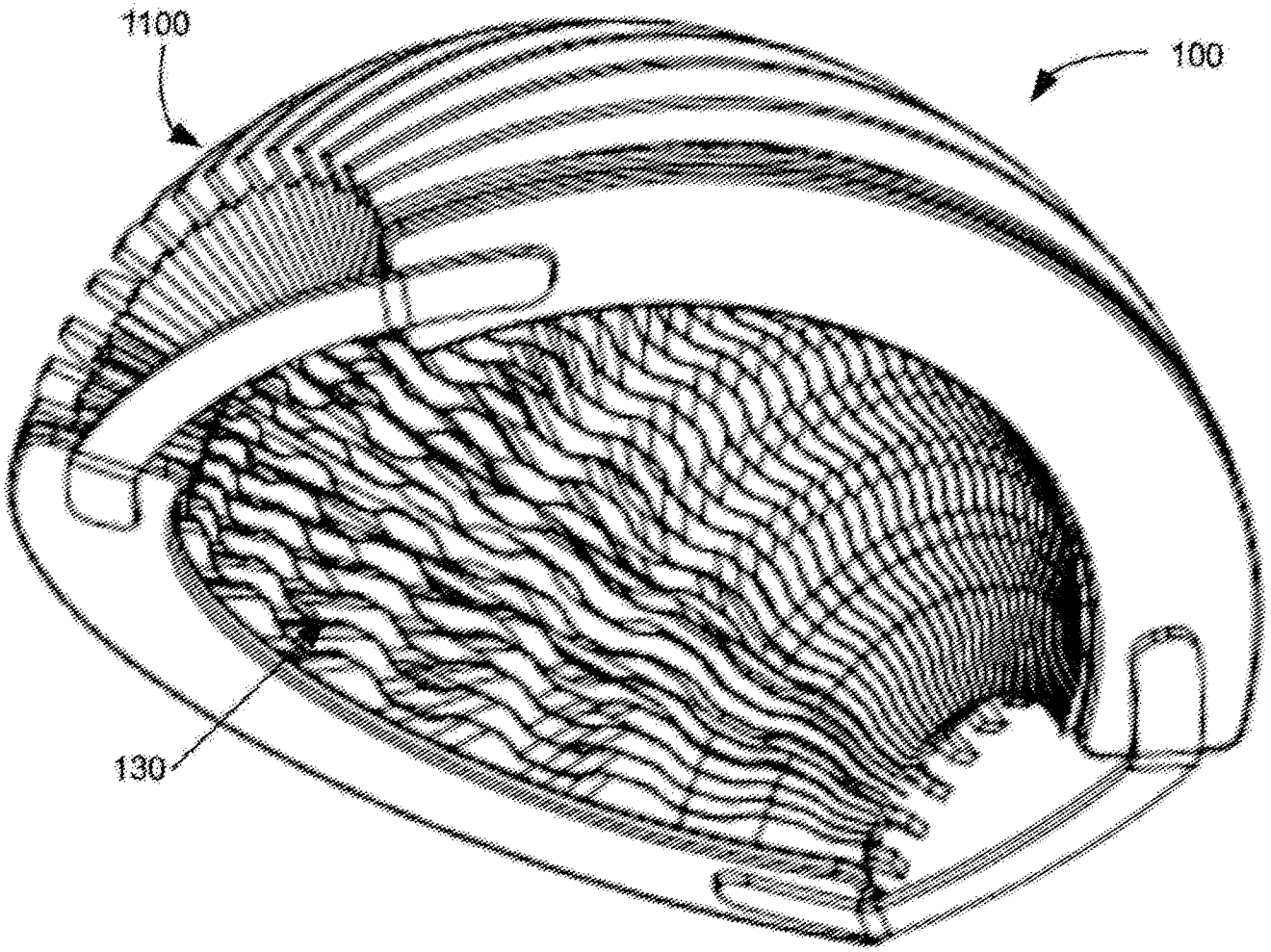
Figure 82:
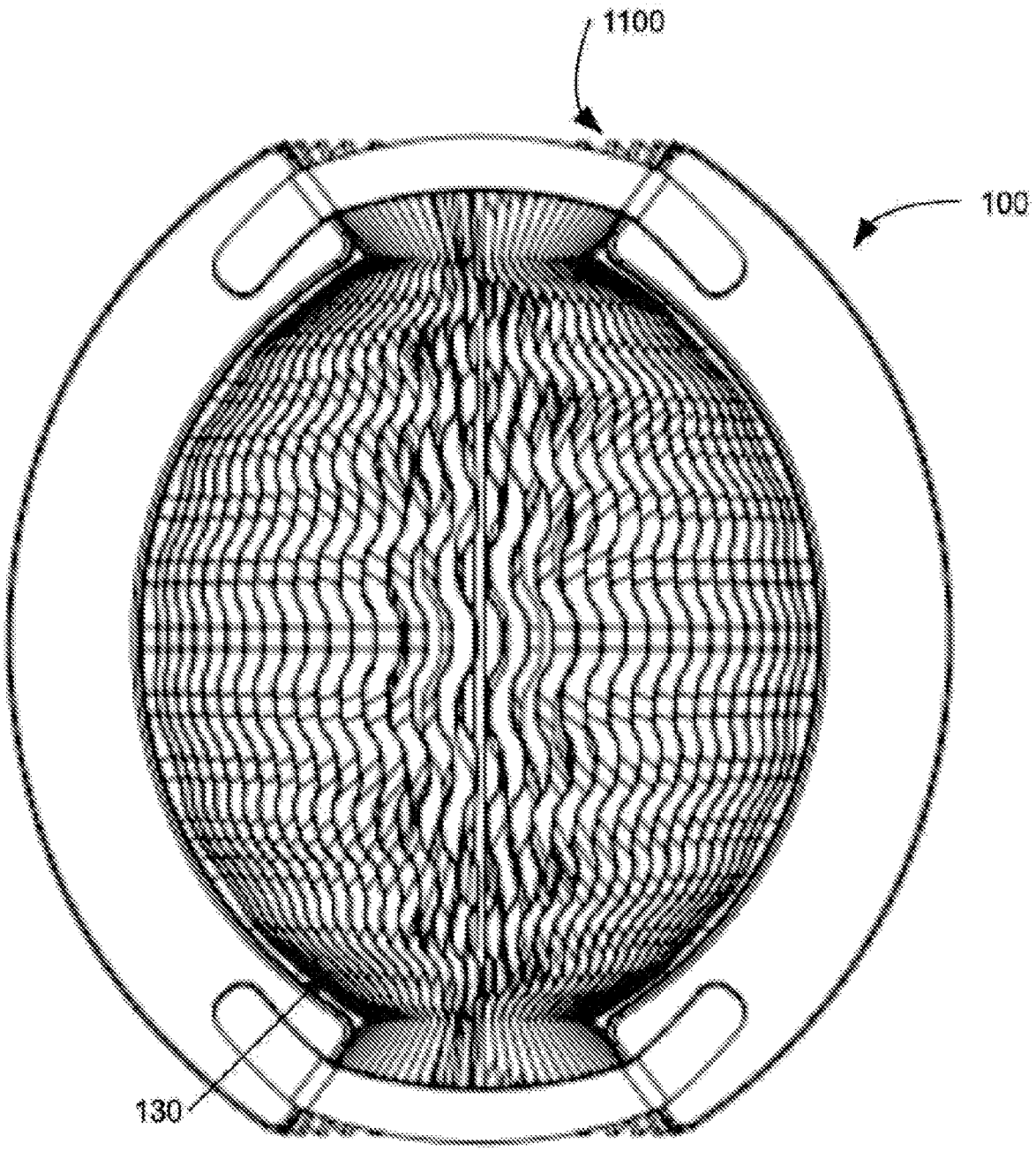
Figure 83:
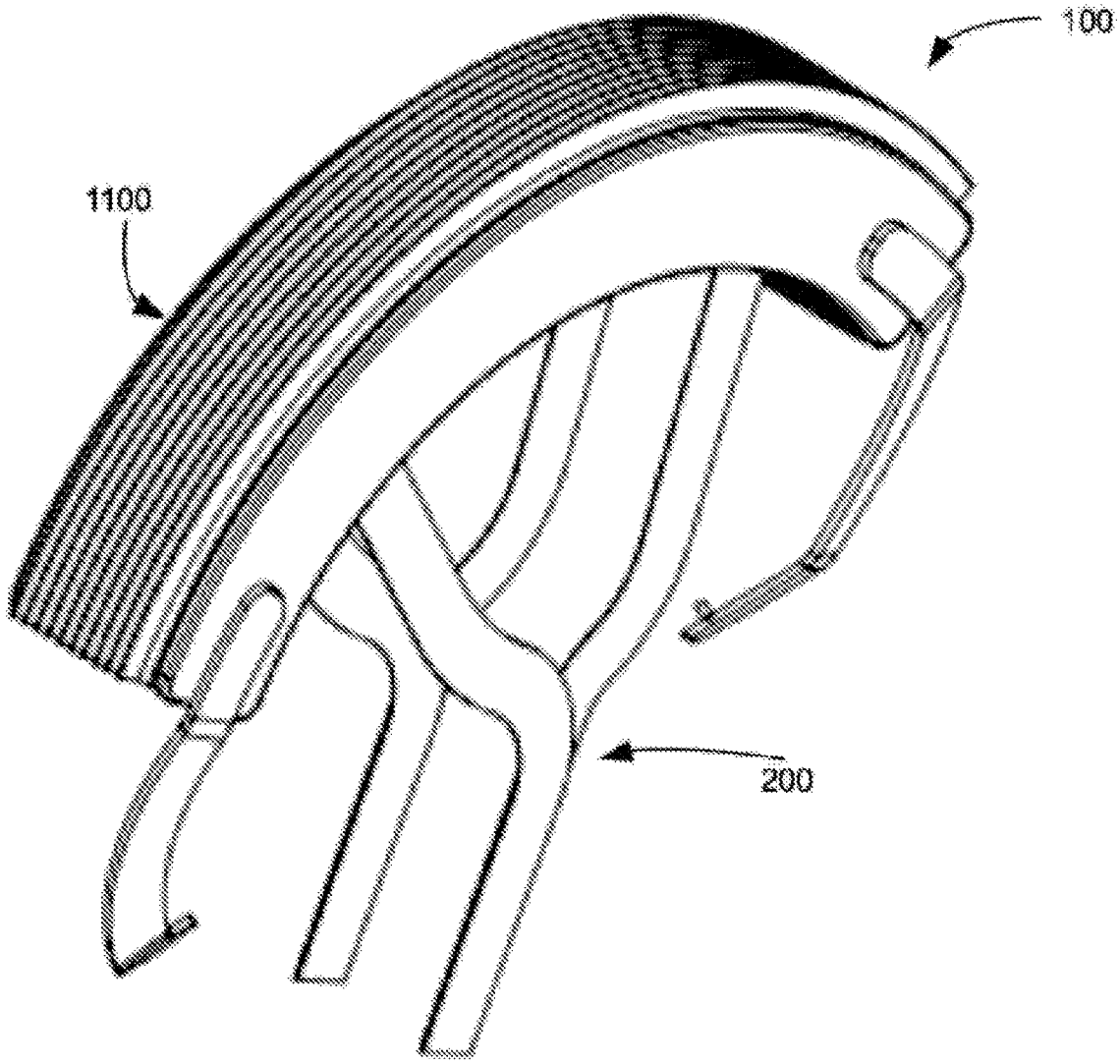
FIGS. 83, 84A, 84B, 84C, 85A, 85B and 85C are perspective views of embodiments of the helmet having a rib structure over the cell structure in a collapsed condition in accordance with the present disclosure.
Figure 84C:
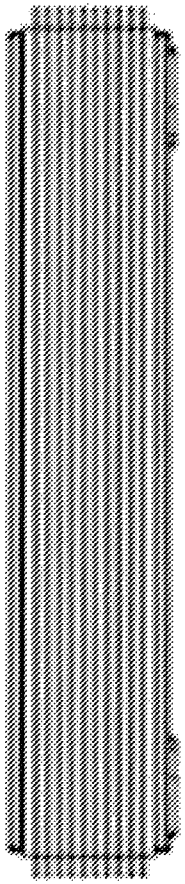
Figure 84B:
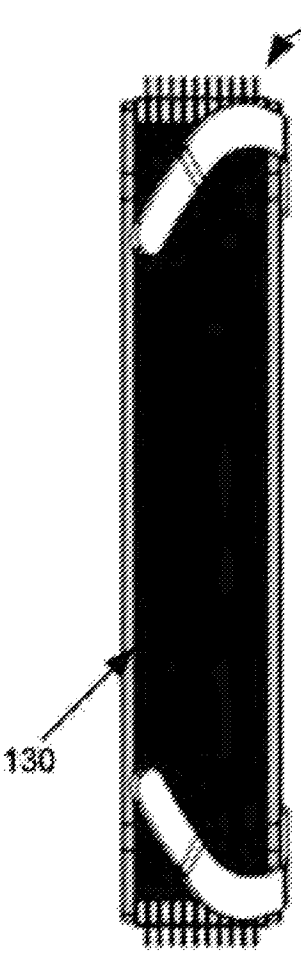
Figure 84A:
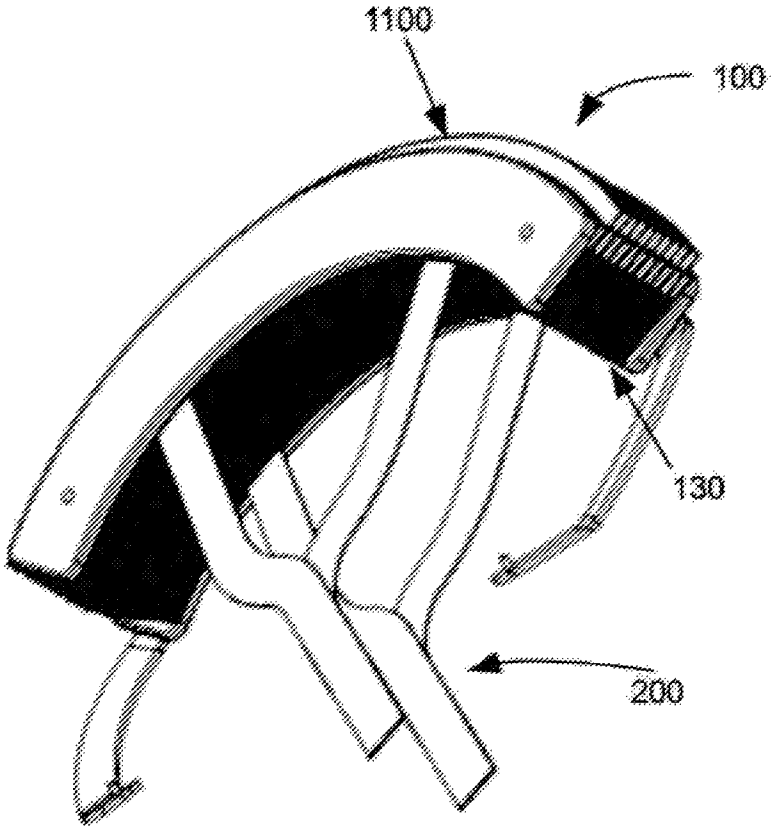
Figure 85C:
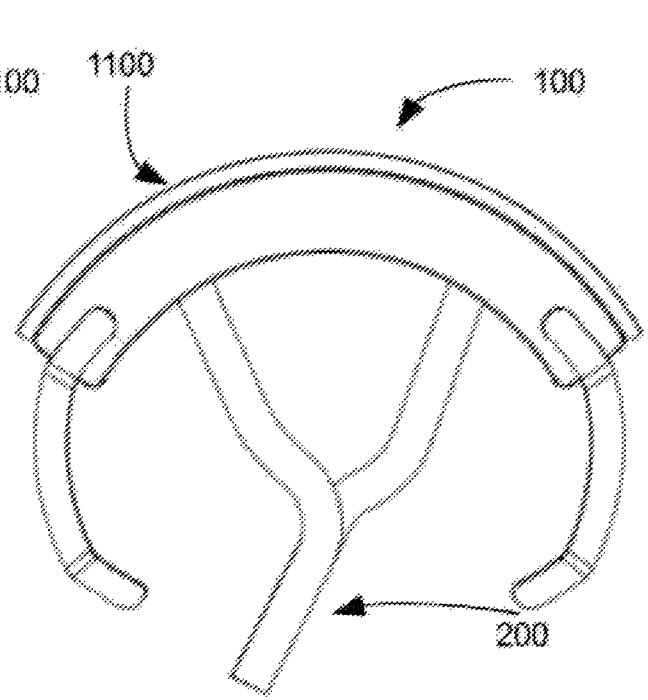
Figure 85B:
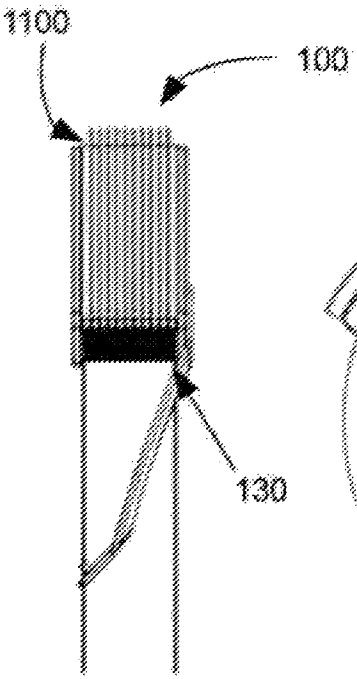
Figure 85A:
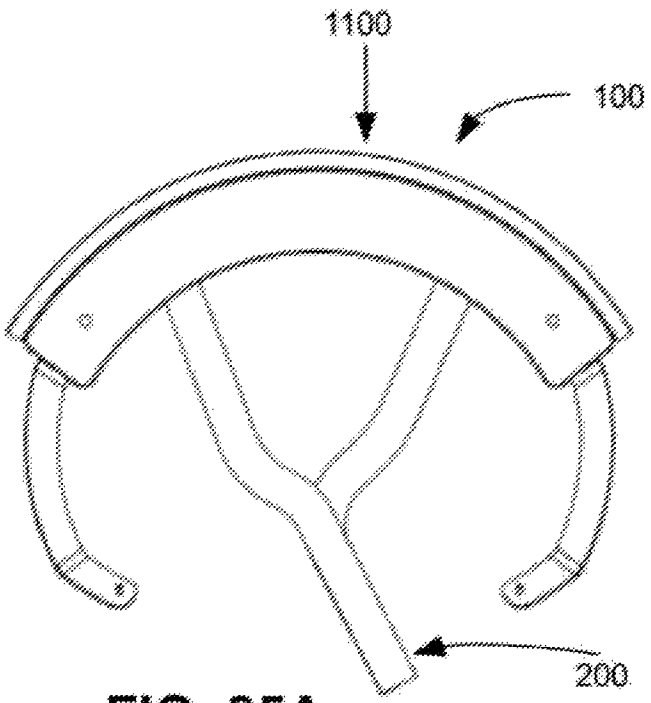
Figure 86C:
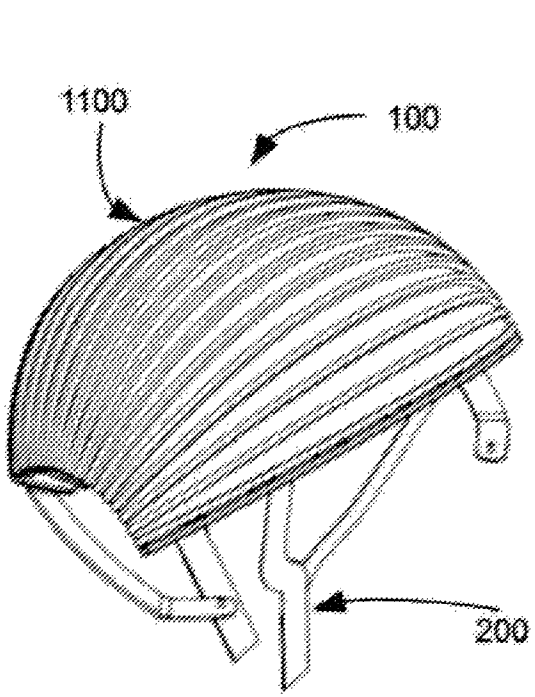
FIGS. 86A, 86B, 86C, 87A, 87B, 87C, 88A, 88B, 88C, 89A, 89B and 89C are perspective views of embodiments of the helmet having a rib structure over the cell structure in an operational condition in accordance with the present disclosure.
Figure 86B:
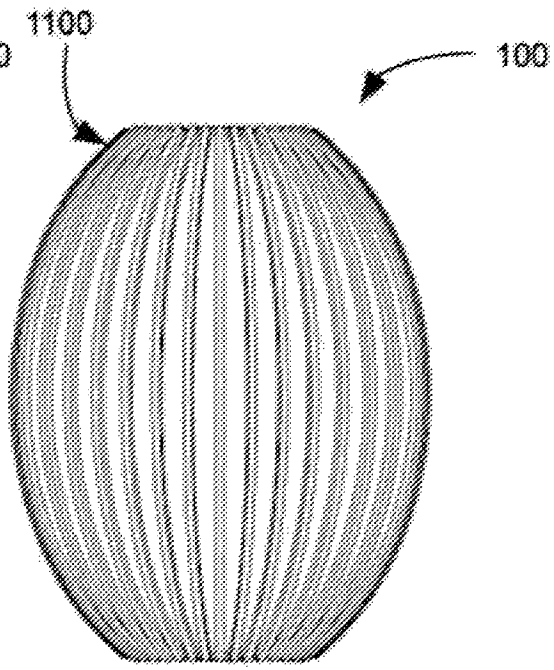
Figure 86A:
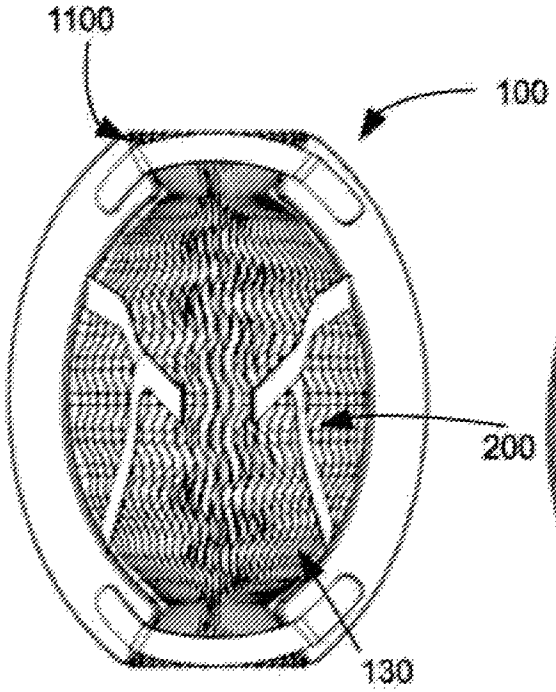
Figure 87C:
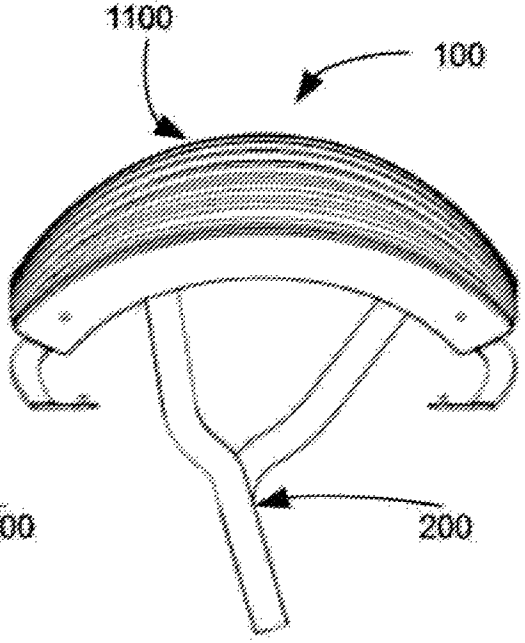
Figure 87B:
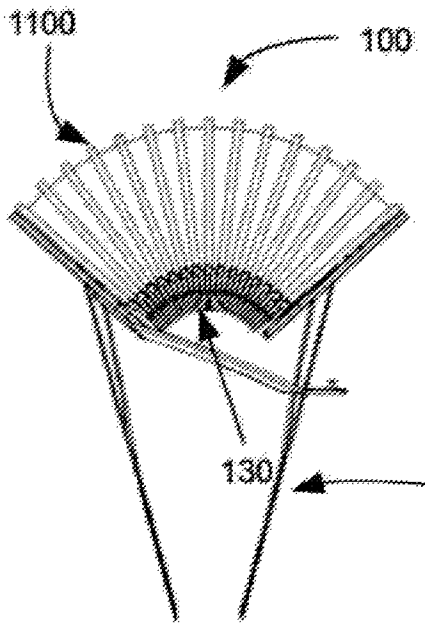
Figure 87A:
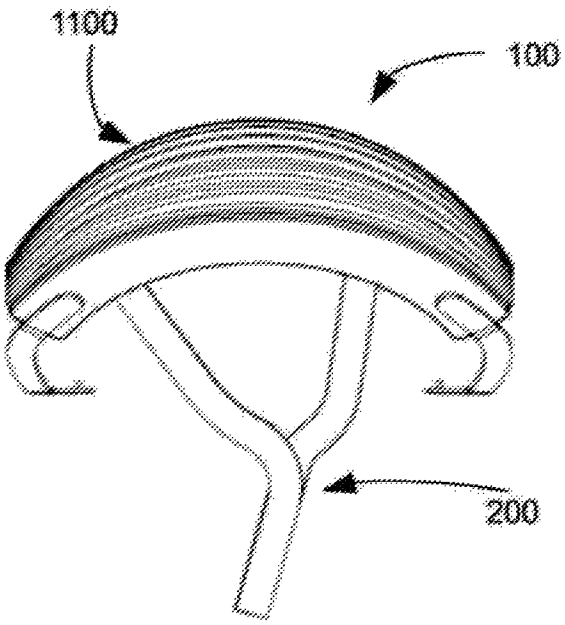
Figure 88C:
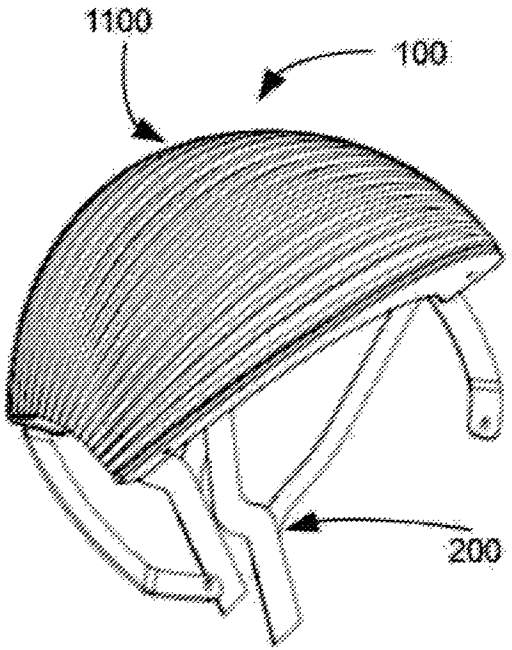
Figure 88B:
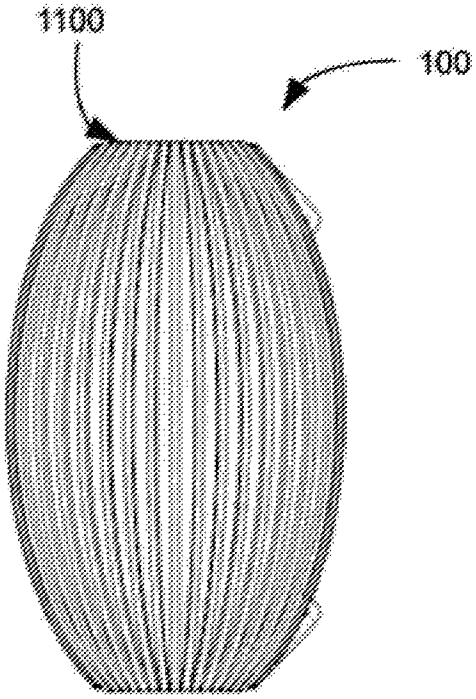
Figure 88A:
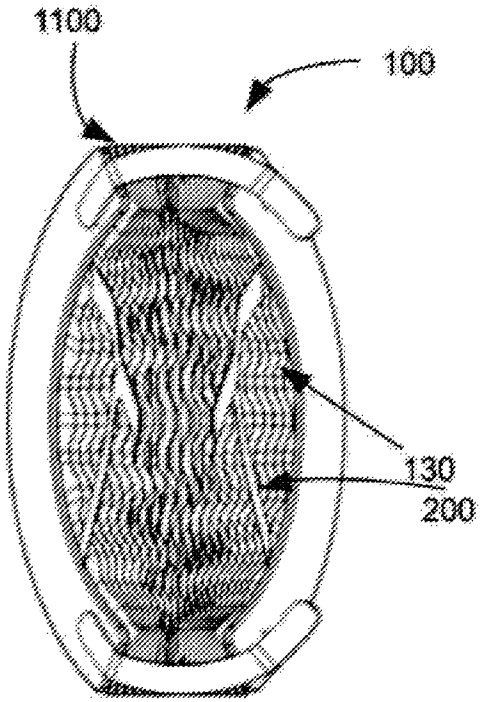
Figure 89C:
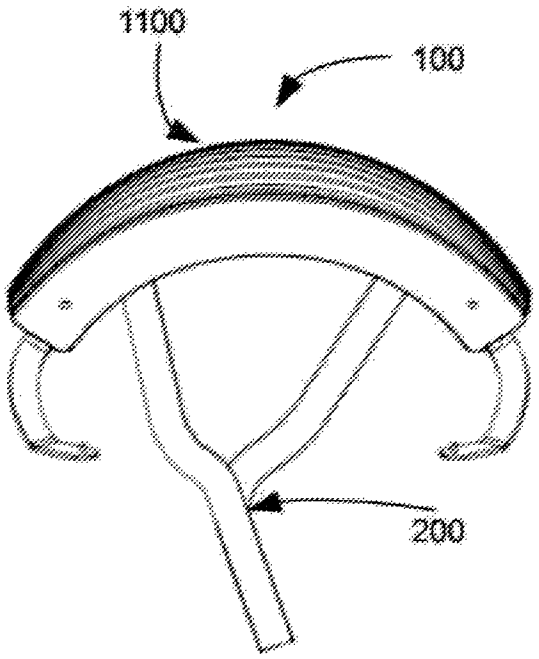
Figure 89B:
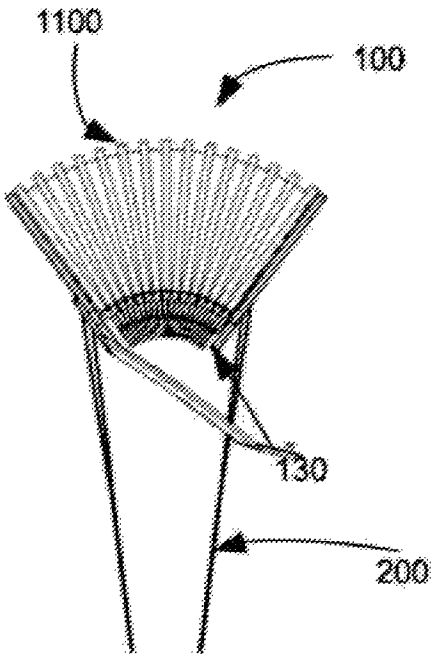
Figure 89A:
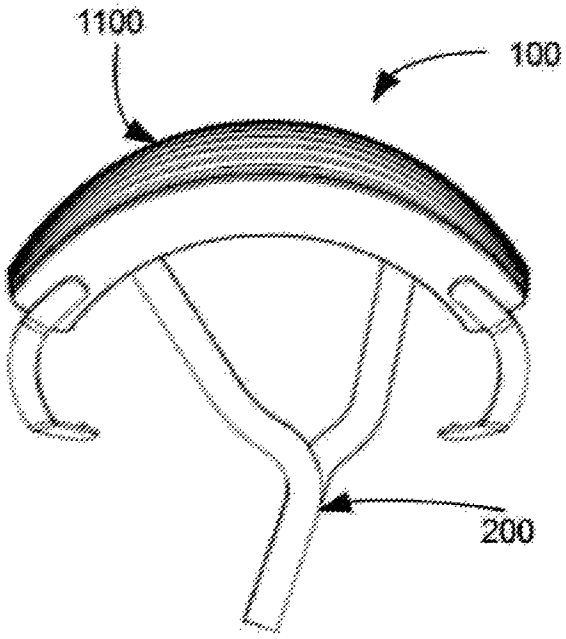

FIG. 64 is a flow diagram illustrating a method of manufacturing the helmet 100. In some embodiments, the helmet 100 includes flexible cell structures that form a honeycomb matrix 130 movable from a collapsed or folded condition to an expanded condition where the honeycomb matrix 130 is at least partially disposed over the head 150 of the user 110 and arranged radially relative to the surface of the head 150 of the user 110. At 1002, a three-dimensional scanned digital image of the head 150 of the user 110 is created. At 1004, the scanned image is stored in a computer memory. At 1006, computer aided design (CAD) software is used to produce a design for the expandable helmet. At 1008, the CAD produced design is used to custom manufacture the helmet with a three-dimensional printer.

FIGS. 65-89 illustrate embodiments of the helmet 100 including a rib structure 1110. In some embodiments, the rib structure 1110 includes a plurality of ribs 1112. The ribs 1112 can be disposed over the honeycomb matrix 130 to provide structural integrity to the helmet 100 and thereby provide protection to the head 150 of the user 110, such as during a bicycle ride. The ribs 1112 can be disposed such that the ribs 1112 are spaced evenly across the top surface of the helmet 100 to form the rib structure 1110. In some embodiments, the ribs are spaced between 0.6 and 0.95 inches from one another. The ribs 1112 can be composed at least partially of a thermoplastic polymer, e.g. acrylonitrile butadiene styrene (ABS). The ribs 1112 can be composed of any other suitable thermoplastic polymer or any other suitable material for protecting the head 150 of the user 110 during one or more bicycle rides.

In some embodiments, the rib structure 1110 includes a fabric layer 1114 disposed over the rib structure 1110. The fabric layer 1114 can be configured such that the fabric layer 1114 covers and substantially conforms to at least a portion of each of the ribs 1112 of the rib structure 1110 and also extends between each of the ribs 1112 of the rib structure 1110. The fabric layer 1114 may be a continuous piece of fabric that is configured to be disposed over the entire rib structure 1110. In some embodiments, the fabric layer 1114 may include several connected pieces of fabric, wherein each piece of fabric is configured to fit over one or more of the ribs 1112, to extend between one or more of the ribs 1112, or a combination thereof. In some embodiments, one or both of the side straps 202, 208 of the chin strap assembly 200 can be attached to the fabric layer 1114, one or more of the ribs 1112 of the rib structure 1110, or a combination thereof. The one or both of the side straps 202, 208 can be attached to the fabric layer 1114 and/or the one or more ribs 1112 by being sewn thereto, by one or more buttons, by one or more rivets, or by any other suitable means of attachment.

In some embodiments, the rib structure 1110 includes a plurality of rib restraints disposed between and attached to the ribs 1112, thereby connecting the ribs 1112 to one another. The rib restraints can align the plurality of ribs 1112 with respect to one another and thereby provide structure and rigidity to the rib structure 1110. In some embodiments, the rib restraints align the ribs 1112 such that the ribs 1112 are substantially parallel to one another. The rib restraints can also align the ribs 1112 such that the ribs are uniformly spaced from one another. In some embodiments, the rib restrains align the ribs 1112 such that the ribs 1112 are nonuniformly spaced from one another. Each of the ribs 1112 can have one or more rib restraints attached thereto. Each of the one or more rib restraints attached to a rib 1112 of the plurality of ribs 1112 can also be attached to one or more adjacent ribs 1112 such that each of the ribs 1112 is connected to one or more adjacent ribs 1112 via the one or more rib restraints. In some embodiments, the restraints can be at least partially composed of fabric, another woven material, a polymer such as polyester, or any other suitable material. In some embodiments, each of the rib restrains is substantially rectangular and is thin relative to length and width thereof.

Figure 90B:
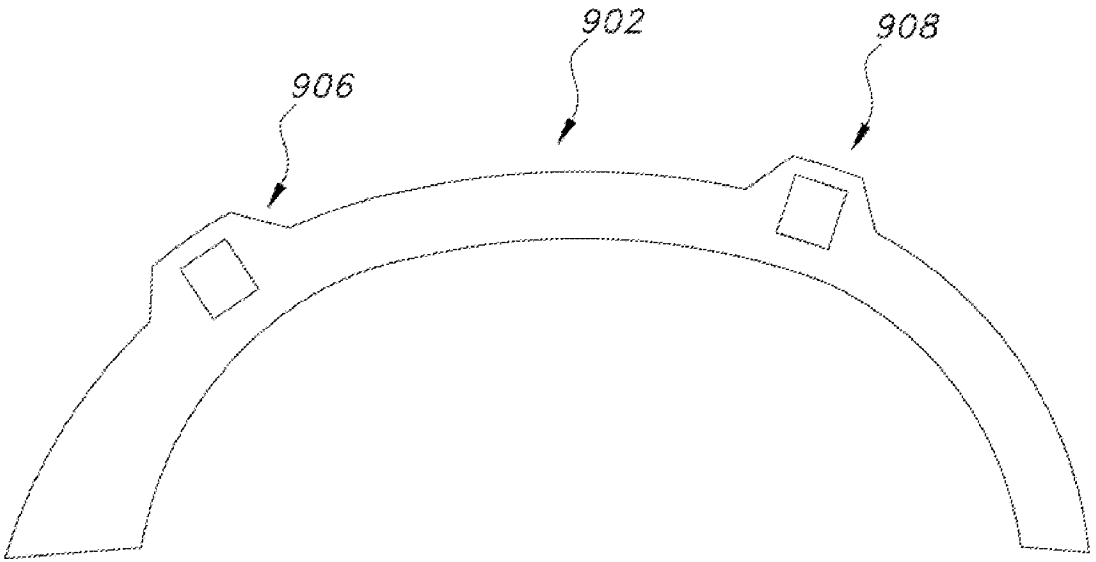
FIGS. 90A and 90B are perspective views of embodiments of the first solid side frame including first and second frame protrusions in accordance with the present disclosure.
Figure 90A:
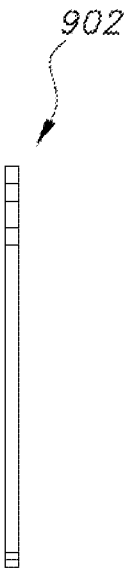

FIGS. 90A and 90B illustrate an embodiment of the first solid side frame 902 including first and second frame protrusions 906, 908. In some embodiments, the second solid side frame 904 may include the first and second frame protrusions 906, 908 and may substantially be a mirror image of the first solid side frame 902.

Figure 91:
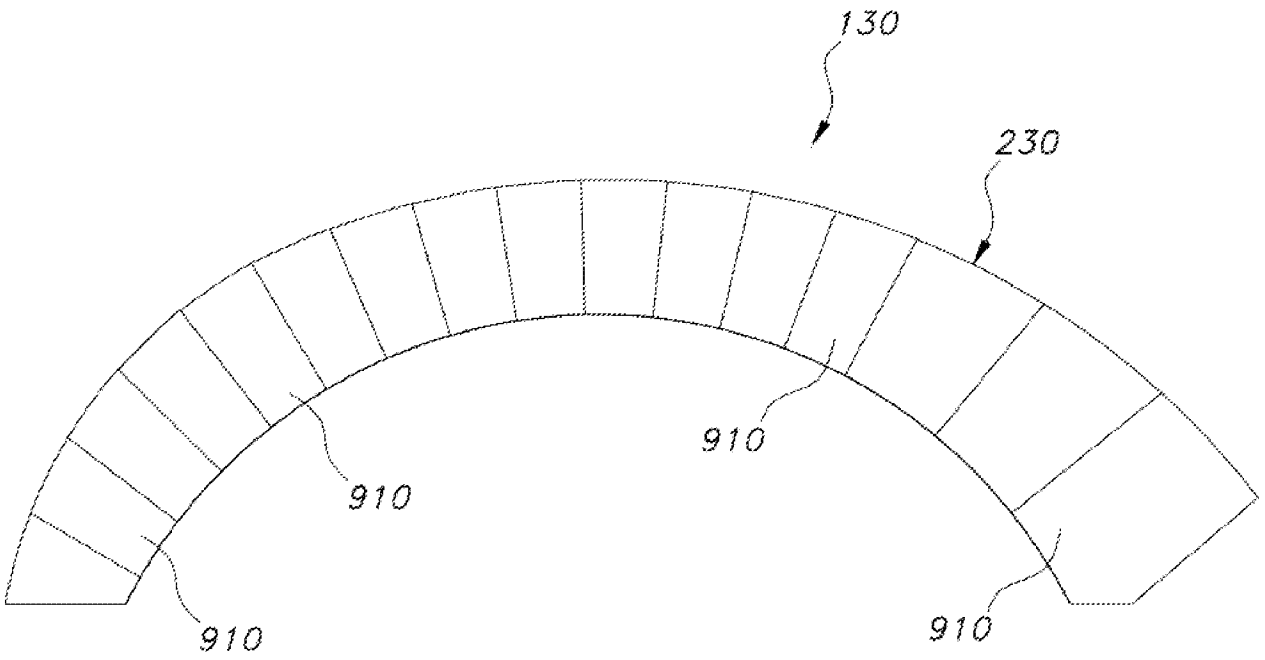
FIG. 91 is a perspective view of embodiments of the honeycomb matrix having bond lines in accordance with the present disclosure.
Figure 92:
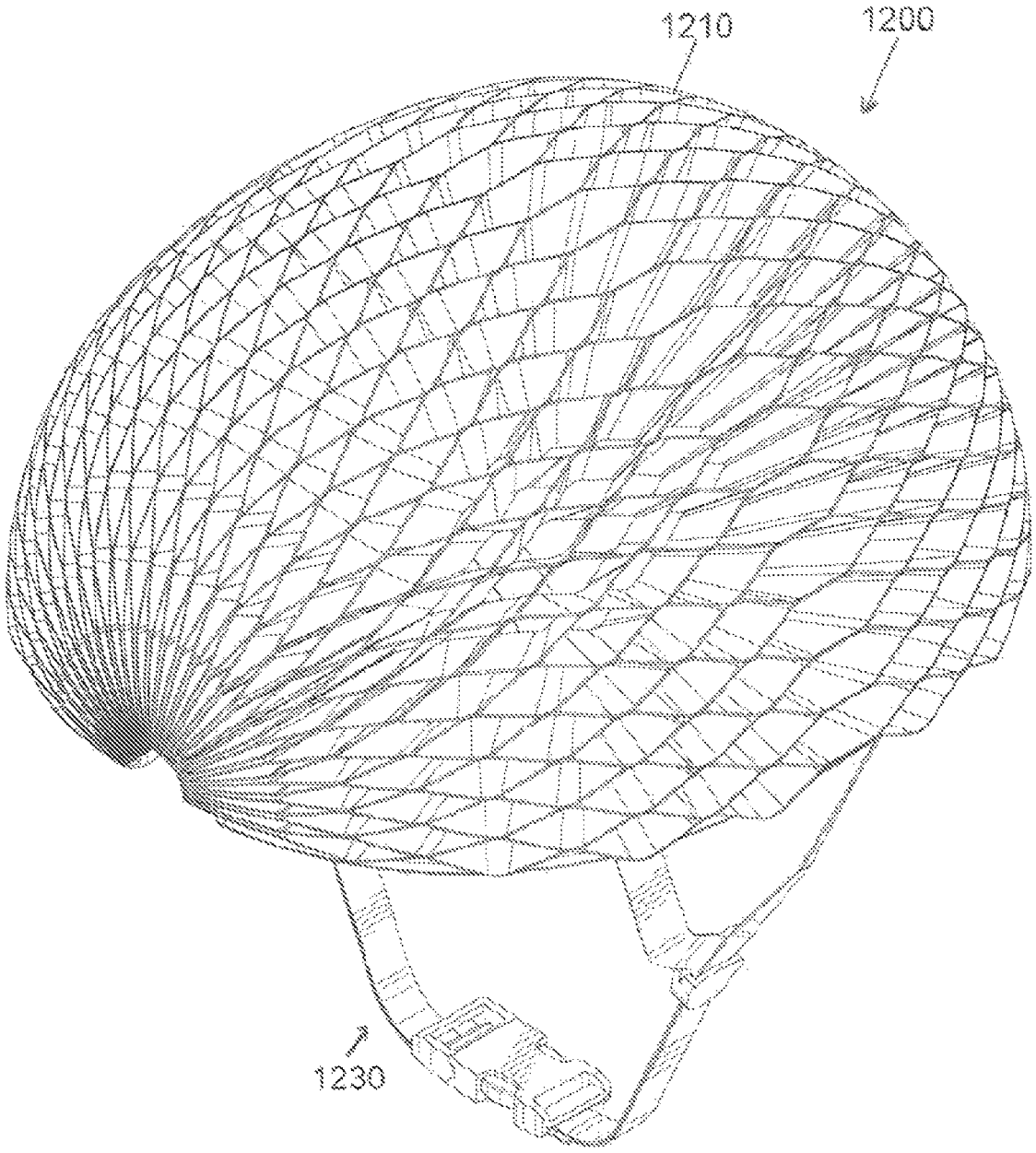
FIG. 92 is a top perspective view of embodiments of a helmet in an operational or expanded condition in accordance with the present disclosure.
Figure 93:
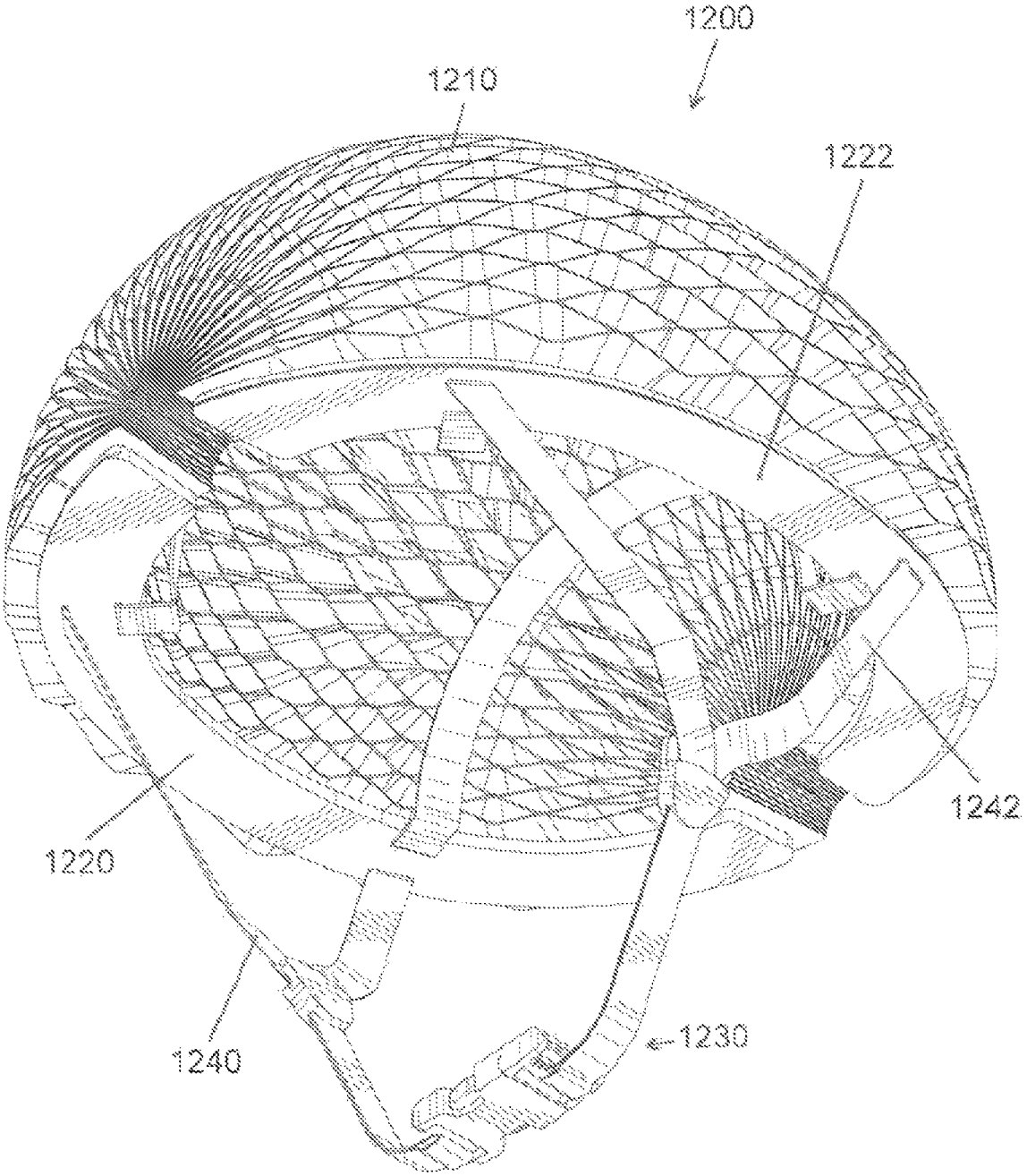
FIG. 93 is a bottom perspective view of the helmet of FIG. 92.
Figure 94:
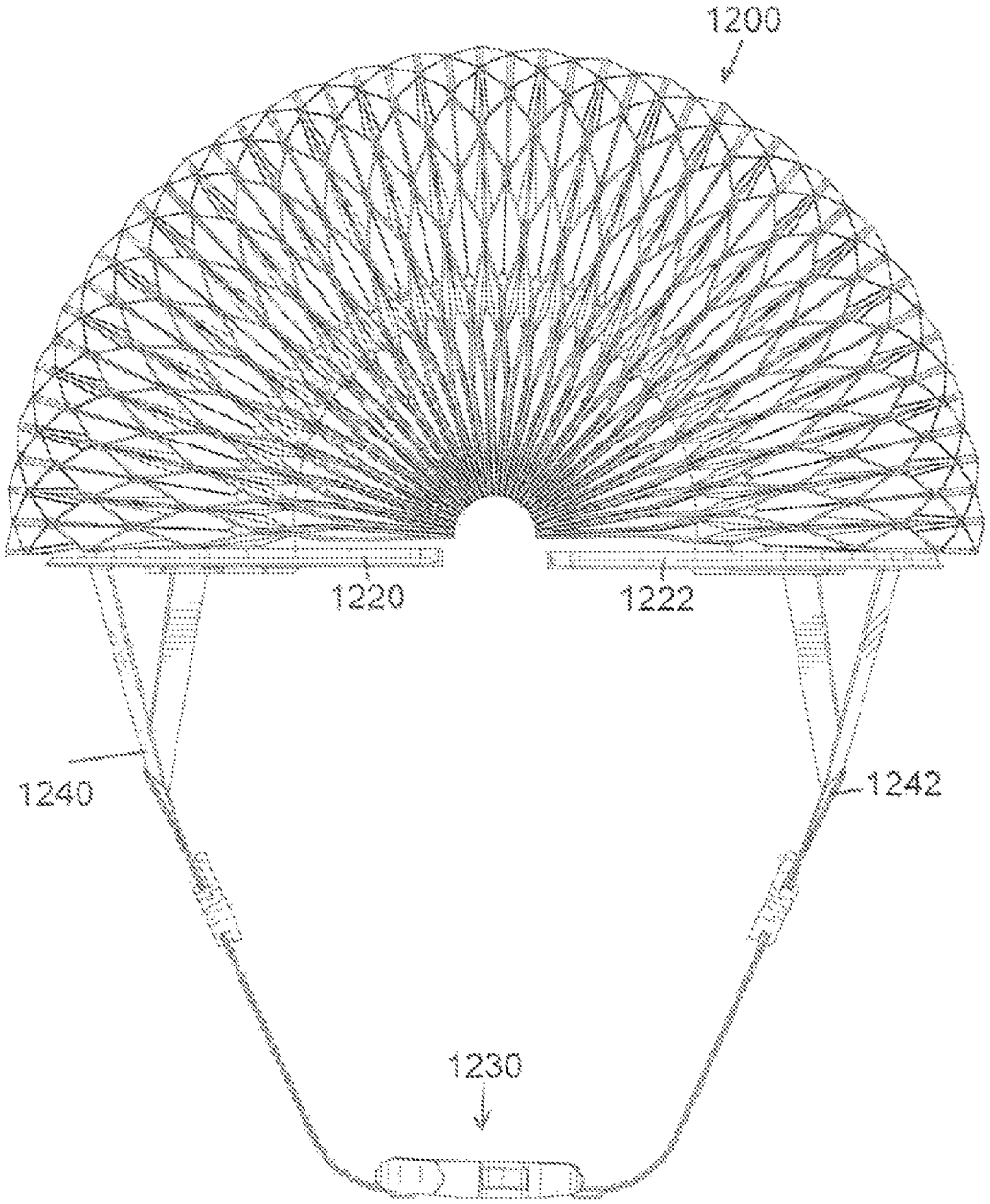
FIG. 94 is a front view of the helmet of FIG. 92.
Figure 95:
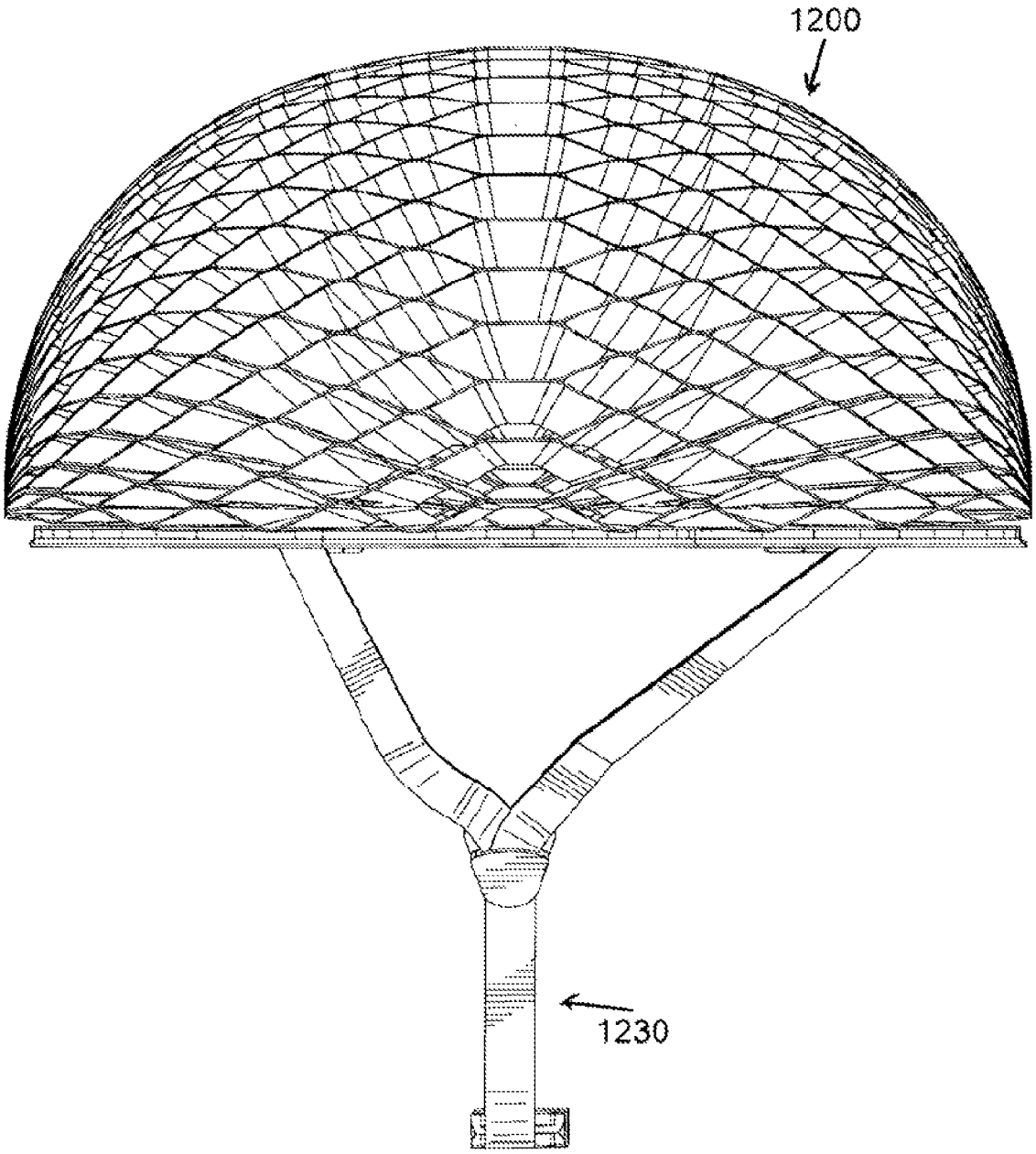
FIG. 95 is a right side view of the helmet of FIG. 92.
Figure 96:
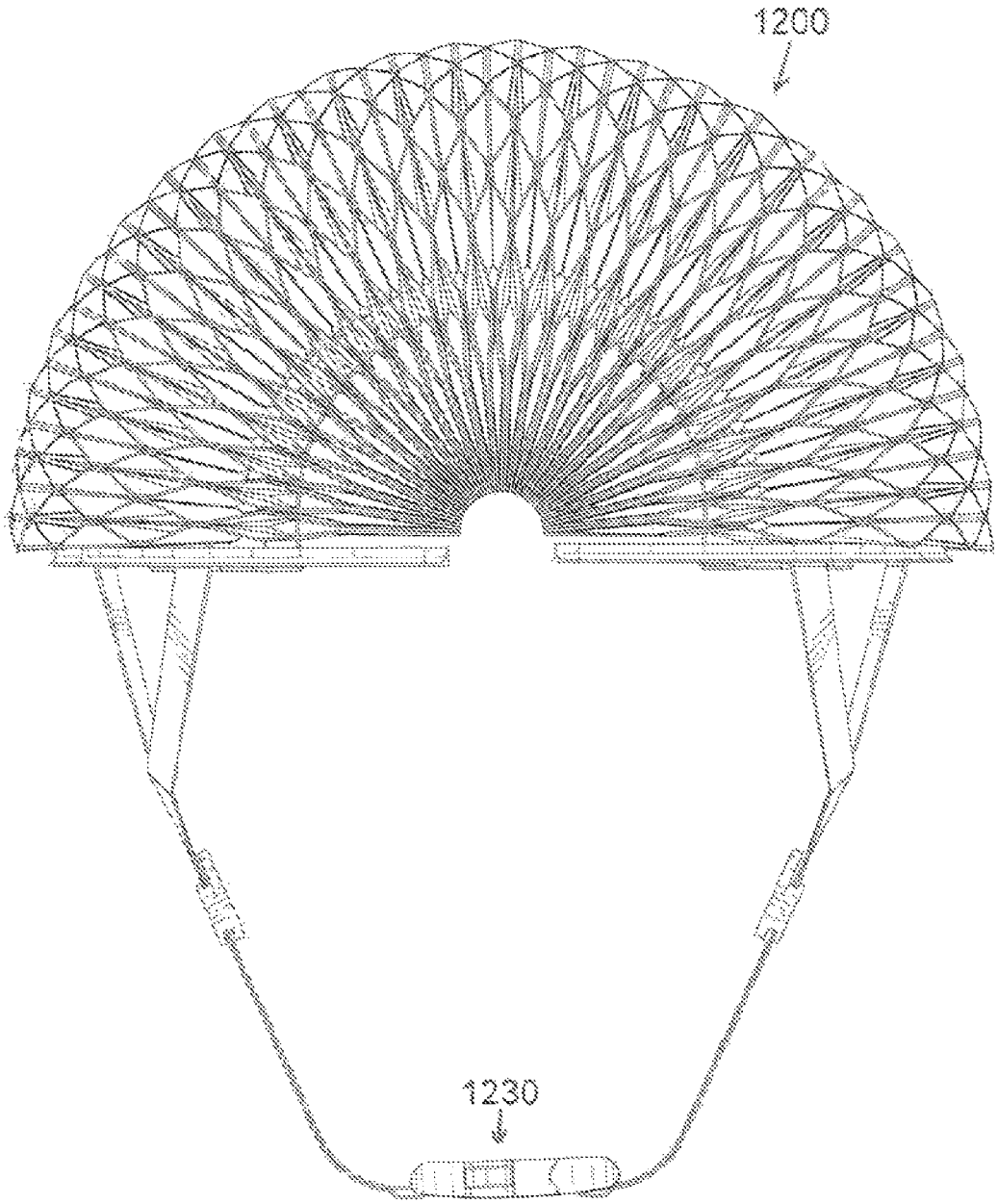
FIG. 96 is a rear view of the helmet of FIG. 92.
Figure 97:
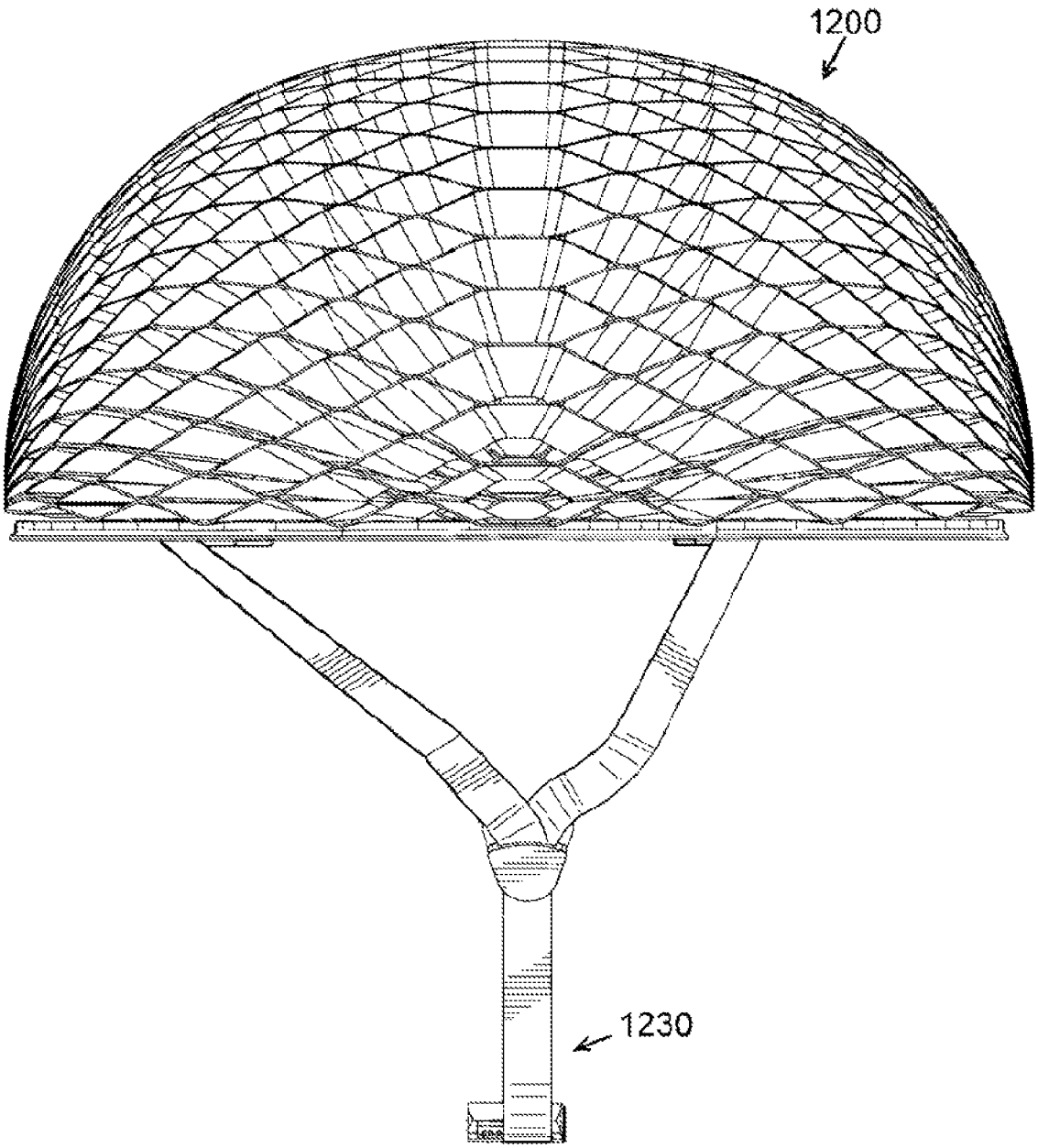
FIG. 97 is a left side view of the helmet of FIG. 92.
Figure 98:
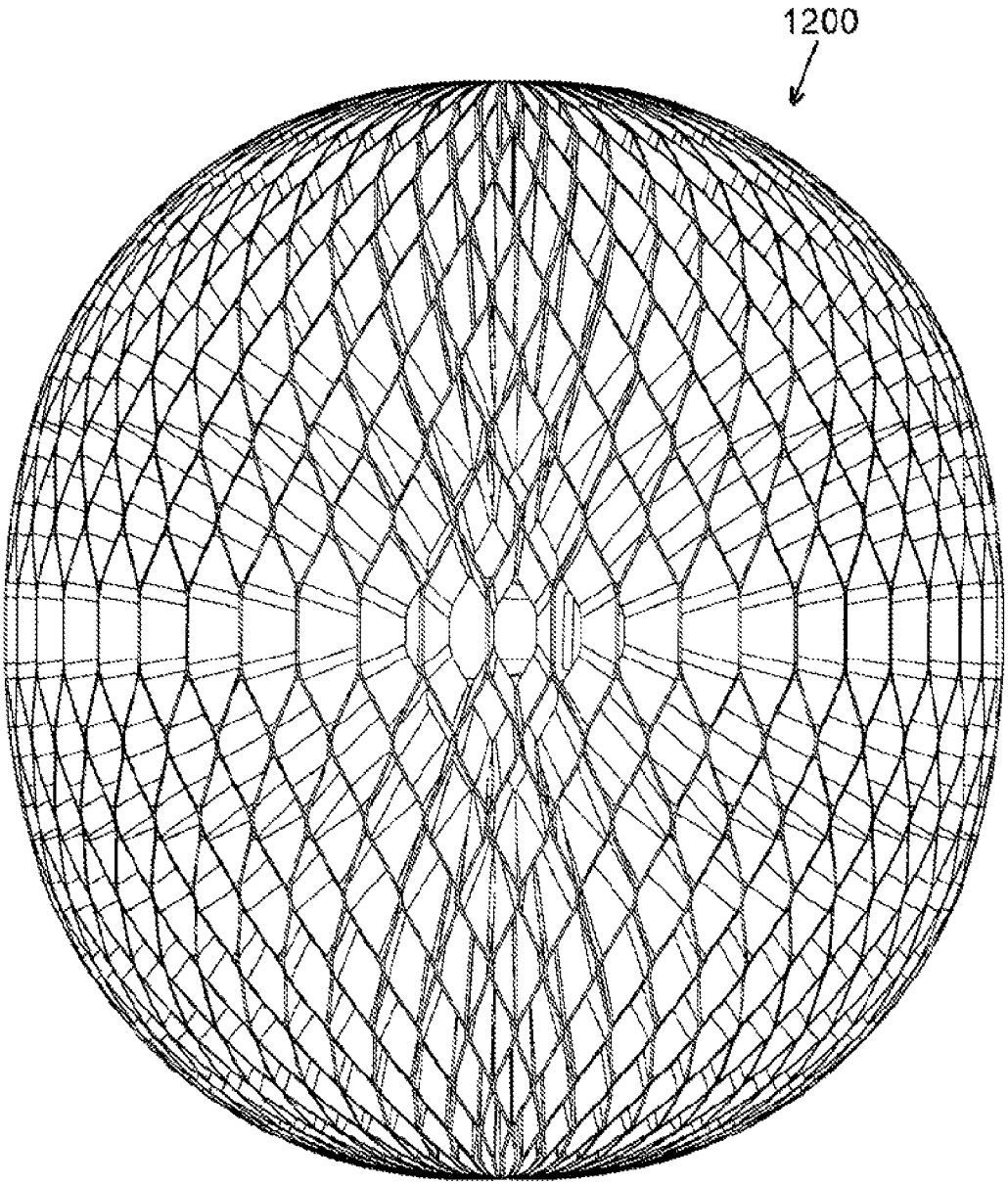
FIG. 98 is a top view of the helmet of FIG. 92.

FIG. 91 illustrates an embodiment of the honeycomb matrix 130 where the helmet material 230 is held together by adhesive, such as glue, applied at a plurality of bond lines 910. The bond lines 910 may be positioned such that the bond lines 910 radiate in a direction normal to the surface of the head 150 of the user 110. In some embodiments, the bond lines 910 may be formed during assembly of the helmet 100 by machine and/or manual gluing of the helmet material 230 along the bond lines 910 to form the cell structures 160. In some embodiments, the helmet material 230 may be glued along the bond lines using an adhesive composed substantially of cyanoacrylate.

FIGS. 92-99 and 108-115 depict different views of embodiments of a helmet in an operational or expanded condition in accordance with the present disclosure. FIGS. 100-107 and 116-123 depict different views of embodiments of a helmet in a collapsed or folded condition in accordance with the present disclosure. The various embodiments of the helmet set forth herein present myriad ornamental features, combinations thereof, and overall impressions based on one or more subsets of ornamental features and/or the ornamental features as a whole, which stand independent and distinct from myriad functional features and one or more combinations thereof also set forth in the present disclosure.

In some embodiments, the helmet material may be substantially composed of PVC-coated polyester, the PVC-coated polyester being substantially resistant to rupturing. Substantial rupture resistance may be necessary to protect the user 110 in cases where the helmet material 230 may buckle during a crash or fall.

With reference now to FIGS. 92-107 helmet 1200 constructed in accordance to embodiments of the disclosure will be further described. Helmet 1200 includes a continuous segment of flexible cell structures that form a radial honeycomb matrix 1210 that is movable between a folded condition (FIG. 100-107) to an expanded condition (FIG. 92-99). The radial honeycomb matrix 1210 is configured to be expanded at least partially over the head of the user and arranged radially relative to the surface of the head of the user. The helmet 1200 includes first and second solid side frames 1220, 1222 attached to the first and last layers of the honeycomb matrix 1210. In some embodiments, a chin strap assembly 1230 is connected to each of the solid side frames 1220, 1222 with side straps 1240 and 1242 configured to be releasably coupled around the head of the user.

Figure 99:
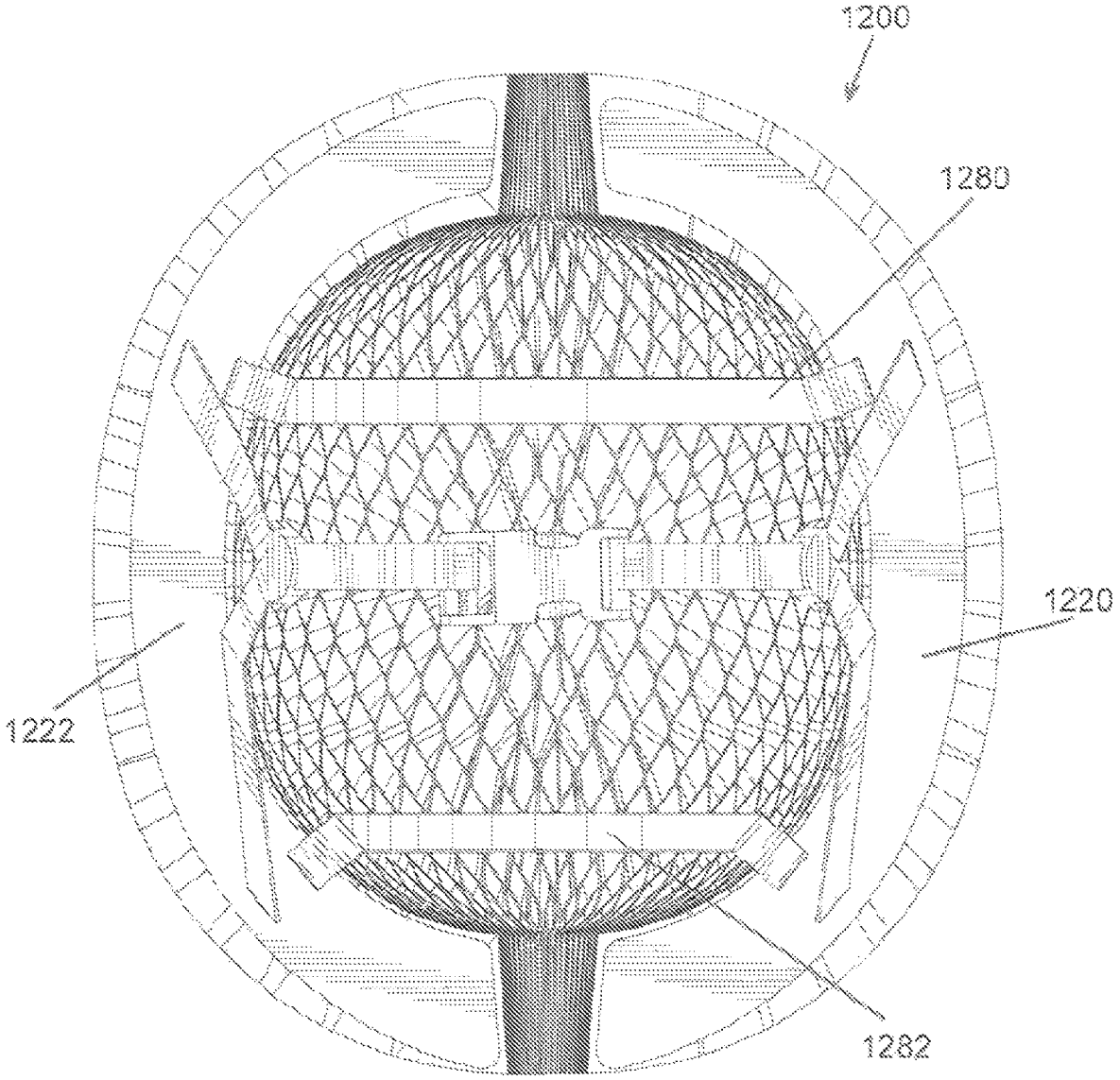
FIG. 99 is a bottom view of the helmet of FIG. 92.
Figure 100:
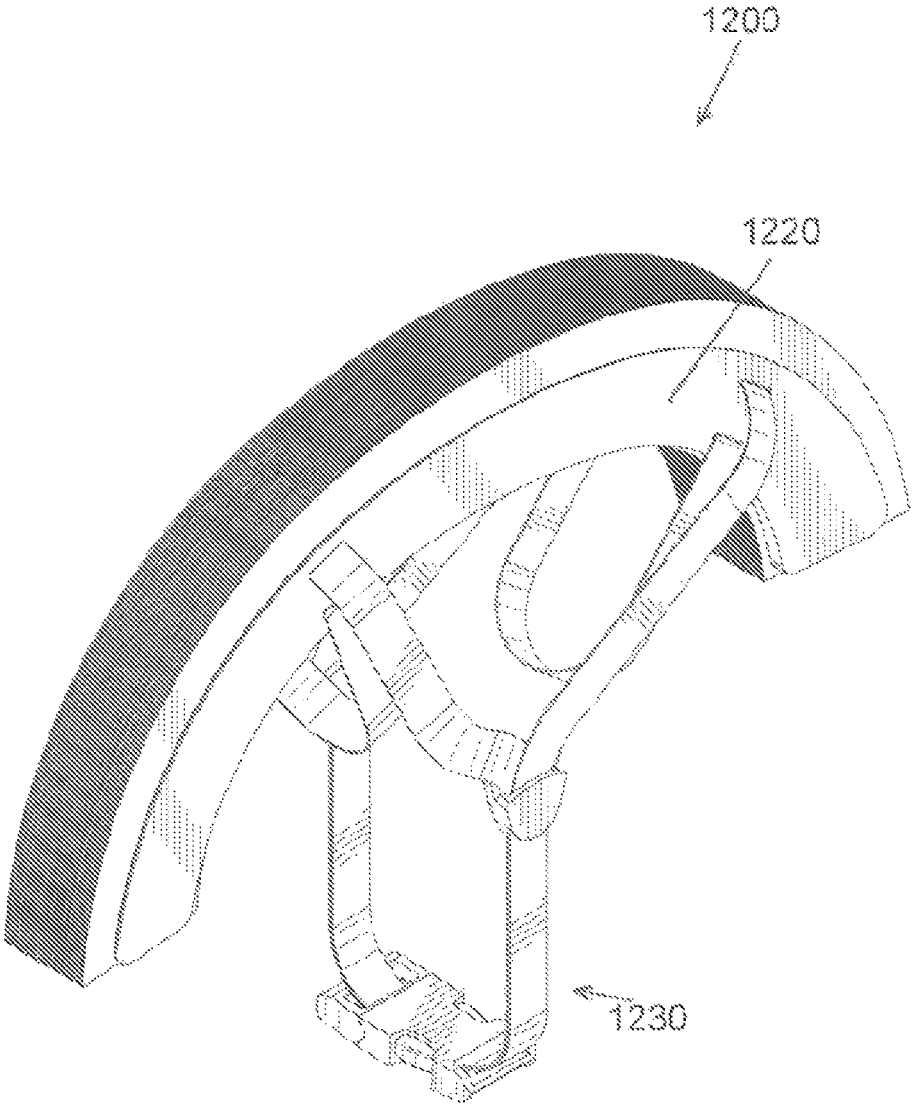
FIG. 100 is a top perspective view of embodiments of a helmet in a collapsed or folded condition in accordance with the present disclosure.
Figure 101:
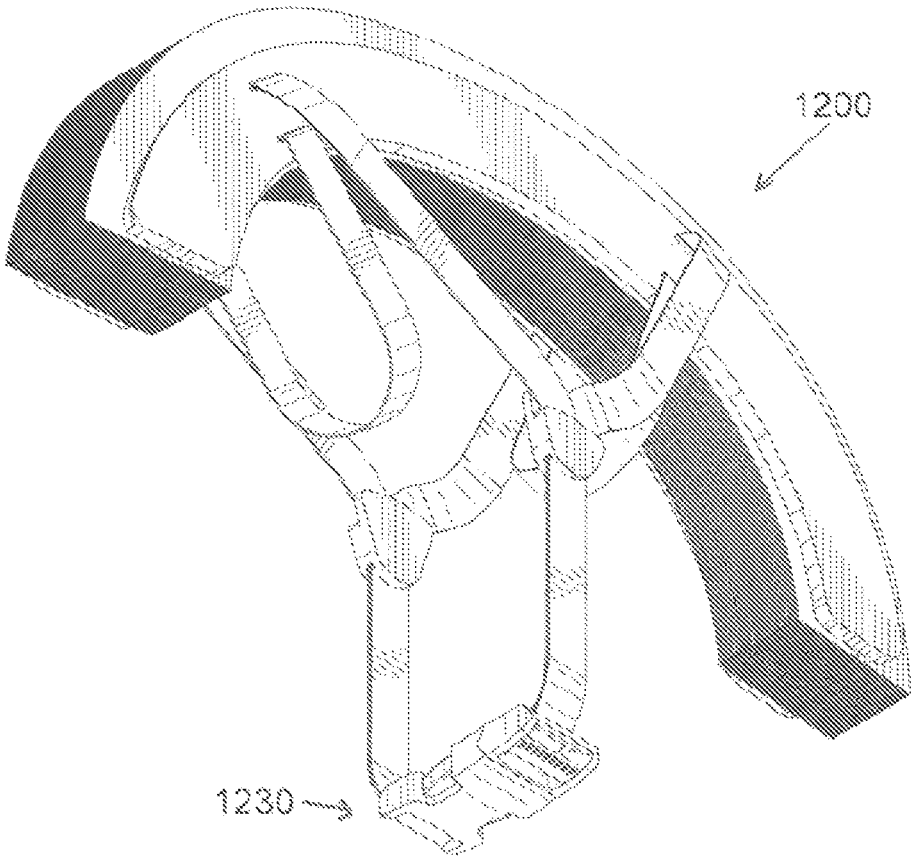
FIG. 101 is a bottom perspective view of the helmet of FIG. 100.
Figure 102:
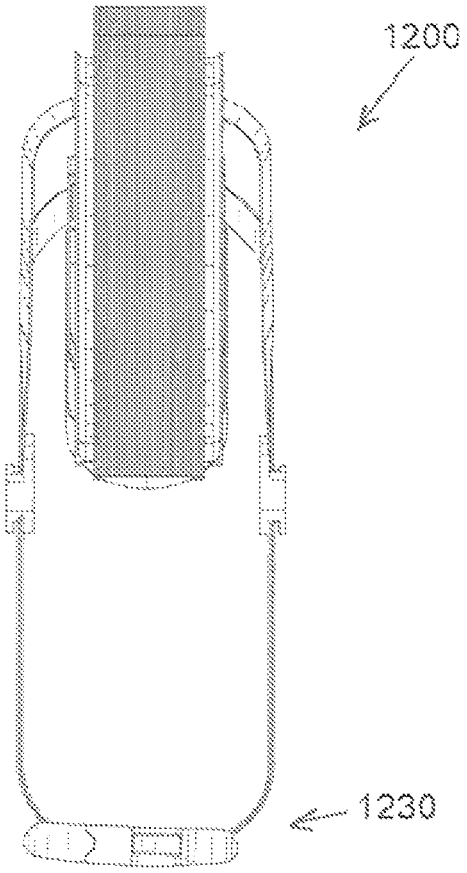
FIG. 102 is a front view of the helmet of FIG. 100.
Figure 103:
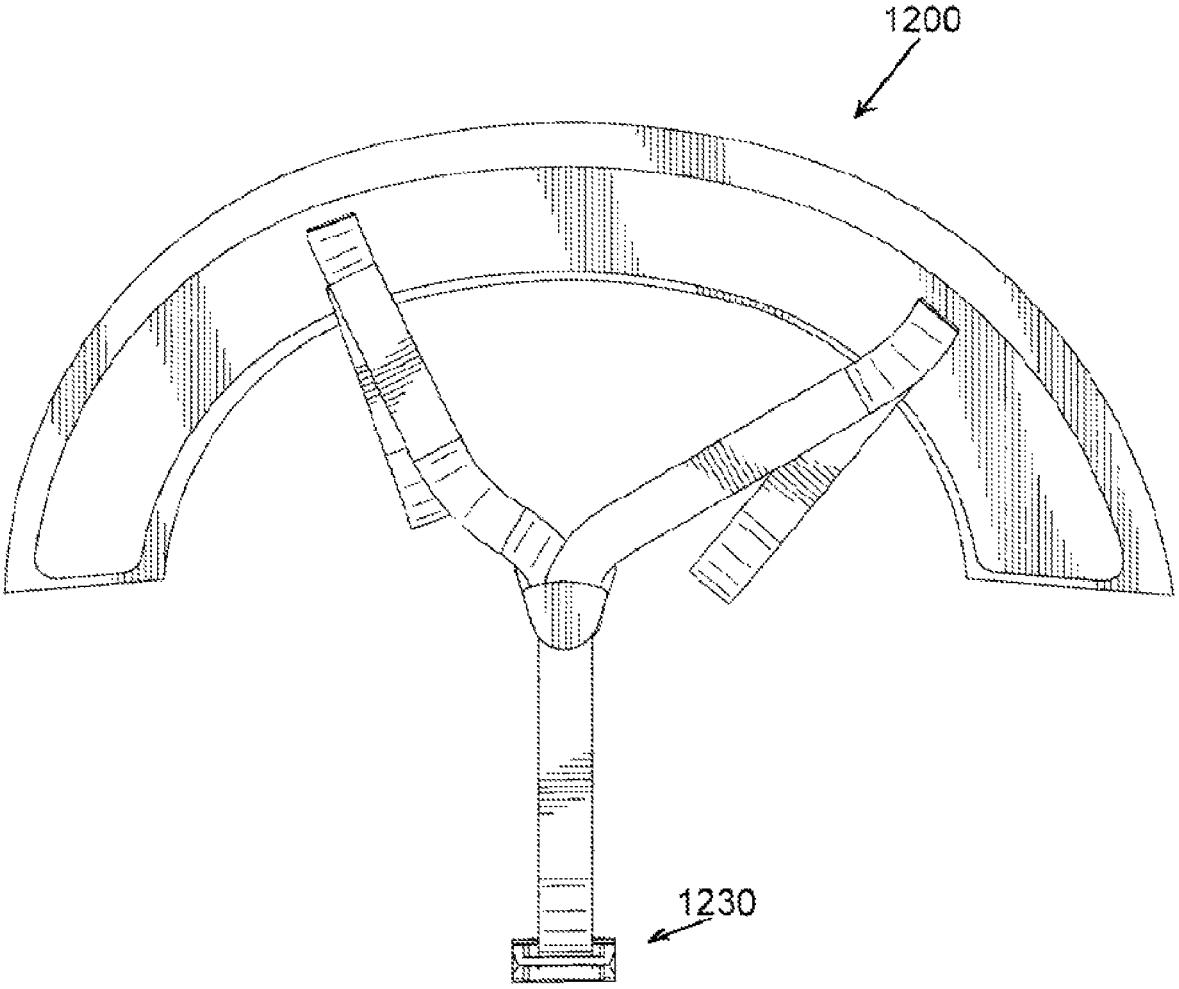
FIG. 103 is a rear view of the helmet of FIG. 100.
Figure 104:
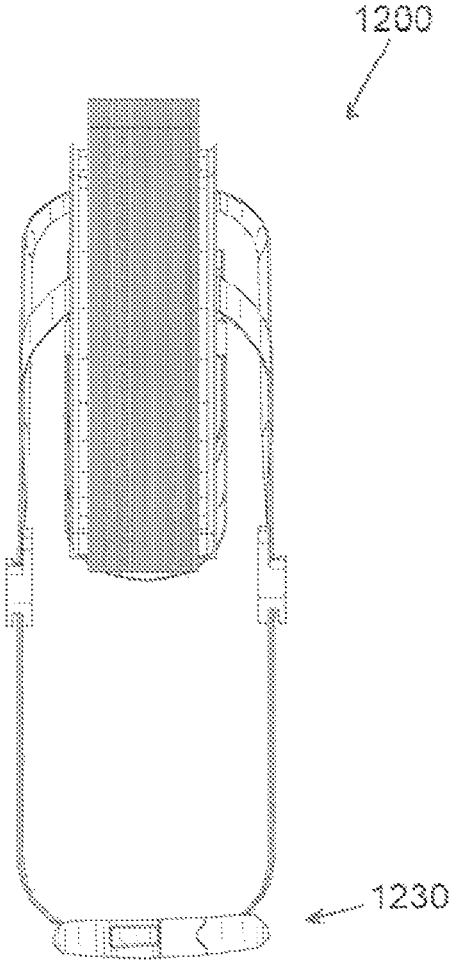
FIG. 104 is a right side view of the helmet of FIG. 100.
Figure 105:
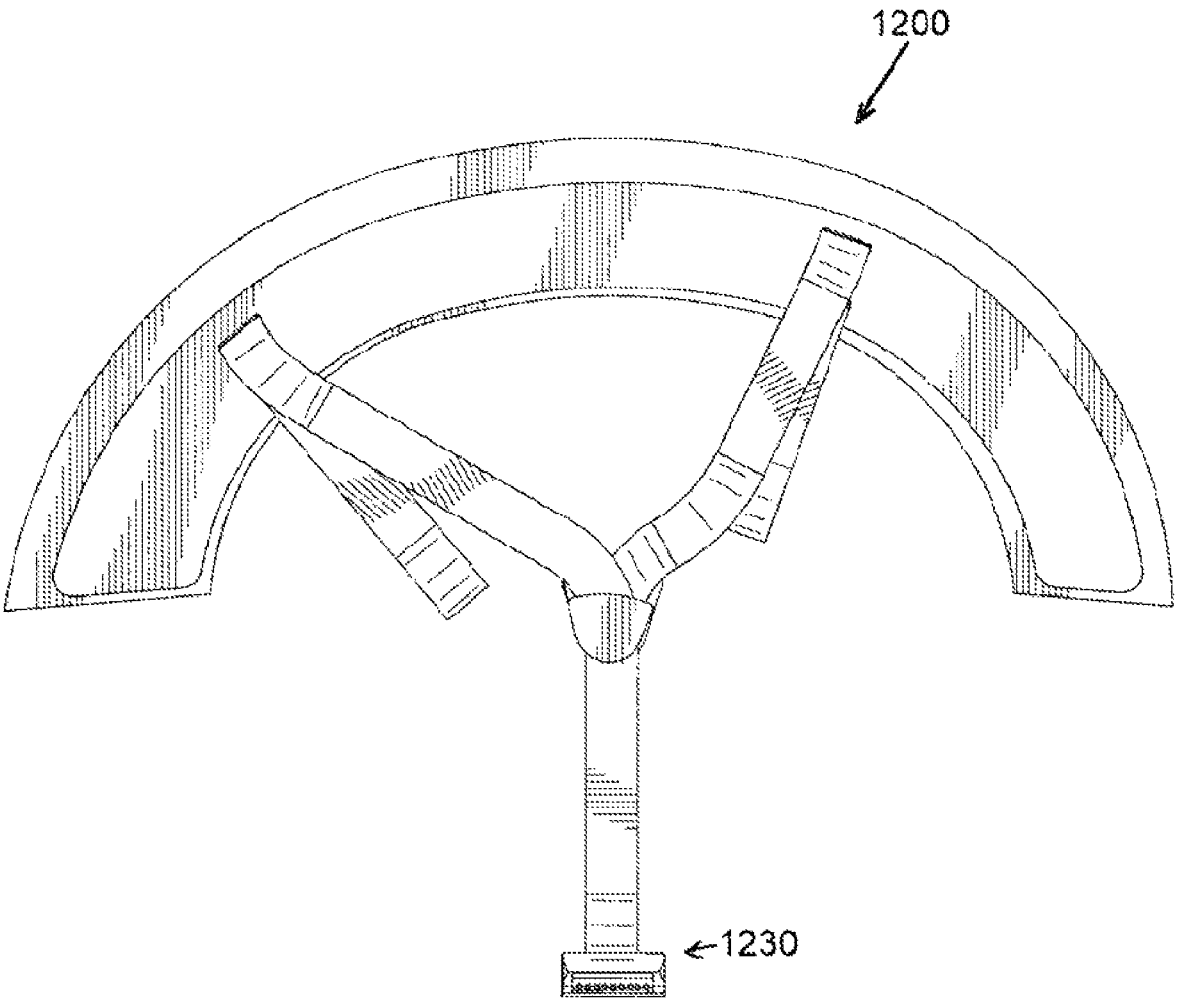
FIG. 105 is a left side view of the helmet of FIG. 100.
Figure 106:
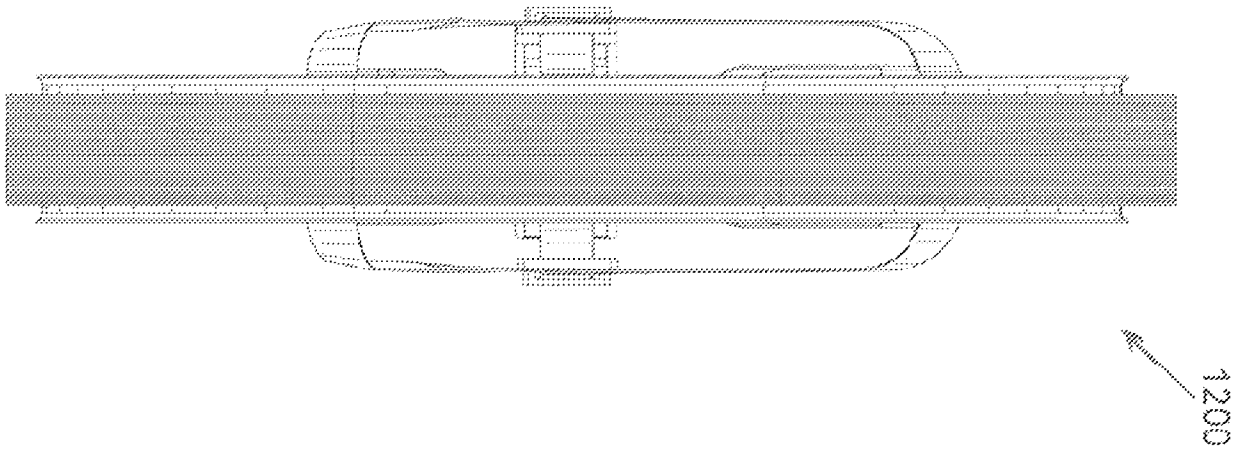
FIG. 106 is a top view of the helmet of FIG. 100.
Figure 107:
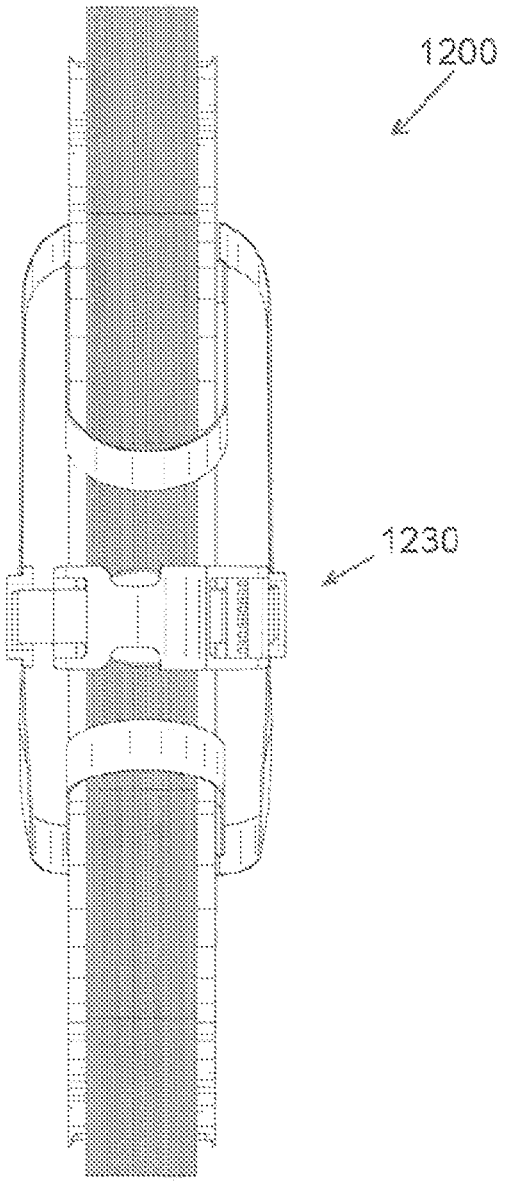
FIG. 107 is a bottom view of the helmet of FIG. 100.
Figure 108:
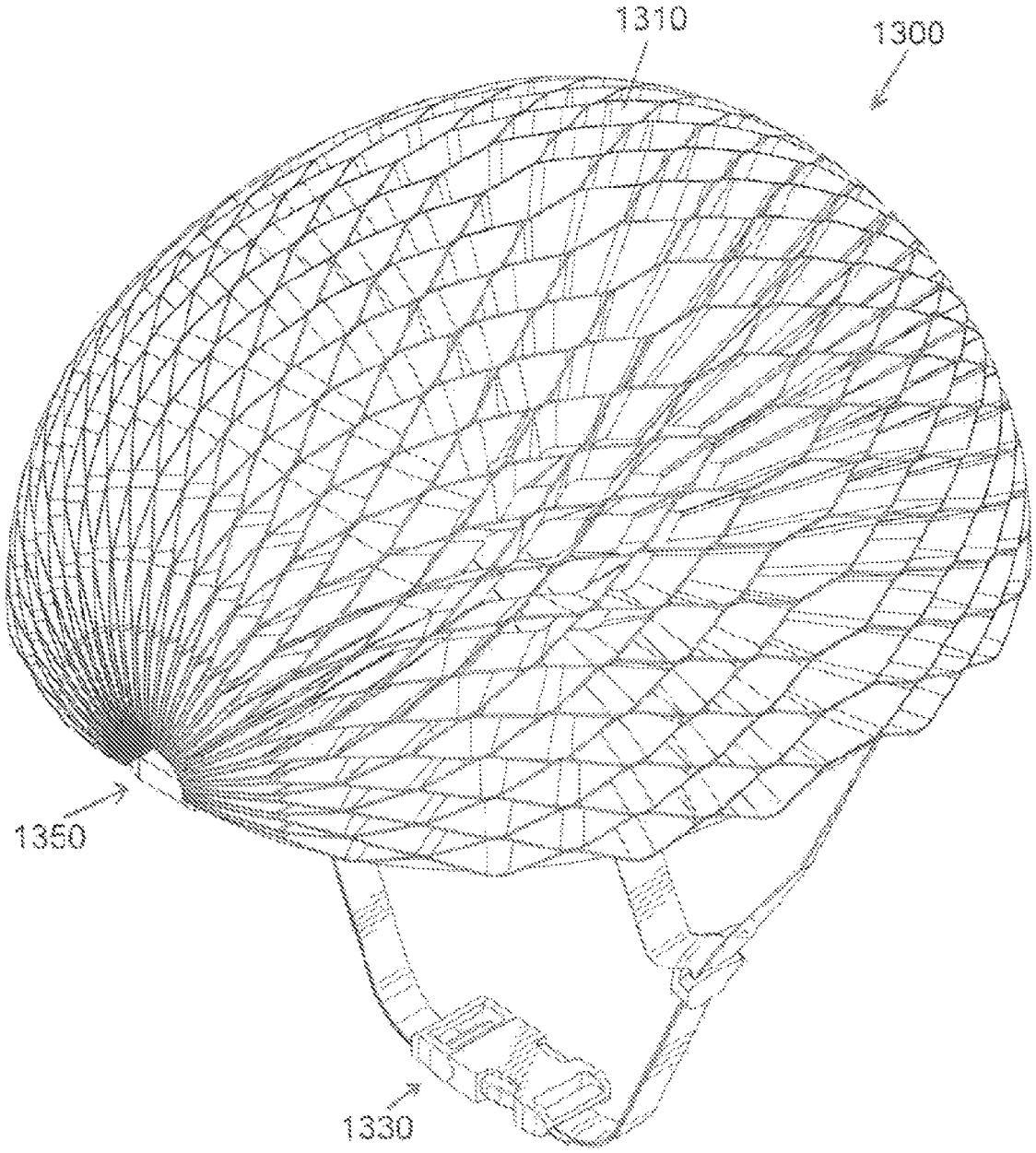
FIG. 108 is a top perspective view of embodiments of a helmet in an operational or expanded condition in accordance with the present disclosure.
Figure 109:
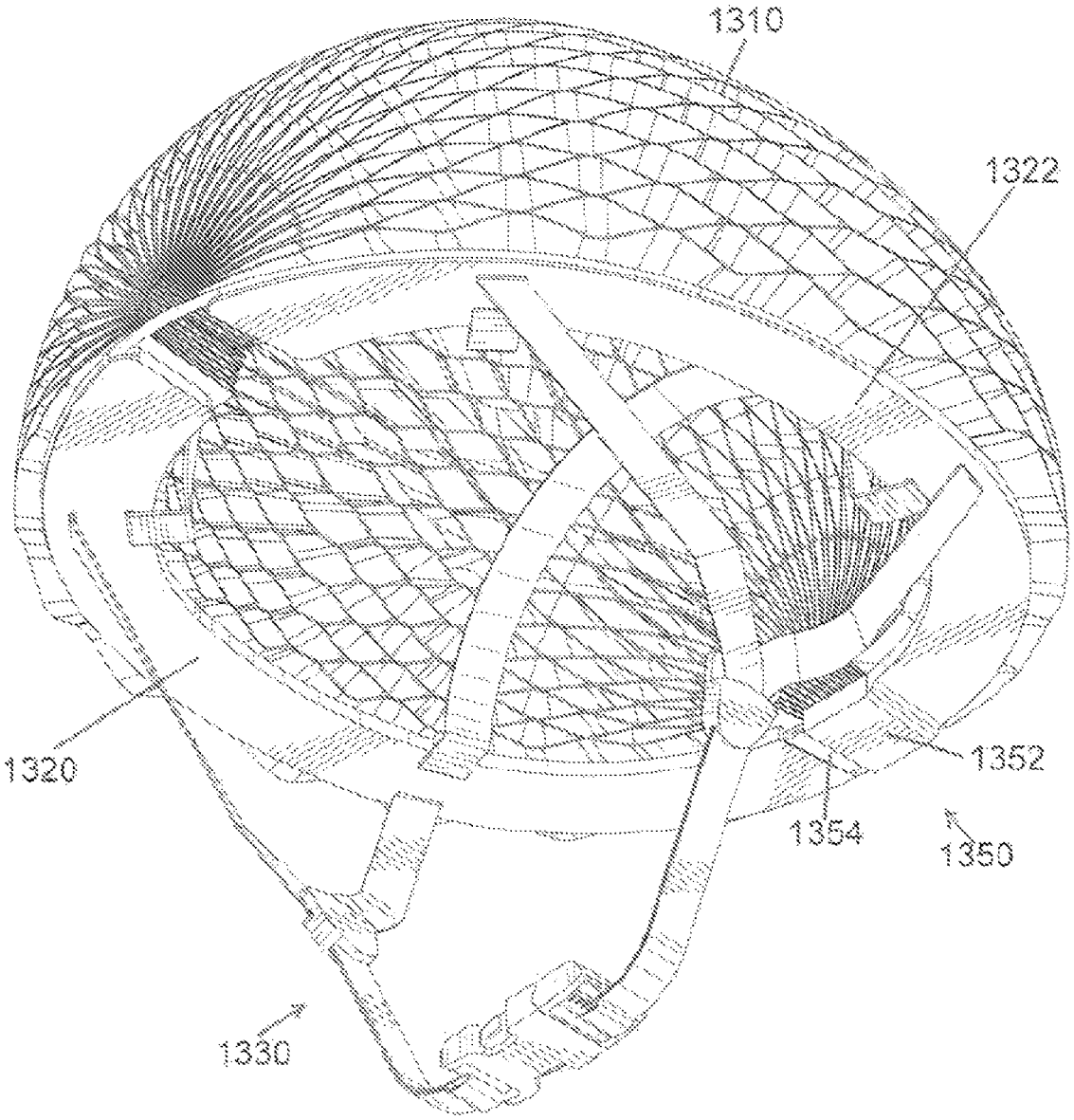
FIG. 109 is a bottom perspective view of the helmet of FIG. 108.
Figure 110:
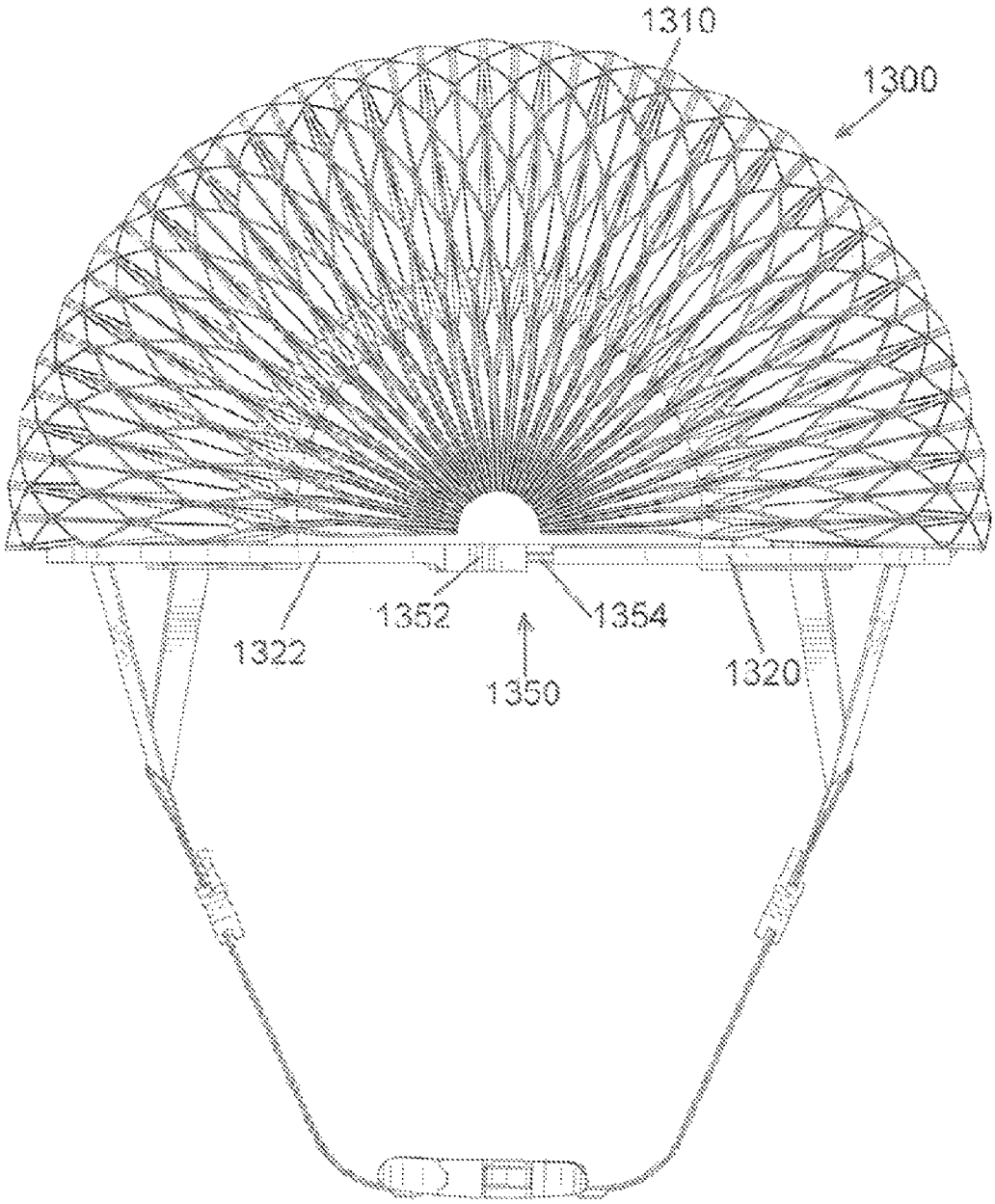
FIG. 110 is a front view of the helmet of FIG. 108.
Figure 111:
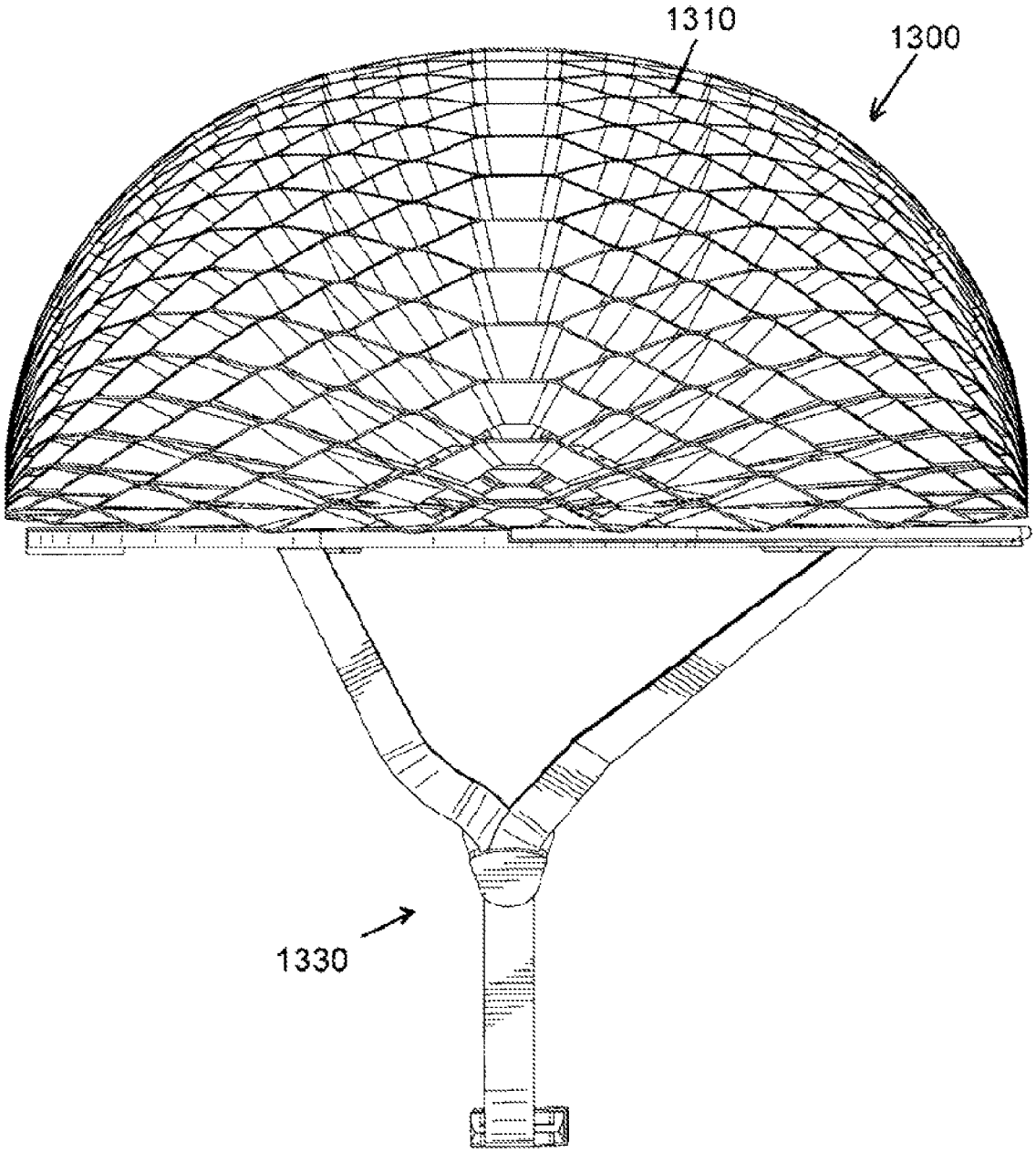
FIG. 111 is a right side view of the helmet of FIG. 108.
Figure 112:
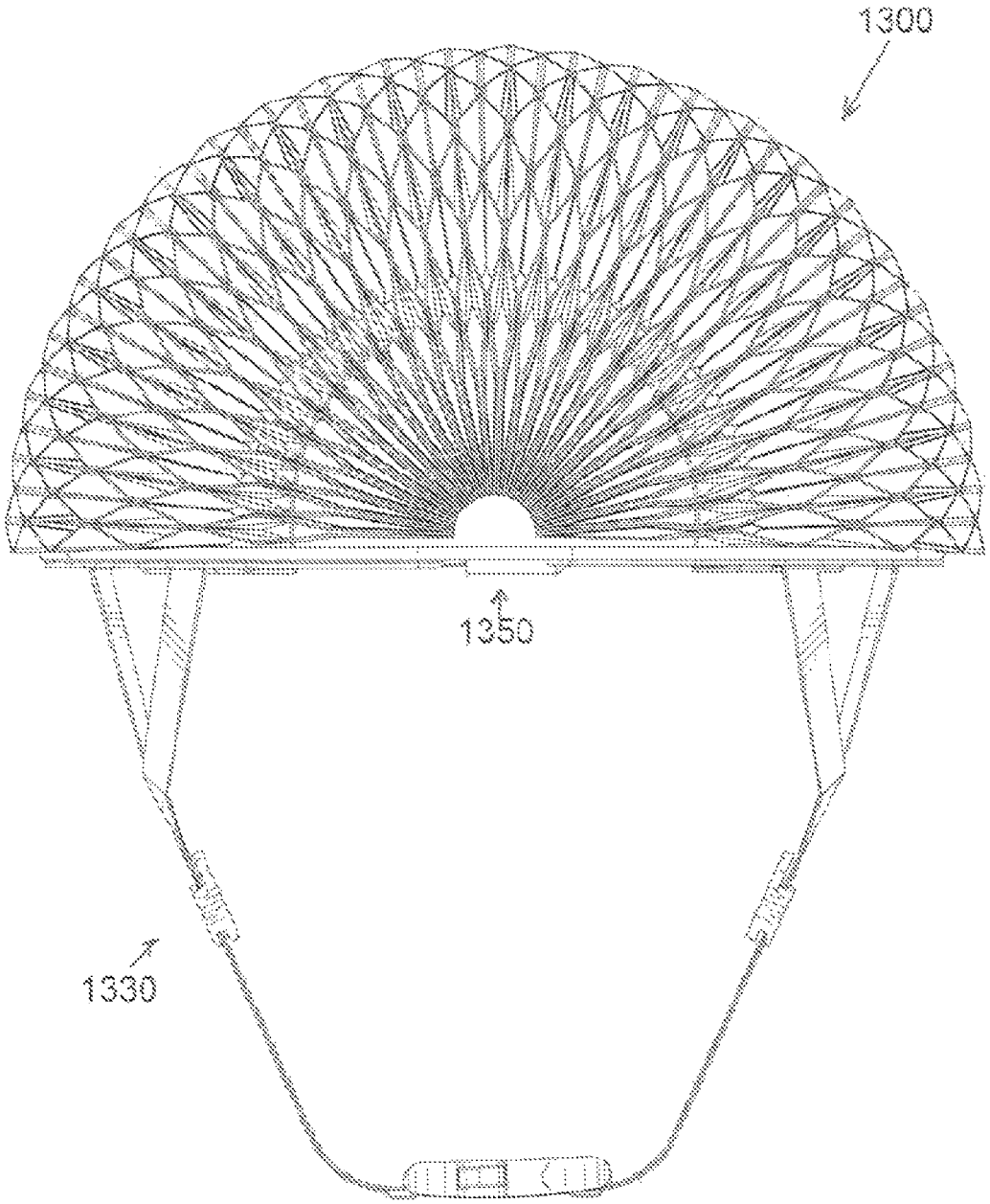
FIG. 112 is a rear view of the helmet of FIG. 108.
Figure 113:
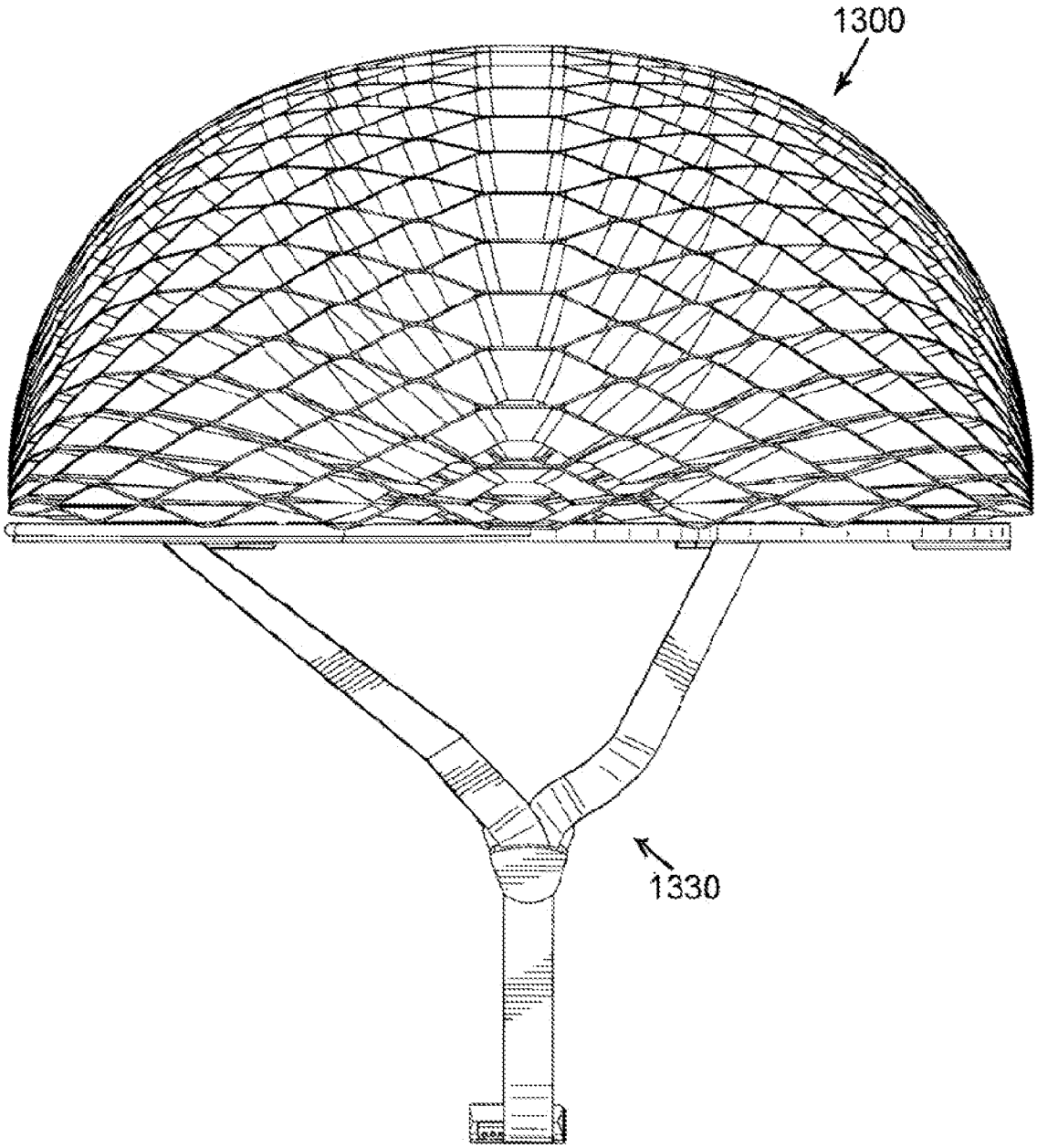
FIG. 113 is a left side view of the helmet of FIG. 108.
Figure 114:
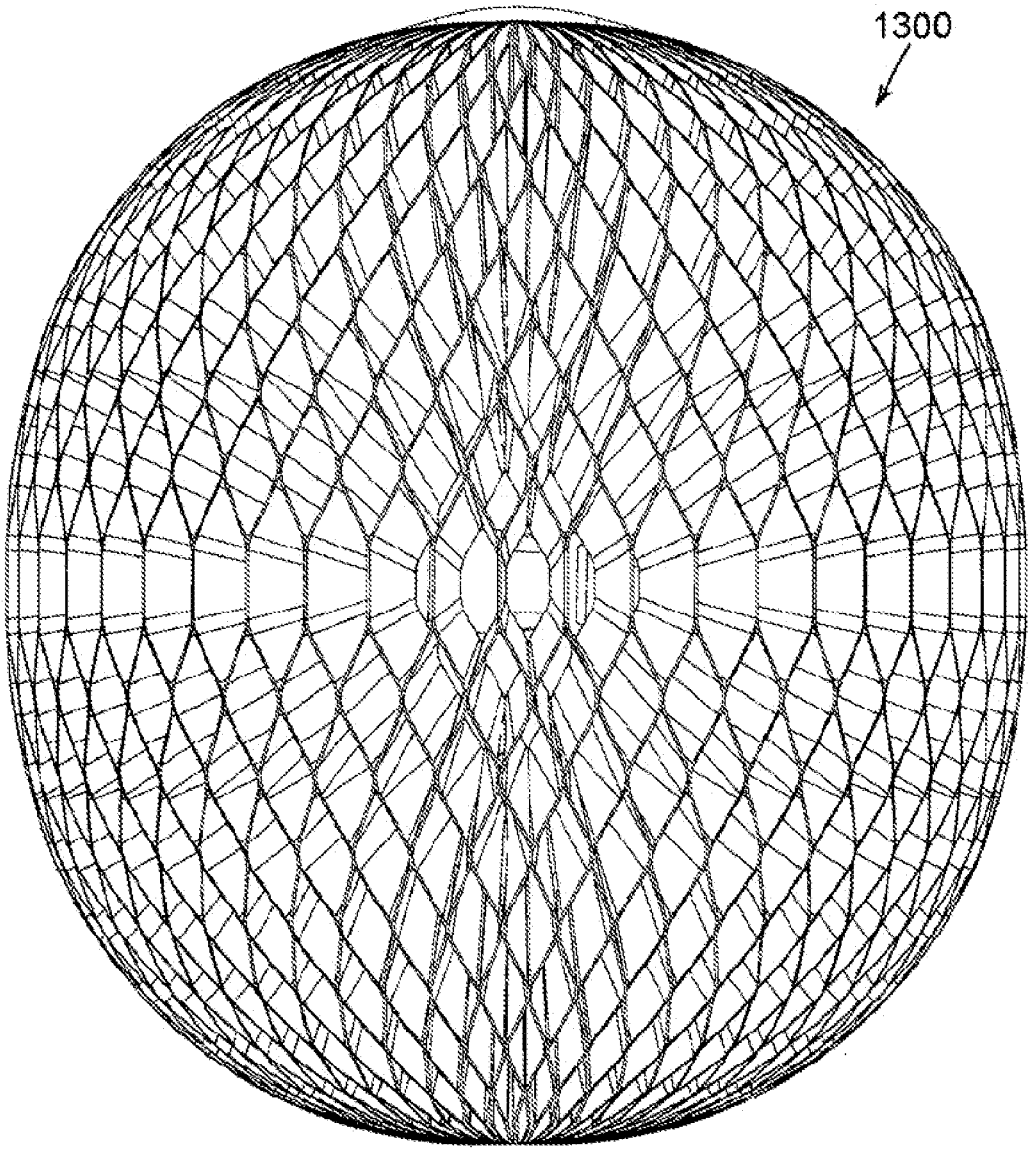
FIG. 114 is a top view of the helmet of FIG. 108.

In additional embodiments, the helmet 1200 may also incorporate internal restriction straps 1280 and 1282 (FIG. 99). In examples, the internal restriction straps 1280 and 1282 are coupled to the side frames 1220, 1222. The internal restriction straps 1280 and 1282 can limit expansion of the helmet 1200 and provide added comfort to the user.

With reference now to FIGS. 108-123 helmet 1300 constructed in accordance to embodiments of the disclosure will be further described. Helmet 1300 includes a continuous segment of flexible cell structures that form a radial honeycomb matrix 1310 that is movable between a folded condition (FIG. 116-122) to an expanded condition (FIG. 108-115). The radial honeycomb matrix 1310 is configured to be expanded at least partially over the head of the user and arranged radially relative to the surface of the head of the user. The helmet 1300 includes first and second solid side frames 1320, 1322 attached to the first and last layers (first and second ends) of the honeycomb matrix 1310. In some embodiments, a chin strap assembly 1330 is connected to each of the solid side frames 1320, 1322. Side straps 1340 and 1342 are configured to be releasably coupled around the head of the user. The helmet 1300 further includes a sliding latch 1350 comprising a receiving portion 1352 and an extending portion 1354. The receiving portion 1352 is shown integrally formed with the side portion 1322 while the extending portion 1354 is shown integrally formed with the side portion 1320. It is appreciated that the locations may be swapped and further that the receiving portion 1352 and/or the extending portion 1354 may be separately formed from the side portions 1320, 1322. The extending portion 1354 is configured to slidably retract into and extend from the receiving portion 1352. The sliding latch 1350 allows the matrix of the helmet to widen (and contract) laterally to accommodate different sizes of heads. Explained further, the side portions 1320 and 1322 can move laterally toward and away from each other along a common plane to alter a head receiving opening 1366 defined between the side portions 1320 and 1322 to accommodate different sized heads.

In other advantages, the sliding latch 1350 inhibits the first and second side frames 1320, 1322 from extending to positions beyond planar (overextending beyond the expanded position) and risking damage to the radial honeycomb matrix 1310. It will be appreciated that while the sliding latch 1350 is shown connecting the respective first and second side frames 1320, 1322 on the front of the helmet 1300, the sliding latch 1350 may be provided on the back of the helmet 1300. Alternatively, a sliding latch 1350 may be provided on both of the front and back of the helmet 1300 that collectively adjust for moving the side frames 1320, 1322 between expanded and contracted positions to adjust for a size of a user's head. It is appreciated that the side frames 1320, 1322 and the sliding latch 1350 cooperate to provide a rigid base to the helmet 1300 as a whole.

Figure 115:
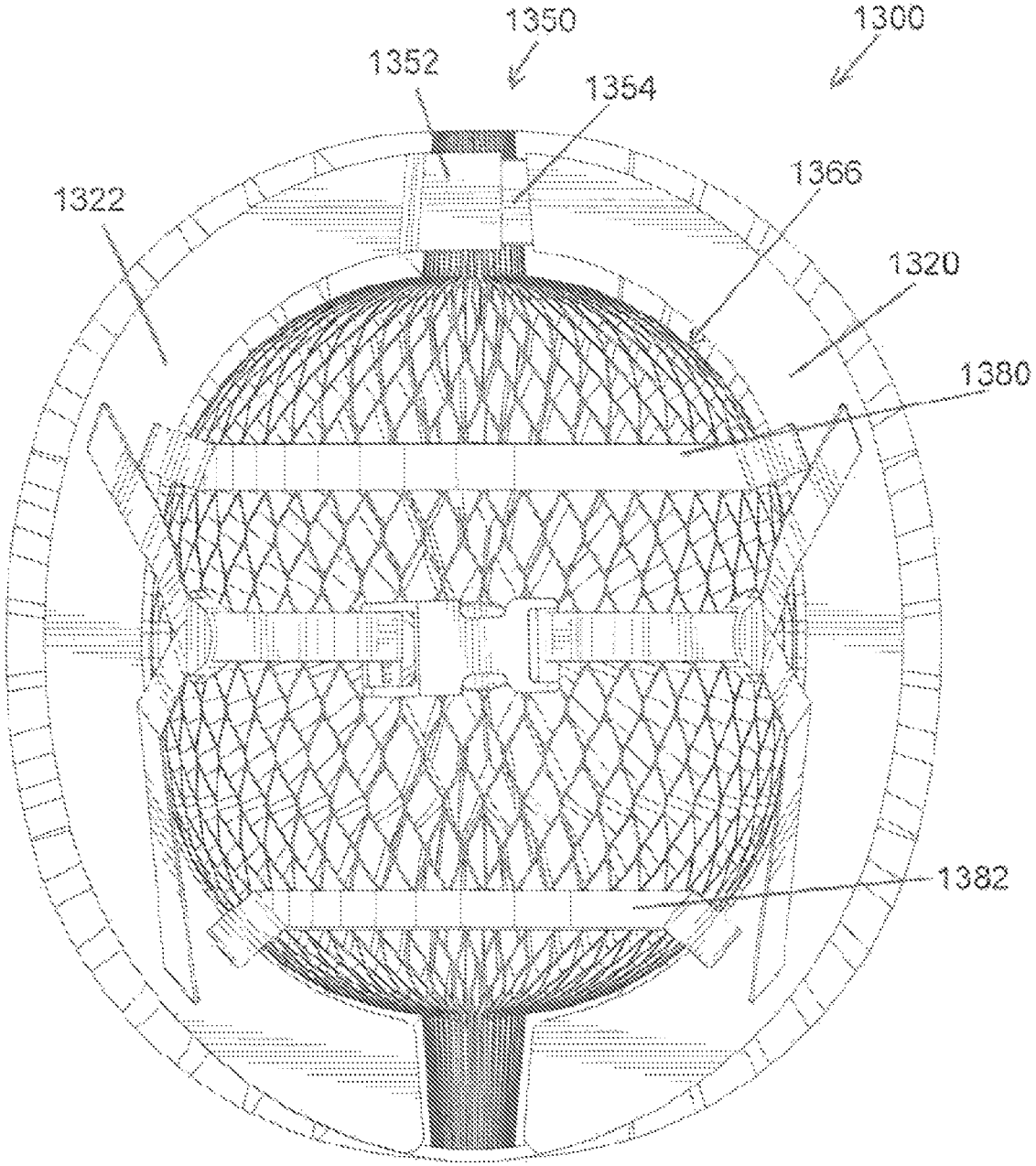
FIG. 115 is a bottom view of the helmet of FIG. 108.
Figure 116:
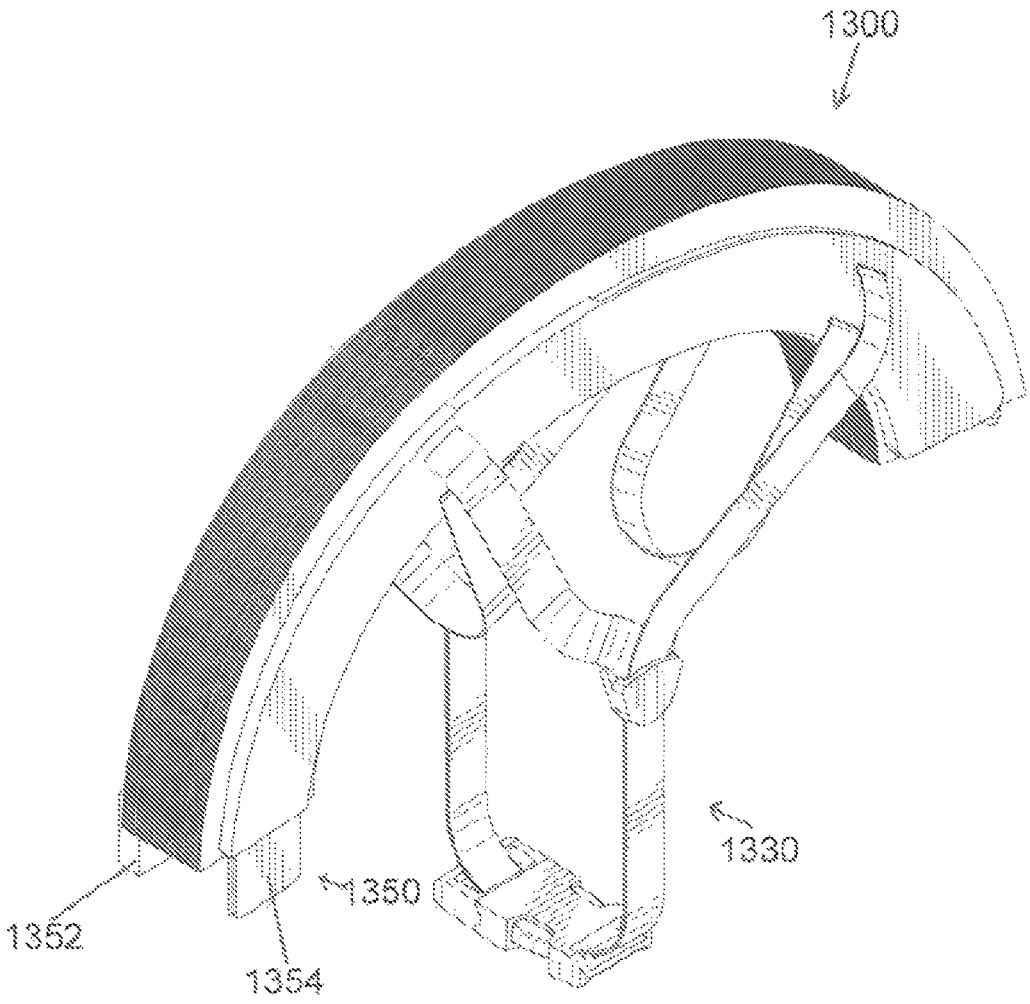
FIG. 116 is a top perspective view of embodiments of a helmet in a collapsed or folded condition in accordance with the present disclosure.
Figure 117:
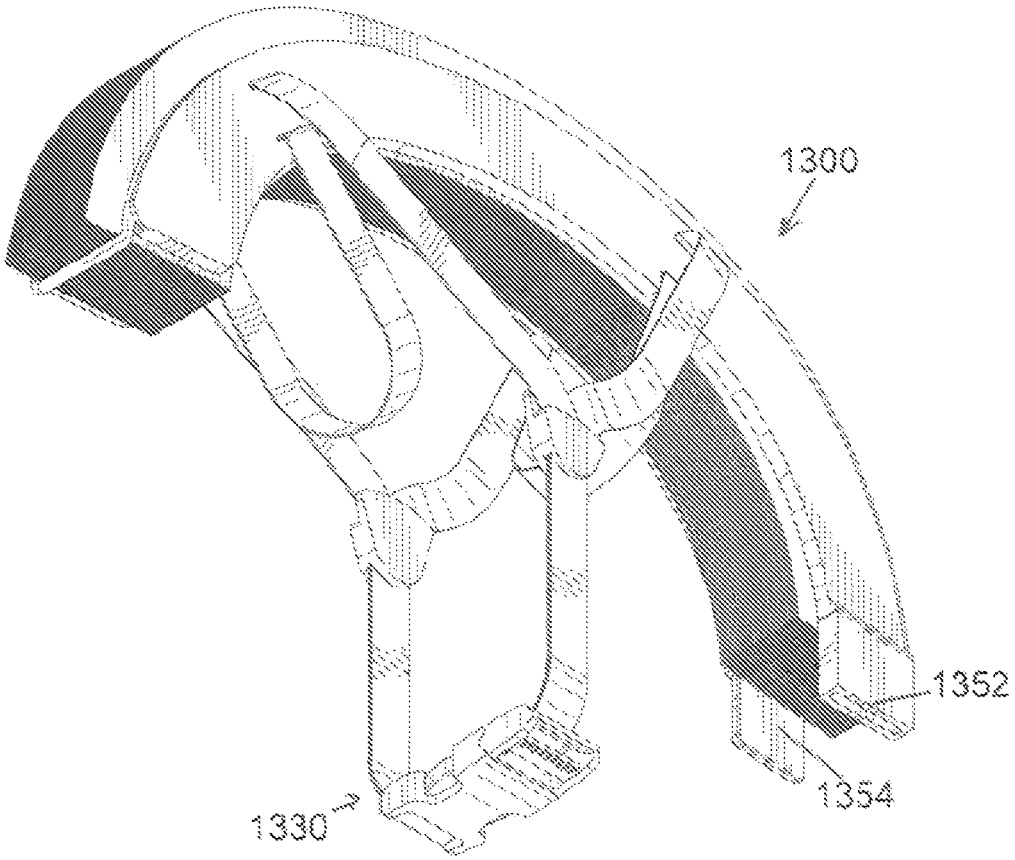
FIG. 117 is a bottom perspective view of the helmet of FIG. 116.
Figure 118:
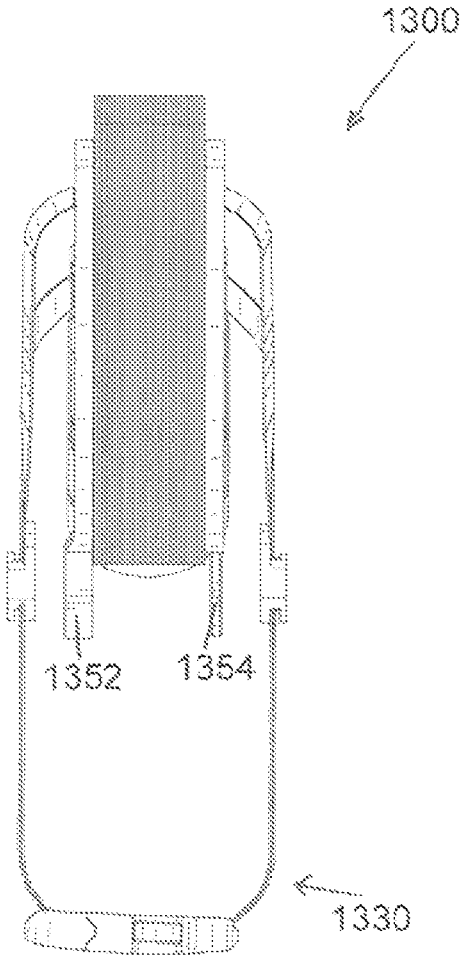
FIG. 118 is a front view of the helmet of FIG. 116.
Figure 119:
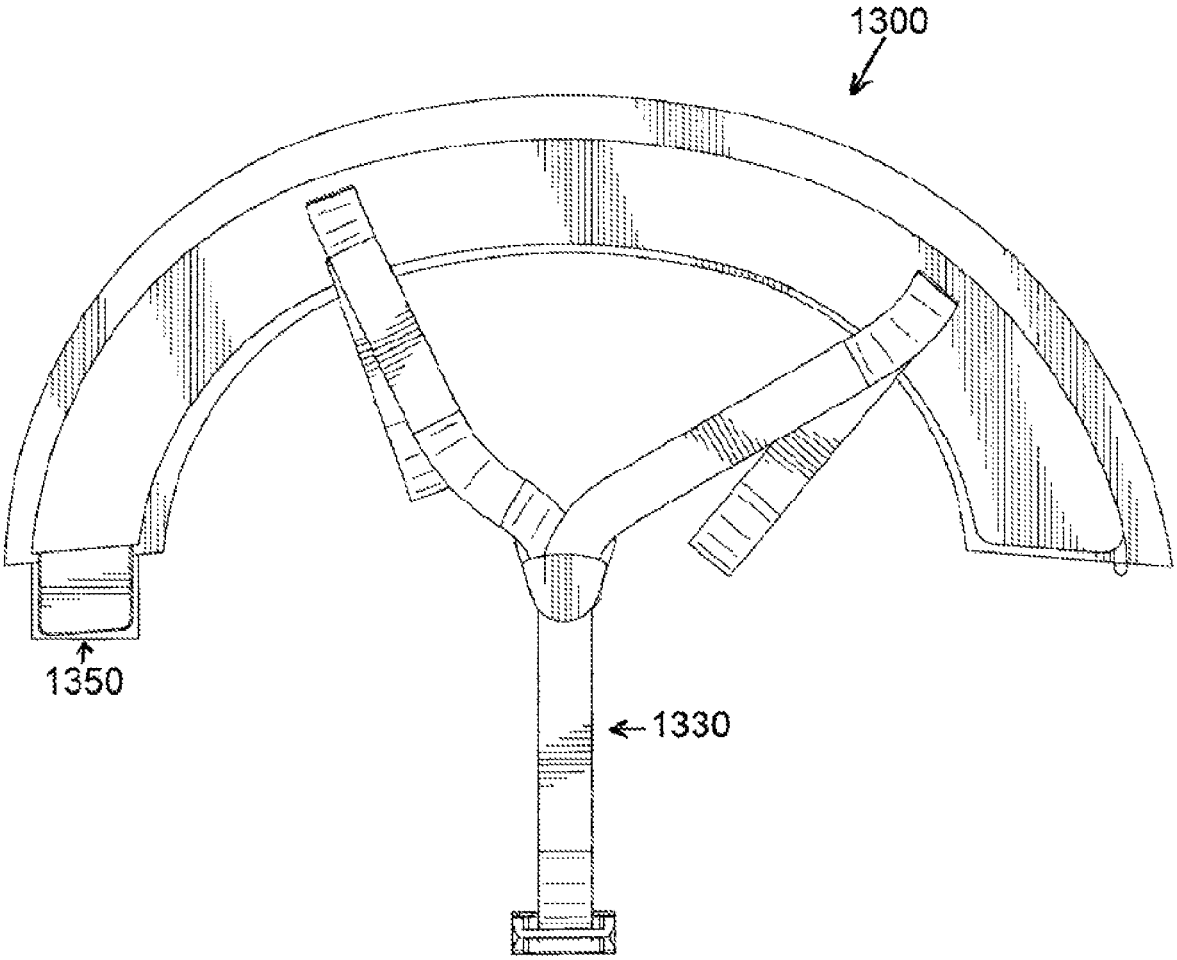
FIG. 119 is a rear view of the helmet of FIG. 116.
Figure 120:
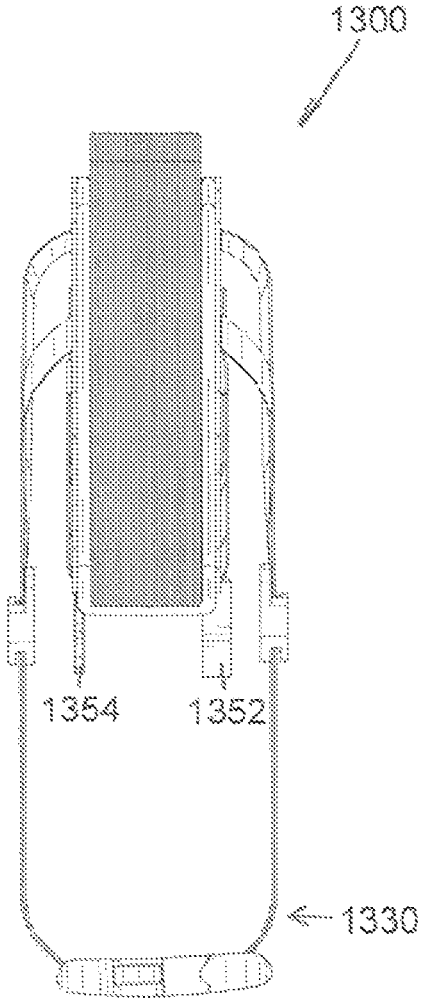
FIG. 120 is a right side view of the helmet of FIG. 116.
Figure 121:
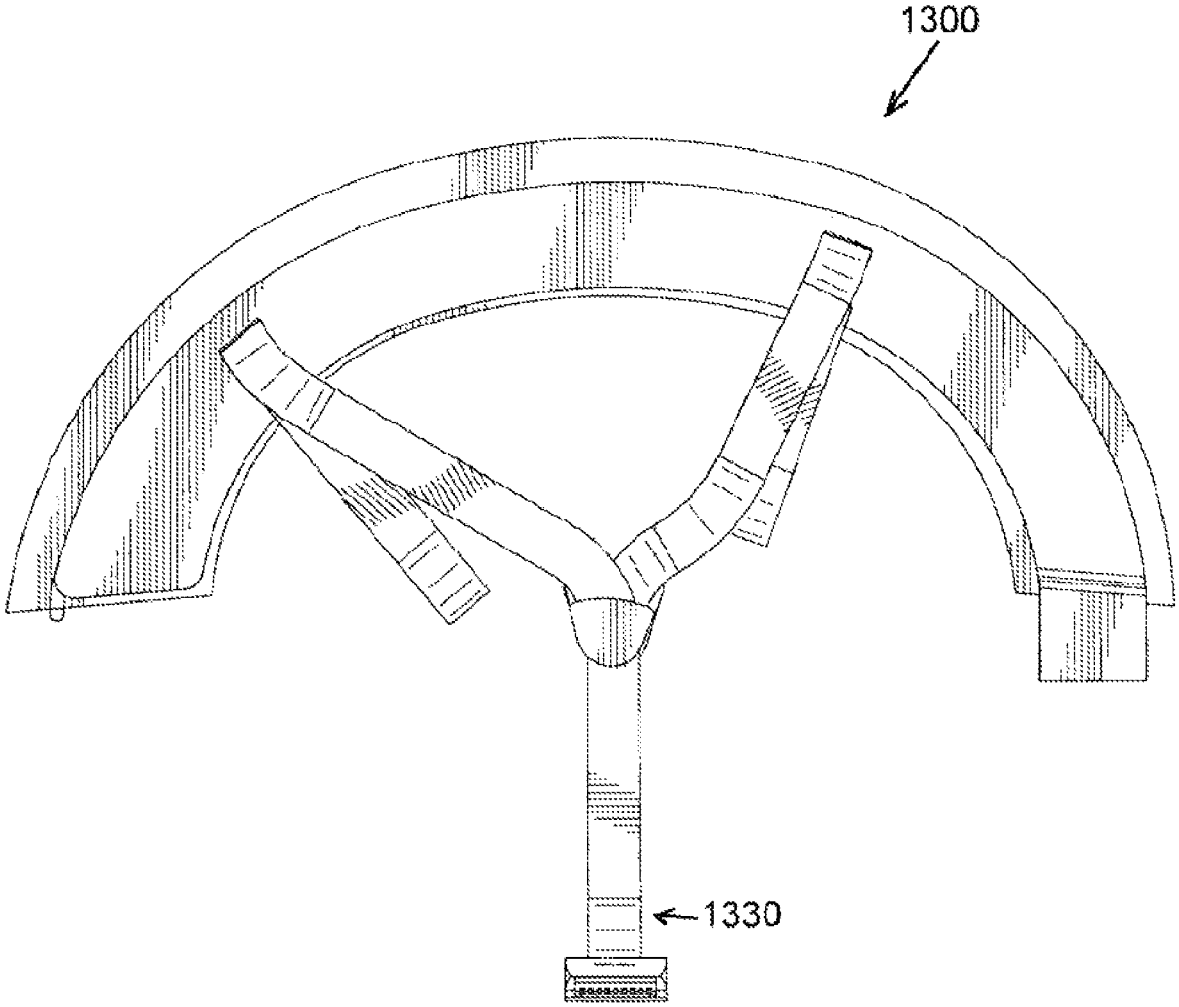
FIG. 121 is a left side view of the helmet of FIG. 116.
Figure 122:
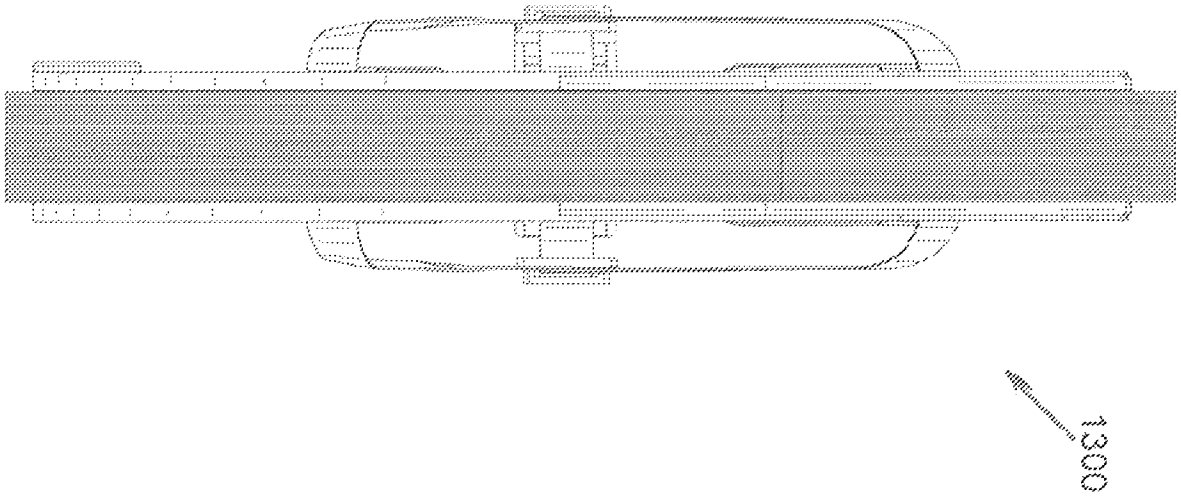
FIG. 122 is a top view of the helmet of FIG. 116.
Figure 123:
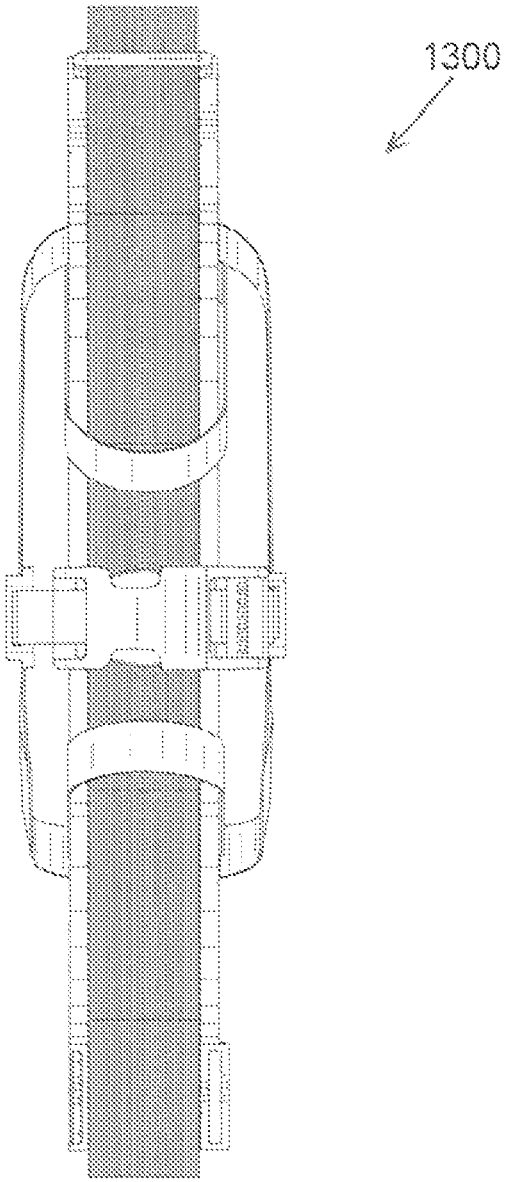
FIG. 123 is a bottom view of the helmet of FIG. 100.
Figure 124:
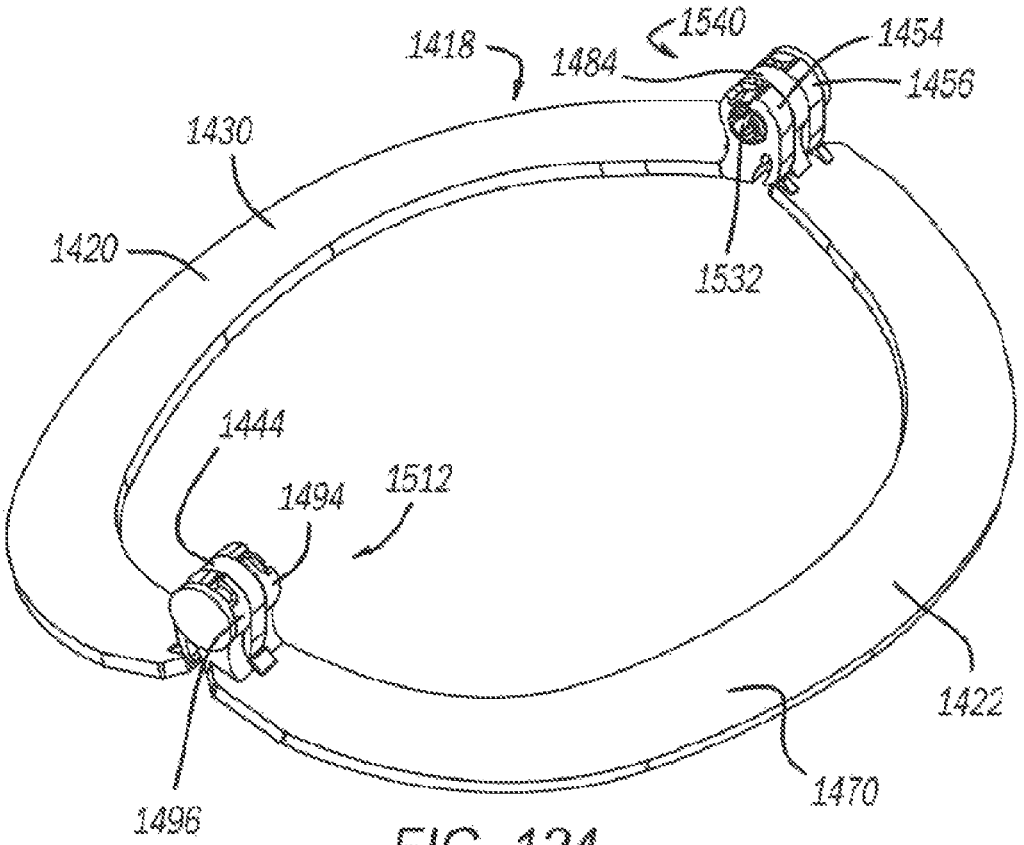
FIG. 124 is a top perspective view of a hinged frame constructed in accordance to one example of the present disclosure.
Figure 125:
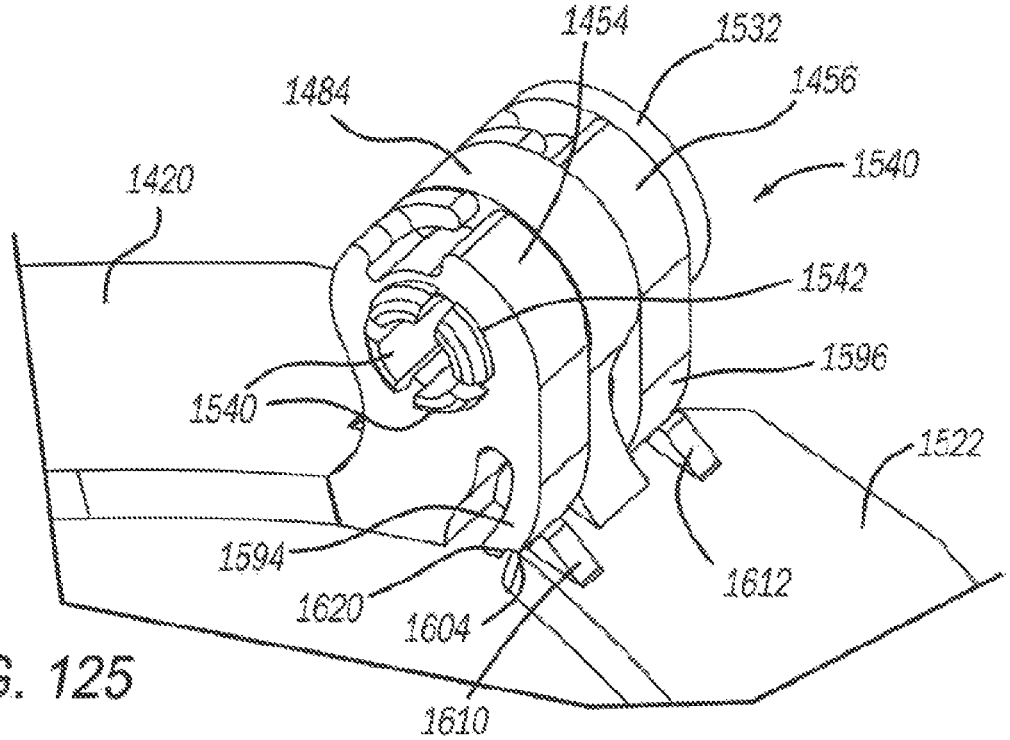
FIG. 125 is a perspective view of a second hinge assembly of the hinged frame of FIG. 124.

In additional embodiments, the helmet 1300 may also incorporate internal restriction straps 1380 and 1382 (FIG. 115). In examples, the internal restriction straps 1380 and 1382 are coupled to the side frames 1320, 1322. The internal restriction straps 1380 and 1382 can limit expansion of the helmet 1300 and provide added comfort to the user.

Figure 130:
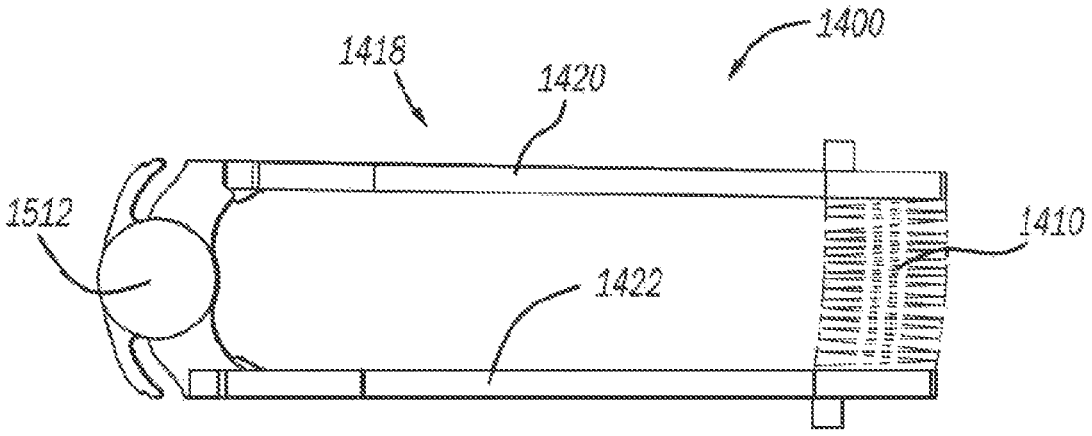
FIG. 130 is a side view of a helmet incorporating the hinged frame of FIG. 124 and shown in the collapsed, folded position.
Figure 131:
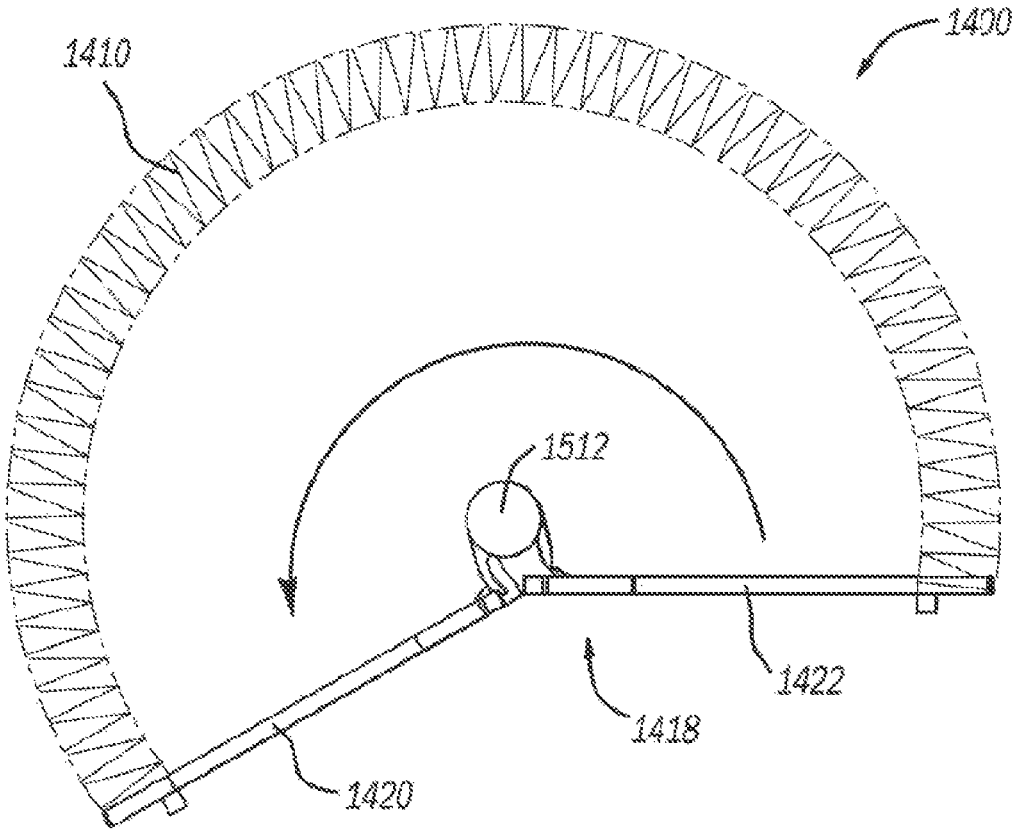
FIG. 131 is a side view of the helmet of FIG. 130 shown rotating the hinged frame from the collapsed, folded position to an expanded, use position.

With reference now to FIGS. 124-133, a helmet 1400 (FIGS. 129 and 130) constructed in accordance to additional examples will be described. The helmet 1400 includes a continuous segment of flexible cell structures that form a radial honeycomb matrix 1410 that is movable between a folded condition (FIG. 130) and an expanded position (FIG. 131). The radial honeycomb matrix 1310 can be constructed similarly to any of the honeycomb matrix examples disclosed herein. The radial honeycomb matrix 1410 is configured to be expanded at least partially over the head of the user and arranged radially relative to the surface of the head of the user (see for example user 110, FIG. 4). The helmet 1400 includes a hinged frame 1418 including first and second solid side frames 1420, 1422 attached to the first and last layers (first and second ends) of the honeycomb matrix 1410.

Figure 126:
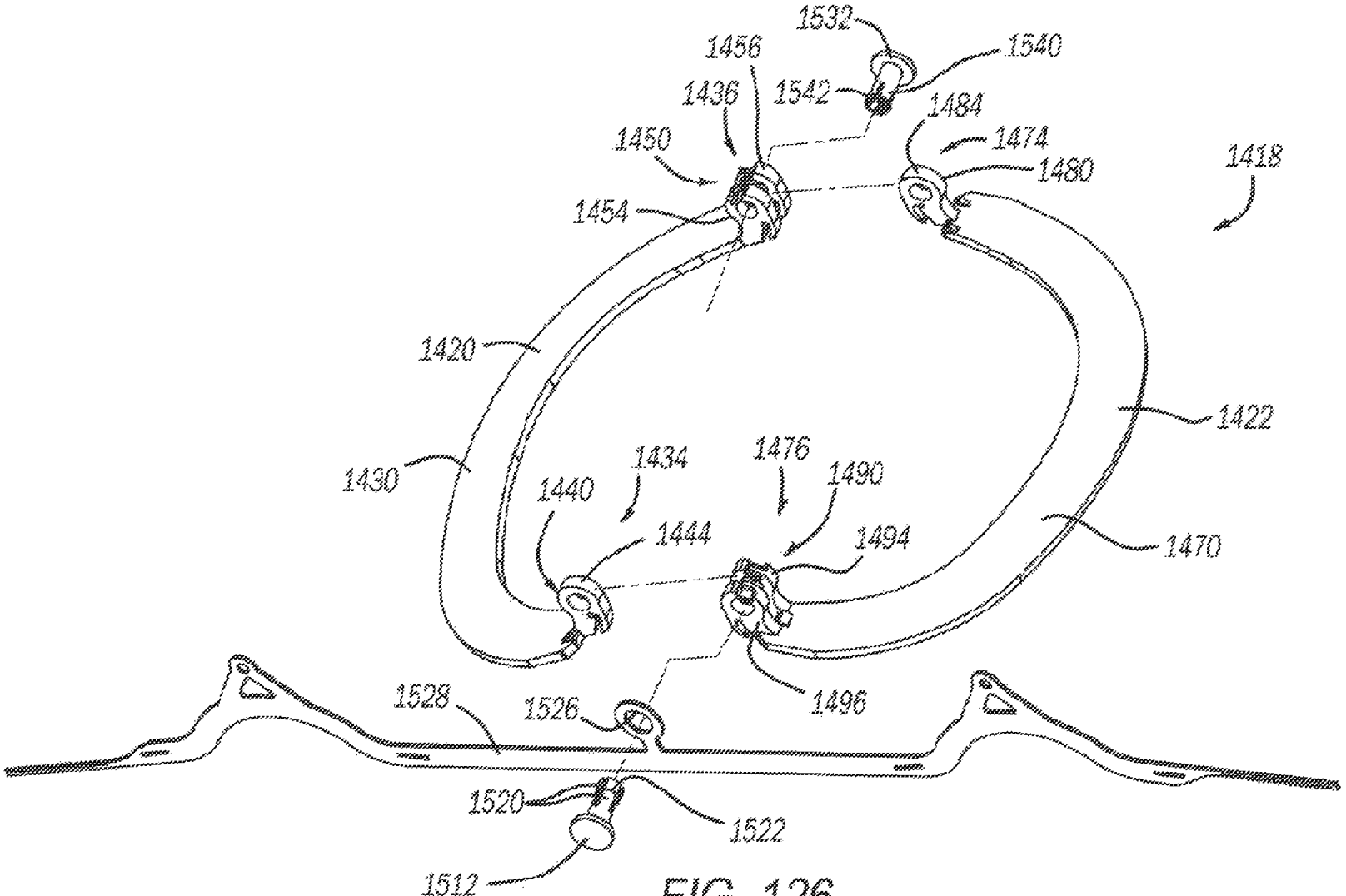
FIG. 126 is a top perspective exploded view of the hinged frame assembly of FIG. 124 shown with an exemplary strap.
Figure 127A:
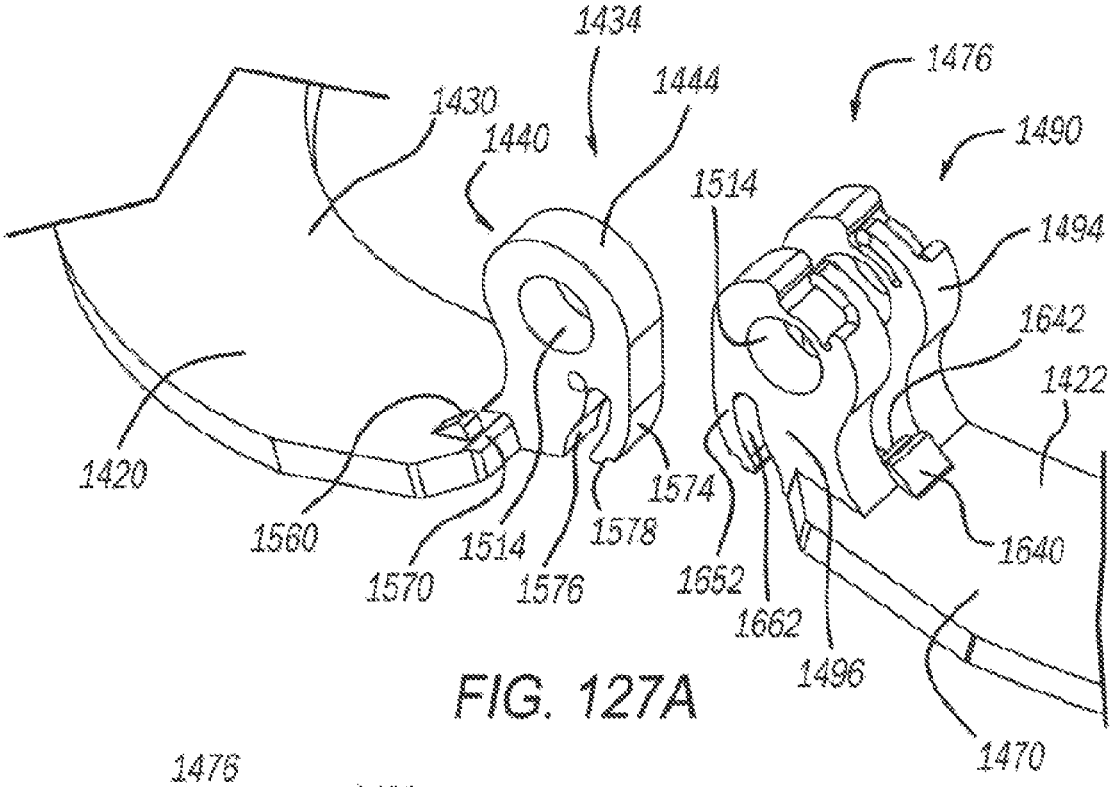
FIG. 127A is a first perspective view of a first hinge assembly of the hinged frame of FIG. 124.
Figure 127B:
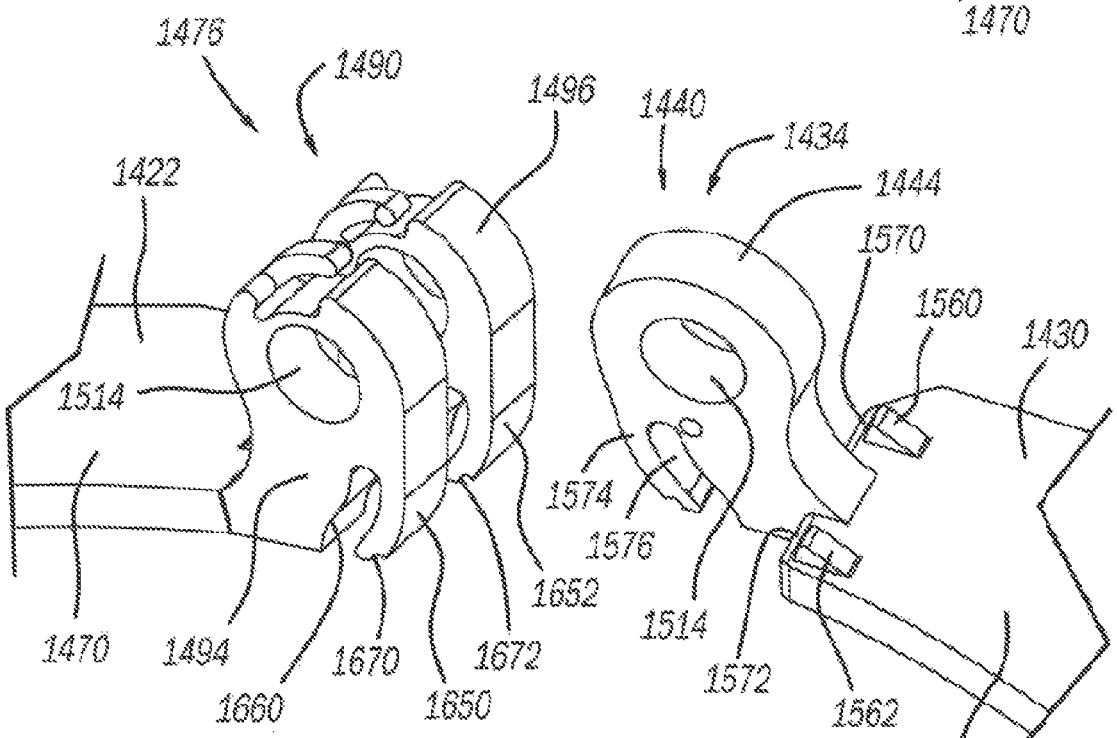
FIG. 127B is a second perspective view of the first hinge assembly of FIG. 127A.
Figure 127C:
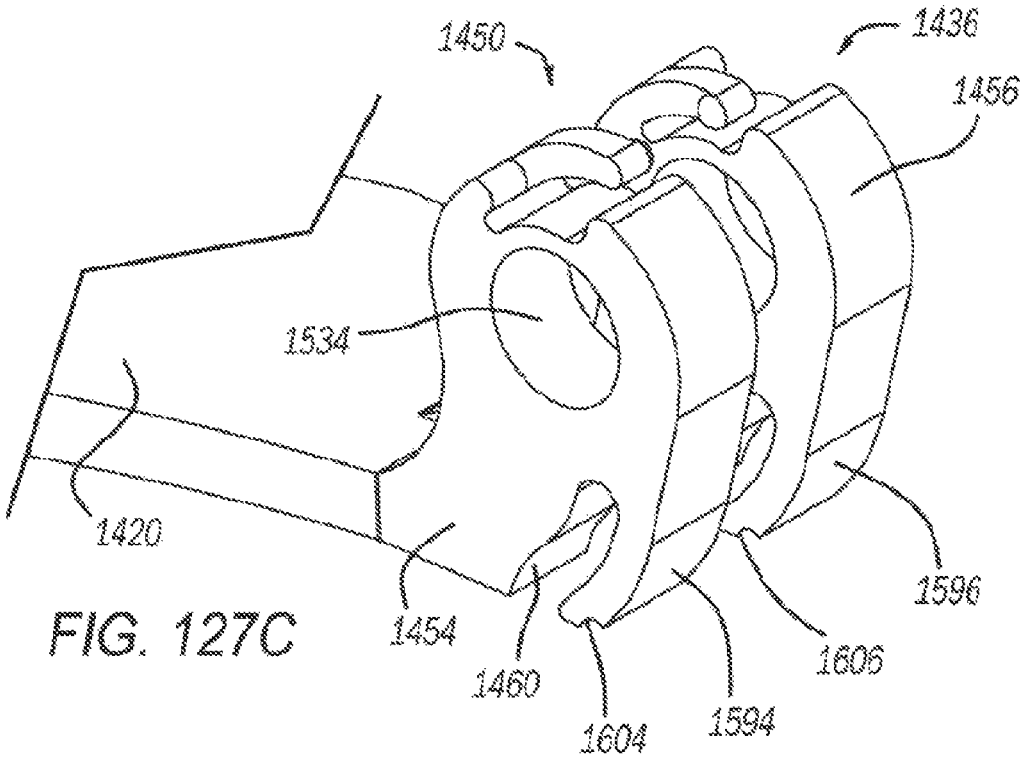
FIG. 127C is a first perspective view of the second hinge assembly.
Figure 127D:
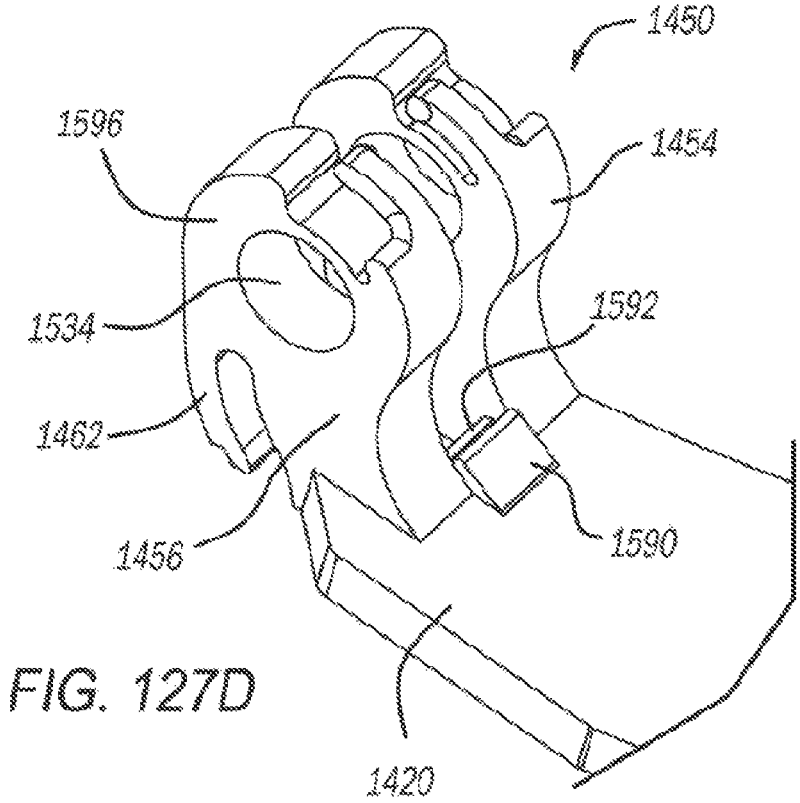
FIG. 127D is a second perspective view of the second hinge assembly.
Figure 128:
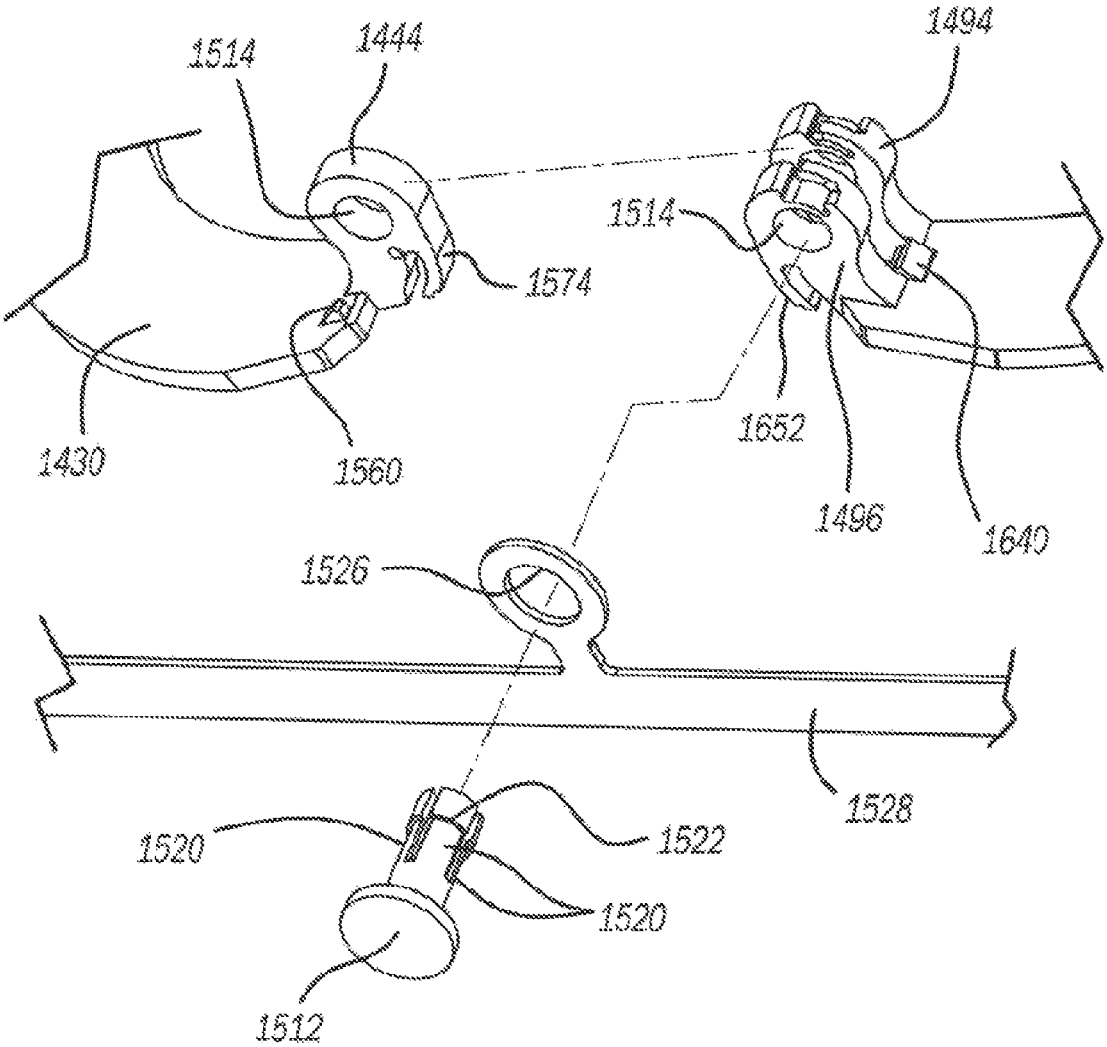
FIG. 128 is an exploded perspective view of the first hinge assembly showing the axle prior to assembly relative to the strap and first hinge assembly.
Figure 129:
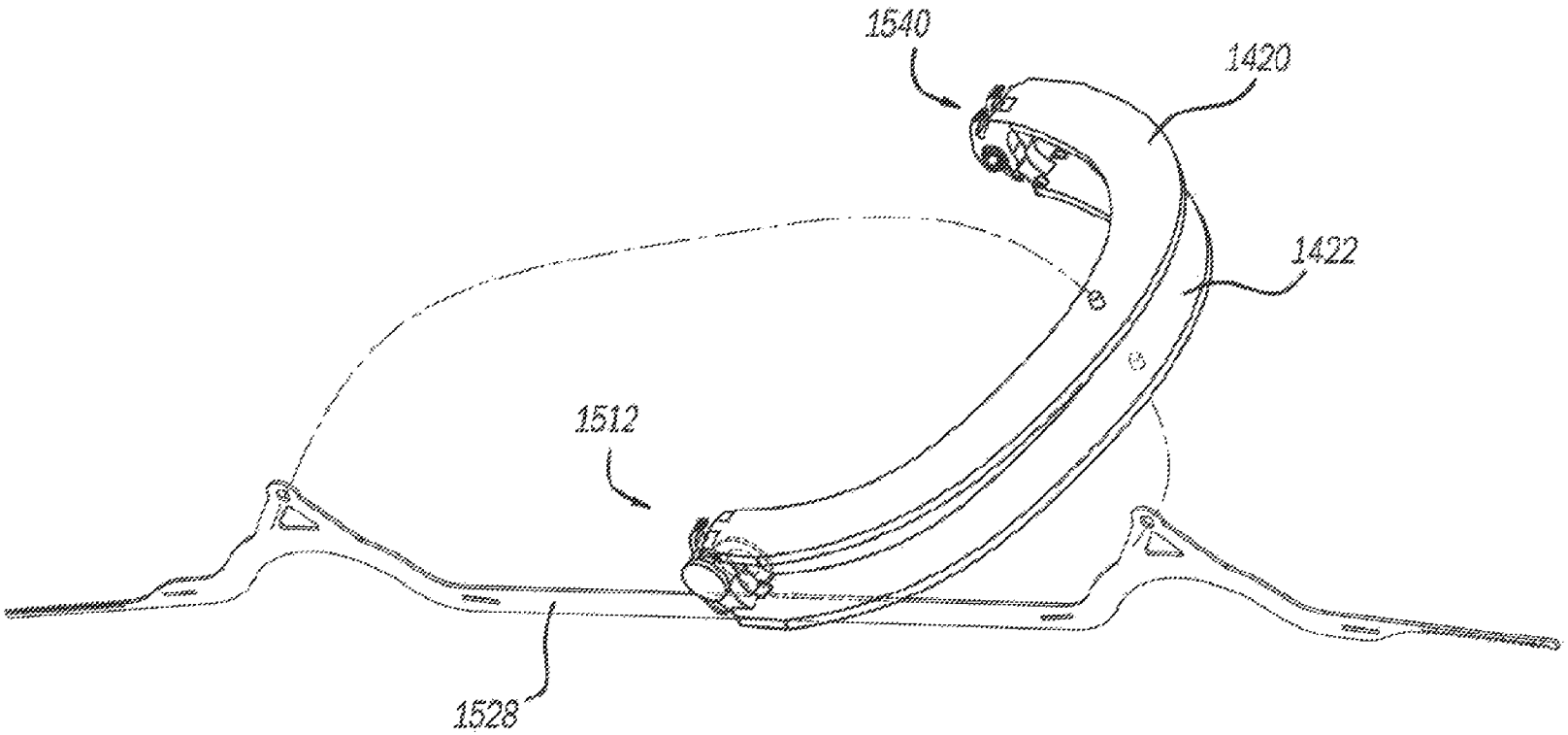
FIG. 129 is a top perspective view of the hinged frame assembly shown in a collapsed, folded position.

With specific reference now to FIGS. 126-127B, additional features of the hinged frame 1418 will be described. While the following discussion assigns distinctly named features and reference numerals to the first and second side frames 1420 and 1422, it will be appreciated that, in examples, the first and second side frames 1420 and 1422 can be constructed similarly. In this regard, as only one component requires manufacturing resources (designing, molding, etc.) manufacturing costs as a whole are reduced.

The first side frame 1420 generally includes an arcuate body portion 1430 that extends between a first hinge portion 1434 and a second hinge portion 1436. In examples, the first hinge portion 1434 can include a single hinge arm 1440 that includes a first hinge arm 1444. The second hinge portion 1436 can include a dual hinge arm 1450 that includes a second hinge arm 1454 and a third hinge arm 1456.

The second side frame 1422 generally includes an arcuate body portion 1470 that extends between a third hinge portion 1474 and a fourth hinge portion 1476. In examples, the third hinge portion 1474 can include a single hinge arm 1480 that includes a fourth hinge arm 1484. The fourth hinge portion 1476 can include a dual hinge arm 1490 that includes a fifth hinge arm 1494 and a sixth hinge arm 1496. In an assembled condition (FIG. 124), the first and fourth hinge portions 1434 and 1476 cooperate to form a first hinge assembly 1510. To assemble the first hinge assembly 1510, the first hinge arm 1444 is located between the fifth and sixth hinge arms 1494 and 1496. In the example shown, a first axle 1512 is passed through a common aperture 1514 defined through the sixth hinge arm 1496, the first hinge arm 1444 and the fifth hinge arm 1494. In examples, the first axle 1512 can include a series of fingers 1520 that snapingly pass through the common aperture 1514 during assembly. In examples, the fingers 1520 can collectively define a terminal ridge 1522 that elastically deflects the fingers 1520 inward during insertion of the first axle 1512 through the common aperture 1514 and rebounds outwardly after passing through the common aperture 1514. In the example shown, the first axle 1512 also passes through an aperture 1526 of a strap 1528.

Similarly, the second and third hinge portions 1436 and 1474 cooperate to form a second hinge assembly 1520. To assemble the second hinge assembly 1540, the fourth hinge arm 1484 is located between the second and third hinge arms 1454 and 1456. In the example shown, a second axle 1532 is passed through a common aperture 1534 defined through the third hinge arm 1456, the fourth hinge arm 1484 and the second hinge arm 1454. In examples, the second axle 1532 can include a series of fingers 1540 that snapingly pass through the common aperture 1514 during assembly. In examples, the fingers 1540 can collectively define a terminal ridge 1542 that elastically deflects the fingers 1540 inward during insertion of the first axle 1532 through the common aperture 1534 and rebounds outwardly after passing through the common aperture 1534.

With particular reference to FIGS. 127A-127D, 130 and 131, additional features of the hinged frame will now be described. The hinged frame is movable between a folded, collapsed or storage position (FIG. 130) and an expanded or use position (FIG. 131). For clarity, only portions of the honeycomb matrix 1410 is shown in FIGS. 130 and 131 with the understanding that the whole honeycomb matrix 1410 moves with the hinged frame 1418 between the folded and expanded positions. The arcuate body portion 1430 of the first side frame 1420 includes first and second ramp portions 1560 and 1562 (FIG. 127B) located generally on opposite sides of the first hinge arm 1444. A first locating ridge 1570 is disposed on the first side frame 1420 proximate to the first ramp portion 1560. A second locating ridge 1572 is disposed on the first side frame 1420 proximate to the second ramp portion 1562. A first finger 1574 extends from the first hinge arm 1444. A notch 1576 is generally defined on the first hinge arm 1444 for accommodating plastic deformation of the first finger 1574 during opening and closing of the helmet 1400. In this regard, the first finger 1574 is resilient and configured to plastically deflect into the notch 1576 as will become appreciated herein. The first finger 1574 includes a first lip 1578. The arcuate body portion 1430 of the first side frame 1420 further includes a third ramp portion 1590 (FIG. 127D) located generally between the second and third hinge arms 1454 and 1456. A third locating ridge 1592 is disposed on the first side frame 1420 adjacent to the third ramp portion 1590.

A second finger 1594 and a third finger 1596 extend from the second and third hinge arms 1454 and 1456, respectively. A notch 1460 is generally defined on the third hinge arm 1454 for accommodating plastic deformation of the third finger 1594 during opening and closing of the helmet 1400. A notch 1462 is generally defined on the third hinge arm 1456 for accommodating plastic deformation of the third finger 1594 during opening and closing of the helmet 1400. In this regard, the second and third fingers 1594 and 1596 are resilient and configured to plastically deflect into the respective notches 1460 and 1462 as will become appreciated herein. The second and third fingers 1594, 1596 include a lip 1604 and 1606, respectively.

The arcuate body portion 1470 of the second side frame 1422 includes third and fourth ramp portions 1610 and 1612 (FIG. 127C) located generally on opposite sides of the third hinge arm 1484. A fourth locating ridge 1620 is disposed on the second side frame 1422 proximate to the third ramp portion 1560. A fifth locating ridge 1622 is disposed on the second side frame 1422 proximate to the fifth ramp portion 1612. A fourth finger 1630 extends from the fourth hinge arm 1484. A notch 1636 is generally defined on the fourth hinge arm 1484 for accommodating plastic deformation of the fourth finger 1484 during opening and closing of the helmet 1400. In this regard, the fourth finger is resilient and configured to plastically deflect into the notch 1576 as will become appreciated herein. The fourth finger 1630 includes a fourth lip 1636. The arcuate body portion 1470 of the second side frame 1422 further includes a sixth ramp portion 1640 (FIG. 127A) located generally between the fifth and sixth hinge arms 1494 and 1496. A sixth locating ridge 1642 is disposed on the second side frame 1422 adjacent to the sixth ramp portion 1640.

A fifth finger 1650 and a sixth finger 1652 extend from the fifth and sixth hinge arms 1494 and 1496, respectively. A notch 1660 is generally defined on the fifth hinge arm 1494 for accommodating plastic deformation of the fifth finger 1650 during opening and closing of the helmet 1400. A notch 1662 is generally defined on the sixth hinge arm 1496 for accommodating plastic deformation of the sixth finger 1652 during opening and closing of the helmet 1400. In this regard, the fifth and sixth fingers 1650 and 1652 are resilient and configured to plastically deflect into the respective notches 1660 and 1662 as will become appreciated herein. The fifth and sixth fingers 1650, 1652 include a lip 1670 and 1672, respectively.

Figure 132:
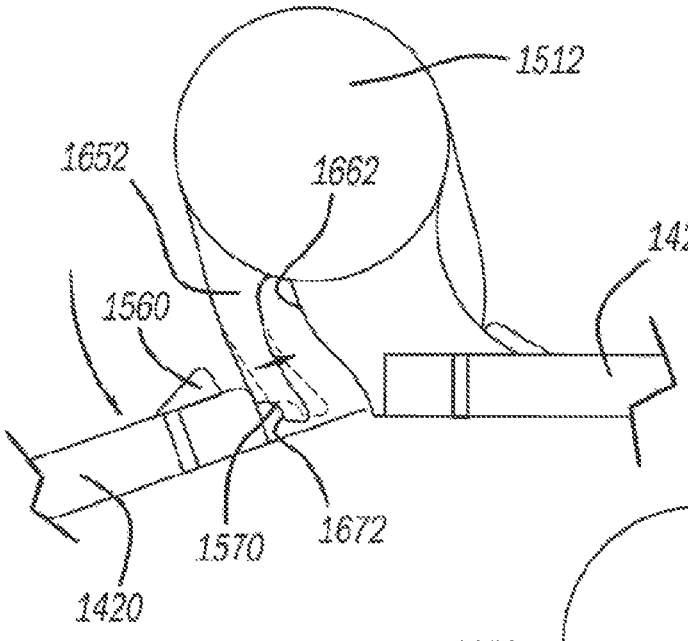
FIG. 132 is a side view of a sixth finger being initially deflecting into a notch resulting from slidably encountering the first side frame and prior to locating at a first locating ridge during movement of the hinged frame from the folded position toward the expanded position.
Figure 133:
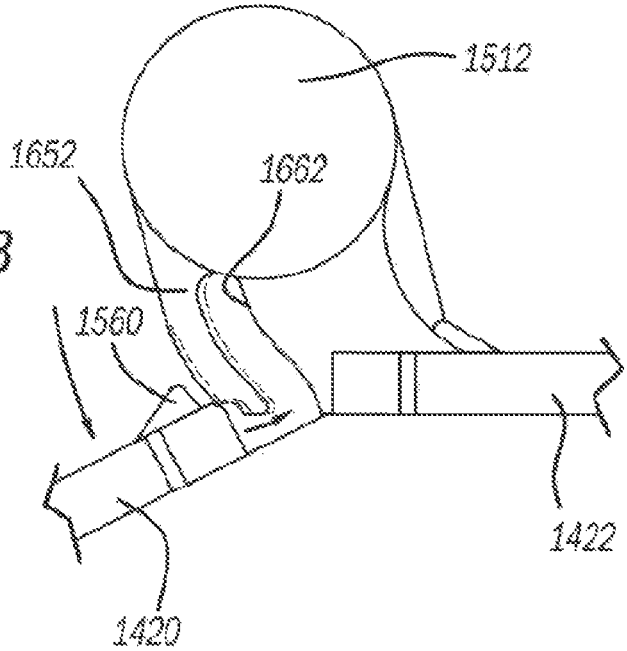
FIG. 133 is the side view of the sixth finger moving closer toward the first locating ridge resulting from further rotation of at least one of the first and second frames beyond parallel.
Figure 134:
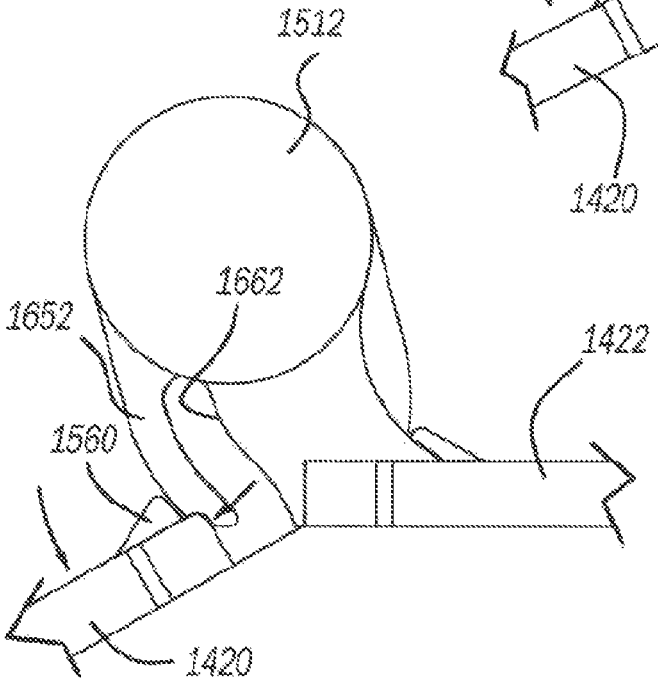
FIG. 134 is the side view of the sixth finger moving to a position where a lip on the sixth finger locates at the first locating ridge once the hinged frame reaches the use position.

With additional reference now to FIGS. 132-134, the interaction of the sixth finger 1652 with the first locating ridge 1570 during opening of the helmet 1400 toward and into the expanded, use position will be described. While the following discussion is specific to the sixth finger 1652 positively locating with respect to the first locating ridge 1570, it will be appreciated that the same interaction occurs substantially simultaneously with the remaining first, second, third, fourth and fifth fingers 1574, 1594, 1596, 1630, and 1650 and their respective locating ridges. In particular, the first finger 1574 locates onto ridge 1542. The second finger 1594 locates onto ridge 1620. The third finger 1596 locates onto ridge 1622. The fourth finger 1630 locates onto ridge 1592. The fifth finger 1650 locates onto ridge 1572.

Referring again to FIGS. 127A and 127B, during movement of the first and second frames 1420 and 1422 toward the expanded, use position, the sixth finger 1652 initially rides along the first frame member 1420 until which point the lip 1672 locates at the first locating ridge 1570. It is appreciated that during the initial riding of the sixth finger 1652 along the first frame member 1420 near the first locating ridge 1570, the sixth finger 1652 partially deflects into the notch 1662 (see FIGS. 132 and 133). Once the lip 1672 reaches the first locating ridge 1570, the sixth finger 1652 rebounds back to its normal position (to an undeflected position, FIG. 134). It will be appreciated that the first and second frame members 1420 and 1422 reach a position beyond 180 degrees (past parallel) in the use position. The interaction of the first locating ridge 1570 and lip 1672 in combination with the sixth finger 1652 returning to its normal at-rest position causes an audible clicking noise and a tactile setting feedback to the user. Such tactile and audible feedback confirms to the user that the helmet 1400 has reached the expanded, use position and is ready for use. Again, this tactile and audible feedback is being provided by the collective interaction of all of the six fingers and their respective locating ridges providing a helmet that moves into and out of the use position in a robust, confident and repeatable manner.

In order to return the helmet 1400 back to the collapsed position, the user must rotate the frame members 1420 and 1422 back toward the collapsed position (FIG. 130). Because the locating ridge 1570 and the lip 1672 are in a set position, a user must overcome the force of the finger interaction to which point the sixth finger 1652 is urged back into the notch 1662 (moving from a position shown in FIG. 134 to a position shown in FIG. 133) such that the lip 1672 moves out of the locating ridge 1570.

While the disclosure has been disclosed in connection with the examples shown and described in detail, various modifications and improvements thereon will become readily apparent to those skilled in the art. Accordingly, the spirit and scope of the present disclosure is not to be limited by the foregoing examples but is to be understood in the broadest sense allowable by law.

Detailed aspects of the present disclosure are disclosed herein; however, it is to be understood that the disclosed aspects are merely exemplary of the disclosure, which may be constructed in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

The method steps of the implementations described herein are intended to include any suitable method of causing such method steps to be performed, consistent with the patentability of the following claims, unless a different meaning is expressly provided or otherwise clear from the context. For example, performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "set" is to be construed as a group having one or more members. Recitations of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

While the foregoing written description enables one skilled in the art to make and use what is considered presently to be the best mode thereof, those skilled in the art will understand and appreciate the existence of variations, combinations, and equivalents of the specific embodiment, method, and examples herein. The disclosure should therefore not be limited by the above described embodiment, method, and examples, but by all embodiments and methods within the scope and spirit of the disclosure. All documents referenced herein are hereby incorporated by reference.

What is claimed is:

1. A bicycle helmet for fitting over a head of a user, the bicycle helmet comprising:

a segment of flexible cell structures that form a radial honeycomb matrix between first and second ends, the segment movable between a folded condition where each of the first and second ends of the segment are disposed generally parallel and an expanded condition where the radial honeycomb matrix of the at least one segment is configured to be expanded at least partially over the head of the user and arranged radially relative to the surface of the head of the user;

a first side frame disposed at the first end of the honeycomb matrix, the first side frame including a first hinge arm having a first finger extending therefrom, the first hinge arm defining a first notch adjacent to the first finger, the first finger having a first lip formed thereon; and a second side frame disposed at the second end of the honeycomb matrix, the second side frame including a first locating ridge;

wherein during movement of at least one of the first and second side frames toward an expanded use position, the first finger (i) slidably moves across the second side frame causing the first finger to be initially deflected into the first notch followed by (ii) the first lip positively locating at the first locating ridge.

2. The bicycle helmet of claim 1 wherein movement of the first lip at the first locating ridge causes an audible sound and positive tactile feedback.

3. The bicycle helmet of claim 2 wherein the first side frame includes a second locating ridge and the second side frame includes a second hinge arm having a second finger extending therefrom, the second hinge arm defining a second notch adjacent to the second finger, the second finger having a second lip formed thereon;

wherein during movement of the at least one of the first and second side frames toward the expanded use position, the second finger (i) slidably moves across the first side frame causing the second finger to be initially deflected into the second notch followed by (ii) the second lip positively locating at the second locating ridge.

4. The bicycle helmet of claim 3 wherein movement of the second lip at the second locating ridge causes an audible sound and positive tactile feedback.

5. The bicycle helmet of claim 4 wherein the first and second hinge arms define a common aperture, the helmet further comprising a first axle that locates through the common aperture creating a first hinge assembly.

6. The bicycle helmet of claim 5 wherein the first axle includes a series of fingers that snapingly pass through the common aperture during assembly.

7. The bicycle helmet of claim 6 wherein the series of fingers collectively include a terminal ridge, wherein the series of fingers initially deflect inward until the terminal ridge clears the first and second hinge arms.

8. The bicycle helmet of claim 5 wherein the first side frame includes a third hinge arm having a third finger extending therefrom, the third hinge arm defining a third notch adjacent to the third finger, the third finger having a third lip formed thereon, the second side frame including a second locating ridge;

wherein during movement of at least one of the first and second side frames toward an expanded use position, the third finger (i) slidably moves across the second side frame causing the third finger to be initially deflected into the third notch followed by (ii) the third lip positively locating at the third locating ridge.

9. The bicycle helmet of claim 8 wherein the second hinge arm locates intermediate the first and third hinge arms, wherein the common aperture is further defined through the third hinge arm, the first axle passing through each of the first, second and third hinge arms.

10. The bicycle helmet of claim 1, further comprising internal restriction straps disposed along an inside surface of the helmet, the internal restriction straps configured to limit expansion of the helmet beyond the expanded position.

11. The bicycle helmet of claim 5 wherein the internal restriction straps are coupled to the respective side frames.

12. The bicycle helmet of claim 1 further comprising a chin strap assembly connected to the first and second frame members.

13. The bicycle helmet of claim 1 wherein the flexible cell structures of the radial honeycomb matrix of the at least one segment are each configured to be located adjacent to and positioned generally perpendicular to a portion of the surface of the head of the user.

14. The bicycle helmet of claim 1 wherein the first and second frames are positioned parallel relative to each other in the folded position.

15. The bicycle helmet of claim 1 wherein the first and second frames rotate to a position beyond parallel in the expanded use position.

16. A bicycle helmet for fitting over a head of a user, the bicycle helmet comprising:

a segment of flexible cell structures that form a radial honeycomb matrix between first and second ends, the segment movable between a folded condition where each of the first and second ends of the segment are disposed generally parallel and an expanded condition where the radial honeycomb matrix of the at least one segment is configured to be expanded at least partially over the head of the user and arranged radially relative to the surface of the head of the user;

a first side frame disposed at the first end of the honeycomb matrix, the first side frame including:

a first hinge arm having a first finger extending therefrom, the first hinge arm defining a first notch adjacent to the first finger, the first finger having a first lip formed thereon;

a third hinge arm having a third finger extending therefrom, the third hinge arm defining a third notch adjacent to the third finger, the third finger having a third lip formed thereon; and a second locating ridge;

a second side frame disposed at the second end of the honeycomb matrix, the second side frame including:

a second hinge arm having a second finger extending therefrom, the second hinge arm defining a second notch adjacent to the second finger, the second finger having a second lip formed thereon; and a first and third locating ridge;

wherein during movement of at least one of the first and second side frames toward an expanded use position;

the first finger (i) slidably moves across the second side frame causing the first finger to be initially deflected into the first notch followed by (ii) the first lip positively locating at the first locating ridge;

the second finger (iii) slidably moves across the second side frame causing the second finger to be initially deflected into the second notch followed by (iv) the second lip positively locating at the second locating ridge; and the third finger (v) slidably moves across the first side frame causing the third finger to be initially deflected into the third notch followed by (vi) the third lip positively locating at the third locating ridge.

17. The bicycle helmet of claim 16 wherein the second hinge arm locates intermediate the first and third hinge arms.

18. The bicycle helmet of claim 17 wherein the first, second and third hinge arms define a common aperture, the helmet further comprising a first axle that locates through the common aperture creating a first hinge assembly.

19. The bicycle helmet of claim 18 wherein movement of the first lip at the first locating ridge causes an audible sound and positive tactile feedback.

20. The bicycle helmet of claim 19 wherein the first and second frames are positioned parallel relative to each other in the folded position and rotate to a position beyond parallel in the expanded use position.

* * * * *